US007441771B2

(12) United States Patent
Tamura et al.

(10) Patent No.: US 7,441,771 B2
(45) Date of Patent: Oct. 28, 2008

(54) SHEET-LIKE MEDIUM ALIGNMENT APPARATUS

(75) Inventors: Masahiro Tamura, Tokyo (JP); Shuuya Nagasako, Tokyo (JP); Akihito Andoh, Tokyo (JP); Kazuya Tsutsui, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 12 days.

(21) Appl. No.: 11/622,489

(22) Filed: Jan. 12, 2007

(65) Prior Publication Data

US 2007/0145675 A1 Jun. 28, 2007

Related U.S. Application Data

(62) Division of application No. 10/974,837, filed on Oct. 28, 2004, now Pat. No. 7,182,333, which is a division of application No. 09/997,304, filed on Nov. 30, 2001, now Pat. No. 6,889,974.

(30) Foreign Application Priority Data

| | | |
|---|---|---|
| Nov. 30, 2000 | (JP) | 2000-365145 |
| Nov. 30, 2000 | (JP) | 2000-365738 |
| Jan. 12, 2001 | (JP) | 2001-004945 |

(51) Int. Cl.
*B65H 31/04* (2006.01)

(52) U.S. Cl. ..... 271/207; 271/213; 271/220

(58) Field of Classification Search ..... 271/207, 271/213, 220; 270/58.08, 58.09, 58.11, 58.12, 270/58.13; 414/788.9, 789.1, 791.2
See application file for complete search history.

(56) References Cited

U.S. PATENT DOCUMENTS

| | | | |
|---|---|---|---|
| 4,444,388 | A | 4/1984 | Stefannson et al. |
| 4,474,366 | A | 10/1984 | Reider |
| 4,844,438 | A | 7/1989 | Mistyurik et al. |
| 5,026,036 | A | 6/1991 | Takahashi |
| 5,037,077 | A | 8/1991 | Kubota et al. |
| 5,058,880 | A | 10/1991 | McGraw et al. |
| 5,249,793 | A | 10/1993 | Scheufler |
| 5,288,062 | A | 2/1994 | Rizzolo et al. |
| 5,294,107 | A | 3/1994 | Allmendinger et al. |
| 5,320,336 | A | 6/1994 | Asami |

(Continued)

FOREIGN PATENT DOCUMENTS

| | | |
|---|---|---|
| DE | 197 31 481 | 5/1998 |
| DE | 198 44 232 | 3/2000 |
| GB | 2.269.582 A | 2/1994 |
| JP | 62-046862 | 2/1987 |
| JP | 62-093168 | 4/1987 |
| JP | 63-093339 | 6/1988 |
| JP | 63-147771 | 6/1988 |
| JP | 1-117166 | 5/1989 |
| JP | 1-275370 | 11/1989 |
| JP | 2-215648 | 8/1990 |

(Continued)

OTHER PUBLICATIONS

Patent Abstracts of Japan JP 2001-348155, Dec. 18, 2001.
Patent Abstracts of Japan JP 2000-219406, Aug. 8, 2000.

*Primary Examiner*—David H Bollinger
(74) *Attorney, Agent, or Firm*—Oblon, Spivak, McClelland, Maier & Neustadt, P.C.

(57) ABSTRACT

To ensure that the leading edge of the sheet ejected onto a tray 12 does not push and move loaded sheets in advance, loaded sheets are retained at position (II) by a retaining roller. A roller (returning roller in this case) 121 for applying external force to a sheet S ejected onto the tray 12 and moving the sheet toward a end face 131 for alignment is displaced to a different position in the direction of ejection "a", thereby firmly gripping the trailing edge of the sheet S ejected on the tray 12.

24 Claims, 69 Drawing Sheets

U.S. PATENT DOCUMENTS

| | | | |
|---|---|---|---|
| 5,467,974 | A | 11/1995 | Ishiwata et al. |
| 5,583,664 | A | 12/1996 | Sanpei |
| 5,762,328 | A | 6/1998 | Yamada et al. |
| 5,791,644 | A | 8/1998 | Regimbal et al. |
| 5,931,460 | A | 8/1999 | Kadowaki et al. |
| 6,095,518 | A | 8/2000 | Allmendinger et al. |
| 6,142,466 | A | 11/2000 | Dickhoff |
| 6,264,193 | B1 | 7/2001 | Moeller |
| 6,283,470 | B1 | 9/2001 | Hirai |
| 6,286,829 | B1 | 9/2001 | Emmrich |
| 6,302,389 | B1 | 10/2001 | Kato et al. |
| 6,398,214 | B1 | 6/2002 | Moteki et al. |
| 6,412,774 | B1 | 7/2002 | Saito et al. |
| 6,547,238 | B2 | 4/2003 | Ardery et al. |
| 6,550,758 | B2 | 4/2003 | Ardery et al. |
| 6,561,504 | B2 | 5/2003 | Mlejnek et al. |
| 6,588,741 | B2 | 7/2003 | Dobrindt |
| 2005/0067764 | A1 | 3/2005 | Tamura et al. |

FOREIGN PATENT DOCUMENTS

| | | |
|---|---|---|
| JP | 4-23764 | 1/1992 |
| JP | 4-77554 | 7/1992 |
| JP | 5-043118 | 2/1993 |
| JP | 6-100229 | 4/1994 |
| JP | 6-171816 | 6/1994 |
| JP | 6-255877 | 9/1994 |
| JP | 6-263303 | 9/1994 |
| JP | 6-345317 | 12/1994 |
| JP | 8-2767 | 1/1996 |
| JP | 08-198505 | 8/1996 |
| JP | 8-203192 | 8/1996 |
| JP | 9-100060 | 4/1997 |
| JP | 09-151023 | 6/1997 |
| JP | 9-226986 | 9/1997 |
| JP | 10-181987 | 7/1998 |
| JP | 10-226451 | 8/1998 |
| JP | 10-245148 | 9/1998 |
| JP | 10-310320 | 11/1998 |
| JP | 11-263517 | 9/1999 |
| JP | 2000-086064 | 3/2000 |
| JP | 2000-143073 | 5/2000 |
| JP | 2000-177920 | 6/2000 |
| JP | 2000-219406 | 8/2000 |
| JP | 2000-272808 | 10/2000 |

(Home position)

(Receiving position)

Fron jogger· ' alignme t 1 02a
Back ' joggeralignme nt 02b

SHEET-LIKE MEDIUM ALIGNMENT APPARATUS

CROSS-REFERENCE TO RELATED APPLICATIONS

This application is a divisional of and is based upon and claims the benefit of priority under 35 U.S.C. §120 for U.S. Ser. No. 10/974,837, filed Oct. 28, 2004, U.S. Ser. No. 09/997,304, filed Nov. 30, 2001 (now U.S. Pat. No. 6,889,974) and claims the benefit of priority under 35 U.S.C. § 119 from Japanese Patent Application No. 2001-004945, filed Jan. 12, 2001, Japanese Patent No. 2000-365738, filed Nov. 30, 2000, Japanese Patent Application No. 2000-365145, filed Nov. 30, 2000, the entire contents of each which are incorporated herein by reference.

BACKGROUND OF THE INVENTION

1. Field of the Invention

The present invention relates to a sheet-like medium alignment apparatus, sheet-like medium post-treatment apparatus and image forming apparatus.

2. Description of the Prior Art

A sheet-formed medium alignment apparatus provided with a returning means consisting of a rotating body is known in the prior art, wherein a sheet-formed medium is ejected onto a loading means by an ejecting means and the end of the aforementioned sheet-formed medium on the upstream side in the direction of ejection is pressed against the vertical wall (end fence) provided at the alignment position, whereby the sheet-formed medium is aligned and loaded. External force is applied to the sheet-formed medium ejected onto the aforementioned loading means (tray), and the medium is fed to the aforementioned vertical wall so as to be aligned.

The sheet-like medium handled in the present specification includes duplicating paper, transfer paper, recording paper, cover sheet, offset paper (divider), computer sheets, special paper, OHP sheet and others. In the following description, they will be genetically called sheets.

In an image forming apparatus, a punching unit for punching filing holes on the imaged sheets ejected from the image forming apparatus, staple means, and a sheet-like medium post-treatment apparatus for post-treatment such as stamping, the sheets ejected from the ejecting means are loaded on a tray as a loading means called an ejection tray or loading tray. The sheets loaded on the loading means are automatically aligned for subsequent use. In this case, the major point is the degree of sheet alignment, namely, accuracy of alignment.

In FIG. 77 illustrating an example of the prior art sheet treatment apparatus, for example, sheets S1 with an image created thereon by an image forming apparatus (not illustrated) are fed to the sheet processing apparatus, and are led to a pair of ejection rollers 3 as an ejecting means comprising a lower roller 3*a* and a upper roller 3*b* through the ejection sensor for detecting the passage of this sheet. Then sheets are ejected in the direction of ejection "a" (orthogonal to the axial direction of the lower roller 3*a* within the common tangential plane between a lower roller 3*a* and a upper roller 3*b*) on a direct extension of the aforementioned feed direction.

A vertical wall (end fence) 131 is provided below the ejection roller 3, and a tray 12 is located in such a way that it crosses this end fence 131. A tray 12 has a slope which is higher on the downstream side of ejection direction than the fence 131, and sheets are loaded on this slope. Further, tray 12 is movable in the vertical direction, and a sheet surface feeler (not illustrated) detects the top surface of the tray 12 (the top surfaces of the sheets when the sheets are loaded). As sheets are stacked on the tray 12, the tray 12 is lowered, and control is made to ensure that the distance from the nip of an ejection roller to the top surface of the sheet on the tray 12 will be kept constant.

Depending on the ejection speed, the intermediate position of the sheets S1 ejected from the ejection roller 3 to the tray 3 may be bent in the process of ejection while the rear ends of the sheets S1 are still gripped by the ejection roller 3 as shown in FIG. 77, and the sheets S1 may be fed out with the leading edge thereof kept in contact with the loaded sheets S" which are already loaded on the tray 12.

Under this condition, the leading edges of sheets S1 moves the sheets S2 located on the top surfaces of the loaded sheets S" toward the downstream side in direction of ejection a; therefore, the trailing edges of the sheets S2 aligned after having been pressed against the end fence 131 by the inclination of the tray 12 are separated from the end fence 131 and is misaligned toward the downstream side in the direction of ejection, with the result that the trailing edge is misaligned.

In the paper copying industry, a bundle of loaded sheets may be fed to the next process to be processed by a punching machine, for example, and this requires excellent alignment accuracy. If a bundle of sheets has a poor alignment accuracy, the bundle taken out of the tray has to be aligned again by human hand before it is fed to the punching machine, with the result that work efficiency is reduced. To solve this problem, the upstream segment, e.g., copying industry requires very severe alignment accuracy of the loaded sheets. Improvement of alignment accuracy is urgently required at present.

To solve this problem of misalignment resulting from the loaded sheet being moved by the leading edge of the ejected paper according to the prior art, a retaining roller 121' as a retaining means is provided at a central position along the width of the sheet between the ejection roller 3 and the upper surface of the tray 12 in such a way that it can be rotated and driven, as shown in FIG. 78.

The retaining roller 121' is fixed at a specified position on the immovable member, and is kept in a light contact with the upper surface of the tray 12 (the top surface of the sheet when the sheet is loaded). When paper is loaded on the tray 12, even if the leading edge of the paper ejected on the tray 12 attempts to move the loaded paper, the loaded paper is exposed to the force opposite to the direction of ejection "a" while being pressed by the retaining roller 121', and is kept pressed against the end fence 131.

The sheet S1 ejected from the ejection roller 3 onto the tray 12 in the manner mentioned above is held by the retaining roller 121', and is pressed against the end fence 131. This eliminates the so-called vertical misalignment on the trailing edge in the direction of ejection a.

When the retaining roller 121' is rotating in the arrow-marked direction as shown in FIG. 78, the retaining roller 121' has also a function of returning the sheet to the side of the end fence 131. The roller in this case is referred to as a returning roller. As shown in FIG. 79, the returning roller 121' is kept in a light contact with the top surface on the tray 12 and is driven in such a way as to move the contact surface toward the upstream side in the direction of ejection a, so the sheets fed onto the tray 12 whose trailing edges are gripped by the returning roller 121' are returned opposite to the direction of ejection "a" and are pressed against the end fence 131.

The sheets S1 ejected by the ejection roller 3 and loaded on the tray 12 in the manner mentioned above are gripped by the returning roller 121'. Or those sheets which have been ejected slightly farther in the direction of ejection "a" than the returning roller 121' are slid under its own weight along the inclination of the tray 12, and their trailing edges are gripped by the returning roller 121' to be pressed against the end fence 131, whereby the trailing edge is aligned.

These sheets fall under free conditions without any restriction on the distance from the ejection roller 3 to the tray 12, namely, on the distance of free fall of the sheet until they are loaded on the tray 12 by free falling after their trailing edges are released from the ejection roller 3. So a slight displacement will be formed between sheets under the influence of air, and alignment accuracy will be adversely affected. However, these sheets are correctly pressed against the end fence 131 due to the inclination of the tray 12 and the action of the returning roller 121, with the result that basically excellent alignment accuracy is ensured.

Another known art is a sheet-like medium alignment apparatus provided with a sorting means for sorting the sheet-like media fed upward one after another from the image forming apparatus. Such a sheet-like medium alignment apparatus is characterized by operation by an aligning means for aligning the sheet trailing edge, operation by a returning means for returning the sheet to the end fence and sorting operation by the aforementioned sorting means. These operations are performed by using the aforementioned time intervals of sheet-like media being fed one after another.

For example, when the sheet-like medium has been ejected and loaded onto the tray, the following operations are required before the next sheet is ejected; (1) a returning operation for ensuring alignment in the direction of ejection by returning the sheet-like medium with the returning roller until it is pressed against the end fence in order to ensure alignment between the sheet-like medium immediately after ejection and the edge of the already ejected sheet-like medium in the direction of ejection; (2) an alignment operation of gripping the end face in the direction of shift by the aligning means together with the sheet-like medium of the same portion already ejected in order to improve the alignment of the edge of the sheet-like medium in the direction of shift; and (3) a sorting operation by shifting the tray (or an aligning member) by a specified distance only during the time between ejection of the sheet-like medium at the end of this portion and ejection of the first sheet-like medium of the next portion.

SUMMARY OF THE INVENTION

In the prior arts using the retaining roller mentioned above, the retaining roller is made of elastic material such as sponge to allow the trailing edge of the sheet to be gripped easily. It is designed to have a rugged surface, and is driven in the state of deformation since the roller is brought in a slight contact with the upper surface of the loaded paper; therefore, the roller is subjected to earlier wear, hence earlier loss by wear.

Further, when this roller is used as a returning roller, back curling (downward curling) occurs to the sheet ejected from the ejection roller. If a great number of curled sheets are loaded on the tray, there will be a gradually decrease in the angle of inclination of the top surface of the loaded paper. In other words, assume that angle of inclination of the upper surface on the tray 12 is $\alpha$ degrees, as shown in FIG. 79. Then when a great number of back curled sheets are loaded, the angle of inclination of the top surface of the loaded paper will be $\beta$ degrees ($\alpha>\beta$). Under this condition, sheets S1 dropped on the tray 12 cannot easily slide along the inclination on the loaded surface. The trailing edges of some of the sheets having fallen on the top surface of the loaded paper cannot be caught by the returning roller 121'. As a result, longitudinal misalignment will be caused on the downstream side in the direction of ejection "a" as shown in FIG. 79, and these sheets (sheets S') will be protruded from others.

In other words, as shown in FIG. 80, the sheets S1 ejected from the ejection roller 3 sequentially drop with the positions of the trailing edges thereof changed along the outer periphery of the lower roller 3*a*, as shown by the two-dot chain line, and are brought in contract with the returning roller 121' during this time. Then they are further stacked on the sheets S' loaded on the tray 12 along the outer periphery of the returning roller 121'. If many back-curled sheets are loaded and there is a gradual inclination on the loaded surface, the sheet trailing edge in contact in the range from the top of the returning roller 121' to the side of it is flapped in the direction of ejection "a" by the driving force of the returning roller 121'. Without being caught by the returning roller 121', these sheets are stacked on the loaded sheets S", with the result that protruded sheets S' occur. Such a phenomenon occurs intermittently. As shown in FIG. 79, the protruded sheets S' occur partially, resulting in misalignment.

In the apparatus provided with a sorting means, the internal of the sheet-like medium being ejected is not the same depending on various types of image forming apparatuses; it varies according to image forming apparatuses. So, depending on the ejection interval of the sheet-like medium of the image forming apparatus combined with the sheet-like medium alignment apparatus, the time of the aforementioned operations (1), (2) and (3) may be greater than the interval of the sheet-like medium ejection. In this case, the aligning means and returning means may interfere with the sheet-like medium being fed, and a serious misalignment may occur as a result.

The first object of the present invention is to avoid earlier wear and loss of the retaining roller.

The second object of the present invention is to stack sheet-like media in the state of excellent alignment in the direction of ejection.

The third object of the present invention is to keep the time for return operation, alignment operation and sorting operation within the sheet-like media transport time interval.

To achieve these objects, the present invention provides the following configuration:

(1) In a means for aligning and loading a sheet-like medium ejected on a loading means with an ejecting means by pressing the end of the aforementioned sheet-like medium on the upstream side in the direction of ejection by the aforementioned ejecting means against the vertical wall (end fence) provided at the alignment position, namely, in a sheet-like medium alignment apparatus provided with a retaining means for ensuring that the already loaded sheet-like medium is not shifted to the downstream side in the direction of ejection by the sheet-like medium ejected on the aforementioned loading means (tray); the aforementioned retaining means is designed to move between at least two positions—the first position as a waiting position separated from the sheet-like medium already loaded on the loading means and the second position for fulfilling the aforementioned retaining function.

(2) In a sheet-like medium alignment apparatus according to (1), the aforementioned retaining means is separated at the aforementioned first position from the upper surface of the sheet-like medium loaded on the aforementioned loading means, and is in contact with the sheet-like medium loaded on the loading means at the aforementioned second position.

(3) In a sheet-like medium alignment apparatus according to (1), before the end of the aforementioned sheet-like medium ejected by the aforementioned ejecting means on the downstream side in the direction of ejection contacts the sheet-like medium on the loading means, the aforementioned retaining means moves from the aforementioned position to the second position and fulfills the aforementioned retaining function; then it moves back to the aforementioned first position.

(4) In a sheet-like medium alignment apparatus according to (3), before the end of the aforementioned sheet-like medium ejected by the aforementioned ejecting means on the upstream side in the direction of ejection run onto the retaining means, the aforementioned retaining means moves from the second position to the first position.

(5) In a sheet-like medium alignment apparatus according to (3), movement of the aforementioned retaining means from the first position to the second position is triggered by the timing when the leading edge of the sheet-like medium on the downstream side in the direction of ejection has been detected by an ejection sensor provided at the closest position upstream from the ejecting means in the aforementioned direction of ejection.

(6) In a sheet-like medium alignment apparatus according to (3), the aforementioned retaining means is located at the second position during the period of time after the aforementioned retaining means moves to the second position before the leading edge of the ejected sheet-like medium contacts the sheet-like medium loaded on the loading means, until the leading edge of the ejected sheet-like medium does not move the sheet-like medium loaded on the loading means.

(7) In a sheet-like medium alignment apparatus according to (6), the aforementioned period of time is variable according to the dimensions of the sheet-like medium.

(8) In a sheet-like medium alignment apparatus according to (6), the aforementioned period of time is variable according to the number of the stacked sheet-like media ejected by the aforementioned ejecting means.

(9) In a sheet-like medium alignment apparatus according to (6), the aforementioned period of time is variable according to the direction of curls of the aforementioned sheet-like medium ejected by the aforementioned ejecting means.

(10) In a sheet-like medium alignment apparatus according to (3), the aforementioned retaining means consists of a rotating body, and fulfills a retaining function at the second position whenever the sheet-like medium falls down, and a function of returning the fallen sheet-like media to the vertical wall (end fence) at the second position whenever the sheet-like medium falls down.

(11) In a sheet-like medium alignment apparatus according to (10), after fulfilling the function of returning the fallen sheet-like media at the second position, the aforementioned retaining means moves to a third position separated from already loading sheet-like medium between the first position and the second position, and then moves to the second position from the third position in an attempt to fulfill the retaining function.

(12) In a sheet-like medium alignment apparatus according to (1), the retaining means consisting of a rotating body is normally driven in the direction of returning, but rotation stops when it has moved to the second position in an attempt to fulfill the retaining function.

(13) The sheet-like medium alignment apparatus according to (1) has the aforementioned a retaining means and a displacement means for allowing displacement between at least two positions.

(14) In a sheet-like medium alignment apparatus according to (13), the aforementioned displacement means comprises;

a first member, a member shaped in a vertical orientation, with its intermediate position pivoted on an immovable member, wherein the aforementioned first member is installed so as to allow rocking about the first pivot portion (this pivot portion) within a specified angle, and a second member, a member shaped in a vertical orientation, with its intermediate position is pivoted on one free end side separated from the first pivot portion on the first member, wherein the aforementioned second member is installed to allow rocking about the second pivot portion (this pivot portion) within a specified angle. The returning mean is pivoted on a desired free end off the rotational center on the second pivot portion of the second member, and the returning means is shifted to a different position in the direction of ejection by a combination between rocking of the first member and rocking of the second member.

(15) In a sheet-like medium alignment apparatus according to (14), the first member is rocked about the first pivot portion by the first rocking means installed on the free side opposite to where the second member is mounted.

(16) In a sheet-like medium alignment apparatus according to (15), the first rocking means comprises;

an eccentric cam rotating in contact with the free end of the first member and a first contacting means for bringing the aforementioned eccentric cam in contact with the free end side.

(17) In a sheet-like medium alignment apparatus according to (16), the aforementioned eccentric cam is driven by a stepping motor and the amount of rotation is controlled by an encoder.

(18) In a sheet-like medium alignment apparatus according to (16), the main component of the first contacting means is an elastic means installed between the first member and the immovable member.

(19) In a sheet-like medium alignment apparatus according to (14), the second member is rocked by a second rocking means installed to act on the free end side opposite to where the returning member is installed with the second pivot portion located in-between on the second member.

(20) In a sheet-like medium alignment apparatus according to (19), the second rocking means is a cam sliding along the free end on a desired side off the center of the second pivot portion on the second member; and comprises a flat plate cam with protrusion formed on some portion and a second contacting means for allowing the aforementioned free end to contact the aforementioned flat plate cam.

(21) In a sheet-like medium alignment apparatus according to (20), the flat plate cam is located upward of the free end side of the second member.

(22) In a sheet-like medium alignment apparatus according to (14), the displacement means has a power transmission system for driving the returning means and this power transmission system mainly comprises pulleys rotating about the pivoting center of the aforementioned first pivot portion and second pivot portion and belts applied to these pulleys.

(23) In a sheet-like medium alignment apparatus according to (22), rotation power is transmitted to the aforementioned returning means by the pulleys provided concentrically with the first pivot portion and the second pivot portion and the belts between pulleys, and the rotation power is applied to the second member using the frictional force between the returning means and a pivoting shaft integral with the second member provided by the tension of these belts, whereby the function of the second contacting means is fulfilled.

To achieve the second object, the present invention provides the following configuration:

(24) In a means for aligning and loading the sheet-like medium ejected on a loading means with an ejecting means by pressing the end of the aforementioned sheet-like medium on the upstream side in the direction of ejection by the aforementioned ejecting means against the vertical wall (end fence) provided at the alignment position, namely, in a sheet-like medium alignment apparatus provided with a returning means consisting of a rotary body wherein external force is applied to the sheet-like medium ejected onto the aforementioned loading means (tray), and the medium is fed to the aforementioned vertical wall so as to be aligned;

the aforementioned returning means can be located at different positions in the direction of ejection.

(25) In a sheet-like medium alignment apparatus according to (24), the distance between one of the aforementioned different positions and the other position is greater than the amount of variation in the position of the trailing edge of the sheet-like medium when falling on the loading means.

(26) In a sheet-like medium alignment apparatus according to (25), one of the aforementioned positions is the first stop position upstream from the other position in the direction of ejection, without interference given to the loaded sheet-like medium ejected from the ejecting means, and the other position is the second stop position downstream from the first stop position in the direction of ejection, obtained by contact with the upper surface of the sheet-like medium on the loading means.

(27) In a sheet-like medium alignment apparatus according to (26), a third stop position is provided between the first stop position and the second stop position.

(28) In a sheet-like medium alignment apparatus according to (24), the aforementioned returning means is provided, and a displacement means capable of reciprocating at least in the aforementioned direction of ejection is also provided.

(29) In a sheet-like medium alignment apparatus according to (28), the aforementioned displacement means comprises;

a first member, a member shaped in a vertical orientation, with its intermediate position pivoted on a immovable member, wherein the aforementioned first member is installed so as to allow rocking about the first pivot portion (this pivot portion) within a specified angle, and a second member, a member shaped in a vertical orientation, with its intermediate position is pivoted on one free end side separated from the first pivot portion on the first member, wherein the aforementioned second member is installed to allow rocking about the second pivot portion (this pivot portion) within a specified angle. The returning mean is pivoted on a desired free end off the rotational center on the second pivot portion of the second member, and the returning means is shifted to a different position in the direction of ejection by a combination between rocking of the first member and rocking of the second member.

(30) In a sheet-like medium alignment apparatus according to (29), the first member is rocked about the first pivot portion by the first rocking means installed on the free end side opposite to where the second member is installed.

(31) In a sheet-like medium alignment apparatus according to (30), the first rocking means comprises an eccentric cam rotating in contact with the free end side of the first member and a first rocking means for contacting the eccentric cam to the free end side.

(32) In a sheet-like medium alignment apparatus according to (31), the eccentric cam is driven by a stepping motor and the amount of rotation is controlled by an encoder.

(33) In a sheet-like medium alignment apparatus according to (31), the first contacting means mainly comprises an elastic means installed between the first member and immovable member.

(34) In a sheet-like medium alignment apparatus according to (29), the second member is rocked by the second rocking means installed to act on the free end side opposite to where the aforementioned returning member is installed with the second pivot portion located in-between on the second member.

(35) In a sheet-like medium alignment apparatus according to (34), the second rocking means is a cam sliding along the free end on a desired side off the center of the second pivot portion on the second member; and comprises a flat plate cam with protrusion formed on some portion and a second contacting means for allowing the aforementioned free end to contact the aforementioned flat plate cam.

(36) In a sheet-like medium alignment apparatus according to (35), the flat plate cam is located upward of the free end side of the second member.

(37) In a sheet-like medium alignment apparatus according to (29), the displacement means has a power transmission system for driving the returning means and this power transmission system mainly comprises pulleys rotating about the pivoting center of the aforementioned first pivot portion and second pivot portion and belts applied to these pulleys.

(38) In a sheet-like medium alignment apparatus according to (37), rotation power is transmitted to the aforementioned returning means by the pulleys provided concentrically with the first pivot portion and the second pivot portion and the belts between pulleys, and the rotation power is applied to the second member using the frictional force between the returning means and a pivoting shaft integral with the second member provided by the tension of these belts, whereby the function of the second contacting means is fulfilled.

(39) In a sheet-like medium alignment apparatus according to (24), a controlling means is provided to ensure that retaining operation by the returning means is performed after the sheet-like medium has been ejected onto the loading means.

(40) In a sheet-like medium alignment apparatus according to (39), the operation of the returning means is triggered by the timing when an ejection sensor installed in the most downstream portion in the transport system sensor has detected that there is no sheet-like medium.

(41) In a sheet-like medium alignment apparatus according to (24), the returning means is movable between the first stop position which does not interfere with the sheet-like medium loaded on the loading means and the second stop position which may interfere with the sheet-like medium loaded on the loading means, and a controlling means is provided to ensure that, subsequent to the movement of the returning means to the second position, movement is stopped for the specified time when the sheet-like medium returned by the returning means is pressed against the vertical wall; then the returning means is moved to the first position.

(42) In a sheet-like medium alignment apparatus according to (41), a controlling means is provided to ensure that the time when the returning means is stopped at the second position is variable according to any one of the quality, size and number of the sheet-like media ejected onto the loading means, or a combination thereof.

(43) In a sheet-like medium alignment apparatus according to (41), a controlling means is provided to ensure that the speed at which the returning means moves from the first position to the second position is slower than the returning speed of the sheet-like medium by the returning means.

(44) In a sheet-like medium alignment apparatus according to (41), a controlling means is provided to ensure that the returning means is moved to the first position when a jam has occurred in a sheet transport path upstream from the ejecting means.

(45) In a sheet-like medium alignment apparatus according to (44), a controlling means is provided to ensure that the returning means is disabled in the alignment operation immediately after a failure of the returning means has been detected.

(46) In a sheet-like medium alignment apparatus according to (41), when the returning means consists of a returning roller, the drive speed when the returning roller is located at the first position is slower than the drive speed when it is located at the second position.

(47) In a sheet-like medium alignment apparatus according to (46), the return rotating speed of the returning roller at the second position is set to the value at which the sheet-like medium is not pushed out in the direction of ejection even if the trailing edge of the sheet-like medium contacts the returning roller.

(48) In a sheet-like medium alignment apparatus according to (41), the rotating speed of the returning roller at the first position is set to a constant value at all times, independently of the printing speed of the image forming apparatus to be connected.

To achieve the third object, the present invention provides the following configuration:

(49) In a sheet-like medium alignment apparatus comprising;

(1) an ejecting means for ejecting the transported sheet-like medium, (2) a loading means (tray) for loading the sheet-like medium ejected by this ejecting means, (3) an aligning means for ensure alignment by contact in such a way as to sandwich the end face parallel to the direction of ejection of the sheet-like medium by the ejecting means of the sheet-like medium loaded on this loading means (tray), (4) a sorting means (tray feed means or adjusting member drive means) for sorting the sheet-like media by moving the loading means (tray) or aligning member by a specified distance in the direction at a right angle to the direction of ejection of the sheet-like medium by the ejecting means, and (5) a returning means comprising a rotating body which achieves alignment by pressing the sheet-like medium against the vertical wall (end fence) provided at the alignment position;

the space (time) between sheets is reserved for the operation required for treatment by the sorting means, the returning means and aligning means, and the sheet-like medium ejection speed by the ejecting means can be controlled.

(50) In a sheet-like medium alignment apparatus according to (49), the ejection speed of the sheet-like media (sheet-like media for which aligning operation and returning operation have been completed) is increased, in order to reserve the time required for the operation of the aligning means and returning means, until the sheet-like medium is loaded on the loading means, when the aligning means and the returning means operate.

(51) In a sheet-like medium alignment apparatus according to (49), if there is a relationship of Ts>T1 where Ts denotes the time required for the aligning operation by the aligning means and returning operation of the returning means, and T1 represents the space between sheets (time) at a sheet receiving speed (V1), then the ejection speed by the ejecting means, of the sheet-like media involved in the aforementioned aligning operation and returning operation is increased over the aforementioned V1, in order to satisfy the relationship of the space between sheets (time T4:T4>Ts).

(52) In a sheet-like medium alignment apparatus according to (49), the sheet-like medium ejection speed is reduced in order to reserve the operation time of the sorting means until the first sheet-like medium subsequent to sorting is loaded on the loading means.

(53) In a sheet-like medium alignment apparatus according to (49), if there is a relationship of Tc>T1 where Tc denotes the time required for sorting by sorting means and T1 indicates the space between sheets (time) at a sheet receiving speed of V1, only the ejection speed by the ejecting means of the first sheet-like medium transported during the sorting operation subsequent to sorting is lower than the aforementioned V1 in order to satisfy the relationship of the space between sheets (time T3:T3>Tc).

(54) In a sheet-like medium alignment apparatus according to (53), the first sheet-like medium ejected by the aforementioned operation is not aligned.

(55) In a sheet-like medium alignment apparatus according to (49), the ejection speed of the sheet-like medium by the ejecting means is readjusted to a moderate speed before the trailing edge of the sheet-like medium passes through the ejecting means, with consideration given to stacking properties.

(56) In an image forming apparatus comprising an image forming means for forming an image on the sheet-like medium and a transporting means for transporting this image formed sheet-like medium, the aforementioned image forming apparatus further comprises a sheet-like medium alignment apparatus according any one of (1) to (55).

(57) In a sheet-like medium treatment apparatus comprising a post-treatment means for post-treatment of sheet-like medium and a transporting means for transporting this post-treated sheet-like medium, the aforementioned sheet-like medium treatment apparatus further comprises a sheet-like medium alignment apparatus according to any one of (1) to (55).

(58) In a sheet-like medium treatment apparatus comprising (1) an ejecting means for ejecting transported sheet-like media, (2) a tray for loading these sheet-like media ejected by this ejecting means, and (3) a tray traveling means for performing sorting operation by traveling the tray a specified distance in the direction of shift orthogonal to the direction of sheet-like media ejected by the ejecting means in order to sort sheet-like media loaded on this tray; an aligning means for aligning sheet-like media loaded on the tray is provided. This aligning means has a pair of aligning members for ensuring that the aligned portions of the sheet-like medium ejected onto the loading means from the ejecting means are kept in contact with each other in such a way two end faces of the sheet-like medium in parallel with the direction of ejection are sandwiched, whereby the aforementioned end face positions are aligned. The aforementioned sorting operation is performed in such a way that the sheet-like media loaded subsequent to sorting operation are aligned to a position different from that of the sheet-like media loaded before sorting operation.

(59) In a sheet-like medium treatment apparatus according to (58), the aligning means has an aligning member traveling means for traveling one of the aforementioned pair of aligning members from the other or vice versa in the direction of separating them independently.

(60) In a sheet-like medium treatment apparatus according to (58), a concave is formed on the upper surface of this tray to ensure that part of the aforementioned pair of aligning member can be positioned below the upper surface of the aforementioned tray.

(61) In a sheet-like medium treatment apparatus according to (60), the concave is designed to have the dimensions which allow an aligning member to be accommodated when the aforementioned aligning member aligns the minimum sized sheet-like medium.

(62) In a sheet-like medium treatment apparatus according to (60), the concave is designed to have the dimensions which allow the aforementioned pair of aligning members to be accommodated even when the tray has shifted in the direction of shift.

(63) In a sheet-like medium treatment apparatus according to (60), sheet-like media are ejected by the ejecting means when no sheet-like medium is loaded on the tray, if part of the aforementioned pair of aligning members is located below the loaded surface of the tray.

(64) In a sheet-like medium treatment apparatus according to (60), the aligning means comprises a supporting shaft for supporting the aligning member rotatably and a regulating member for regulating the amount of rotation about the aforementioned supporting shaft of the aforementioned pair of aligning members.

(65) In a sheet-like medium treatment apparatus according to (64), the aforementioned pair of aligning members are rotated by the moment under its own weight, and are placed inside the concave on the upper surface of the tray or at the aligning position in contact with the top surface of the sheet-like media loaded on the tray.

(66) In a sheet-like medium treatment apparatus according to (59), the aforementioned pair of aligning members can be placed by the aligning member traveling means into at least two aligning positions;

(1) a receiving position where the aligning portions are located outside the end face of the sheet-like media ejected from the ejecting means and which are separated from the end face, and (2) an aligning portion where the aforementioned aligned portions is located further inside the sheet-like media than the aforementioned receiving position and is in contact with the end face.

(67) In a sheet-like medium treatment apparatus according to (58), a retracting means for retracting the aforementioned pair of aligning members by rotating and moving them from the aligning position to a retract position, wherein the aforementioned retract position is a position separated from the point where the aforementioned pair of aligning members come in contact with the top surface of the sheet-like medium loaded onto the tray.

(68) In a sheet-like medium treatment apparatus according to (67), the aforementioned pair of aligning members are moved to the retract position by the retracting means after completion of aligning a series of sheet-like media or before sorting the tray.

(69) In a sheet-like medium treatment apparatus according to (68), the aforementioned pair of aligning members are displaced from the retract position to the alignment position by the retracting means, after the aforementioned pair of aligning members have moved to the aforementioned receiving position or the tray have moved in the direction of shift to perform sorting operation.

(70) In a sheet-like medium treatment apparatus according to (58), this sheet-like medium treatment apparatus comprises;

(1) an elevating means for elevating the tray, and (2) a positioning means for determining the position of the tray fed by the elevating means in the vertical direction in such a way that the vertical position of the upper surface of the tray or the sheet-like medium loaded on the upper surface of the tray is the appropriate ejection position suitable for ejection of the sheet-like medium from ejecting means, when the aforementioned sheet-like medium is ejected by the aforementioned ejecting means.

(71) In a sheet-like medium treatment apparatus according to (70), the tray is lowered from the appropriate ejection position by the elevating means after a specified number of sheet-like media in an given job has been aligned or before the tray has been moved in the direction of shift to sort the sheet-like media in the next job.

(72) In a sheet-like medium treatment apparatus according to (71), the tray is moved upward to the appropriate ejection position by the elevating means after the aforementioned pair of aligning members have moved to the receiving position or after the tray has been moved in the direction of shift in order to sort the sheet-like media in the next job.

(73) In a sheet-like medium treatment apparatus according to (58), the aforementioned pair of aligning members consists of a plate body, the aligned portion is located at the bottom position of the aligning member, and the mutually opposite surfaces are formed of a flat surface orthogonal to the direction of shift.

(74) In a sheet-like medium treatment apparatus according to (58), the aforementioned pair of members sheet escape portions wherein the upper portion of each aligned portion is formed in a space greater than the opposite spaces of these aligned portions in order that the sheet-like media ejected from the ejecting means are led within the opposite space of these aligning members.

(75) In a sheet-like medium treatment apparatus according to (58), the inner edge of each lower end of the aforementioned pair of members is formed in a sharp edge.

(76) In a sheet-like medium treatment apparatus according to (58), the aforementioned pair of aligning members is made of the material wherein frictional coefficient of each lower end in contact with the sheet-like medium is smaller than the frictional coefficient between sheet-like media.

(77) In a sheet-like medium treatment apparatus according to (58), the aforementioned pair of members are supported above the ejecting means by the apparatus proper.

(78) In a sheet-like medium treatment apparatus according to (58), the aligning means can be mounted or dismounted from the apparatus proper.

(79) In an aligning member drive apparatus comprising a pair of aligning members for aligning the position of the end faces through movement in the direction of alignment adjacent to the end faces so as to sandwich two end faces of the sheet-like media, this aligning member drive apparatus further comprises (1) a fulcrum shaft pivoted commonly to the aforementioned pair of aligning members, (2) a push/move shaft for rotating the aligning member about the fulcrum shaft by coming in contact with each acting point on each aligning member offset with respect to the fulcrum shaft, and (3) a rotation preventive member capable of preventing rotation due to angular moment about the fulcrum shaft under the weight of the aligning member. The fulcrum shaft also serves as a guiding shaft for guiding each aligning member in the direction of alignment, and the rotation preventive member also serves as a drive means for moving the aligning member in the direction of alignment.

(80) In an aligning member drive apparatus according to (79), a switch/drive means is provided to ensure switching between the status of pushing and moving the aforementioned acting point by acting on the push/move shaft and the status of releasing push/move operation.

(81) In an image forming apparatus comprising an image forming means for forming an image on the sheet-like medium and a transporting means for transporting this image-like sheet-like medium, the aforementioned image forming apparatus further comprises a sheet-like medium treatment apparatus according to any one of (58) to (78).

(82) In a sheet-like medium treatment apparatus comprising a post-treatment means for post-treatment of sheet-like medium and a transporting means for transporting this post-treated sheet-like medium, the aforementioned sheet-like medium treatment apparatus further comprises a sheet-like medium treatment apparatus according any one of (58) to (78).

(83) In an image forming post-treatment apparatus comprising (1) an image forming apparatus comprising an image forming means for forming an image on the sheet-like medium and a transporting means for transporting this image-like sheet-like medium, (2) a sheet-like medium post-treatment apparatus for post-treatment of sheet-like medium ejected from the image forming apparatus, and (3) a transporting means for transporting this sheet-like medium post-treated by this sheet-like medium post-treatment apparatus; this image forming post-treatment apparatus further comprises a sheet-like medium treatment apparatus according to any one of (58) to (78).

(84) In a sorting and aligning method comprising a combination between (1) a step of aligning the sheet-like medium ejected on the tray by the ejecting means and (2) a step of sorting out sheet-like media by moving the tray in the direction of shift orthogonal to the direction of ejection; when the positions of two end faces of sheet-like media are aligned by the step of alignment by contacting the alignment portions of a pair of aligning members in such a way as to sandwich the aforementioned two end faces of sheet-like media in parallel with the direction of ejection wherein sheet-like media are ejected from the ejecting means and loaded on the tray, one of the aforementioned pair of aligning members is fixed and the other is moved to align the end face of the sheet; thereafter, the tray is shifted in the direction of shift, and one of the aforementioned pair of aligning members having been moved in the aforementioned step is fixed this time, and its counterpart having been moved in the aforementioned step is fixed, whereby sheets are aligned.

(85) In a sorting and aligning method according to (84), the step of aligning is realized when the aligning member located in contact with the already aligned sheet-like media subsequent to shifting of the tray is made immovable.

(86) In a sorting and aligning method according to (84), if a stepping motor corresponding to each aligning member is used as a source for the step of alignment by the aforementioned pair of aligning members, the stepping motor corresponding to the aligning member on the fixed side is driven by magnetic excitation alone without pulse sent thereto, and is used as a brake, whereby the fixed state is maintained.

(87) In any one of the descriptions according to any one of description in (84) or according to (29) aligning operation is performed by moving a pair of aligning members when the size of the sheet-like medium is greater than the specified one.

(88) In a sorting and aligning method according to (84), the aforementioned pair of aligning members are retracted upward and/or the tray is fed downward before the tray is shifted in the direction of shift.

(89) In a sorting and aligning method according to (84), the first sheet-like medium ejected the aforementioned ejecting means is not aligned by the aforementioned pair of aligning members.

Even if a retaining means of rotation/drive type is used, it does not interfere with the sheet-like medium loaded on the loading means at the first position. This protects the retaining means against earlier wear due to sliding contact, unlike in the case of the prior art. Further, when a retaining means which is not a rotation/drive type is used, it waits at the first position after fulfilling retaining function. This does not interfere with the step of alignment where ejected sheet-like media are moved by the gravitational action until it hits the vertical wall.

The retaining means is not kept in a sliding contact with the sheet-like medium on the loading means at all times. This allows a considerable reduction of temporal wear and loss.

The retaining member moves to the second position to perform retaining function before the leading edge of the sheet-like medium being ejected contacts the loaded sheet-like medium. Then it moves to the first position which is not in contact with the loaded sheet-like medium. This allows retaining function to be fulfilled while wear and loss due to sliding contact with the loaded sheet-like medium are reduced.

In one embodiment, ejected sheet-like media to be dropped on the already stacked sheet-like media.

The operation of the retaining means is triggered at the time when a sensor installed at the closest position upstream from the ejecting means has detected the leading edge downstream from the sheet-like medium. This allows the sheet-like media to be retained with the minimum time error, and prevents the loaded sheet-like media from protruding. Further, time required from the detection by the sensor to the start of the movement of the retaining means can be set to a constant set value, independently of the dimensions of the sheet-like medium, with the result that the control software can be simplified. This permits the size the control storage element to be reduced, whereby cost reduction can be achieved.

The aforementioned loaded sheet-like medium is retained by the retaining means until the leading edge of the ejected sheet-like media contacts the sheet-like medium loaded on the loading means to stop movement. This prevents the sheet-like medium from being pushing out, and protects alignment of the loaded sheet-like medium against possible interference.

The time of stopping the retaining means can be set in conformity to the change of sheet-like medium. This protects vertical alignment of the loaded sheet-like medium against possible interference.

Protrusion of the ejected sheet-like medium is eliminated by setting the time when the retaining means stops in conformity to the change of the configuration on the upper surface of the sheet-like medium according to the number of sheet-like media loaded on the loading means. This method also protects vertical alignment of the loaded sheet-like medium against possible interference.

It is possible to set the time when the retaining means stops in conformity to the change in the distance from the ejecting means varying in conformity to the curled shape of the ejected sheet-like medium to the loaded sheet-like medium. Pushing out by the ejected sheet can be eliminated can be eliminated by setting the suitable time when the retaining means stops. This method also protects vertical alignment of the loaded sheet-like medium against possible interference.

Vertical alignment is improved by the sheet-like medium retaining function by the same retaining means and returning function, independently of the state of curling and loading.

A third position is provided between the first and second positions in order to ensure a waiting position between one returning operation and the next returning operation. This reduces the traveling distance and traveling time of the retaining means, thereby ensuring improved productivity.

The rotation of the retaining means consisting of a rotary body is stopped when the retaining function of the retaining means is carried out. This method prevents the sheet-like medium from buckling due to excessive return of the sheet-like medium to the vertical wall.

The retaining means can be set to a desired stop position on a periodic basis.

The retaining means can be displaced to a far distance. The configuration allowing free bending between the first and second members is more compact than other configurations to achieve the same stroke. This method also allow vertical displacement, for example, in plotting an angular locus, and it can be made to hit the sheet-like medium on the loading means.

The first member supporting the second member equipped with a retaining means can be rocked and displaced by the first rocking means.

A periodic displacement moving between at least two different positions can be given to the first member, hence, retaining means by the rotary motion of an eccentric cam.

The position of the retaining means can be adequately managed by adoption of a combination of a stepping motor and encoder.

A stable periodic rocking operation is given to the first member by a reliable contact between the first member and eccentric cam provided by the first contacting means consisting of an elastic means.

Installation of a second rocking means makes it possible to change the angle of the second member with respect to the first member around the second pivot portion, whereby the returning means can be moved between desired positions along a desired locus. Further, the stroke of the returning means can be increased by a combination between the rocking operations of the first and second members.

Contact of the second member with the flat plate cam is provided by the second contacting means. This allows the returning means to be moved in the vertical direction in conformity to the rocking of the first member, and the retaining means can be displaced along an angular locus by a combination of rocking between the first and second members. Then the sheet-like medium loaded on the loading means can be moved to the second stop position without being pushed out in the direction of ejection.

The second member rotates about the second pivot portion away from the flat plate cam even if the loading means has risen, thereby preventing the member from being damaged.

The rocking fulcrum points of the first and second members are provided with pulleys, and power is transmitted to the retaining means by these pulleys. The shaft for power transmission is also used as a rocking shaft for displacement of the returning means. This configuration ensures a simple structure of the power transmission system and allows electric power to be easily supplied from outside the first member. This ensures a light weight and compact configuration of the displacement means.

The function of the second contacting means is provided by a simple configuration using the mechanism for turning the retaining means, without having to install a second contacting means.

Loading operation can be performed at an excellent state of alignment as to the direction of ejection even if back curled paper is used or the type of the sheet has been changed.

The trailing edge of the sheet-like medium is firmly caught by the returning means and excellent alignment is provided even if there is a variation in the direction of ejection at the trailing edge of the sheet-like medium falling on the loading means.

Excellent alignment is ensured by complete elimination of uncertain elements by the thrust action of the sheet-like medium by the returning means.

A third stop position is provided between the first and second stop positions to reduce the time required to reach the second stop position and time required for retreat from the second stop position, with the result that high speed paper ejection is ensured.

The returning means can be set to a desired stop position on a periodic basis.

The retaining means can be displaced to a far distance. The configuration allowing free bending between the first and second members is more compact than other configurations to achieve the same stroke. This method also allow vertical displacement, for example, in plotting an angular locus, and it can be made to hit the sheet-like medium on the loading means.

The first member supporting the second member equipped with a retaining means can be rocked and displaced by the first rocking means.

A periodic displacement moving between at least two different positions can be given to the first member, hence, retaining means by the rotary motion of an eccentric cam.

The position of the retaining means can be adequately managed by adoption of a combination of a stepping motor and encoder.

A stable periodic rocking operation is given to the first member by a reliable contact between the first member and eccentric cam provided by the first contacting means consisting of an elastic means.

Installation of a second rocking means makes it possible to change the angle of the second member with respect to the first member around the second pivot portion, whereby the returning means can be moved between desired positions along a desired locus. Further, the stroke of the returning means can be ensured by a combination between the rocking operations of the first and second members.

Contact of the second member with the flat plate cam is provided by the second contacting means. This allows the returning means to be moved in the vertical direction in conformity to the rocking of the first member, and the retaining means can be displaced along an angular locus by a combination of rocking between the first and second members. Then the sheet-like medium loaded on the loading means can be moved to the second stop position without being pushed out in the direction of ejection.

The second member rotates about the second pivot portion away from the flat plate cam even if the loading means has risen, thereby preventing the member from being damaged.

The rocking fulcrum points of the first and second members are provided with pulleys, and power is transmitted to the retaining means by these pulleys. The shaft for power transmission is also used as a rocking shaft for displacement of the returning means. This configuration ensures a simple structure of the power transmission system and allows electric power to be easily supplied from outside the first member. This ensures a light weight and compact configuration of the displacement means.

The function of the second contacting means is provided by a simple configuration using the mechanism for turning the retaining means, without having to install a second contacting means.

The returning means is operated subsequent to ejection to the tray. This makes it possible to firmly catch the sheet-like media having failed to get back to the vertical wall because of changes in the inclination on the top surface of the load on the tray in conformity to the state of curling, with the result that excellent alignment in the vertical direction is ensured, independently of the state of curling and loading of the sheet-like medium.

The time from the detection of the trailing edge of the sheet by an ejection sensor to the start of operation by the returning means can be set to a constant value, independently of the dimensions of the sheet-like medium, with the result that the control software can be simplified. This permits the size the control storage element to be reduced, whereby cost reduction can be achieved.

The set value T2 is adjusted to a time sufficient to allow the sheet to hit the end fence, thereby ensuring that the sheet can be returned to the end fence and sheet-like media can be aligned in the vertical direction.

The time when the returning means is stopped at the second stop position can be changed in conformity to the conditions of the sheet-like medium. This permits returning roller control to be made in response to the friction of the sheet and change of the weight due to the difference in sheet-like media, and ensures sheet-like media to be aligned in the vertical direction.

The speed of the returning means traveling from the first stop position to the second stop position is slower than the returning speed by the returning means. As a result, when the returning means travels from the first stop position to the second stop position, it is kept in contact with the sheet-like media on the loading means. When force is applied to push the sheet-like media in the direction of ejection, the returning speed by the returning means becomes higher than the push-out speed, therefore, preventing the sheet-like medium from being pushed out in the direction of ejection. This also ensures the alignment of the sheet-like media in the vertical direction.

The returning means is moved to the first stop position when a paper jam has occurred. This allows the returning roller to be retracted to the position where the amount of getting from the machine is the minimum. This avoids the possibility of damaging the returning means when a user takes step of solving the jamming problem.

Accuracy in the alignment of the sheet-like medium in the vertical direction by the returning means is adversely affected by stopping the alignment operation if a failure has been detected in the returning means; however, sheets can be ejected without having to stop the system.

The drive speed when the returning roller is located at the first stop position is reduced below that when it is located at the second stop position, thereby preventing the trailing edge of the ejected sheets from being flipped and pushed out in the direction of ejection.

The drive speed when the returning roller is located at the first stop position is reduced below that when it is located at the second stop position, whereby sheet-like media which can be gripped by the returning roller are ejected onto the loading means, without the trailing edge of the ejected sheets being flipped or stopped. According to the invention, the drive speed of the returning roller 121 is constant even when an apparatus equipped with the returning roller is connected to various types of image forming apparatuses having different transport speeds. This prevents the trailing edge of the ejected sheet from being flipped and the sheet from being pushed out in the direction of ejection.

The processing time by the aligning means, sorting means and returning means can be easily assigned by a simple means of variable control of ejection speed by the ejecting means.

Aligning and returning operation time can be easily assigned by increasing the ejection speed.

It is possible to define the degree of ejection speed increase which allows aligning and returning operation time to be assigned.

Sorting operation time can be easily assigned by decreasing the ejection speed.

It is possible to define the degree of ejection speed decrease which allows sorting operation time to be assigned.

Sorting operation time can be assigned by omitting the aligning operation.

The speed is adjusted to an appropriate level when sheet-like media are ejected from the ejecting means, whereby excellent stacking is provided.

Sheet-like media subsequent to image formation can be aligned to a high precision, and sheet aligning, sorting and returning functions are provided.

Sheet-like media can be aligned to a high precision in a sheet-like medium post-treatment apparatus having a post-treatment function subsequent to image formation and sheet aligning, sorting and returning functions are provided.

Sheet-like media can be stacked separately at different positions on the tray.

Sheet sheet-like media of different sizes can be sorted according to size and stacked on the tray.

Proper alignment of sheet-like media is possible.

The top surface of the tray or sheet-like medium loaded on the upper surface of the tray can be set at a proper position.

Proper alignment of sheet-like media is possible.

Easy alignment of the end faces of sheet-like media is possible.

Sheet-like media subsequent to image formation can be aligned to a high precision.

Proper alignment of sheet-like media is possible.

DETAILED DESCRIPTION OF THE PREFERRED EMBODIMENT

Embodiment 1

The present embodiment represents an example of a variable retaining means which is separated from the loaded paper at the wait position.

Example 1

Figure 1:
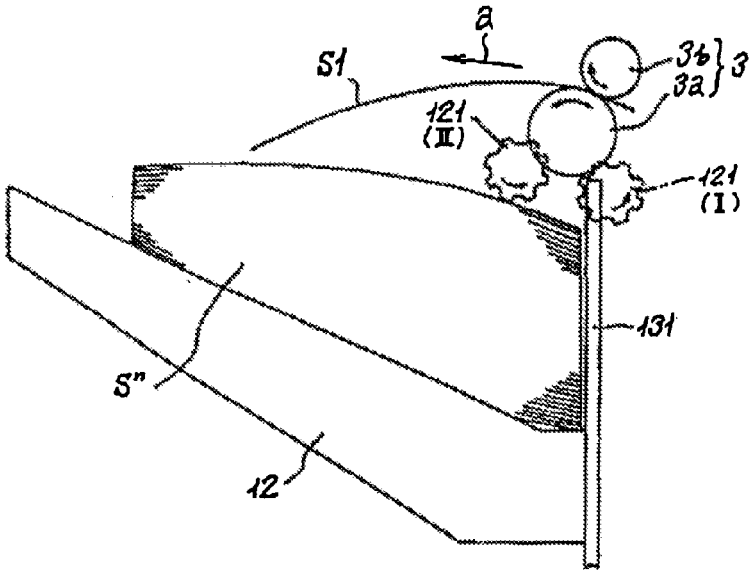
FIG. 1 is a front view representing a tray and retaining means.
Figure 77:
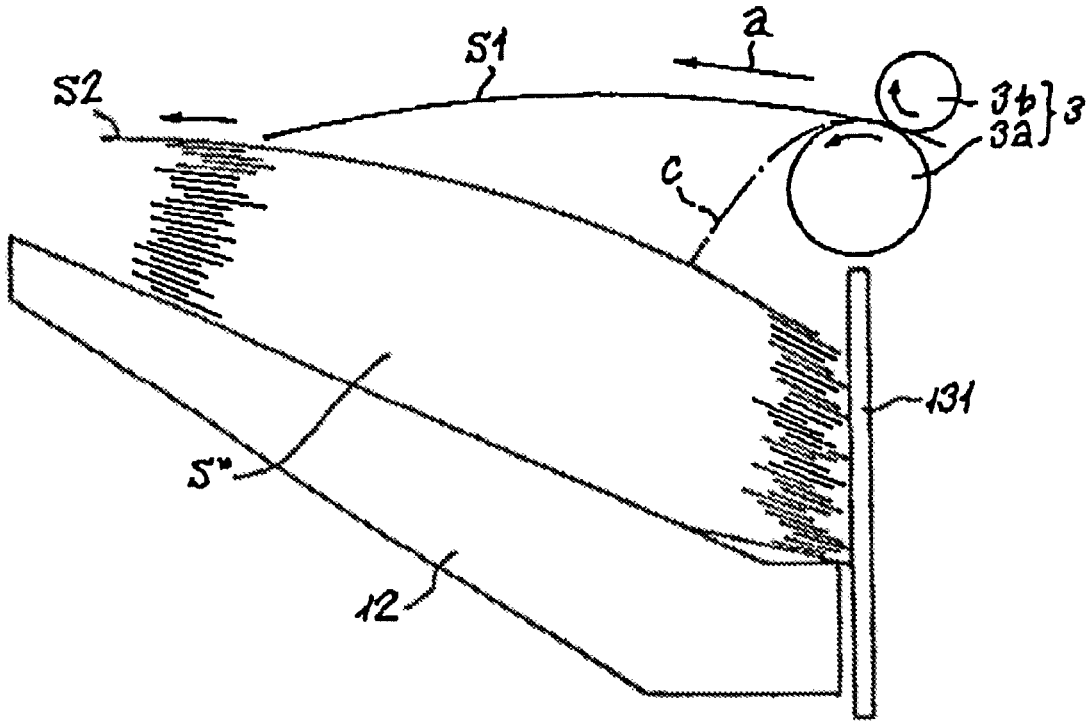
FIG. 77 is a front view representing the tray and loaded paper illustrating the issues involved in the present invention.
Figure 78:
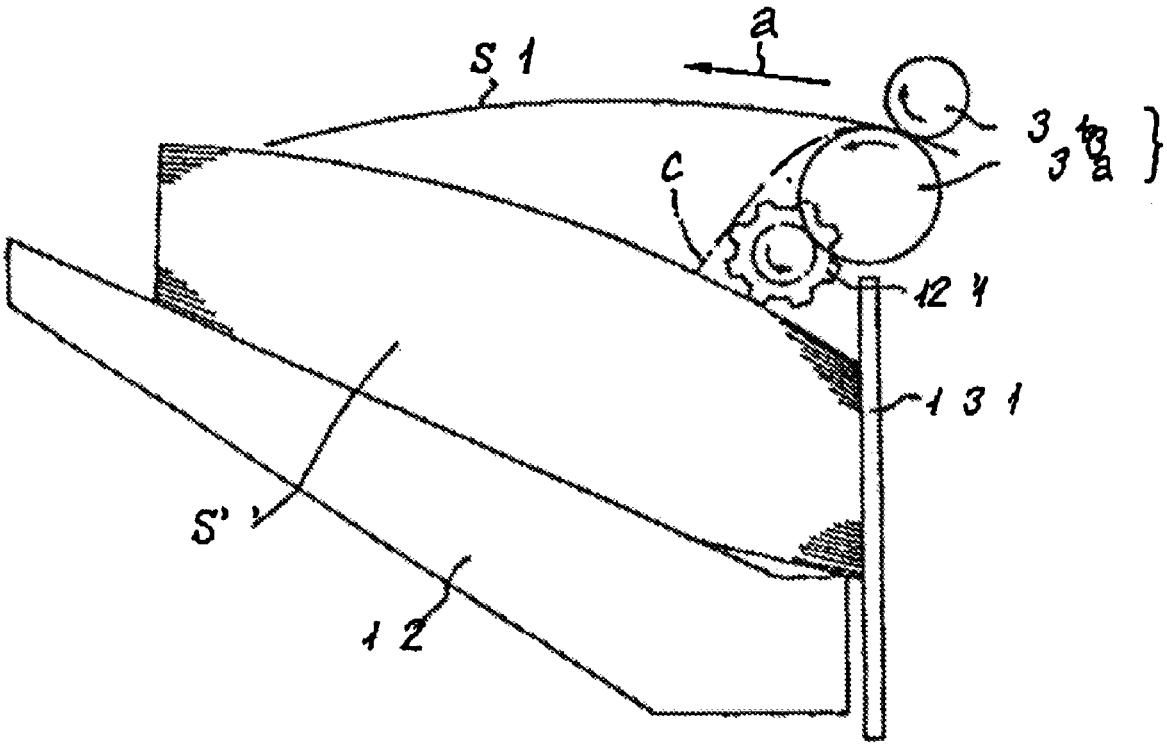
FIG. 78 is a front view representing the tray and loaded paper illustrating a prior art.
Figure 79:
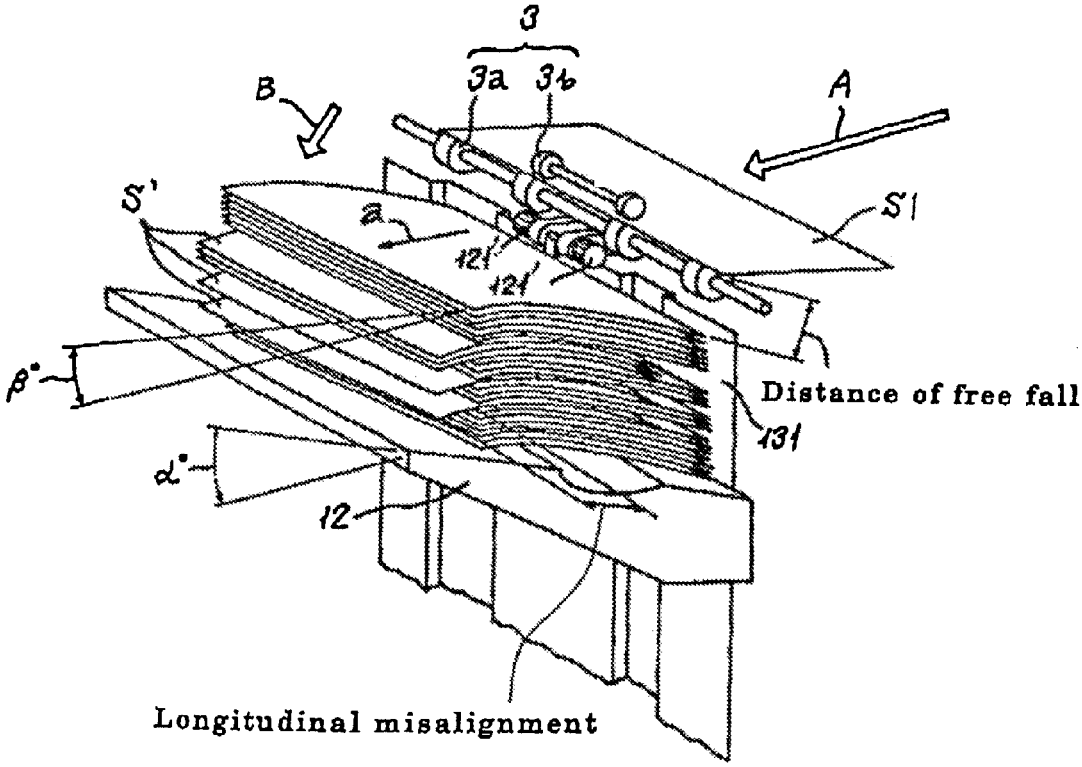
FIG. 79 is a perspective view representing the state of loaded sheets according to the prior art.

This is an example of traveling in the direction of ejection. In FIG. 1 showing the major portion of the sheet-like medium alignment apparatus, the members denoted by the same numerals of reference as those in the foregoing FIGS. 77 and 78 will not be described since they are the same as those previously described.

In FIG. 1, numeral 121 denotes a retaining roller. According to the foregoing retaining roller 121', two retaining rollers are provided along the width of the sheet orthogonal to the direction of ejection "a", and they are collectively called a retaining roller. In the present example, the retaining roller 121 can be located at different positions in the direction of ejection "a".

One of these two different positions is the first position as a wait position indicated by a two-dot chain line not in contact with the paper S' loaded on the tray 12 in FIG. 1. The other position is a second position indicated by a solid line in contact with the paper S' loaded to fulfill the retaining function. For the sake of expediency, the first position is indicated by (I) and the second position by (II).

As described above, the retaining roller 121 is located at a position deviated from the first position (I) and the second position, without being set at a fixed position as in the prior art. Then the retaining roller 121 is placed in a waiting state separated from the loaded paper S" at the first position where the retaining function is not fulfilled. As a result, there is no friction with loaded paper S' despite rotation of the retaining roller 121, and this prevents the retaining roller 121 from getting worn out.

Further, when the retaining roller 121 is not designed as a rotating type, it quickly moves to the first position (‡T) after the retaining function has been fulfilled, in order to ensure that dropping of the ejected sheet S1 onto the loaded paper S" will not be interrupted. The dropped sheet S1 slides along the inclination of the tray 12 until it hits the back fence 131. The following is the step-by-step description:

In FIG. 1, the retaining roller 121 in the vicinity of an ejection roller 3 located waiting at the first position (I) above and separated from loaded papers S" moves from the first position (I) to the second position (II) at the timing shown in FIG. 1 before sheet S1 is ejected from the ejection roller 3 and its leading edge contacts with loaded paper S". The loaded paper S" is retained in position, with the roller contacting the upper surface of the loaded paper S".

This allows the sheet S1 to be fed further, and the leading edge thereof contacts the top surface of loaded paper S" in an attempt to push it out in the direction of ejection. However, the retaining roller 121 is already in contact with the top surface of the loaded paper S", and retaining function is carried out; therefore, the loaded paper S" hits a back fence 131 and does not deviate from the already aligned alignment position.

Further, at the first position (I) where the retaining roller 121 does not contact the loading sheet, there is no counterpart along which rotating retaining roller 121 slides. This can bring about a considerable reduction in temporal wear of the retaining roller 121, compared to the prior art configuration where the retaining roller 121 is constantly kept in contact with the loaded paper S".

Figure 2:
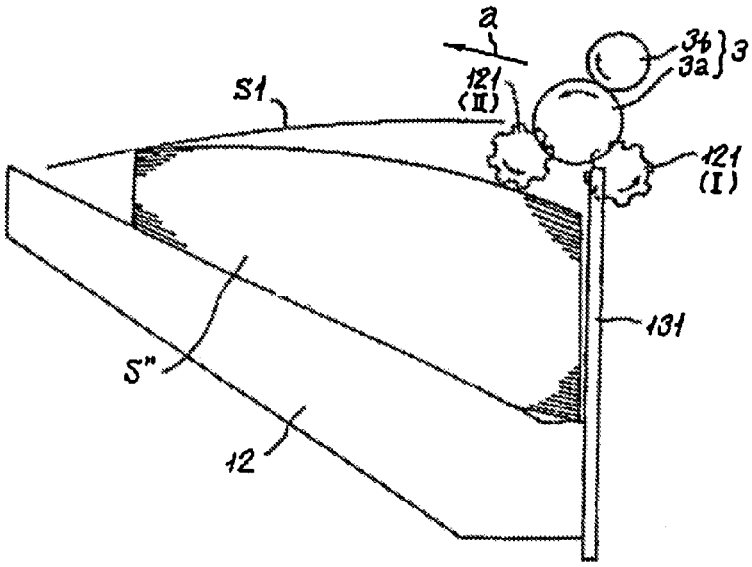
FIG. 2 is a front view representing a tray and retaining means.

In FIG. 2, the sheet S1 is further ejected than that shown in FIG. 1. The end of the sheet S1 on the upstream side in the direction of ejection "a" (trailing edge) has completed passed through the ejection roller 3, and the trailing edge is about to fall down on the retaining roller 12 located at the second position (II). If the trailing edge falls on the retaining roller 121, then sheet S1 may not be able to fall on the loaded paper S". To avoid this, the retaining roller 121 located at the second position (II) is retracted to the first position (I) before the trailing edge falls on the retaining roller 121. This allows the sheet to be fallen on loaded paper S". If this returning operation is performed too early, retaining function will become insufficient. If it is carried out too late, the sheet may be caught by the retaining roller 121 without falling down on the loaded paper S".

For example, if the retaining roller 121 is moved to the first position (I) before the trailing edge of sheet S1 falls on the retaining roller 121 located at the second position (II), the inclination of the top surface of the loaded paper S" will become gradually reduced below that of the tray 12, if the sheet is back-curled in upper convex shape when sheet S1 is fallen on the loaded paper S". Under this condition, sheet S1 on loaded paper S" cannot slip down to the side of the back fence 131 under its own weight, with the result that sheet misalignment will occur.

Figure 3:
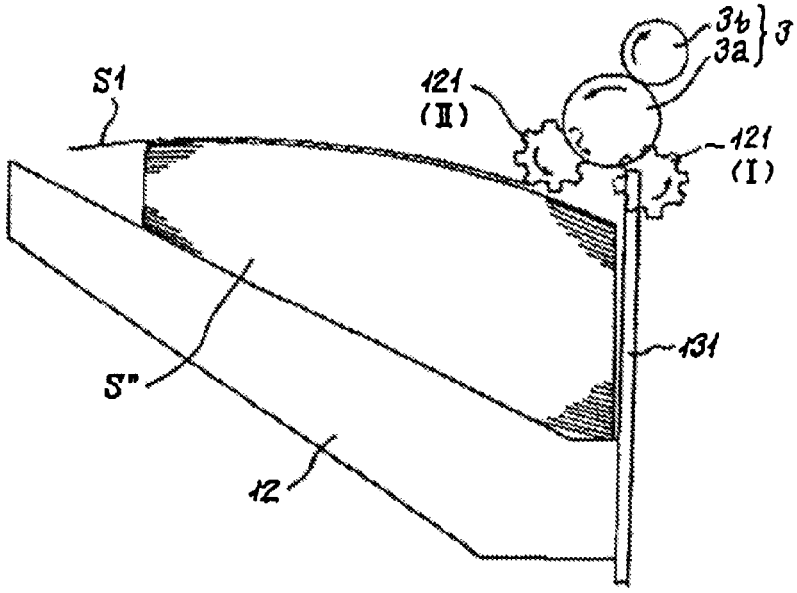
FIG. 3 is a front view representing a tray and retaining means.

If this may happen, the retaining roller 121 having moved to the first position (I) is moved back to the second position (II), as shown in FIG. 3, and is moved by returning force resulting from the rotation of the retaining roller 121 until the trailing edge of sheet S1 hits the back fence 131, whereby the returning function is fulfilled.

Figure 4:
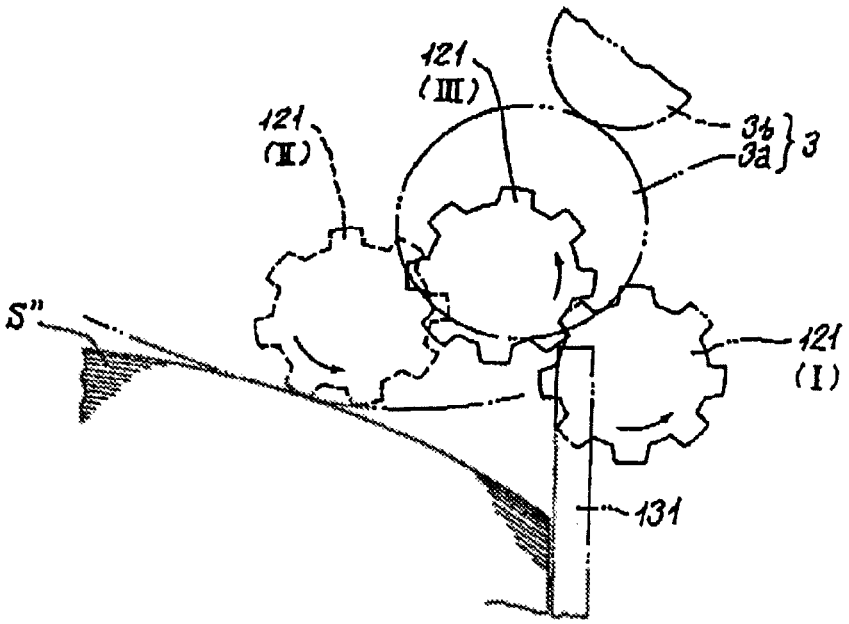
FIG. 4 is a drawing representing the position of a retaining roller.

According to the above-mentioned method of fulfilling the retaining function first, and returning function thereafter, it is necessary to go back to the first position every time, and this consumes time. To solve this problem, a third position is provided for the retaining roller 121 between the first position (I) and second position (II) and separated from the loaded paper S" in the present embodiment as shown in FIG. 4. After retaining function has been performed at the second position (II), the roller moves to the third position (III) and stays there. Before it performs retaining function it waits until the newest sheet S1 ejected from the ejecting means falls on the tray 12. After the sheet has fallen, the roller moves to the second position, and performs the returning function of feeding the newest sheet S1 back to the end fence 131 at that position. This method saves time since the second position (II) is closer to the third position (III) than to the first position (I).

In the above description, the roller moves to the third position after it has fulfilled the retaining function, and moves to the second position in order to perform returning operation in conformity to ejection of the sheet. However, the following cycle is more practical: Namely, for the first sheet of the job, there is no sheet to be retained on the tray 12, so the roller first moves from the first position (I) to the second position (II) where it performs returning operation. Then the roller moves to the third position (III). In conformity to the next sheet being ejected, the roller moves to the second position (II) where it performs the retaining function. After that, the roller returns to the third position (III) and returning function is fulfilled at the second position (II) in conformity to the ejection of the sheet. Then the roller returns to the first position (I).

Example 2

The following describes an example of the displacement means in the vertical direction. In the above example 1, the direction of movement between the first position (I) and the second position (II) where the retaining roller 121 is located is found between two different positions. Without being restricted thereto, the same effect can be obtained by setting the first and second positions approximately in the vertical direction orthogonal to the direction of ejection "a".

The following describes an example of setting the direction of the movement of the retaining roller 121 approximately in the vertical direction as described above, together with the example of the displacement means for displacing the retaining roller 121 in that manner.

Figure 5:
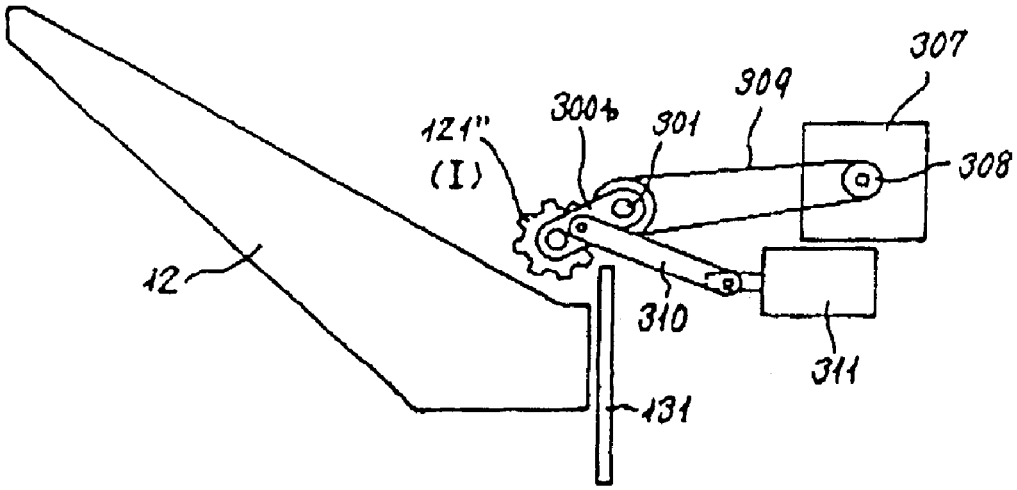
FIG. 5 is a front view representing a retaining roller displacement means.
Figure 6:
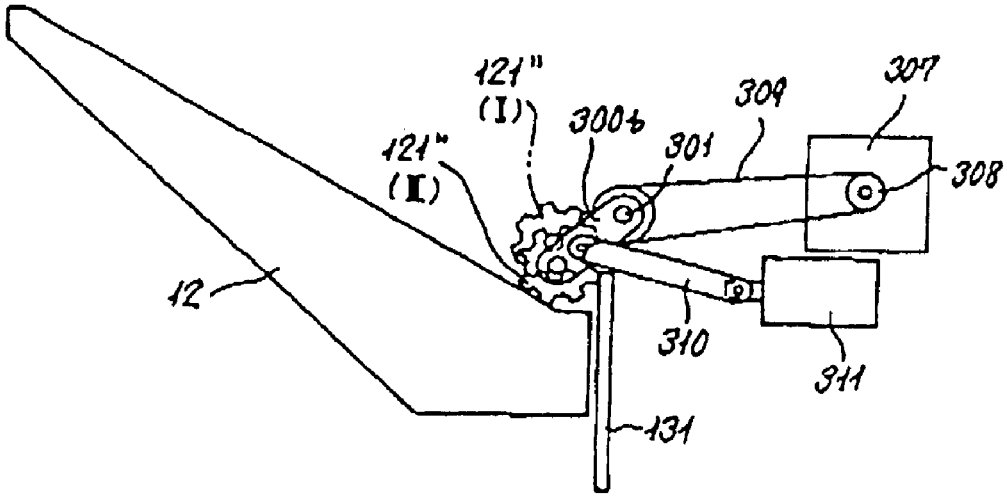
FIG. 6 is a front view representing a retaining roller displacement means.
Figure 7:
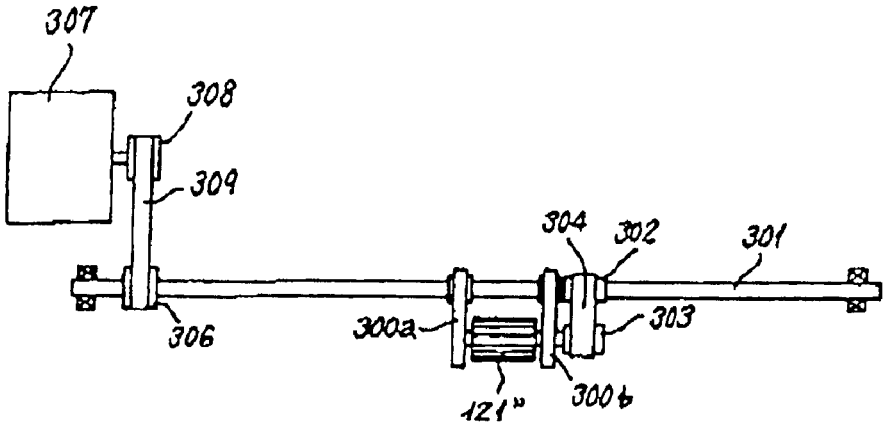
FIG. 7 is a plan view representing a retaining roller displacement means.

The following describes the displacement means with reference to FIGS. 5 to 7:

In this example, the retaining roller 121" is journaled by one end of two rocking arms 300*a* and 300*b*, and the other end of rocking arms 300*a* is 300*b* are journaled by the immovable member. The shaft 301 is equipped with the pulley 302, and the shaft integral with the retaining roller 121 is equipped with the pulley 303 integrally. A belt 304 is applied between these pulleys 302 and 303. In the same way, a belt 309 is also applied between a pulley 306 integral with the shaft 301 and a pulley 308 integral with the shaft of the motor 307. The rotation of the motor 307 is transmitted to the retaining roller 121", whereby the retaining roller 121 can be driven.

One end of a link 310 is pivoted to the position between rocking arms 300*a* and 300*b*, and the other end is pivoted to the plunger of solenoid 311. The plunger of the solenoid 311 is pulled by the pulling spring (not illustrated) in the direction of being pulled out.

When the solenoid 311 is not energized, the plunger is pulled out by the energizing force of the above-mentioned pulling spring (not illustrated) as shown in FIG. 5, and rocking arms 300*a* and 300*b* are turned about the shaft 301 in the clockwise direction. In this case, the retaining roller 121" is located at the first position (I) separated from the upper surface of the tray 12 (or upper surface of the loaded sheet if the sheet is loaded).

Further, if the solenoid 311 is energized, the plunger is pulled back against the energizing force of the above-mentioned pulling spring, as shown in FIG. 6, and the retaining roller 121" is located at the second position (II) indicated by a two-dot chain line in light contact with the upper surface of the tray 12 (or upper surface of the loaded sheet if the sheet is loaded).

As described above, the retaining roller 121" can be moved freely between the first position (I) and second position (II) in the vertical direction by the displacement means comprising rocking arms 300*a* and 300*b*, link 310 and solenoid 311. Further, retaining roller 121" can be driven by the motor 307.

The retaining roller 121" can be moved freely between the first position (I) and the second position (II) in the vertical direction by the displacement means mentioned in this example. Then the retaining function can be obtained, similarly to the description of Example 1.

Example 3

Figure 8:
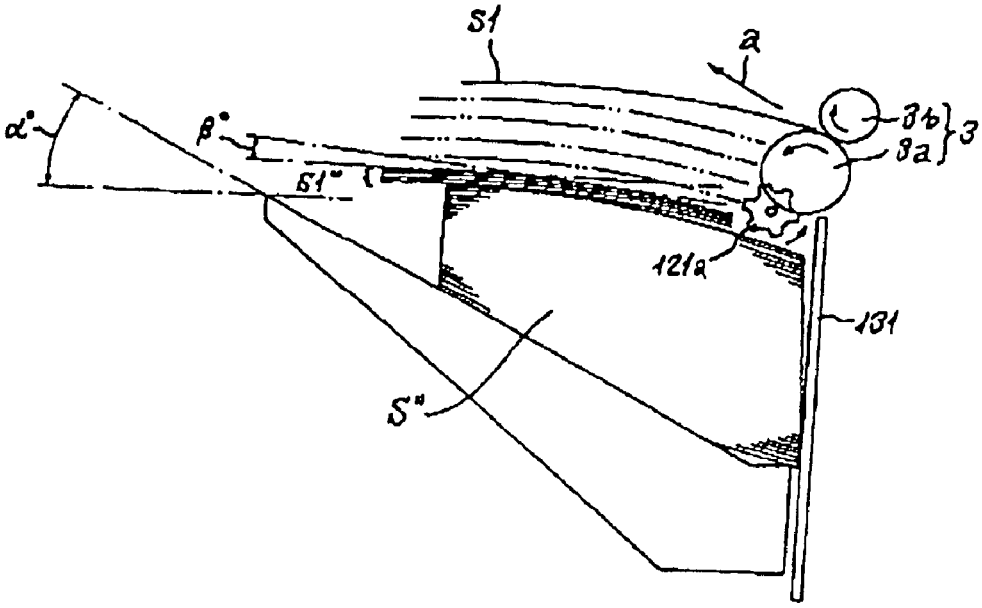
FIG. 8 is a front view of a tray illustrating the change in the tilt angle due to the curling of the sheet located on the tray.

The following describes an example of the displacement means in the direction of ejection: In the case of movement in the vertical direction as described above, sheets S1 ejected from the ejection roller 3 are lowered one by one as shown by a two-dot chain line in FIG. 8, and are dropped on the loaded paper S". When the loaded paper S" is face curled, the sheets S1 subjected to gravity drop cannot move under their own weight until they hit the end fence 131, as described above. They will produce misaligned sheets S1'.

Figure 9:
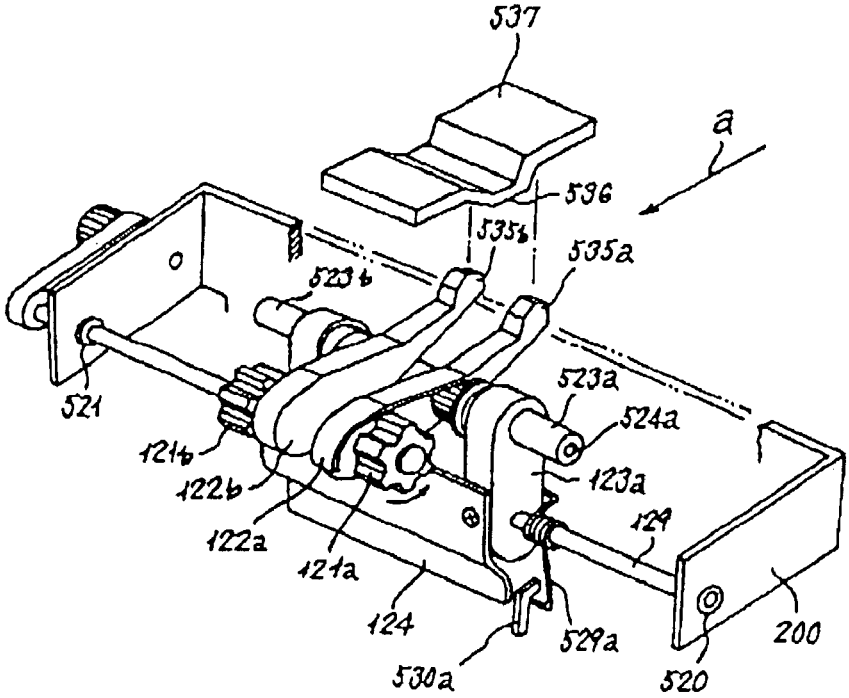
FIG. 9 is a perspective view representing the major portion of the sheet-like medium alignment apparatus.
Figure 10:
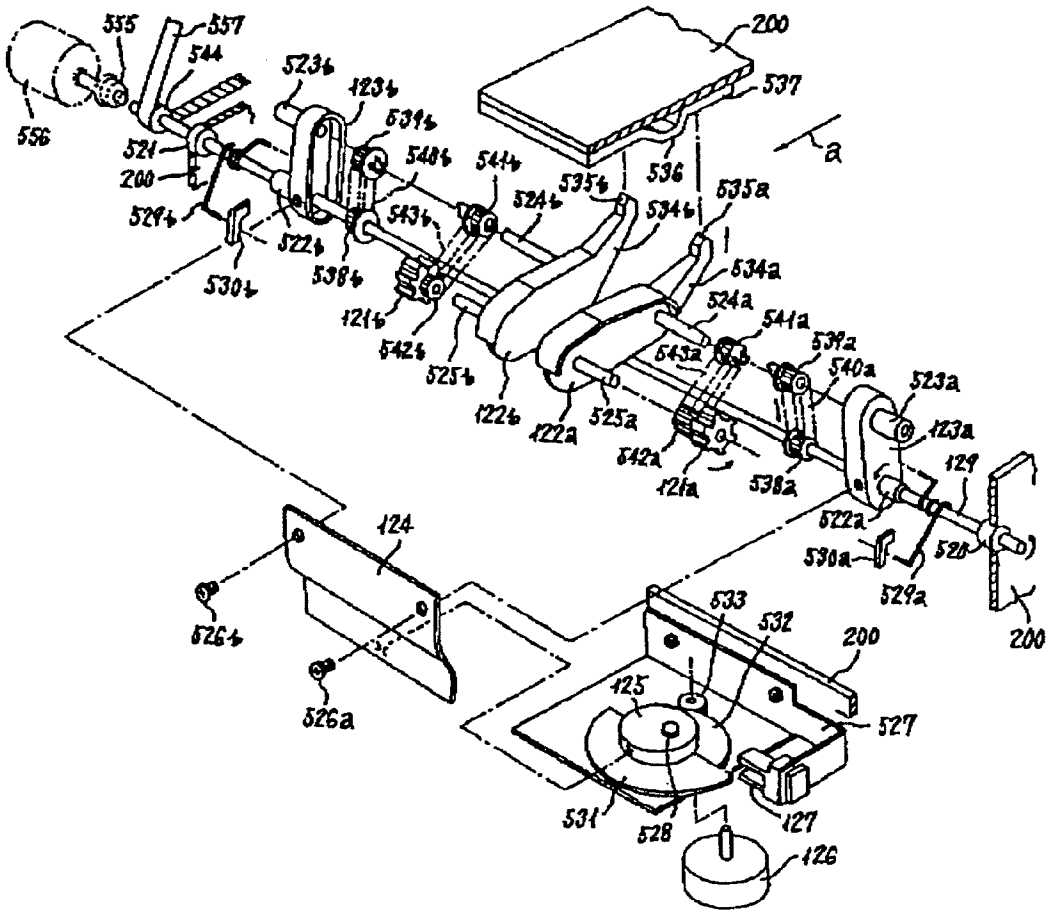
FIG. 10 is an exploded perspective view representing the major portion of the sheet-like medium alignment apparatus.

Such misalignment problems cannot be solved by the displacement means which moves the retaining roller 121 in the vertical direction, as shown in FIGS. 5 to 7. This requires use of a displacement means which allows change of the position in the direction of ejection "a", as shown in FIGS. 1 to 4. The following describes an example of the displacement means for changing the position of the retaining roller 121 in the direction of ejection "a":

FIG. 9 represents the major portion of the displacement means and retaining roller assembled together. FIG. 10 represents the major portion of the displacement means and retaining roller disassembled together. In these figures, the constituent members are mounted on the frame 200 and are assembled together.

The retaining roller 121 comprises retaining rollers 121*a* and 121*b*. The means of displacing the retaining roller 121*a* and means of displacing the retaining roller 121*b* are designed in an identically the same configuration in the common portion. To avoid confusion regarding the configuration of the common portion, letter "a" will be affixed to the numeral of reference for each member of the retaining roller 121*a*. For each member of the retaining roller 121*b*, letter "b" will be affixed to the numeral of reference.

The following describes the basic configuration of the displacement means:

In FIGS. 9 and 10, the first member (hereinafter referred to as "drive lever") 123*a* is a long member, and a shaft 129 penetrates through the intermediate position thereof. Here the shaft 129 is freely rotatable with respect to the lever 123*a*, and both ends of the shaft 129 are journaled by a frame 200 as an immovable member through bearings 520 and 521. The portion of the drive lever 123*a* penetrated by the shaft 129 is a pivot portion. This portion is called the first pivot portion 522*a*. The driven lever 123*a* can be rocked within a specified angular range about the first pivot portion 522*a*. A second pivot portion 523*a* is provided on one end of the free end side of the drive lever 123*a* disengaged from the first pivot portion 522*a*.

The second member (hereinafter referred to as "driven lever") 122*a* is a long member, and a shaft portion 524*a* is installed at the intermediate position in an overhanging sheet. This shaft portion 524*a* is pivoted to the second pivot portion 523*a* of the drive lever 123*a*. The driven lever 122*a* can be rocked within a specified angular range about the second pivot portion 523*a*.

A shaft portion 525*a* is integrally formed on a given free end side off the center of rotation (center of the shaft portion 524*a*) at the second pivot portion 523*a* of the driven lever 122*a*, and retaining roller 121*a* is pivoted to this shaft portion 525*a*.

The retaining roller 122*a* pivoted to the free end side of the driven lever 122*a* can be displaced to different positions in the direction of ejection "a" by a combined operation between rocking about the first pivot portion 522*a* of these drive levers 123*a* and rocking about the second pivot portion 523*a* of the driven lever 122*a*.

This allows the retaining roller 121 to be displaced further than that in the configuration wherein the retaining roller is installed on the leading edge of a freely rocking lever as a single unit.

As compared to other configurations, this configuration provides a compact structure because of the design which ensures free bending of the drive lever 123*a* and driven lever 122*a*, when the same stroke is to be achieved. Further, displacement in the vertical direction is also possible in the case of drawing a bell-shaped locus, for example. The roller can hit the upper surface of the sheet on the tray by traveling over the trailing edge which is curled upward due to face curling.

The drive lever 123*a* has a bracket 124 comprising a sheet metal fixed on the side in the vicinity of the first pivot portion 522*a* by means of a screw 526*a*. This allows the drive lever 123*a* to be integrated with the plate-shaped bracket 124.

The peripheral surface of an eccentric cam 125 for rocking the drive lever 123 is kept in contact with the lateral portion of the upstream side of this bracket 124 in the direction of ejection "a". This eccentric cam 125 is designed to be driven integrally with the shaft 528 journaled by the support plate 527 shaped integrally with the frame 200. A torsional coil spring 529*a* is provided as the first contacting means for pressing the cam surface of the eccentric cam 125 elastically against the bracket 124. One end of this torsional coil spring 529*a* loosely winding around the outer periphery of the first pivot portion 522*a* formed in a boss is applied to the side of the drive lever 123*a*, and the other end of this torsional coil spring 529*a* is applied to the hook 530*a* which is configured as part of the frame 200.

The drive lever 123*a* is turned about the first pivot portion 522*a* in the arrow direction and is energized by the elastic force of this torsional coil spring 529*a*, and is pressed elastically against the eccentric cam 125. Accordingly, the drive lever 123*a* is rocked about the first pivot portion 522*a* by rotation and drive of the eccentric cam 125 in conformity to the amount of the deviation of the cam surface.

Since the eccentric cam 125 has an endless cam surface, a periodic displacement can be given to the drive lever 123, hence, retaining roller 121 by the rotary movement.

The first rocking means is composed of a torsional coil spring 529*a* as the first contacting means and eccentric cam 125. The free end sides of the eccentric cam 125 and the drive lever 123*a* (bracket 124) are brought in a sliding contact with by this first rocking means. In conformity to the rotation of the eccentric cam 125, the drive lever 123*a* can be rocked at a specified angle.

In this way, the drive lever 123*a* is rocked to the specified angle by the first rocking means, whereby the driven lever mounted on the drive lever 123*a* is moved together with the retaining roller 121*a*, and an arch-shaped displacement in the direction of ejection "a" can be given to the retaining roller 121*a*.

The shaft center of a shaft 528 fixing the eccentric cam 125 is fixed by a shield plate 531 made of a disk with semicircular sheet notched on part thereof, and the gear 532 is fixed to the shaft center. The gear 532 is meshed is fixed with a gear 533 which is turned and driven by the stepping motor 126 fixed to the support plate 527. Further, a sensor 127 is fixed to the position where the notch of the shield plate 531 pass, and the amount of rotation of the eccentric cam 125 is detected according to the information on the shield plate 531 detected by the sensor 127. This allows the drive stop of the stepping motor 126 to be controlled. An encoder is composed of a combination of sensor 127 and shield plate 531. The eccentric cam 125 is driven by a stepping motor 126, and the amount of rotation is controlled by the aforementioned encoder. As described above, a combination of the stepping motor and encoder allows an appropriate control of the position of the retaining roller 121. For example, the retaining roller 121 can be positioned to the first position (I), second position (II) and third position (III) shown in FIGS. 1 to 4.

The driven lever 122*a* is rocked about the second pivot portion 523*a* (shaft portion 524*a*) by the second rocking means provided so as to act on the free end 534*a* on the side opposite to where the retaining roller 121*a* is provided.

This second rocking means permits the driven lever 122*a* to be rocked about the second pivot portion 523*a* by a specified amount of angle in response to the rocking of the drive lever 123*a*. This second rocking means displaces the angle of the driven lever 122*a* with respect to the drive lever 123*a* about the second pivot portion 523*a*, whereby the retaining roller 121 can be moved between desired positions along a desired locus. Further, the stroke of the returning roller 121 can be increased by a combination between the rocking operation of the driven lever 122*a* and rocking operation of the drive lever 123*a*.

A projection 535*a* is provided on the free end side 534*a* of the driven lever 122*a* opposite to where the retaining roller 121*a* is mounted. The second rocking means is a cam sliding along the projection 535, and is equipped with a flat plate cam 537 where a trapezoidal projection 536 is formed on part of the peripheral surface of infinite curvature, and a second contacting means for contacting the flat plate cam 537 to the projection 535*a*. The aforementioned second contacting means can be formed by winding a torsional coil spring on the shaft portion 524*a* and by applying one end of this torsional coil spring to the driven lever 122*a*, with the other end of this torsional coil spring applied to the immovable member.

Contact of the projection 535*a* to the flat plate cam 537 is ensured by the second contacting means, and the retaining roller 121*a* can be moved in the vertical direction on a periodic basis in response to the rocking of the drive lever 123*a*. The retaining roller 121*a* can be displaced along a bell-shaped locus by a combination between the drive lever 123*a* and driven lever 122*a*. As a result, sheets loaded on the tray 12 can be moved to the second position (II) without being pushed out in the direction of ejection "a".

As shown in FIGS. 9 and 10, the flat plate cam 537 is located above the free end side 534*a* of the driven lever 122*a*, and a tray 12 is positioned below the retaining roller 121*a*.

The tray 12 is lowered as the sheet is ejected and the height of the tray 12 is increased, in order to keep a constant distance between the upper surface of the loaded sheet and ejection roller 3. This lowering operation is driven by a motor.

Limit switches are provided as safety measures to protect the upper and lower limits of the tray 12. Control is provided to ensure that the tray can be stopped in the event of the vertical tray traveling motor running away out of control. In the present example, the flat plate cam 537 is located above the free end side 534*a* of the driven lever 122*a*. If this configuration is adopted, the driven lever 122*a* is allowed to turn about the second pivot portion 523*a* and escape from the flat plate cam 537 even when a failure has occurred to the tray 12 for any reason before these limits are reached, and even if the tray 121 pushes up the retaining roller 121*a*. Then there is mere rotation of the driven lever 122*a* without any interference with other portions, whereby the member is protected against possible damage. The following describes the power transmission system for turning and driving the retaining roller 121*a*:

The power transmission system mainly comprises pulleys rotating about the pivot centers of the first pivot portion 522*a* and second pivot portion 523*a*, and belts applied to these pulleys. The pulleys and belts herein include the gears and chains as similar power transmission means.

FIG. 10 shows a combination of a pulley 538*a* rotating integrally with the shaft 129, a pulley 539*a* pivoted to the shaft portion 524*a*, and a belt 540*a* applied to these pulleys 538*a* and 539*a*. Further, there is a combination of a pulley 541*a* pivoted to shaft portion 524*a*, a pulley 542*a* pivoted to shaft portion 525*a* and integrally formed with retaining roller 121*a*, and a belt 543*a* applied to these pulleys 541*a* and 542*a*.

Pulleys 541*a* and 539*a* are integrally rotated by the meshing of the meshing portion formed on the side when meshed with a common shaft portion 524*a*.

A stepping motor 556 is coupled to the shaft end of the shaft 129 through the joint 555 and shaft 129 is rotated and driven by the stepping motor 556. The stepping motor 556 is fixed to the frame 200. Further, when the stepping motor 556 is not installed, a pulley 544 is mounted, so torque can be obtained through the belt 557 commonly driven by the ejection roller 3. In any way, power is transmitted by the rotation of the shaft 129 in the order of pulley 538*a*, belt 540*a*, pulley 539*a*, pulley 541*a*, belt 543*a*, pulley 542*a* and retaining roller 121*a* to rotate and drive the retaining roller 121*a*.

As described above, a pulley is arranged at the rocking fulcrum of each of the drive lever 123*a* and driven lever 122*a*, and power is transmitted to the retaining roller 121*a* through these pulleys. At the same time, the shaft portion of the power transmission pulley is used also as a rocking fulcrum shaft for displacement of the retaining roller. This allows easy formation of the power transmission system, and power can be supplied easily from outside the drive lever 123*a*. This ensures a light weight and compact configuration of the displacement means.

As described above, the power transmission system for rotation of the retaining roller 121 in FIG. 10 contains a pulley 538*a* provided integrally with shaft 129 concentric with the first pivot portion 522*a*, a pulley 539*a* pivoted to the shaft portion 524*a* concentric to the second pivot portion 523*a*, and a belt 540*a* applied between these pulleys 538*a* and 539*a*.

Figure 11:
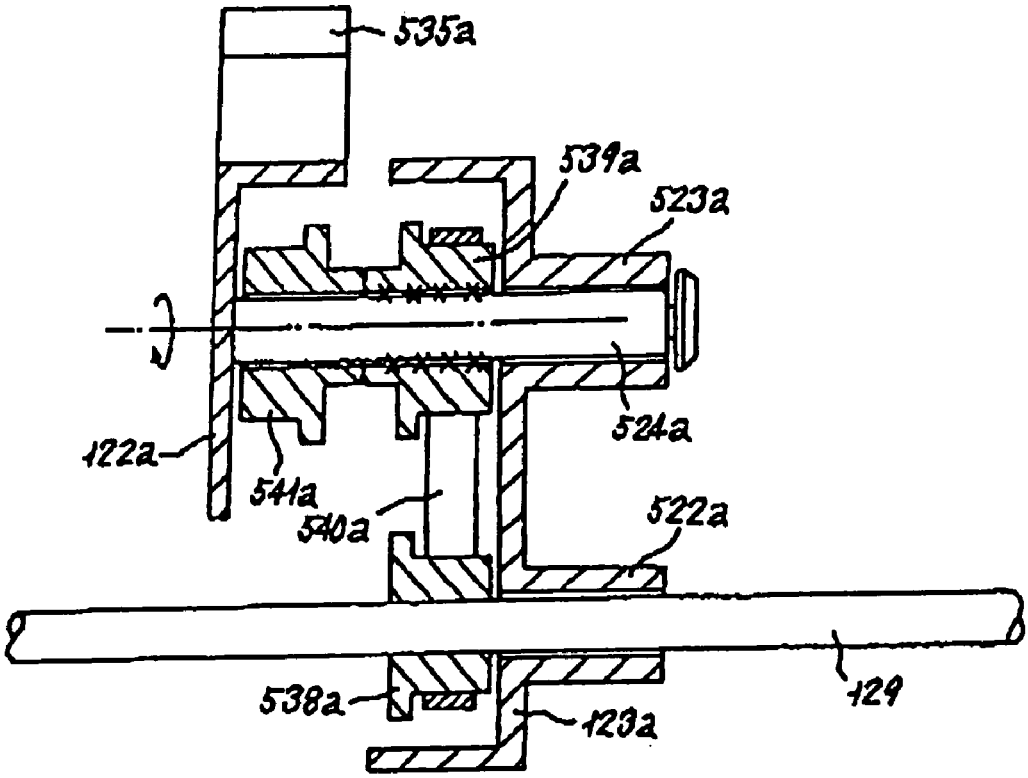
FIG. 11 is a cross sectional view representing the power transmission system illustrating the rotary drive system of the retaining roller.

In FIG. 11 showing the cross section of this power transmission system, the pulley 538*a* is fixed integrally with the shaft 129, and the pulley 539*a* is pivoted to the shaft portion 524*a*. In this example, especially, a proper tension of the belt 540*a* applied between these pulleys 538*a* and 539*a* is selected, and the pulley 539*a* is pressed against the shaft portion 524*a* by this tension, whereby an appropriate frictional force between the inner diameter of the this pulley 539 and the shaft portion 540*a*. This frictional force allows the drive force of the pulley 539*a* to be transmitted also to the shaft portion 524*a*, and the driven lever 122*a* is turned about the second pivot portion 523*a* and is energized thereby.

In FIGS. 9 and 10, rotation is made in the counterclockwise direction in order to allow the retaining roller 121*a* to fulfill the function of returning the sheet to the back fence. When the retaining roller 121*a* is rotated in this direction, the pulley 539*a* rotates in the counterclockwise direction. The driven lever 122*a* operated by the aforementioned frictional force during rotation in this direction is also rotated about the second pivot portion 523*a* in the counterclockwise direction and is energized. Energization is provided by this force of rotation and energization in the direction where projection 535*a* of the driven lever 122*a* is pressed against the flat plate cam 537.

As shown in this example, it is possible to use the function of the second energizing means wherein the projection 535*a* of the driven lever 122*a* is pressed against the flat plate cam 537 by (1) frictional force between the pulley 539*a* and shaft portion 524*a* caused by the tension of belt 540*a*, and (2) rotation of the driven lever 122*a* provided by torque of the pulley 539*a*. This provides a simpler configuration than when the torsional coil spring is used. In this case, the belt 540*a* is set to a proper tension so that there is a slip between the pulley 539*a* and shaft portion 524*a* when the projection 535*a* is pressed against the flat plate cam 537 at a proper pressure.

Alignment operation performed by deforming the retaining roller using the displacement means having a configuration described with reference to FIGS. 9 to 11 will be described with reference to FIGS. 12 to 13, and the configuration will also be included in the description.

Figure 12:
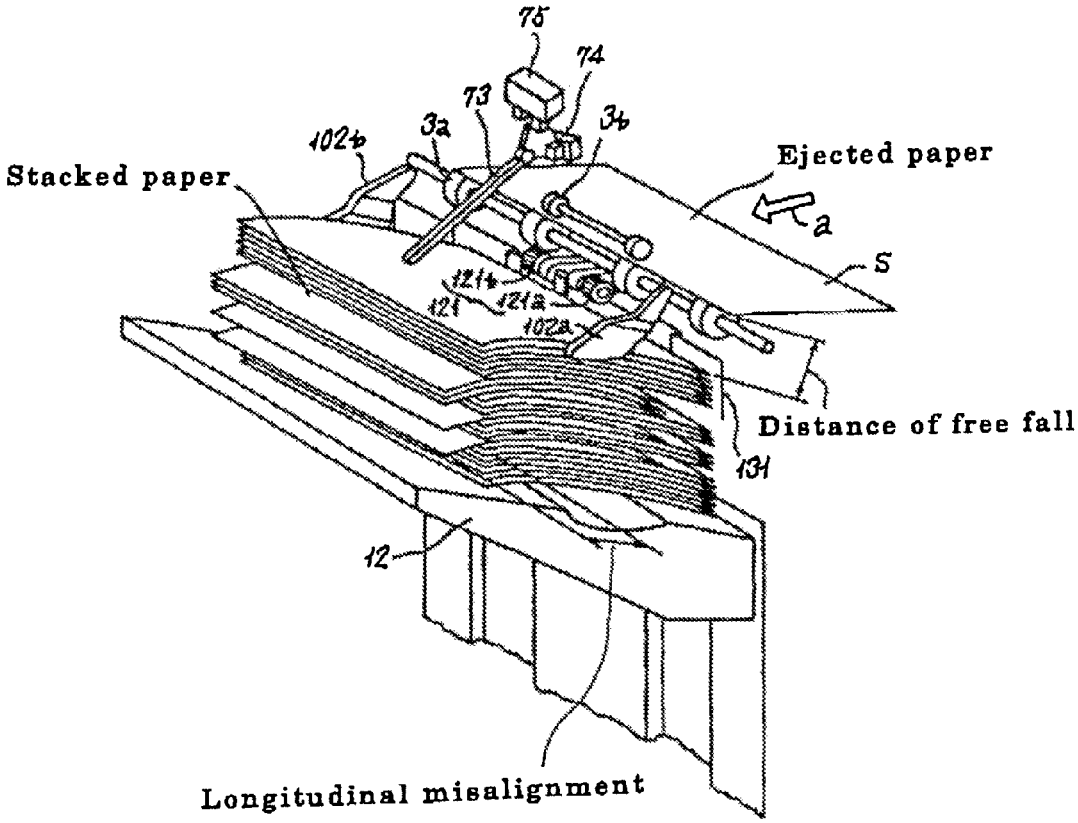
FIG. 12 is a perspective view representing the tray and retaining roller.
Figure 13:
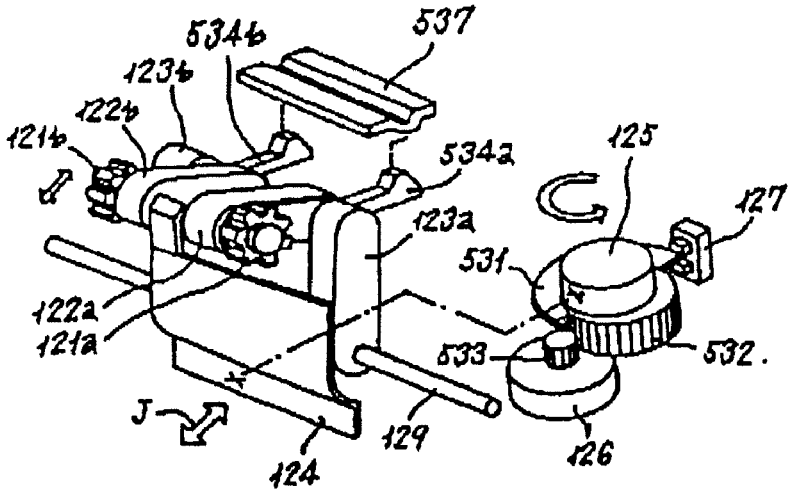
FIG. 13 is an exploded perspective view illustrating the major portion of the sheet-like medium alignment apparatus.

In FIG. 12, the retaining roller 121 is located in the vicinity of the bottom of the ejection roller 3 of the sheet alignment apparatus. In this example, this roller consists of two retaining rollers 121*a* and 121*b*, which are arranged opposite to the center along the width of the sheet orthogonal to the direction of ejection "a". A paper surface lever 73 for detecting the height of the loaded paper surface is located in the vicinity of this retaining rollers 121*a* and 121*b*. When the sheet has been loaded, the shield of the paper surface lever 73 is detected by the paper surface sensor 74, and the tray 12 is lowered. Accordingly, the contact point between the paper surface lever 73 and the surface of the sheet loaded on the tray 12 is controlled and kept at a constant height at all times.

As shown in FIG. 3, to ensure the retaining roller 121 fulfills the returning function, the retaining roller 121 is displaced up to the second position to be in contact with the trailing edge of the sheet, and is returned by torque.

As described above, the retaining roller 121 is pivoted to the shaft portions 525*a* and 525*b* of driven levers 122*a* and 122*b*, and the shaft portions 524*a* and 524*b* opposite to these driven levers 122*a* and 122*b* are inserted into drive levers 123*a* and 123*b*. This allows the driven levers 122*a* and 122*b* to be turned about the shaft portions 524*a* and 524*b*.

Further, the sides of drive levers 123*a* and 123*b* opposite to where driven levers 122*a* and 122*b* are pivoted are inserted through the shaft 129 so that drive levers 123*a* and 123*b* can be turned about the shaft 129. Further, bracket 124 is connected to drive levers 123*a* and 123*b*. The bracket 124 is displaced by the eccentric cam 125, whereby the drive levers 123*a* and 123*b* are rocked about the shaft 129. The driven levers 122*a* and 122*b* pivoted to the drive levers 123*a* and 123*b* are rocked to displace the retaining roller 121.

Figure 14:
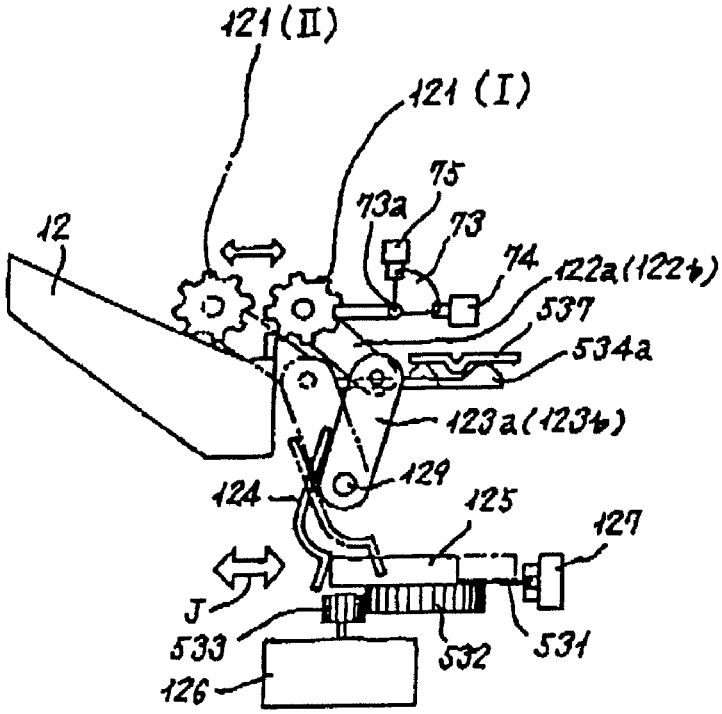
FIG. 14 is a front view illustrating the major portion of the sheet-like medium alignment apparatus.

As shown in FIG. 14, the retaining roller 121 moves from the first position (I) (home position) to the second position (II) illustrated by the two-dot chain line, and comes in contact with the trailing edge of the sheet fallen on the tray 12. The sheet is pulled back to the end fence 131 by this torque, whereby the trailing edge of the sheet is aligned.

The eccentric cam 125 for displacing the bracket 124 connected to the drive levers 123*a* and 123*b* in the arrow-marked direction is rotated by the stepping motor 126 through the gears 533 and 532. The aforementioned displacement is performed by this rotation.

A semicircle shield plate 531 is mounted on the eccentric cam 125. This shield plate 531 is detected by the sensor 127, whereby the stop position of the eccentric cam 125, hence, the stop position of the retaining roller 121 is regulated. In FIG. 14, the first position (I) of the retaining roller 121 (wait position) is indicated by a solid line, while the second position (II) (returning and retaining position) is shown by a two-dot chain line.

The following describes the timing of displacing the retaining roller 121:

Normally, this roller is located at the first position (I), and is displaced from the first position (I) to the second position (II), before the sheet is ejected from the ejection roller 3 and the leading edge or end of the sheet on the upstream side in the direction of ejection contacts the loading sheet. The retaining roller 121 displaced along the bell-shaped locus in conformity to the sheet of the cam by the flat plate cam 537 is lowered to contact the trailing edge of the loaded paper, and stays at the second position (II) for a specified time until pushing of the loaded paper by the leading edge of the ejected sheet is suspended. After the retaining function has been fulfilled, the eccentric cam 125 is rotated, and the roller is displaced up to the first position (I) or the third position (III). Then after the aforementioned ejected sheet has dropped onto the loaded paper, the roller moves back to the second position (II) to return this sheet to the back fence, and fulfills the returning function. Then it goes back to the first position (I). This cycle is repeated. Through such operations, sheet alignment accuracy in the direction of ejection "a" is improved by the retaining function and returning function.

If back curling is not so marked as that shown in FIG. 3 and paper can be returned sufficiently until it hits the back fence 131 merely by being from the ejection roller 3 without any need for using the returning function, then it is not necessary for the retaining roller 121 to perform returning function, or to turn or drive the retaining roller 121. In this case, it is necessary only to repeat a cycle of reciprocating the retaining roller 121 between the first position (I) and second position (II).

Figure 15:
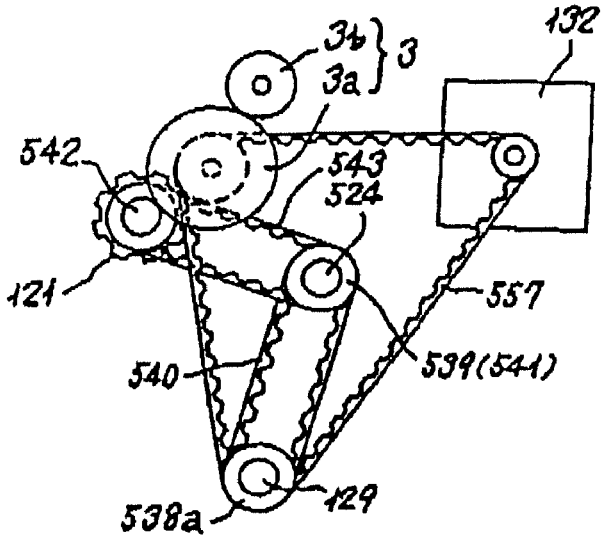
FIG. 15 is a front view illustrating the major portion of the retaining roller and ejection roller wherein (a) depicts an example of a drive source used for both the retaining roller and ejection roller, while (b) shows an example of drive sources installed separately for them.
Figure 15:
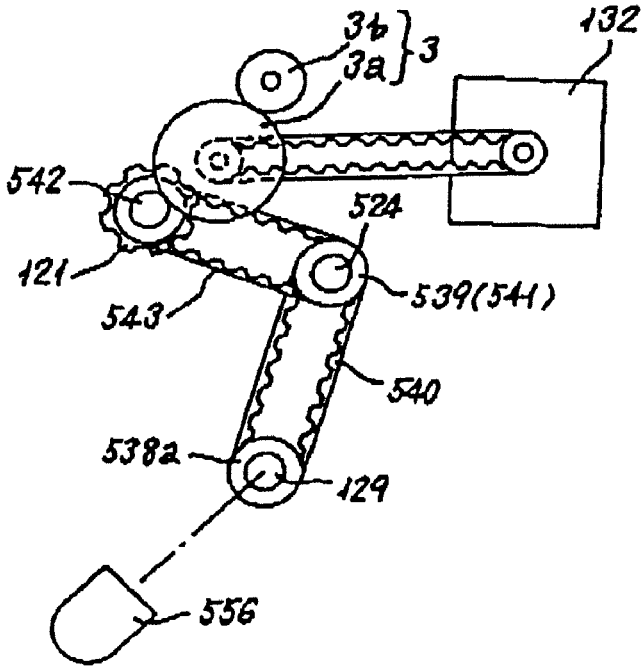

The following describes an example of turning and driving the retaining roller 121 with reference to FIG. 15(*a*): As shown in FIG. 10, the retaining roller 121*a* is integrally provided with a pulley 542*a*, and these pulleys are connected between the pulley 541*a* on the shaft portion 524 and belt 543*a*. Further, a pulley 539*a* coaxial and integral with pulley 541*a* is connected a pulley 538*a* on the drive side through the belt 540*a*.

The belt 540*a* is turned by the pulley 538*a* rotating integrally with a shaft 129 connected to a drive source, then pulleys 539*a* and 541*a* are turned. The pulley 542*a* is driven through belt 543*a*, then the retaining roller 121 is turned. The pulley 542*b* is also driven in the same manner.

Here, the belt 543 is housed in the driven lever 122*a* (122*b*) shown in FIG. 14, and the belt 540 is incorporated in the drive lever 123*a* (123*b*). These structures were already described with reference to FIG. 10.

In this example, the shaft 129 is turned through belt 557 by the stepping motor 132 driving the lower roller 3*a* on the drive side. In other words, the retaining roller 121 is also rotated by the stepping motor 132 turning the ejection roller 3.

Alternatively, as described above, a stepping motor 556 specifically designed for rotation of the shaft 129 may be installed without using the stepping motor 132 for dual purpose, as shown in FIG. 15(*b*) or 10. In the case of FIG. 15(*a*), the stepping motor 132 is used for dual purpose. So one motor is sufficient, but there is a disadvantage that drive of the ejection roller 3 and that of the returning roller 3 cannot be controlled separately. The example where a drive motor is installed separately as shown in FIG. 15(*b*) has an advantage that the drive of the ejection roller 3 and that of the returning roller 3 can be controlled separately.

In any case, the retaining roller 121 is made to wait at the first position (I) until the sheet passes through the ejection roller 3 to drop onto the tray 12. The retaining function or returning function is performed by displacement to the second position (II) at a specified time.

The following describes the configuration where the angle formed by the drive lever 123 and driven lever 122 (angle of engagement) is changed between the first position (I) and the second position (II).

The traveling distance of the retaining roller 121 can be increased if the angle of engagement formed between the drive lever 123 and a driven lever 122 as a displacement means for displacing the retaining roller 121 by supporting it is changed between the first stop position and the second stop positions of the retaining roller 121.

Figure 16:
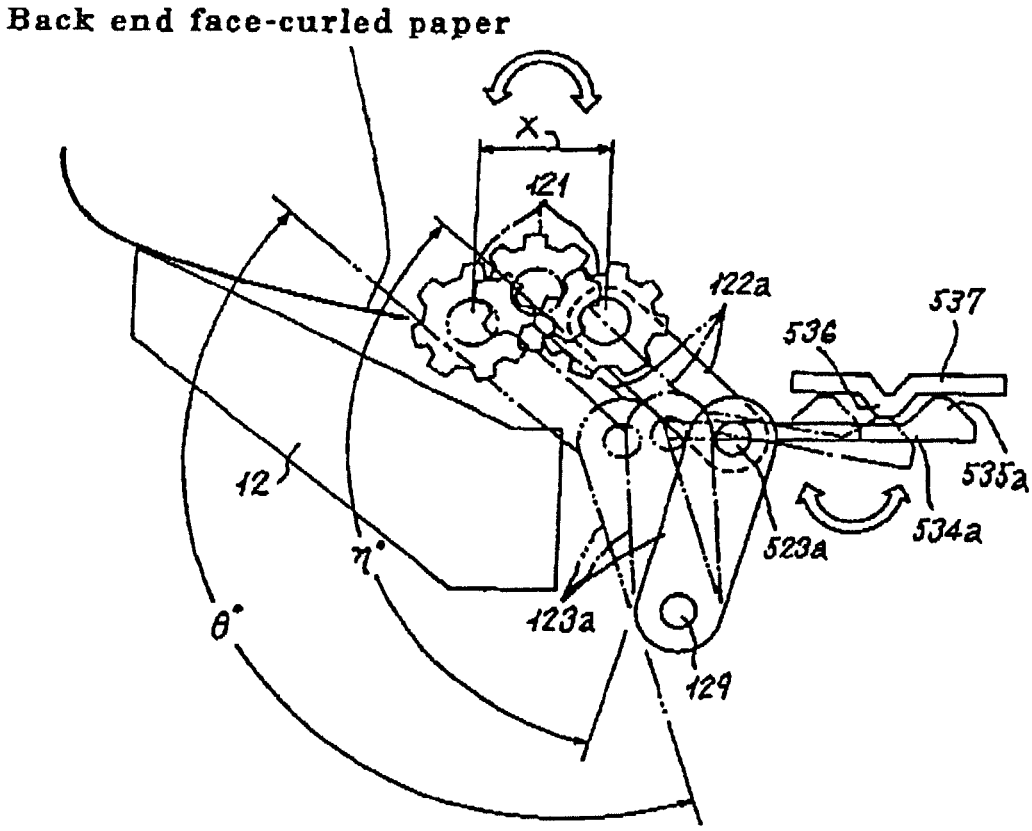
FIG. 16 is a front view illustrating the operation mode of the displacement means.

As shown in FIG. 16, when the angle of engagement θ degrees at the second position (II) is greater than that η between driven lever 122 and drive lever 123 at the first position (I) of the retaining roller 121, the traveling distance X of the retaining roller 121 can be increased over that when the retaining roller 121 is arranged directly on drive lever 123, in the case of the same rotary angle about the shaft 129.

If the traveling distance X can be increased, it becomes possible to ensure that the trailing edge of the sheet dropped onto the tray 12 is brought in contact with the retaining roller 121 especially when the returning function is used, and this allows the alignment accuracy to be improved. Even if the sheet is dropped away from the retaining roller 121 and is loaded for some reasons for example, reliability of the contact the trailing edge of the sheet is increased as the traveling distance of the retaining roller 121 is increased.

Here the rocking amount of the driven lever 122 depends on the characteristics of the flat plate cam 537. The amount of rotation of the driven lever 122 is regulated by the amount of the projection 535*a* pushed down by the projection 536 of the flat plate cam 537 when the projection 535*a* shaped on the free end side 534*a* deviated from the second pivot portion 523*a* as a rocking center of the driven lever 122 is made to slide with the flat plate cam 537. Accordingly, the traveling locus of the retaining roller 121 is necessarily determined by the locus of the contract between the flat plate cam 537 and projection 536.

The retaining roller 121 contacts the sheet in the vicinity of the paper surface lever 73 where the height of the trailing edge of the sheet is detected. The trailing edge of the sheet is always controlled to remain at a specified height. So when the retaining roller 121 has shifted to the second position (II) by the projection 535*a* running on the projection 536, retaining roller 121 is brought in contact with the sheet trailing edge, and the returning portion (sponge) of the retaining roller 121 is slightly deformed to perform retaining function. Further, it can also carry out the returning function.

As described above, the drive lever 123 is designed to rotate about one end as a fixed center, and a driven lever 122 is pivoted to the other side. The retaining roller 121 is installed on one side with the pivot portion of the driven lever 122 as its center, while a cam means for regulating the amount of rocking is provided on the other side. If the retaining roller 121 is located at the first position (I), and the angle of engagement between drive lever 123 and driven lever 122 at the second position (II) is made greater than that at the first position (I), then operation can be made farther with the same amount of rotation than when the retaining roller 121 is supported by a single rocking support member. Further, since the angle of engagement between the drive lever 123 and driven lever 122 is changed by the cam means, it can be shifted to the optimum returning position in conformity to the positional relationship with the tray 12. This makes it possible to realize the returning roller which rocks between the first position (I) and the second position (II) at a smaller space, thereby improving the alignment accuracy in the direction of ejection.

The following describes the locus in the event of displacement of the retaining roller 121 with reference to FIG. 16: When the sheet trailing edge is face curled, the sheet is retained at the first position (I) where the retaining roller 121 is waiting. Alternatively, the trailing edge of the sheet curled and raised by the retaining roller 121 may be pushed when shifting to the second position (II) for returning operation. This may deteriorate alignment accuracy.

To solve this problem, a projection 535 is formed on the leading edge of the 534*a* on the free end side of the driven lever 122, and is brought in a sliding contact with the projection 536 formed on part of the flat plate cam 537. Thus, the free end side 534*a* of the driven lever 122 is displaced upward before convex portions of both the projections 535 and 536 are brought in contact in conformity to rocking of the driven lever 122*a*. The retaining roller 121 opposite to the rotational center is raised accordingly. When both convex portions are brought in contact, the retaining roller 121 is lowered. The retaining roller 121 is raised by the aforementioned cam until the curl of the trailing edge of the sheet is got over. When the curl of the trailing edge of the sheet has been got over, the retaining roller 121 is lowered by the aforementioned cam. In other words, the aforementioned cam is used to allow the retaining roller 121 to plot a bell-shaped locus. This reduces the possibility of the trailing edge pushing out the face-curled sheet, thereby preventing the alignment accuracy from being deteriorated.

Embodiment 2

The present embodiment represents an example of application of a sheet-like medium post-treatment apparatus. The following describes the case where a sheet-like medium alignment apparatus equipped with a displacement means having a configuration described with reference to the aforementioned FIGS. 4 to 16 is mounted on the sheet-like medium post-treatment apparatus:

(1) Overview of the Sheet-like Medium Post-treatment Apparatus

The sheet-like medium post-treatment apparatus according to the present invention includes the one provided with a post-treatment means for post-treating the sheet and a transporting means for transporting the post-treated sheet, wherein post-treatment comprises steps of stamping, drilling, staple treatment and processing of the sheet-like medium in any manner.

The sheet-like medium alignment apparatus equipped with the displacement means described with reference to FIGS. 4 and 11 is arranged integrally with this sheet-like medium post-treatment apparatus. This sheet-like medium post-treatment apparatus allows one to select whether post-treatment is to be performed or not. Sheets post-treated as a result of selection of post-treatment or sheets not post-treated as a result of non-selection of post-treatment are can be sorted and loaded on the tray by the sorting function and alignment function of the sheet-like medium treatment apparatus.

Figure 17:
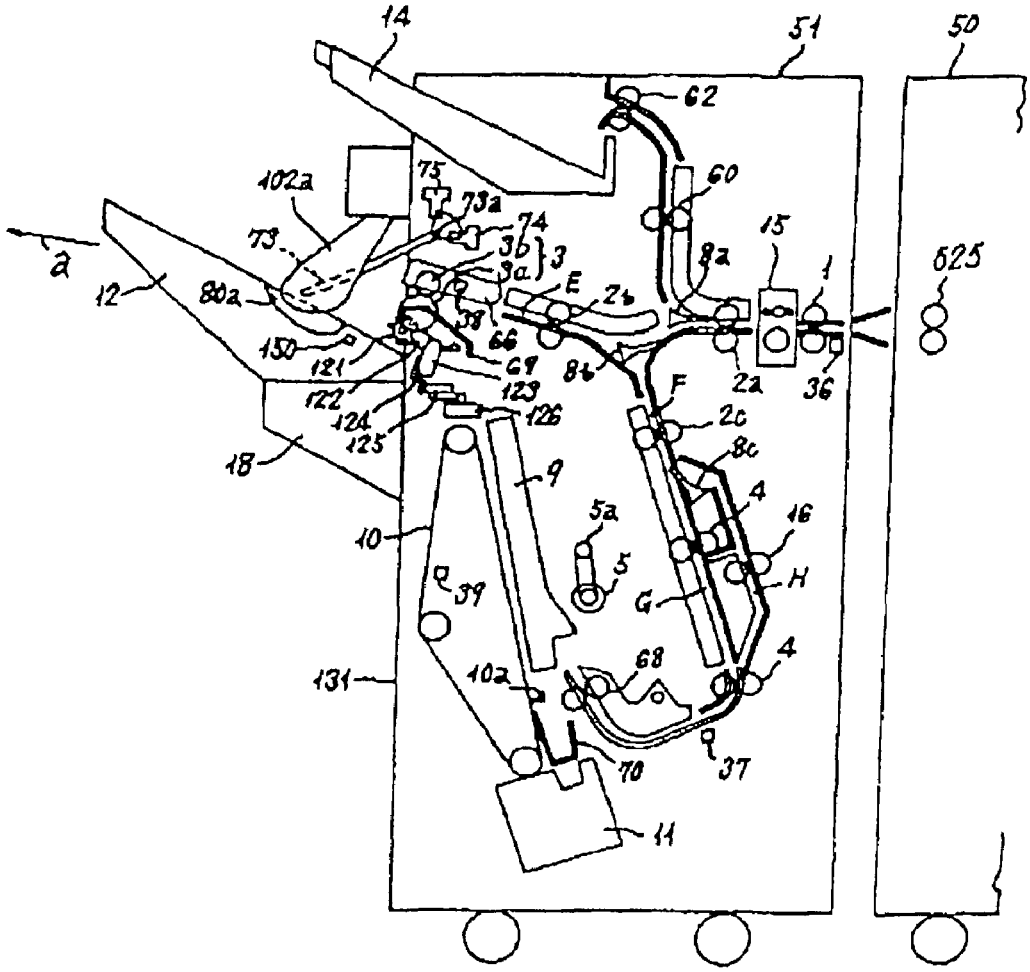
FIG. 17 is a front view representing the schematic configuration wherein the sheet-like medium alignment apparatus is configures as a sheet-like medium post-treatment apparatus.

FIG. 17 shows an example of the overall configuration of the sheet-like medium post-treatment apparatus 51 according to the present example. The sheet-like medium post-treatment apparatus of the present example is used in combination with other apparatuses having a sheet ejecting means, for example, the image forming apparatus 50 without alignment function, and sheets can be aligned on the tray by the alignment function.

In the image forming apparatus 50, imaged sheets are fed to the sheet-like medium post-treatment apparatus 51. It allows one to select whether post-treatment is performed or not. Sheets post-treated by selection of its performance or those not post-treated by selection of non-performance are aligned on the tray in the direction of ejection "a" by alignment operation of the sheet-like medium alignment apparatus combined with the sheet-like medium post-treatment apparatus 51. At the same time, they are loaded in the sorted state where they are displaced by the specified number of sheets in the direction orthogonal to the direction of ejection "a", if required. This sorting function is performed by the tray traveling means 98 (to be described later) for traveling the tray 12 in the direction of shift orthogonal to the direction of ejection "a" (denoted by "d" in FIG. 18).

In the image forming apparatus 50, sheet S imaged by the image forming means is fed to the sheet-like medium post-treatment apparatus 51 according to the post-treatment command given by the operator.

Post-treatment operations in the sheet-like medium post-treatment apparatus 51 comprises the following modes when the image forming apparatus 50 is a copying machine: (1) A normal mode for loading sheets simply in the order of ejection, wherein treatment is performed by specifying the sheet size and number of sheets to be copied; (2) a staple mode for stable treatment, wherein treatment is performed by specifying sheet size and number of sheets to be copied, as well as the number of sheets to bound and position to be bound; (3) sorting mode for sorting treatment wherein treatment is performed by specifying the sheet size and number of sheets to be sorted; and (4) a punch mode for punching operation.

Work instruction for these post-treatment operations is conveyed to the controlling means including a CPU through key entry from the operation panel of the image forming apparatus 50. Post-treatment execution signals are exchanged between the image forming apparatus 50 and sheet-like medium post-treatment apparatus 51, whereby post-treatment is performed.

As shown in FIG. 17, the sheet-like medium post-treatment apparatus 51 has a tray 12 capable of elevation as a loading means. It has a proof tray 14 as a position-fixed tray on the top of the apparatus.

An inlet sensor 36 and a pair of inlet rollers 1 are installed in the vicinity where sheets are exchanged with the image forming apparatus 50. Via the ejection roller 525 of the image forming apparatus 50 (see FIG. 12), sheets captured by a pair of inlet rollers 1 are transported through each transport route in conformity to the ¤post-treatment mode.

A punch unit 15 for punching operation is installed downstream from below a pair of inlet rollers 1. A pair of transport rollers 2*a* are mounted downstream from the punch unit 15, and a branching jaw 8*a* is installed downstream from a pair of transport rollers 2*a*. Sheets are selectively guided by the branching jaw 8*a* to a transport route leading to the proof tray 14 or a transport route running approximately horizontally. When sheets are transported to the proof tray 14, they are fed by a pair of transport rollers 60 and are ejected onto the proof tray 14 by a pair of ejection rollers 62.

A branching jaw 8*b* is installed on the downstream side of the branching jaw 8*a*, and the sheet is fed to the non-staple route E and staple route F by the branching jaw 8*b* on a selective basis. Branching jaws 8*a* and 8*b* are designed to be switched by the on/off control of the solenoid (not illustrated).

The sheet led to the non-staple route E is transported by a pair of the transport rollers 2*b*, and is ejected to the tray 12 by the ejection roller 3 as an ejecting means. A retaining roller 121 displaced by the displacement means explained with reference to the aforementioned FIGS. 9 and 16 is provided so as to overlap with the bottom of the ejection roller 3, or on the downward position. The end fence 131 for aligning the trailing edge of the sheet with respect to tray 12 is located on the left side in the drawing of the apparatus proper.

The ejection roller 3 comprises an upper roller 3*b* and lower roller 3*a*, and the upper roller 3*b* is rotatably supported on the free end of the supporting member 66 which is supported on the upstream side of the sheet in the direction of ejection "a" and which is provided freely rotatably in the vertical direction. The upper roller 3*b* is brought in contact with the lower roller 3*a* under its own weight or by energization. Sheets are held and sandwiched between both rollers and are ejected. When a bundle of bound sheets are ejected, the supporting member 66 is rotated upward, and is returned at a specified timing. This timing is determined on the basis of the detection signal of the ejection sensor 38.

The sheets fed to the staple route F are transport by a pair of transport rollers 2*c*. A branching jaw 8*c* is installed on the downstream side of a pair of transport rollers 2*c*, and sheets are fed to the main route G of the staple and retract route H on a selective basis by the branching jaw 8*c*. The branching jaw 8C is designed in such a way that its position is switched by the on/off control of the solenoid (not illustrated).

The sheets fed to the main route G of the staple are fed through the pair of transport rollers 4 and are detected by the ejection sensor 37 by a pair of ejection rollers 68. They are then loaded to the staple tray (not illustrated). In this case, each sheet is aligned by a taping roller 5 in the vertical direction (in the direction of sheet transport), and the jogger fence 9 is used for alignment in the direction of shift (width direction of the sheet orthogonal to the direction of ejection "a"). The stapler 11 is driven by the staple signal sent from the controlling means (not illustrated) at a break of the job, namely, between the last sheet of the bundle of sheets and the first sheet of the next bundle of sheets, whereby sheets are bound.

If the next sheet arrives in the process of binding at a short distance between sheets ejected from the image forming apparatus 50, the next sheet is led to a retract route H, where it is made to wait. The sheet led to the retract route H is transported by a pair of transport rollers 16.

The bundle of bound sheets are immediately sent to the ejection roller 3 by a discharge belt 10 comprising a discharge jaw 10*a* via the guide 69, and are ejected to the tray 12. The specified position of the discharge jaw 10*a* is detected by the sensor 39.

Pendulum movement about the fulcrum 5*a* is given to the taping roller 5 by the solenoid (not illustrated). It acts intermittently to the sheets fed to the aforementioned staple tray until sheets hit the end fence 131. A pair of ejection rollers 68 has a brush roller (not illustrated). This prevents back flow of the trailing end of the sheet. It should be noted that the taping roller 5 turns in the counterclockwise direction. The above is the outline description of the configuration and operation of inherently function portions of the sheet-like medium post-treatment apparatus.

The sheet-like medium post-treatment apparatus 51 performs post-treatment as an inherent function. It is also possible to align sheets after being loaded on the tray 12 as will be described later. This alignment entails alignment of the training end in the direction of ejection "a" and alignment of the end in the direction of shift "d". The former alignment is provided by hitting the end fence 131 and the function of the retaining roller 131. The latter alignment is provided by the aligning means 102 comprising two opposite aligning members 102*a* and 102*b*. The detailed description of alignment by the aligning means 102 will be omitted.

The sheet-like medium post-treatment apparatus shown in FIG. 17 comprises; (1) an ejection roller 3, (2) a tray 12 for loading the sheets ejected from the ejection roller 3, (3) a tray elevating means for elevating the tray 12, (4) a positioning means for controlling the position of the tray 12 in the vertical direction, (5) a tray traveling means for reciprocal traveling of the tray 12 in the direction of shift "d" orthogonal to the direction of ejection "a" shown in FIG. 17 (direction of penetrating the paper surface in FIG. 17), (6) a retaining roller 121 for preventing sheets from being misaligned on the tray 12, and (7) a displacement means for displacing the retaining roller 121. Of these, the tray elevating means is denoted by numeral 95 in FIG. 18(*a*), and the vertical positioning means is indicated by 96 of FIGS. 18(*a*) and (*b*). The tray traveling means is given by 98 in FIGS. 19 and 20. The following describes the details:

(2) A Tray, Tray Elevating Means, Vertical Positioning Means and Tray Traveling Means In FIG. 17, the sheet S is fed to the tray 12 from the branching jaw 8*b* by a pair of transport rollers 2*b* as a sheet transporting means via the ejection sensor 38, and is fed out in the direction of ejection "a" by the ejection roller 3.

Figure 18:
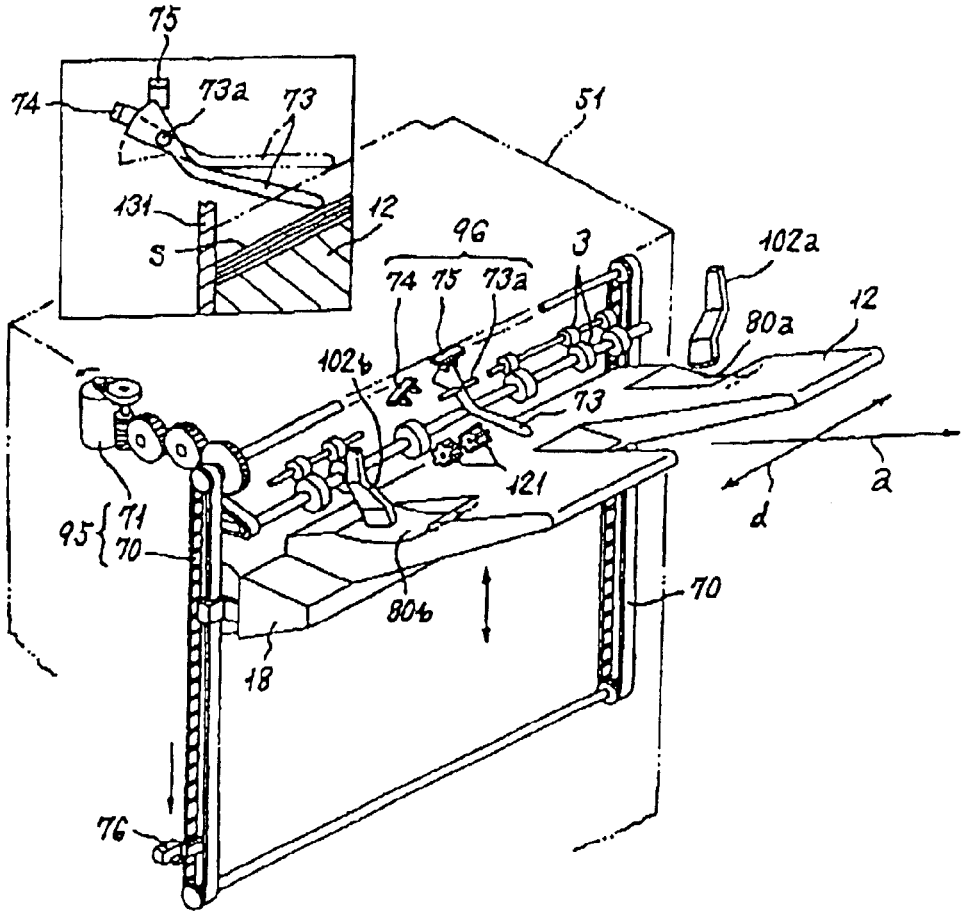
FIG. 18(*a*) is a perspective view representing the major portion of the sheet-like medium post-treatment apparatus, and FIG. 18(*b*) is a schematic perspective view representing the peripheral portion of the sensor for controlling the tray height.
Figure 18:
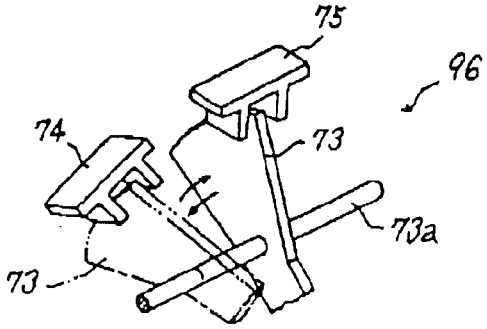

As shown FIGS. 17 and 18, the height of the upper surface of the tray 12 tends to increase as the sheet advances in the direction of ejection "a". An end fence 131 composed of a vertical surface is positioned on the lower base end of the inclined surface of this tray 12.

In FIG. 17, sheet S ejected from the ejection roller 3 goes between aligning members 102*a* and 102*b* waiting at the receiving position, and slides on the tray 12 along the aforementioned inclined surface due to gravity. When the trailing edge has hit the end fence 131, the trailing edge is aligned. The sheets S on the tray 12 with their trailing edges aligned are aligned along the width by the aligning operation of the aligning members 102*a* and 102*b*.

As shown in FIG. 18(*a*), a concave 80*a* is formed in the position opposite to the aligning member 102*a* on the upper surface of the tray 12, and a concave 80*b* is formed in the position opposite to the aligning member 102*b*. These positions are partially lower than the upper surface of the tray 12. At least when the sheet is not loaded in these concaves 80*a* and 80*b*, portions of the aligning members 102*a* and 102*b* located at the receiving position are placed into these concaves 80*a* and 80*b*, and are kept in the state of being overlapped with the tray 12. This is intended to ensure that aligning members 102*a* and 102*b* hit the end face of the sheet S in the aligning operation.

In FIG. 18(*a*), the tray 12 is elevated by the tray elevating means 95, and is controlled by the positioning means 96 in such a way that it is placed at a position suitable for the landing of sheet S at all times.

In other words, when the sheet is ejected from the ejection roller 3 onto the tray 12, and the loaded surface is raised, then the tray 12 is lowered an appropriate amount by the tray elevating means 95 and tray vertical positioning means 96. Control is made to ensure the top surface of the sheet is maintained at a certain height above the nip of the ejection roller 3, and the landing position is maintained at a certain level.

In FIGS. 17 and 18(*a*), the ejection roller 3 is located at a predetermined position. Accordingly, if sheets S are ejected onto the tray 12 and are loaded in a configuration where the tray 12 does not move in the vertical direction, then the height of the bundle of sheets is increased, and this bundle of sheets interrupts the ejection of sheets, until sheets S cannot be ejected any more.

Installation of an elevating means allows the tray 12 to be moved in the vertical direction. At the same time, the space from the nip of the ejection roller 3 to the upper surface of the tray 12 or space from the nip of the ejection roller 3 to the top surface of the sheet S on the tray 12 can be kept by the positioning means at an adequate space ensuring adequate paper ejection. This ensures the sheets S to be ejected onto the upper surface of the tray 12 with the minimum variation in the landing points.

As shown in FIG. 18(*a*), the tray 12 is suspended by a vertical lifting belt 70. The vertical lifting belt 70 is driven by the vertical drive motor 71 through the gear train and timing belt, and is fed upward or downward by the forward or reverse rotation of the vertical drive motor 71. These vertical lifting belt 70, vertical drive motor 71, gear train and timing belt are major components of the elevating means 95 for vertical traveling of the tray.

In FIG. 18(*a*), the retaining roller 121 is positioned in the vicinity of the ejection roller 3. The function of this retaining roller is already described.

In this way, the top surface of sheets S is raised as imaged sheets S are ejected and loaded on the tray 12 one after another. As shown in FIG. 18(*a*), the paper surface lever 73 freely rockably supported by the shaft 73*a* is provided on the top surface of the loaded sheet in such a way that one end of this lever is brought in contact under its own weight. The other end of this paper surface lever 73 is detected by the paper surface sensor 74 composed of a photo interrupter.

The paper surface sensor 74 is intended to control the vertical position of the tray 12 normally in the loaded mode. Further, the paper surface sensor 75 is intended to perform similar control in the staple mode. In this way, the sheet ejection position is varied in conformity to the mode.

The paper surface lever 73 is designed to rotate about the fulcrum under its own weight by moment.

A stopper means is provided to stop the rotation of this paper surface lever 73 at the position where the paper surface sensor 75 or paper surface sensor 74 is turned on by the free end on the upper side of the paper surface lever 73, when the tray 12 is lowered.

In the normal mode, this stopper means stops the rotation at the position where the paper surface sensor 74 is turned on by the paper surface lever 73. In the staple mode, it stops the rotation the paper surface sensor 75 is turned on. As sheets S are loaded on the tray 12, the lower free end of the paper surface lever 73 is pushed up. This allows these sensors to be turned of when the paper surface lever 73 is disengaged from the paper surface sensor 75 or paper surface sensor 74.

Since the mode is normal in this case, the surface of the sheets S is raised every time sheets S are fed one by one. Every time the free end of the paper surface lever 73 is disengaged from the paper surface sensor 74, the vertical drive motor 71 is driven, and the tray 12 is lowered until the paper surface sensor 74 is turned off. Then the space between the ejection roller 3 and tray 12 (the top surface of the sheet) is controlled in such a way as to obtain the aforementioned adequate space, as a condition for the position where the sheet S is landed on the tray 12. The paper surface sensors 74 and 75 and paper surface lever 73 are the major components of the tray positioning means 96 which determines ensures a constant height of the tray 12. They detect the information for positioning and send it to the controlling means.

The height of the tray 12 in the aforementioned adequate space is called an adequate ejection position. It is set as an adequate position for receiving sheets in the normal mode except that sheets are sent out in a curled or other special shape.

The conditions for ejection are different when sheets are ejected one by one in the normal mode and when a bundle of sheets subjected to staple treatment are ejected in the staple mode. As a matter of course, the adequate ejection positions of the tray 12 are different. This is apparent from the fact that paper surface sensors 75 and 74 are mounted at different positions. Further, when post-treatment is terminated, the ejection tray 12 is lowered about 30 mm in preparation for sheets being taken out.

In the mode involving post-treatment, whether normal or staple mode, sheets S are ejected from the ejection roller 3 on the tray 12 at a reference suitable to each. Every time sheets S are stacked, the tray 12 is lowered until the lower limit position is detected by a lower limit sensor 76. Further, when the tray 12 is raised, the tray 12 is raised up to reference height in conformity to the information on the detection of paper surface by the positioning means including paper surface sensors 74 and 75 and paper surface lever 73.

In order to perform sorting operation, the tray 12 is supported slidably on the pedestal 18 in such a way that, having traveled to one end in the direction of shift "d" as shown in FIG. 18(*a*), the aforementioned tray 12 goes to the other end, and the other way around.

The following describes the tray traveling means 98:

In FIG. 18, after having moved to one end in the direction of shift "d" to perform sorting operation, the tray 12 goes back to the other end. Then it goes the other way round. Assume that one job is defined as a work unit when treating a specified number of sheets constituting a segment as a unit of sorting work, the tray 12 does not shift in the direction of shift "d" in the performance of the same job. It goes in the direction of shift "d" every termination of a job (segment), and receives the ejected sheets S which is applied to the next job on one traveling end. Every time sheets are loaded on the tray 12 upon receipt of sheets S, aligning operation is performed by aligning members 102*a* and 102*b*.

Figure 19:
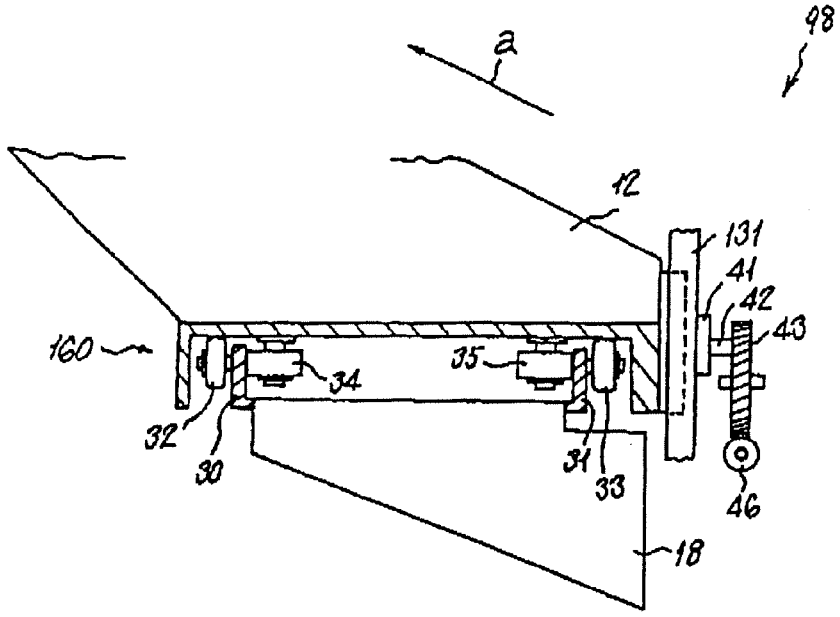
FIG. 19 is a cross sectional view representing the major portion illustrating the configuration of the tray traveling means for traveling the tray in the direction of shift.
Figure 20:
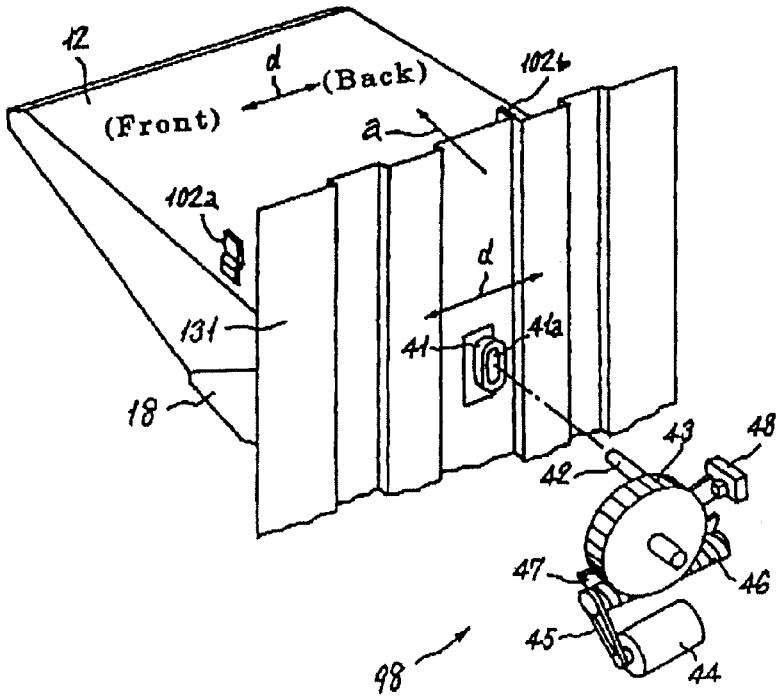
FIG. 20 is an exploded perspective view representing a tray traveling means.

FIGS. 19 and 20 will be used to describe the tray traveling means 98 for moving the tray 12 in the direction of shift "d" in order to sort out the sheets (including a bundle of sheets) loaded on the tray 12. Here the traveling distance d' of the tray 12 is required for sorting, and is set, for example, to about 20 mm, although it depends on the size and the of sheet of the taste of an operator.

The tray traveling means 98 comprises a tray supporting structure which supports the tray 12 slidably through the pedestal 18 as shown in FIG. 19, and a tray reciprocating mechanism for reciprocal movement of the tray 12, as shown in FIGS. 19 and 20.

The tray supporting structure 160 will be described with reference to FIG. 19. In FIG. 19, the upper portion of the pedestal 18 is integrally provided with two guide plates 30 and 31 having a length in the direction of shift "d" and opposing in the lateral direction. A shaft is protruded outside each of these guide plates 30 and 31, and rollers 32 and 33 are journaled thereby.

The bottom of the tray 12 is provided with a flat portion consisting of a flat surface wherein the distance in the lateral direction is greater than the space for rollers 32 and 33, and a sufficient depth to cover the shift of the tray is provided in the direction of shift "d". This flat portion is mounted on the rollers 32 and 33. Further, the aforementioned flat portion of the tray 12 has two shafts installed at the position corresponding to the inner side of guide plates 30 and 31, and rollers 34 and 35 are journaled by each of these two shafts. These rollers 34 and 35 are kept in contact with the inner sides of the guide plates 30 and 31, respectively.

Rollers 32, 33, 34 and 35 and guide plates 30 and 31 constitute a tray supporting structure 160 which supports the tray 12 so that it can travel in the direction of shift "d". The load of the tray 12 is supported by the rollers 32 and 33 through this tray supporting structure 160. Led by the guide plates 30 and 31, the tray is fed in the direction of shift "d".

Reciprocating power is given to the tray 12 by combining the tray reciprocating mechanism with the tray 12 supported by the tray supporting structure 160, thereby allowing reciprocal movement to be made in the direction of shift "d". Various types of tray reciprocating mechanisms can be considered. For example, a rack is mounted in the direction of shift "d", and a pinion meshing with this pinion is driven by a motor capable of forward/reverse rotation (not illustrated). Such a drive mechanism or crank mechanism can be cited as an example.

The tray traveling means based on such configuration permits the tray 12 to be reciprocated in the direction of shift "d" by the specified amount required for sorting of paper. FIG. 12 shows the sheets which are sorted in this manner.

The following describes a specific example of a tray reciprocating mechanism together with the tray position identifier means. In FIG. 20, when the end fence 131 located inside the concavo-convex portion of the end fence 131 is moved in the direction of shift "d", the tray 12 is also moved in the same direction. A bracket 41 with a slot 41*a* is provided on the central portion of the end fence 131 in the direction of shift "d". A pin 42 is inserted in this slot 41*a*.

The pin 42 is fixed as it is inserted in a worm wheel 43 journaled by the main body (not illustrated). This inserted position is off the rotational center of the worm wheel 43. This amount of eccentricity equals to half the traveling distance of the tray 12 in the direction of shift "d".

The worm wheel 43 is rotated by a worm 46 driven by a motor 44 through the timing belt 45. The pin 42 is turned by the rotary movement of the wheel 43 and the direction of movement is changed in such a way that the tray 12 makes a linear reciprocal movement in the direction of shift "d" in conformity to eccentricity. The structure of the pin 42 and slot 41*a* involved in eccentric rotation constitutes a major component of the tray reciprocating mechanism.

Figure 21:
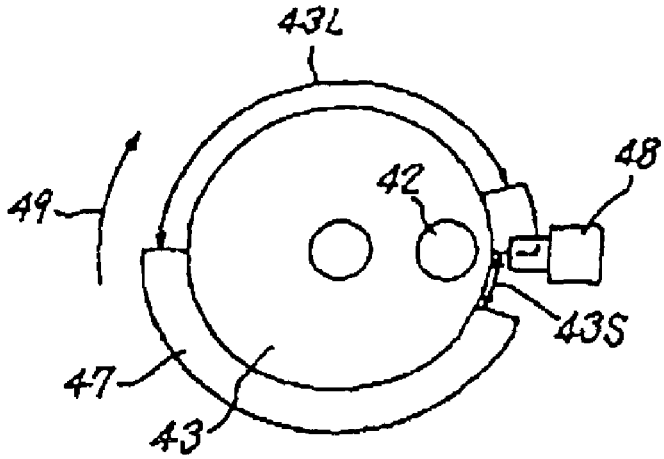
FIG. 21 is a front view representing the worm wheel and home sensor.
Figure 22:
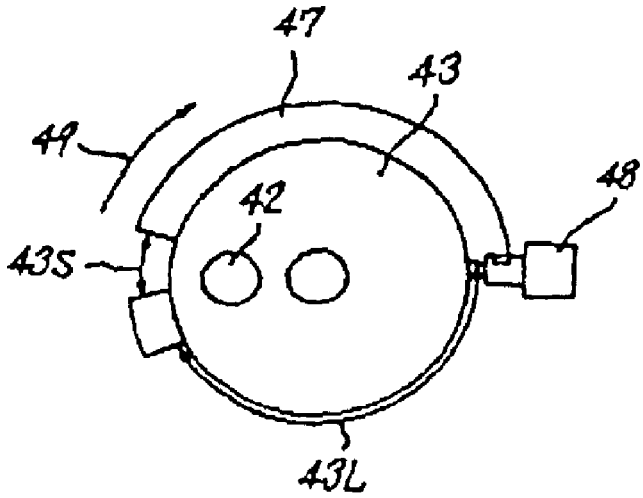
FIG. 22 is a front view representing the worm wheel and home sensor.

As shown in FIGS. 21 and 22, the worm wheel 43 has (1) two notches 43L and 43S of different size, (2) a long convex portion having half the circumference relatively shaped by these notches 43L and 43S, and (3) a disk-like encoder 47 having a short convex portion adjacent thereto.

A notch 43L is a long notch, while a notch 43S is a short notch. At each half the rotation of encoder 47, a home sensor 48 detects the length of the notch of the encoder 47 according to the space between the aforementioned two convex portions, and stop/drive signals of the motor 44 are issued from the controlling means.

In FIG. 21, the motor 44 is stopped when the shorter notch 43S of the encoder 47 having turned in the arrow-marked direction 49 has passed the home sensor 48 and is about to overlap the shorter convex portion. Under this condition, the pin 42 is located on the right, the tray 12 is fed to the right by clockwise rotation of the end fence 131 given in FIG. 20.

In FIG. 22, the encoder 43 rotates further in the arrow-marked direction 49 from the state shown in FIG. 2. When the longer notch 43L passes through the home sensor 48, and is about to overlap the longer convex portion, the motor 44 is stopped. Under this conditions, the pin 42 is located on the left, and the tray 12 is fed to the left by counterclockwise rotation of the end fence 131 given in FIG. 20.

As described above, to determine whether the tray 12 is located on the right or left, the length of the notch of the encoder 47 is detected by the home sensor 48, and the position of the tray 12 is identified based on the information obtained from this detection. Here the encoder 43 and home sensor 48 constitute major components of the tray position identifier means.

As described above, the tray 12 is shifted by receiving the number of sheets constituting a segment in the same job at the go-end in the reciprocal motion of the tray 12 in the direction of shift "d". At the return-end, it receives the number of sheets constituting a segment in the next job.

Repetition of such a sorting operation allows a bundle of sheets to be loaded in a concavo-convex shape for each job (segment) in a state displaced by a specified amount to be sorted, whereby a bundle of sheets can be sorted out for each segment. In conformity to sheet dimensions, the distance of traveling d' can be set to an appropriate value of 5 to 25 mm for clear sorting; for example, it can be set to a value of about 20 mm in the case of A4 size sheets.

Embodiment 3

The present embodiment represents an example of control in a displacement means.

The following describes an example of control when the sheet-like medium alignment apparatus with a displacement means previously described with reference to FIG. 4 to FIG. 16 is mounted on the sheet-like medium post-treatment apparatus described with reference to FIG. 7 to FIG. 22:

The retaining roller 121 can be controlled variously in conformity to ejection of sheets, for example, by changing the position in the direction of ejection or changing rotation speed. This control is made by a controlling means based on a CPU. The following describes the control of displacement and rotation of the retaining roller by a controlling means:

In this example, a sheet-like medium post-treatment apparatus 51 is connected to the image forming apparatus 50, as shown in FIG. 17. It represents an example of control in the retaining means based on the overall configuration of an apparatus where a sheet-like medium alignment apparatus according to the present invention is mounted on this sheet-like medium post-treatment apparatus 51.

Figure 24:
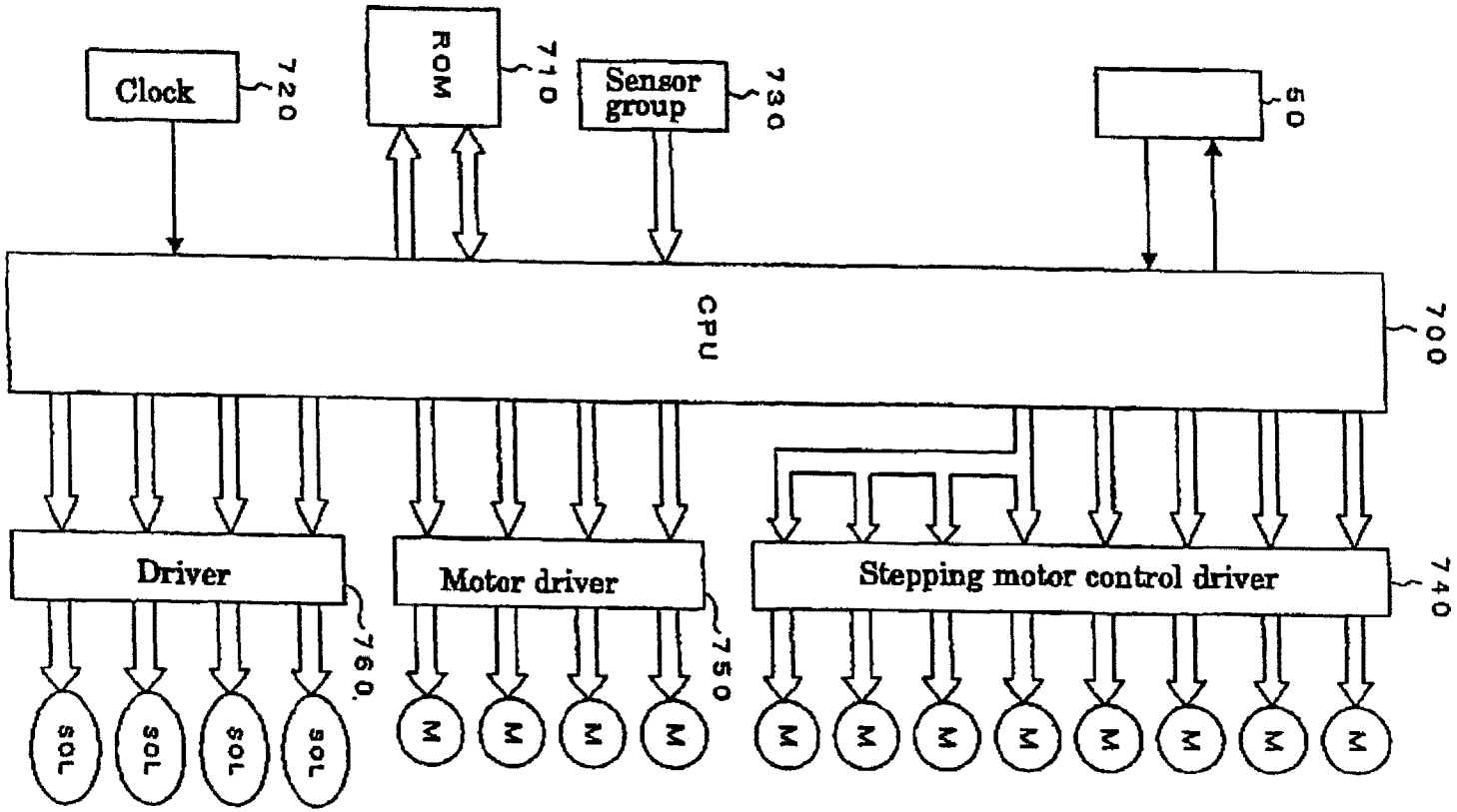
FIG. 24 is a control circuit diagram illustrating the control means.

FIG. 24 shows the control circuit of controlling means. The CPU700 exchanges information with the ROM710 where a control program is stored, and executes the control shown in each of the following flow charts using the clock signal input from a clock 720.

Thus, the CPU700 exchanges signals with the image forming apparatus 50. It is designed in such a way that information is entered from a sensor group 730 is output to the stepping motor control driver 740, motor driver 750 and driver 760.

The term "sensor group" 730 is a collective expression of various sensors used in the sheet-like medium post-treatment apparatus 51 and the sheet-like medium alignment apparatus according to the present invention. It includes various sensors appearing in control according to the following flow chart.

The stepping motor control driver 740 is designed to control various stepping motors used in the sheet-like medium post-treatment apparatus 51 and the sheet-like medium alignment apparatus according to the present invention. To put it more specifically, it includes various stepping motors appearing in the flow chart described below. In FIG. 2I4, it is represented by "M".

The motor driver 750 is designed to control various DC motors used in the sheet-like medium post-treatment apparatus 51 and the sheet-like medium alignment apparatus according to the present invention. To put it more specifically, it includes various motors appearing in the flow chart described below. In FIG. 24, it is represented by "M".

The driver 760 is designed to control various solenoids used in the sheet-like medium post-treatment apparatus 51 and the sheet-like medium alignment apparatus according to the present invention. To put it more specifically, it includes various solenoids appearing in the flow chart described below. In FIG. 18, it is represented by SOL.

The CPU700 in FIG. 24 constitutes the major portion for implementing the following flow. It is a central component of the controlling means according to the present invention:

Example 1

In one example, when the shift mode for sorting sheets is selected in a sheet-like medium post-treatment apparatus 51, sheets transported from the image forming apparatus 50 are received by a pair of inlet roller 1 shown in FIG. 17. After passing through a pair of transport roller 2*a* and a pair of transport rollers 2*b*, they are ejected onto the tray 12 by the ejection roller 3 as a final transporting means. At that time, branching jaws 8*a* and 8*b* stay at the default position, and sheets are ejected onto the tray 12 after passing through the similar transport route one by one.

As described in FIG. 1, sheets S1 are ejected onto the tray 12 from a pair of ejection rollers 3. Before the leading edge contacts the loaded paper S", the retaining roller 121 is required to have moved from the first position (I) to the second position (II). As described above, the problem lies in the leading edge position of the ejected paper. So timing is set in such a way that the retaining roller 121 will start traveling from the first position (I) to the second position (II) immediately when leading edges of the sheets on the downstream side in the direction of ejection of the sheet have been detected by the ejection sensor 38 provided upstream from the ejection roller 3 in the direction of transport at a position just close thereto.

In FIG. 1, the retaining roller 121 remains at the second position (II) for the time specified as a minimum time until the leading edges of ejected sheets S1 stops pressing the paper S" loaded on the tray 12 after the retaining roller 121 has traveled to the second position (II). This solves the problem of misalignment of the loaded paper S" due to sheets S1.

Figure 25:
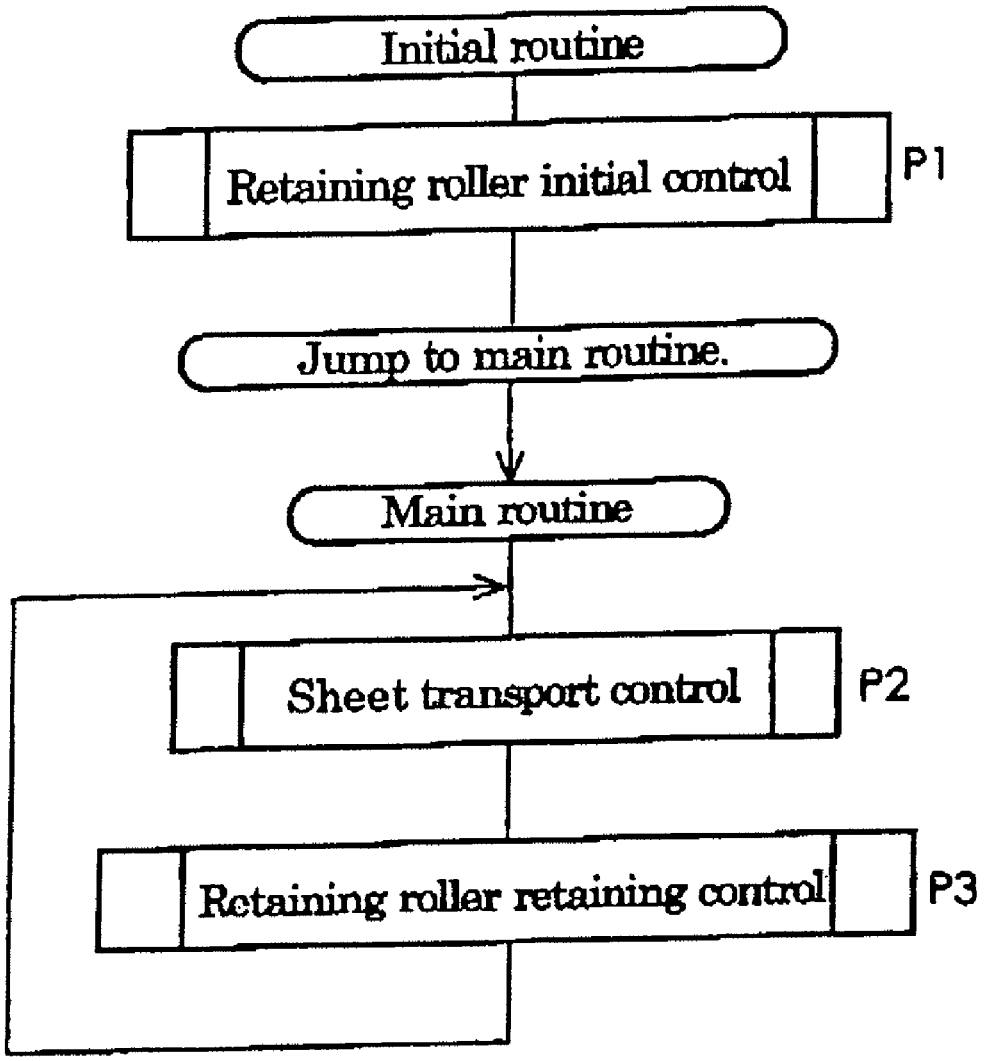
FIG. 25 is a flow chart illustrating the control means.

The following describes the detailed description of the operation with reference to the flow chart. FIG. 25 represents the overall control of the sheet-like medium post-treatment apparatus in this example. It represents only the portion related to the control made to ensure that the retaining roller 121 travels from the first position (I) to the second position (II) after sheets have been ejected onto the tray 12.

FIG. 25 represents the initial operation for turning on the power of the sheet-like medium post-treatment apparatus 51 and the main route which is always passed through subsequent to termination of the initial operation. The sub-routine of "retaining roller initial control" in step P1 is the sub-routine for returning the retaining roller 121 to the first position (II). The details are clear and definite, and therefore will not be described. The sub-routine of "retaining roller initial control" in step P2 is shown in details in FIG. 26. The sub-routine of "returning roller return control" in step P3 is a sub-routine shown in FIG. 26.

Figure 26:
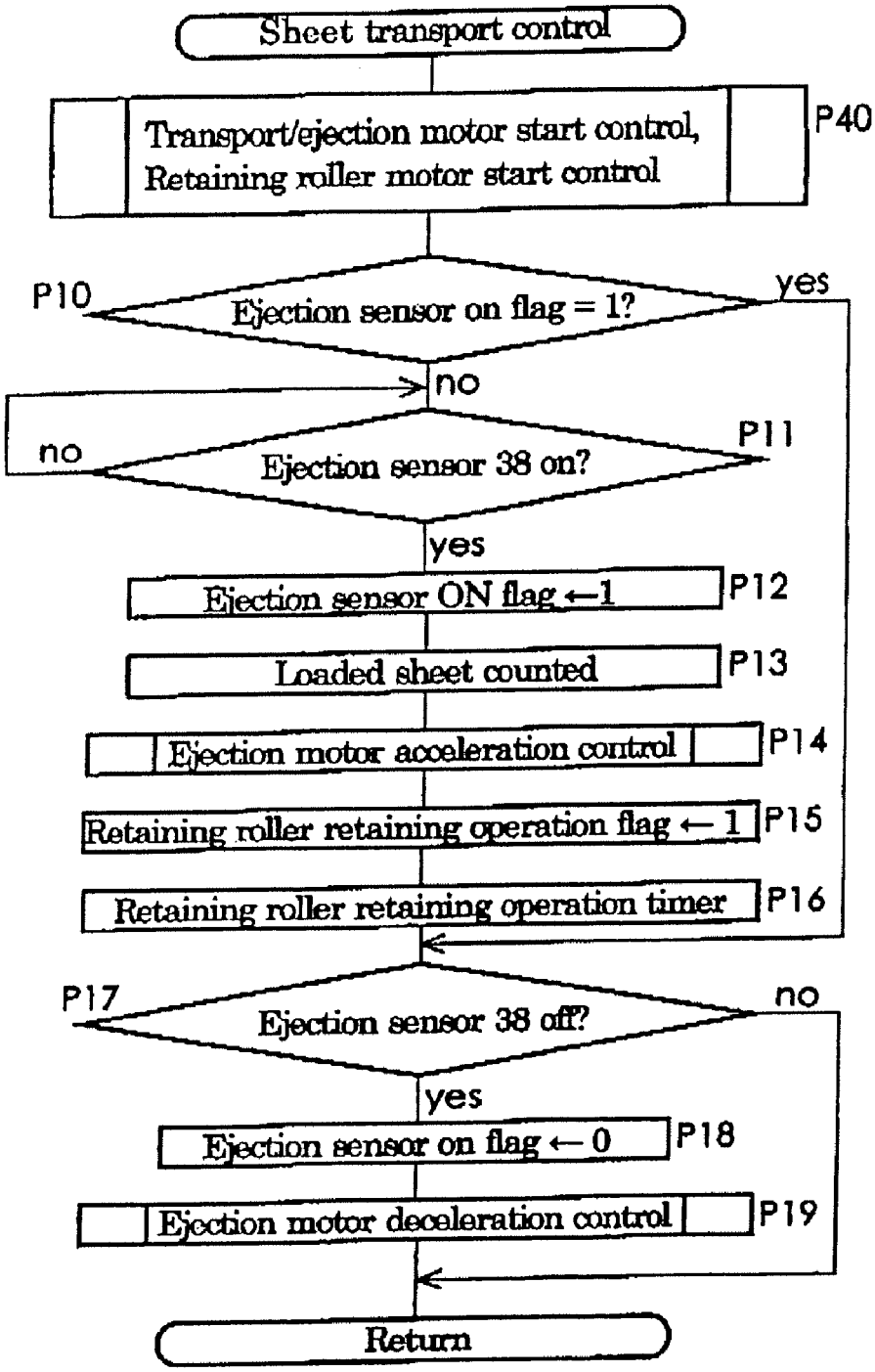
FIG. 26 is a flow chart illustrating the control means.
Figure 27:
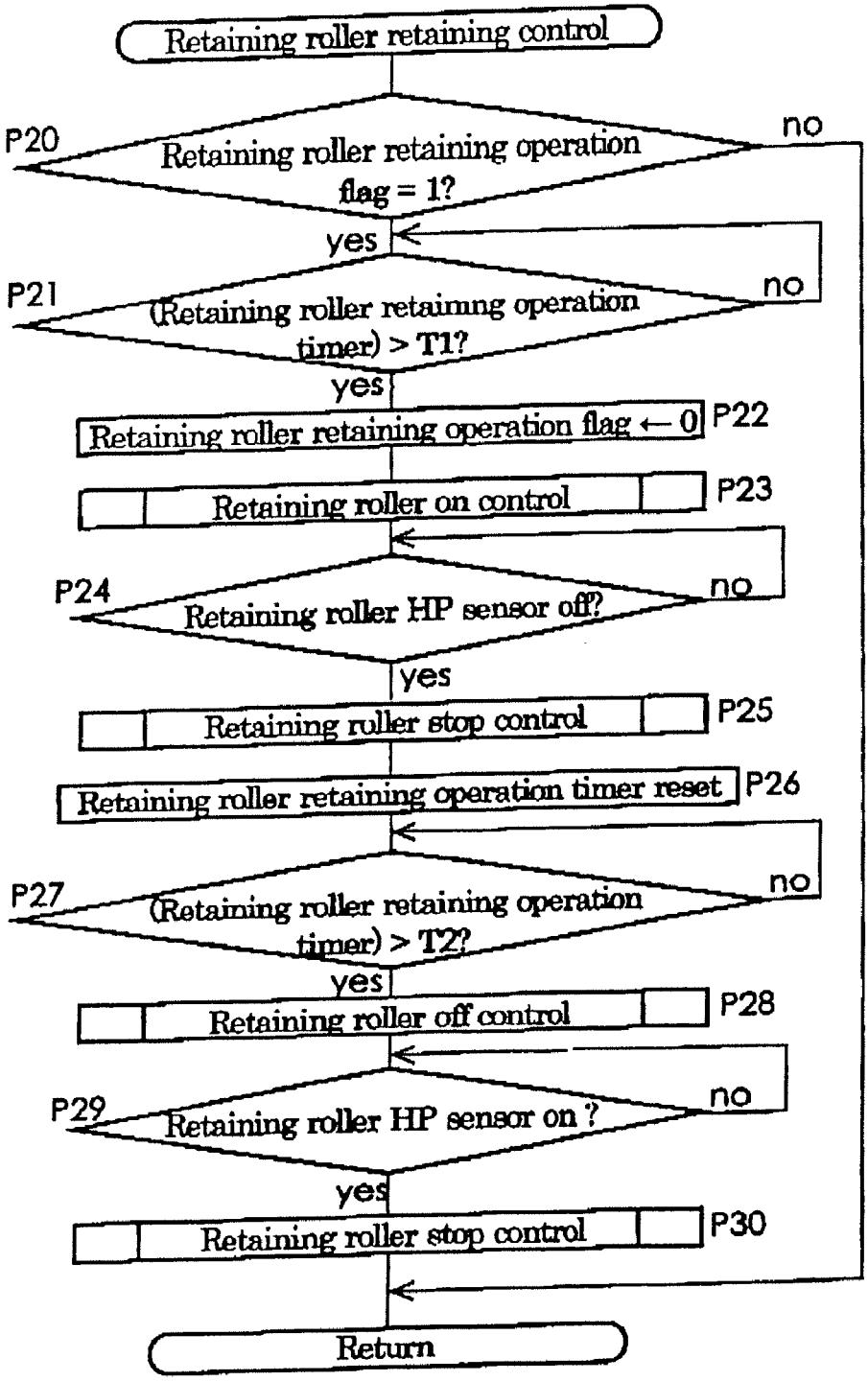
FIG. 27 is a flow chart illustrating the control means.

In FIG. 25, when the power of the sheet-like medium post-treatment apparatus 51 is turned on, the retaining roller 121 is set to the first position (I), in the step P1 of "retaining roller initial control". Then control proceeds to the step P2 of "sheet transport control" through the main routine (not illustrated). Then the sub-routine of the sheet transport control shown in FIG. 26 is implemented. Here control is performed when sheets are transported into the sheet-like medium post-treatment apparatus 51. Then in FIG. 25 control proceeds to the step P3 of "retaining roller retaining control", and sub-routine for sheet retaining by the retaining roller 121 shown in FIG. 27 is implemented.

In FIG. 17, sheets are ejected from the image forming apparatus 50. In the sheet-like medium post-treatment apparatus 51, control of jam detection or the like by the inlet sensor 36 is followed by the control of the ejection sensor 38.

To improve the stacking property for ejecting sheets to the tray 12, control is made in such a way that the ejection roller 3 ejects the sheets at a speed below the normal sheet transport speed when sending the sheets. After the next sheets have been gripped, the feed speed goes back to the normal feed speed (speed increase) in order to save the feed time. Immediately after start of the job, however, a stepping motor 132 as an ejecting motor is started at a normal transport speed, and therefore, speed increase is not controlled in the transportation of the first sheet after starting the job. In FIG. 27, the sub-routine of "transport/ejection motor start control and retaining roller motor start control" is first implemented in step P40, and a stepping motor 132 and motor 556 as drive motors for the ejection roller 3 and retaining roller 121 are started. In the retaining control, rotation of the retaining roller is not always necessary. Then "Ejection sensor ON flag=1" is checked in step F10. The system goes to step P11 before the leading edge of the sheet is detected by the ejection sensor 38, and to step P17 after it has been detected already.

In step P11, the system waits for the leading edge of the sheet to be detected by the ejection sensor 38. Upon detection of the leading edge, the ejection sensor ON flag is set to "1" in step P12, and control proceeds to step P13. The number of sheets loaded on the tray 12 is counted according to the information that the ejection sensor 38 has been turned on. After that, the speed of the ejection stepping motor 132 is increased to the normal speed in step P14.

Then the "retaining roller retaining operation flag" is set to "1" in step P15, and "retaining roller retaining operation timer" is reset in step P16. Then control proceeds to "Ejection sensor 38 off?" check in step P17. After the trailing edge of the sheet has passed through the ejection sensor 38, "ejection sensor on flag" is set to "0" in step P18 and "ejection motor deceleration control" is performed in step P19. Then sheets are ejected onto the tray 12 at a reduced speed. Upon completion of the subsequent treatment (not illustrated), the system exits this routing. In step P17 before the sheet trailing edge passes through the ejection sensor 38, the system goes from step P17 to the return and proceed to the retaining roller retaining control shown in FIG. 27.

In FIG. 26, if the "retaining roller retaining operation flag" is set to "1" in step P15 immediately when the ejection sensor 38 has been turned on, namely, the leading edge of the sheet has been detected, the following control is implemented in FIG. 27:

In step P20, retaining roller retaining operation flag=1, so the system goes to the step P21. Then comparison is made between the value on "retaining roller retaining operation timer" representing the time having passed since the timer is reset in step P16, and the set value T1. If it is greater than T1, then the retaining roller retaining operation flag is set to "0" in step P22, and control proceeds to the "retaining roller on control" in step P23. The stepping motor 126 is started, and the retaining roller 121 is moved from the first position (I) to the second position (II).

The set value T1 of the timer is signifies the time required for aligning members 102*a* and 102*b* to align the sheets already ejected onto the tray 12. The sheet position is unstable during the aligning operation. After stability has been gained, the retaining roller 121 is moved from the first position. Assume that "T" signifies the time until the leading edge contacts the upper surface of the sheets loaded on the tray 12 after the sheet leading edge has been detected by the ejection sensor 38, where T1>T. Also assume that "t" means the time required for the retaining roller 121 to move from the first position (I) to the second position (II). Then T1>t is mandatory. Time counting is based on the output from the clock 720 entered into the CPU700.

In step P24 of "returning roller HP sensor off?" (Second position traveling completed?) checking, the "returning roller HP sensor off" is checked. In step P25 of "retaining roller stop control", the stepping motor 126 is stopped and the retaining roller 121 is stopped at the retaining position of the second position (II).

Upon completion of retaining operation, "retaining roller retaining operation timer" is reset in step P2, and the clock is started, thereby controlling the time for keeping the retaining roller 121 at the second position. Accordingly, "retaining roller retaining operation timer" value is compared with the set value T2 in step P27, and the returning roller is stopped at the retaining position for a specified time. This value of T2 means the time when the retaining roller 121 is kept in contact with the sheets loaded on the tray 12. It is set as the time required until the leading edge of the ejected sheet stops pushing the sheet loaded on the tray 12 after the retaining roller 121 has moved to the second position (II).

If the lapse of set value T2 is determined in step P27, the system goes to step P28 of "retaining roller off control" in order to move the retaining roller 121 to the first position (I). In step 28 of "retaining roller off control", the stepping motor 126 is driven and the retaining roller 121 starts to move to the first position (I). This first position (I) is a waiting position as well as a home position (HP).

In step P29 of "retaining roller HP sensor off" checking, if the retaining roller 121 is confirmed by the sensor 127 to have moved to the first position (I), the stepping motor 126 is stopped in step P30 of "retaining roller stop control". The process of retaining control for one sheet is now complete.

As described above, the operation of the retaining roller is started immediately when the ejection sensor 38 located in the extreme downstream of the transport-related sensors, namely, located on the upstream side closest to the ejection roller 3 has detected the leading edge of the sheet in this Example. This allows the retaining operation to be performed at the minimum time error for the sheets to be retained, thereby ensuring that the loaded paper is not protruded.

The time from detection of the ejection sensor to retaining roller operation can be set to a certain set value, independently of sheet dimensions. This ensures the control software to be simplified, with the result that the control storage devices can be downsized and costs can be cut down. Loaded paper is retained by the retaining roller until the leading edge of the ejected sheet contacts the loaded sheet to stop movement. As a result, the sheets are not pushed out and alignment of the already loaded sheets is not interrupted.

Example 2

In an alternative Example, the timer set value T2 shown in FIG. 27 in the aforementioned Example 1 is made variable in conformity to the dimensions of the sheets ejected from the ejection roller 3. The control in this Example is performed according to the flow charts shown in the FIG. 25, and FIGS. 26 and 28.

Figure 28:
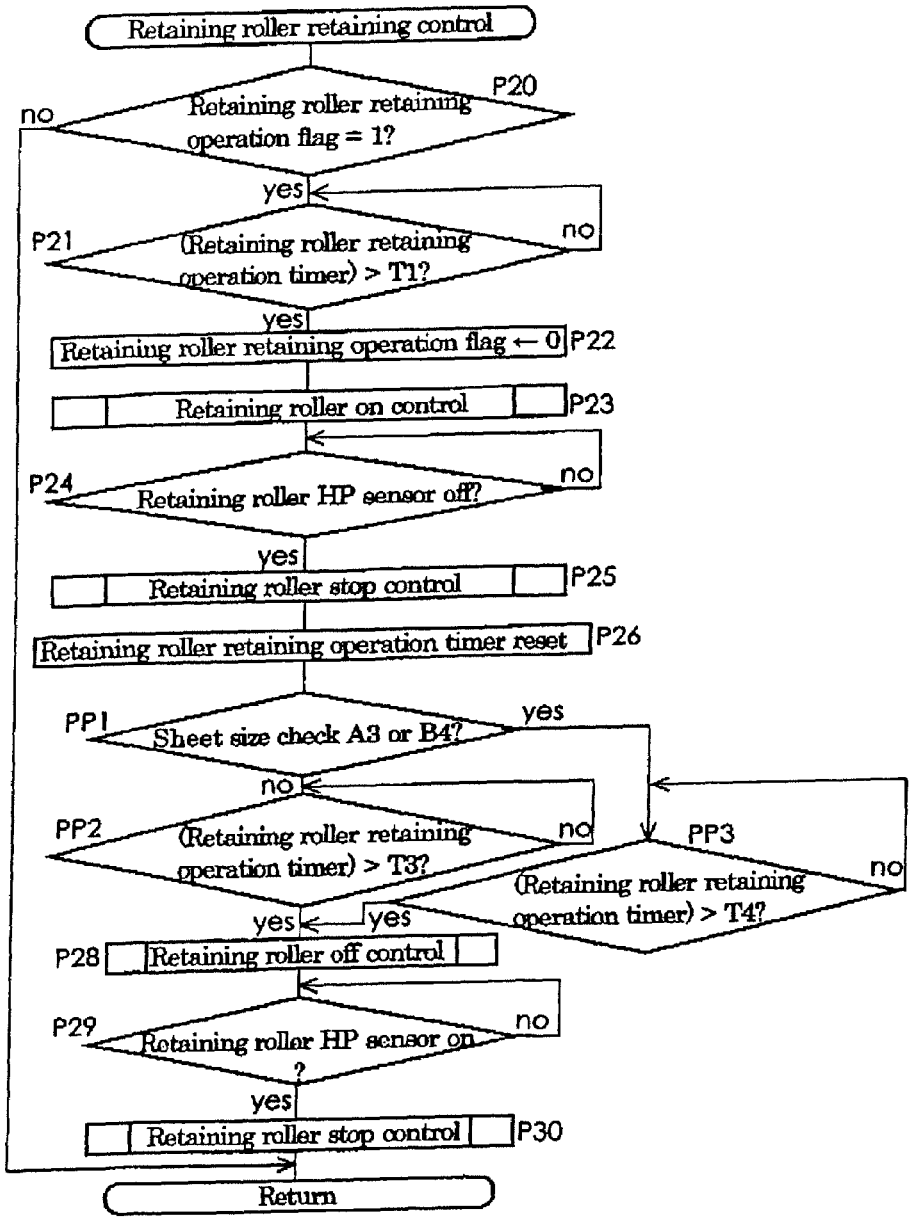
FIG. 28 is a flow chart illustrating the control means.

Description of FIGS. 25 and 26 will be omitted since they have already been described. FIG. 28 is partly the same as the aforementioned FIG. 27. The same step numerals as those of FIG. 27 will be used for the same portions without duplicated description, and only the differences will be described.

After the retaining roller 121 has moved to the second position (II) in FIG. 28, the "retaining roller retaining operation timer reset" is carried out in step P26. Sheet sizes are checked in step PP1, and the time required for the retaining roller 121 to be kept stopped at the second position (II) is controlled in steps PP2 and PP3 in conformity to sizes.

A sheet size is sent as a command by the image forming apparatus 50 every time sheets are ejected to the sheet-like medium post-treatment apparatus 51 by the image forming apparatus 50. Sheet sizes are checked based on the command. In the process of sheet dimension checking, sheets ejected in step PP1 are checked to see if they are A3 or B4 sized sheets. In the case of A3 or B4 sized paper, comparison is made with the set value T3 in step PP2, while in the case of paper of other sizes, comparison is made with the set value T4 in step PP3. If the set value has been exceeded, traveling to the first position (I) is started in step PP28.

In this Example, only A3 and B4 sheets are checked. Strictly speaking, however, the set value may have to be changed for all sheet sizes or the feed direction of the same sized paper (longitudinal or horizontal).

In the case of large-sized paper, the leading edge of the ejected sheet must be kept pressed for a longer time than in the case of small-sized paper. Friction and weight of paper differ depending on the differences in sheet sizes, and the retaining operation changes, accordingly. In this Example, the retaining time by the retaining roller can be set in conformity to the ejected sheet size. Push-out force by the ejected sheet is eliminated by the setting of the stop time of the retaining roller suited to the changes in sheet size, with the result that the alignment of the already loaded sheets is kept uninterrupted.

Example 3

Figure 29:
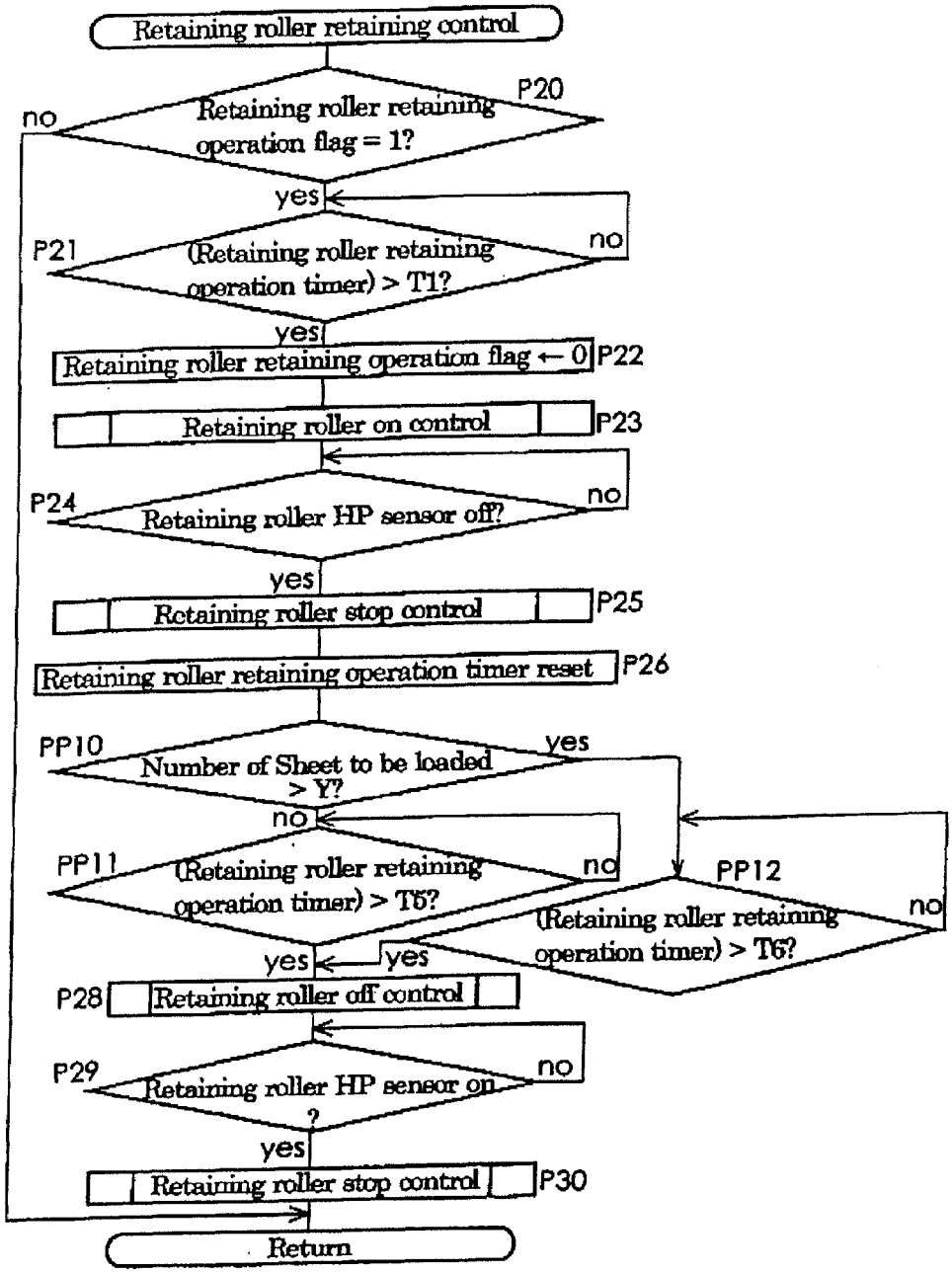
FIG. 29 is a flow chart illustrating the control means.

In an alternative Example, the timer set value T2 given in FIG. 27 in the aforementioned Example 1 can be changed in conformity to the number of the sheet-like media ejected from the aforementioned ejecting means. In this Example, control is made according to the flow chart given in the aforementioned FIGS. 25, 26 and 29. FIGS. 25 and 26 will not be described since they have already been described. FIG. 29 is partly the same as the aforementioned FIG. 27. The same step numerals as those of FIG. 27 will be used for the same portions without duplicated description, and only the differences will be described.

After the retaining roller 121 has moved to the second position (II) in FIG. 29, the "retaining roller retaining operation timer reset" is carried out in step P26. The number of ejected sheets is checked in step PP1, and the retaining time required for the retaining roller 121 to be kept stopped at the second position (II) is determined in steps PP11 and PP12 in conformity to the number of stacked sheets.

Here the number of loaded sheets in step P13 of the aforementioned FIG. 26 has already been counted up. The number of sheets can be reset by means of a tray sheet presence/absence sensor 150 (see FIG. 17) when all sheets have been removed from the tray 12.

In step PP10, the number of sheets is checked according to whether or not the number of sheets is equal to or above a specified number Y. If the number is smaller than Y, comparison is made with retaining roller stop time set value T5. If the number is equal to or greater than Y, comparison is made with retaining roller stop time set value T6. Traveling to the first position (I) is started by the lapse of this set value. Here the number of loaded sheets is checked with reference to a specified value Y. However, the setting time can be changed for a still smaller number, if required.

In the present Example, the retaining time by the retaining roller 121 can be set in conformity to the number of the sheets loaded on the tray 12. Even if the upper surface of the loaded paper is deformed due to curling of the sheet in the case of a large load, it is possible to set the stop time of the of the retaining roller 121 suitable to the change in the distance from the ejection roller 3 to the upper surface of the loaded paper which may change according to the quality of curling. Thus, pushing out by ejected sheets is eliminated by setting the suitable retaining roller stop time, whereby alignment of the already loaded sheets is not interrupted.

Example 4

Figure 30:
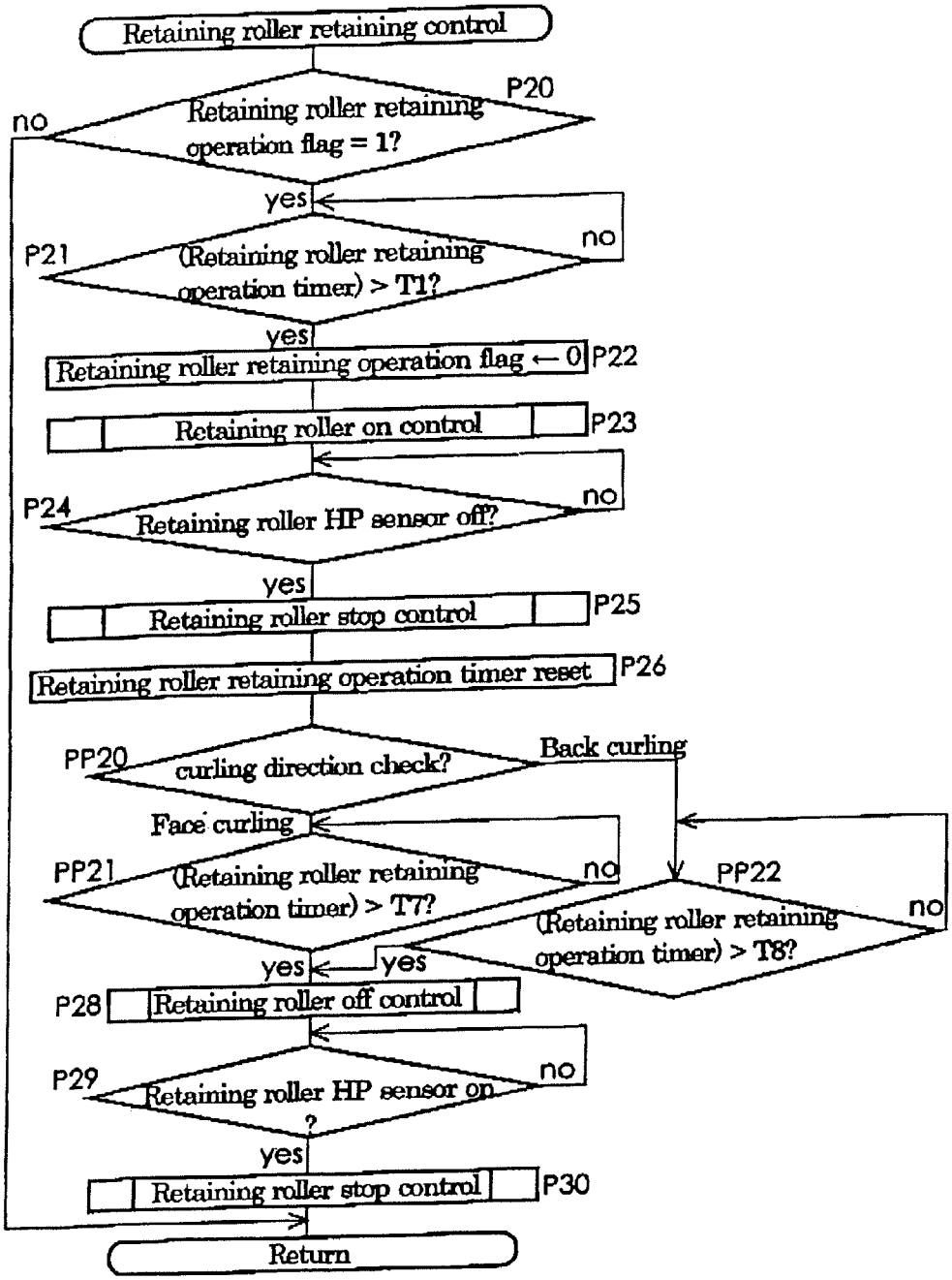
FIG. 30 is a flow chart illustrating the control means.

In another Example, the timer set value T2 given in FIG. 27 in the aforementioned Example 1 can be changed in conformity to the number of the sheet-like media ejected from the aforementioned ejecting means. In this Example, control is made according to the flow chart given in the aforementioned FIGS. 25, 26 and 30. FIGS. 25 and 26 will not be described since they have already been described. FIG. 30 is partly the same as the aforementioned FIG. 27. The same step numerals as those of FIG. 27 will be used for the same portions without duplicated description, and only the differences will be described.

After the retaining roller 121 has moved to the second position (II) in FIG. 30, the "retaining roller retaining operation timer reset" is carried out in step P26. The direction of curling of the ejected paper is checked in step PP20, and the retaining time required for the retaining roller 121 to be kept stopped at the second position (II) is determined in steps PP21 and PP22 in conformity to the direction of curling.

The direction of curling is changed according to the sheet transport route which varies according to the image forming apparatus to be connected. For example, face curling with trailing edge raised or back curling with the trailing edge lowered is determined. In the initial phase of communications carried out after power is turned on, the sheet-like medium post-treatment apparatus 51 determines the direction of curling based on the information on transport line speed of the image forming apparatus 50. Accordingly, in this Example it is necessary to determine the main body to be connected in advance.

If the sheets are determined to be face-curled in step PP20 of checking the direction of curling, control proceeds to step PP21, and comparison is made with the retaining roller stop time set value T7. If the sheets are determined to be back-curled, control proceeds to step PP22, and comparison is made with the retaining roller stop time set value T8. Traveling of the retaining roller 121 to the first position (I) is started by the lapse of this set time.

In this Example, it is possible to set the stop time of the retaining roller 121 suitable to the change in the distance from the ejection roller 3 to the upper surface of the loaded paper which changes according to the shape of curling of the ejected sheet. Thus, pushing out by ejected sheets is eliminated by setting the suitable retaining roller stop time, whereby alignment of the already loaded sheets is not interrupted.

In the aforementioned Examples 2, 3 and 4, the stop time of the retaining roller 121 can be controlled in greater details with consideration given to all of the sheet size, the number of loaded sheets and the direction of curling.

Example 5

In this Example, after having used the retaining function at the second position (I), the retaining roller 121 moves to the first position (I) or a third position (III) intermediate between the first position (II) and second position (II) away from the loaded sheets, and waits there. When fulfilling the retaining function, it moves to the second position (II) after the first sheet ejected from the ejection roller 3 has fallen on the tray 12. Then it performs the returning function of returning the aforementioned first sheet to the end fence 131.

Figure 31:
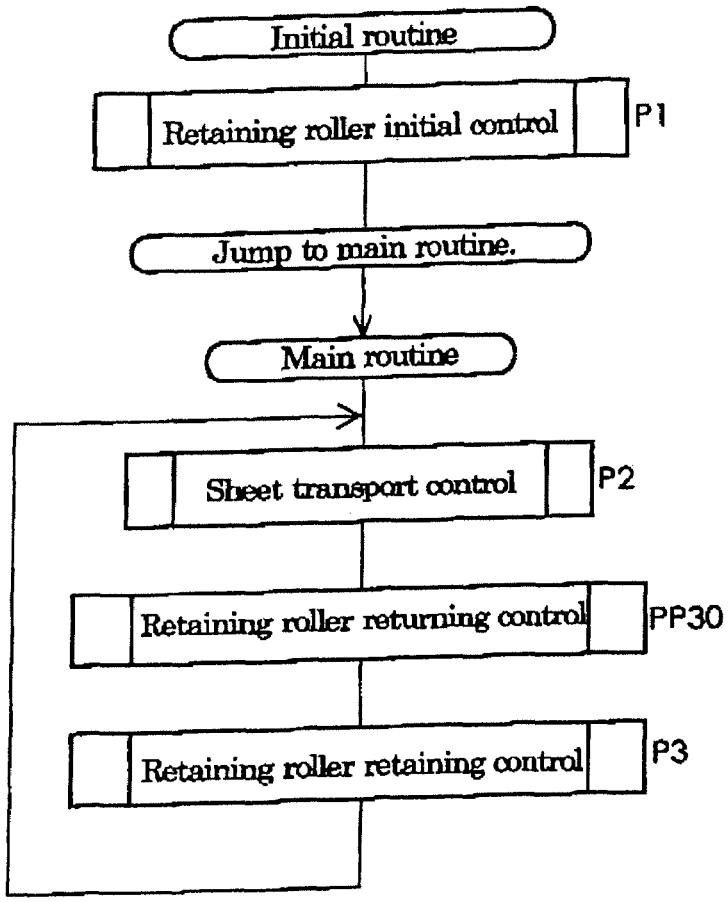
FIG. 31 is a flow chart illustrating the control means.
Figure 32:
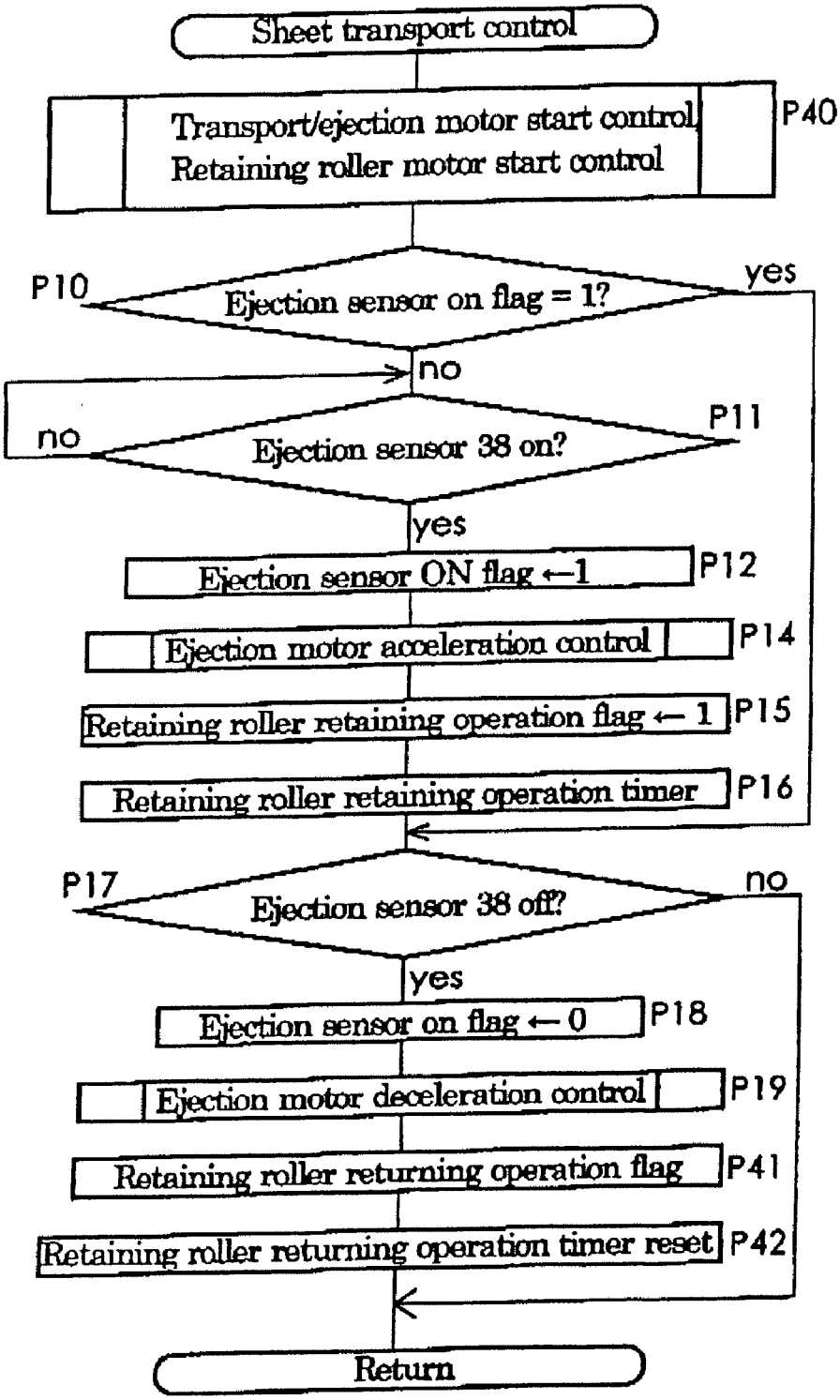
FIG. 32 is a flow chart illustrating the control means.
Figure 33:
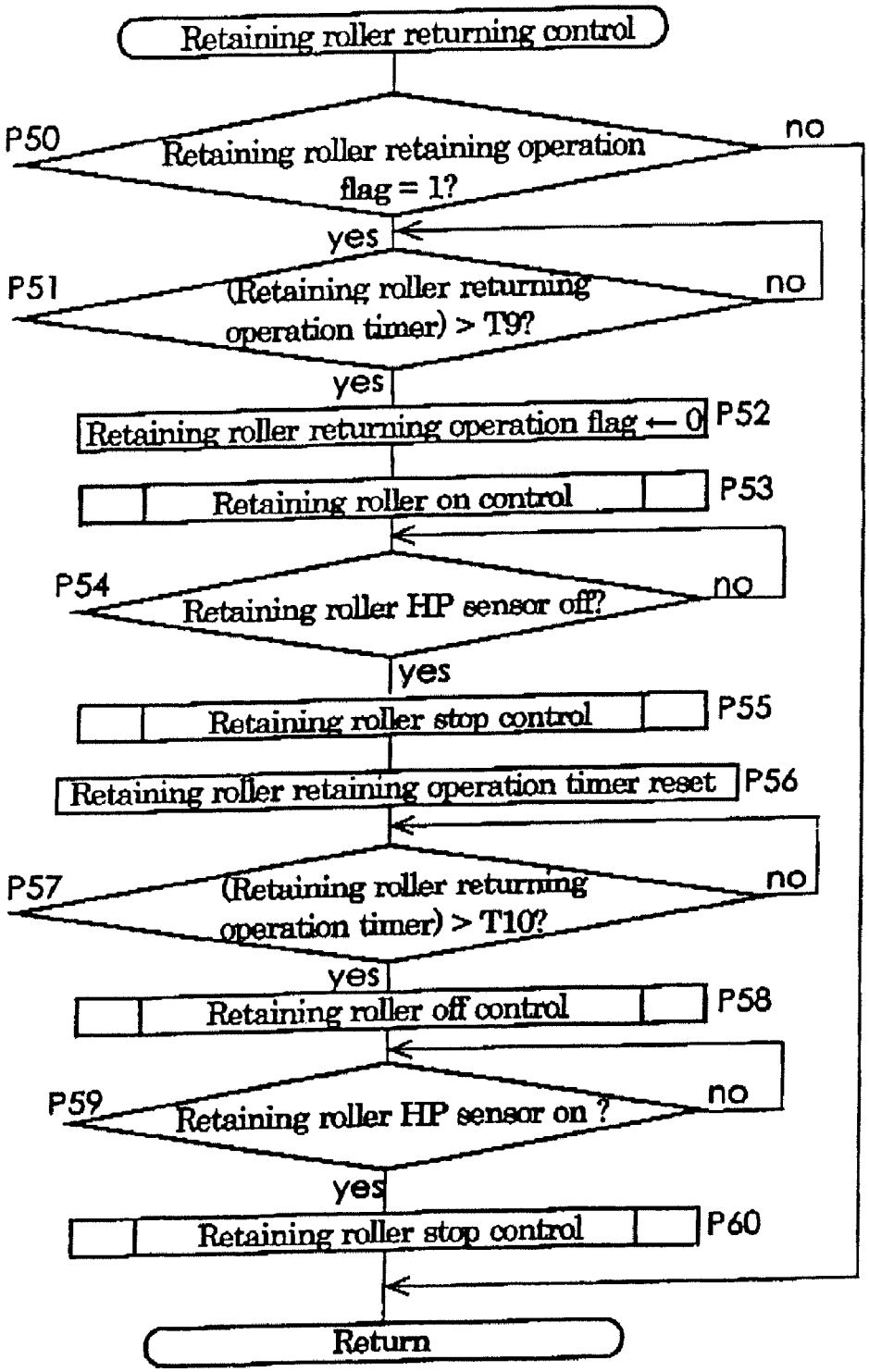
FIG. 33 is a flow chart illustrating the control means.

In this Example, control is made according to the flow chart given in the aforementioned FIG. 27 and FIGS. 31, 32 and 33. The initial routine in FIG. 31 has the steps common to the initial routine in the aforementioned FIG. 25. For these common steps, the same numerals will be used and description will be omitted. The difference is found in the inclusion of a "retaining roller returning control" sub-routine in step PP30 between "sheet transport control" in step P2 and "retaining roller retaining control" in step P3. The details of "retaining roller returning control" in this step PP30 is shown in FIG. 33. The details of "retaining roller retaining control" in step P3 are the same as those of the aforementioned FIG. 27. In the initial routine of FIG. 31, "sheet transport control" in step P2 is performed through the main routine based on the assumption that the retaining roller 121 is located at the first stop position (I) according to the "retaining roller initial control" in step P1.

The sheet transport control in FIG. 32 has steps common to the control in FIG. 26 described in the aforementioned Example 1. For these common steps, the same numerals as those in FIG. 26 will be used and description will be omitted. Only the difference will be described.

In FIG. 32, the differences from the flow chart given in FIG. 26 is that "retaining roller returning operation flag←1" in step P41 and "retaining roller returning operation timer reset" in step P42 are added after step P19. In the former step, the retaining roller returning operation flag is set to "1", and in the latter step, the retaining roller returning operation timer is reset to quit this routine. Further, the retaining roller 121 has a returning function, so the rotation drive of retaining roller 121 is essential in step P40.

Then "retaining roller returning control" routine in step PP30 of FIG. 31 is implemented. When the trailing edge of the sheet has been detected by the ejection sensor 38 according to "Ejection sensor 38 off?" in step P38 in FIG. 32, the information that the sensor has been turned off is used as a trigger to set the "retaining roller returning operation flag" to "1" in step P41. Thus, after "retaining roller returning operation flag=1" in step P50 in FIG. 33 has been completed, control proceeds to step P51. Then the returning roller returning operation timer" value is compared with the set value T9. If it is greater than T9, "retaining roller returning operation flag" in step P52 is set to "0", and the control shifts to the "retaining roller On" control in step P53, whereby the retaining roller is operated.

The value for set value T9 is set at the timing to ensure that the ejected sheets drop completely on the tray 12. Accordingly, it is set at an adequate distance in conformity to the ejection line speed and distance of falling between ejection roller 3 and tray 12. Time is counted through timer counting by the CPU700 and clock counting by stepping motor 132.

The stepping motor 126 as a retaining roller drive motor is driven according to "retaining roller On control" in step P53, and the retaining roller 121 starts moving from the first stop position (I) to the second stop position.

When the sensor 127 has been detected to have turned off by "retaining roller HP sensor off" checking in step P54, the retaining roller traveling is stopped by "returning roller stop control" in step P55. Upon completion of the aforementioned steps, the retaining roller 121 moved to the second position (II) (returning position) shown in FIG. 1, and the retaining roller 121 is pressed against the loaded paper through the trailing edge of the ejected sheet, whereby the sheets ejected by torque of the retaining roller 121 can be pressed against the end fence 131, with the result that alignment of sheets is achieved.

The system then goes to step P57 after the "retaining roller returning operation timer" has been reset in step P56. The time of stopping the retaining roller 121 at the second position (II) is controlled in step P57. The retaining roller 121 stays at the second position (II) for a specified time corresponding to the value T10 set on the "retaining roller returning operation timer". The set value T10 is the time sufficient for the trailing edge of the sheets to hit the side fence 131.

After the lapse of set value T10, control proceeds to "retaining roller off control" in step P58.

The stepping motor 126 for retaining roller traveling is driven according to the "retaining roller off control" so that the retaining roller 121 is fed to the first position (I).

Through "retaining roller HP sensor on?" checking in step P59, retaining roller 121 is confirmed to have been fed to the first position (I) by the sensor 127. After traveling to this position, the stepping motor 126 as a retaining roller drive motor is stopped according to "retaining roller stop control" in step P60. Upon completion of the aforementioned steps, longitudinal alignment (returning) of ejected sheets by the retaining roller is now complete.

Then retaining roller retaining control routine is implemented.

If the leading edge of the sheet is detected by the ejection sensor 38 according to "ejection sensor 38 on" in step P11 given in FIG. 32, the information that the sensor has been turned on is used as a trigger to "1" is set to "retaining roller retaining operation flag" in step P15. The same retaining control as that explained with reference to FIG. 27 in the aforementioned Example 1 is carried out. This causes the retaining roller 121 goes from the first position (I) to the second position (II). Upon completion of the retaining function, the roller returns to the first position (I). Upon completion of the aforementioned steps, retaining operation of the loaded paper by the retaining roller 121 is now complete.

In this Example, the retaining roller 121 is moved from the first position to the second position after the sheet has been ejected to the tray 12. Therefore, the sheets having failed to go back to the end fence 131 are gripped and are made to return, despite inclination of the top surface of the loaded paper, and excellent alignment is ensured despite the curling or loaded status of the sheets. At the same time, the retaining roller 121 is moved from the first position to the second position before the sheets are completed ejected onto the tray. This allows the loaded paper to be held in position, and prevents the leading edges of the sheets from being ejected to push the loaded paper, whereby loaded paper is not pushed out, and alignment is not interrupted.

Further, it is important to use the retaining function in the case of face curling with trailing edge raised. In the case of back curling with the trailing edge lowered, it is important to use returning function. Thus, problems which may be caused by face/back curling are solved by using both returning and retaining functions. When connected with various types of image forming apparatuses characterized by different directions of curling, this apparatus improves longitudinal alignment; with the result that versatility as a post-treatment apparatus is improved.

Example 6

In this Example, control is made in such a way that the retaining roller 121 is allowed to move also to a third position (III) intermediate between the first position (II) and second position (II) away from the loaded sheets, and to wait there. This method of control is intended to reduce the time for traveling to the second position.

In this Example, the initial routine given in FIG. 31 in the aforementioned Example 5 and the sheet transport control given in FIG. 32 are put into common use. "Retaining roller returning control" in step PP30 given in the flow chart of FIG. 31 is implemented according to the flow chart shown in FIG. 34. "Retaining roller retaining control" in step P3 is executed according to the flow chart shown in FIG. 35.

Figure 34:
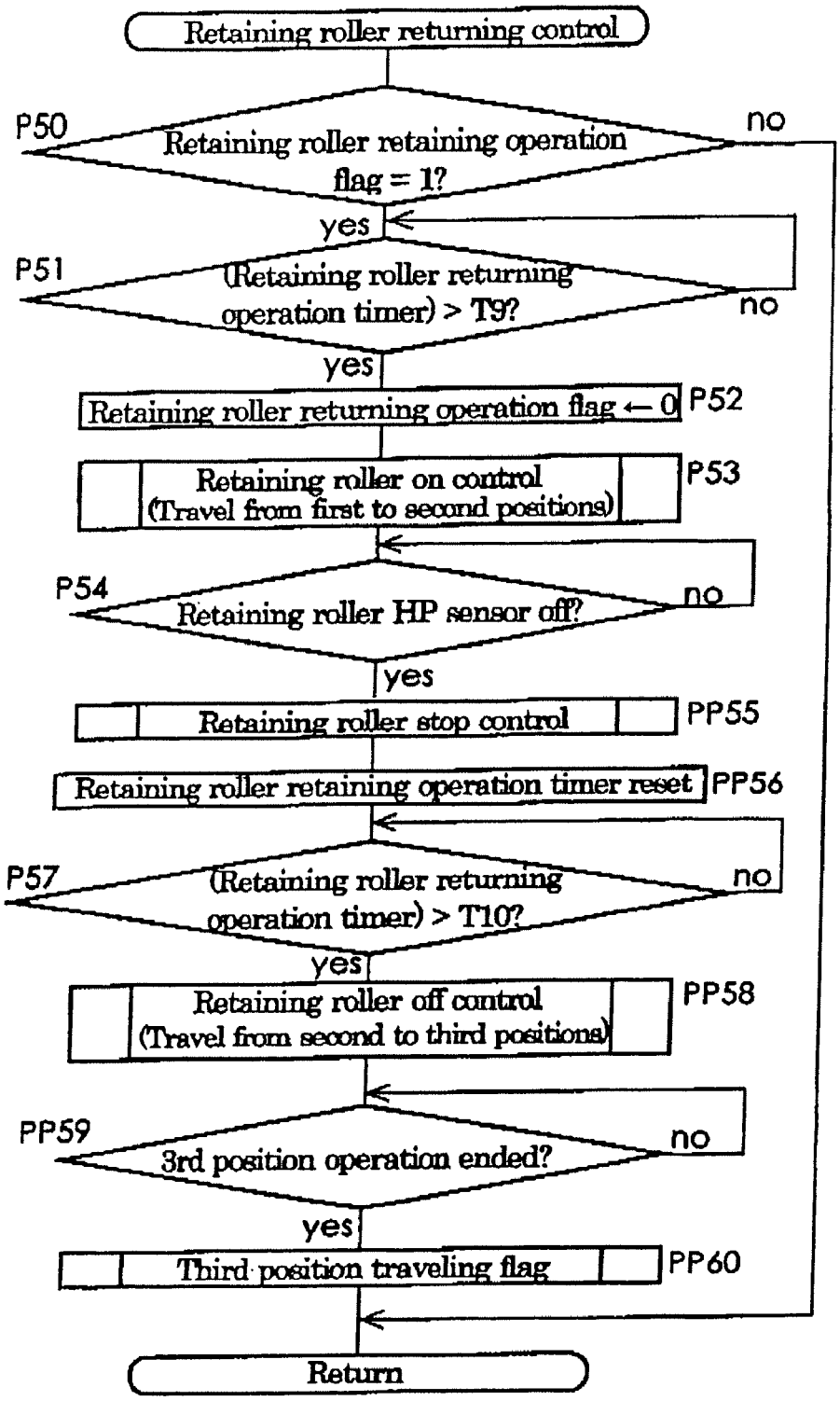
FIG. 34 is a flow chart illustrating the control means.

In FIG. 32, "ejection sensor 38 off" in step P17 is used as a trigger to set "1" to "retaining roller returning operation flag" in step P41; then the following control will be performed in FIG. 34:

FIG. 34 has the same steps as those of the flow chart in the aforementioned FIG. 33. For these same steps, the same numerals will be used. To put it briefly, the retaining roller returning flag is already set "1" in step P50. So control proceeds to step P51, and the set value in the "retaining roller returning operation timer" is compared with the T9 where the timing of the ejected sheets completely falling on the tray is set, as described above. If it is greater than T9, the retaining roller returning operation flag set to "0" in step P52, and control proceeds to step PP54.

The stepping motor 126 as a motor for feeding the retaining roller 121 is started by "retaining roller on control" in step P53. In "retaining roller HP sensor off" checking in step P54, the time when the retaining roller 121 has reached the second position (II) is detected by confirming that the sensor 127 is turned off. The stepping motor 126 is stopped by "retaining roller stop control" in step P55, whereby the movement of the retaining roller 121 is stopped. Upon completion of the aforementioned steps, the retaining roller 121 goes to the returning position (the second position) given in FIG. 4, and the retaining roller 121 is pressed against the loaded paper via the trailing edge of the ejected sheet. This allows the sheet to be pressed against the end fence 131 by means of the torque of the retaining roller 121, thereby ensuring longitudinal alignment.

Then "returning roller retaining operation timer" is reset in the step P56, and the time of remaining in the second position (II) is controlled in step P57. The time of the retaining roller 121 remaining at the second position represents the set value T10 of the "retaining roller returning operation timer", which is set as the time sufficient to allow the sheet to hit the side fence 131.

After the lapse of the time set in step P57, control proceeds to "retaining roller off control" in step PP58. In this "retaining roller off control", the stepping motor 126 as a motor for feeding the retaining roller is driven, and control is made in such a way that the retaining roller 121 goes from the second position (II) to the third position (III).

The third position (II) is located intermediate between the first position (I) and second position (II). It is a desired position where the retaining roller does not contact the loaded paper, and is shown in the aforementioned FIG. 4. The retaining roller 121 is driven by the stepping motor 126. So this control is made by setting the number of pulses for the retaining roller 121 traveling from the second position (II) to the third position (III).

Completion of the set pulse is identified in step PP59 by confirmation, for example, by checking the operation end flag. Stepping motor pulse control is specified to CPU, and various control methods are available. They will not be described here. After completion of the third position traveling operation, "1" is set to "the third position traveling flag" in step PP60, and this routine is quitted in return operation. Upon completion of the aforementioned steps, alignment of the ejected paper (returning) by the retaining roller is now complete.

Figure 35:
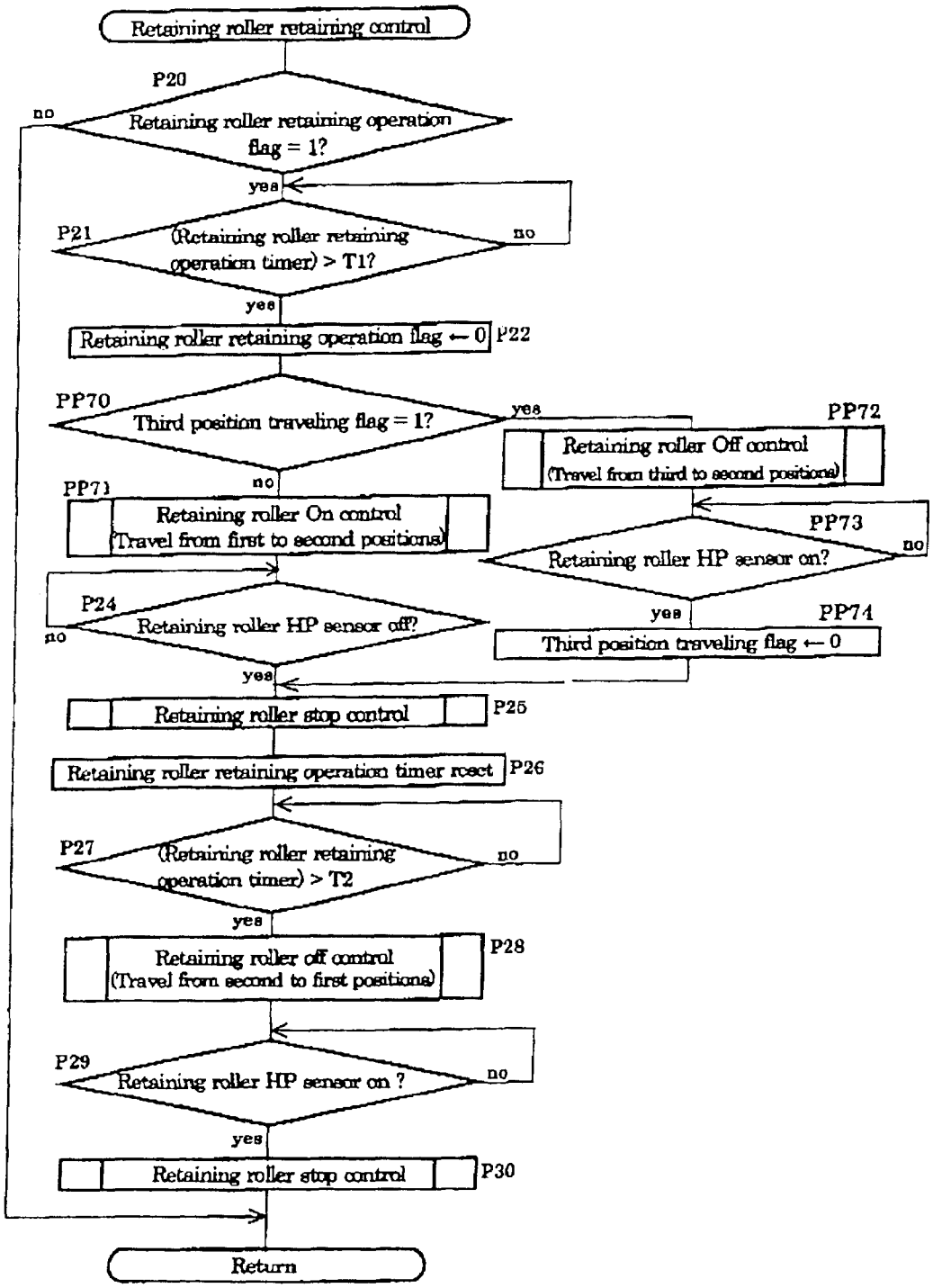
FIG. 35 is a flow chart illustrating the control means.

Then the retaining operation will be described with reference to FIG. 35. Control shown in FIG. 35 is performed in "retaining roller retaining control" routine of step P3 given in FIG. 31. In the flow chart shown in this FIG. 35, the same steps as those in the flow chart of the aforementioned FIG. 27 are taken. So the same numerals are used to represent the same steps.

In FIG. 32, "ejection sensor 38 On" in step P11 is used as a trigger, namely, detection of the sheet leading edge is used as a trigger to set "1" to "retaining roller retaining operation flag" in step P15. Then the following control is performed in FIG. 35.

In step P20, retaining roller retaining operation flag=1; therefore, control proceeds to step P21, and the set value T1 is compared with the value of "retaining roller retaining operation timer" as time elapsed subsequent to resetting of the timer in step P16 of FIG. 32. If the value becomes greater than T1, then the retaining roller retaining operation flag is set to "0" in step P22, and control proceeds to the next control. The value T1 set on the timer represents the time required for the sheets already ejected on the tray 12 to be caught by aligning members 102*a* and 102*b*. Sheet position is unstable during the aligning operation, so retaining roller 121 is shifted from the first position or third position after stability is gained.

"T" is assumed, as the time required until the aforementioned leading edge contacts the upper surface of the sheet loaded on the tray 12, after sheet leading edge is detected by the ejection sensor 38. Assume that T1>T and "t" represents the time required for the retaining roller 121 to travel from the first position (I) or the third position (III) to the second position (II). Then T1>t is mandatory. Time counting is based on the output of clock 720 entered into the CPU700.

Step PP70 of "third position traveling flag checking" is a step of checking whether the retaining roller 121 is waiting at the third position (III) or not. When this flag is set to "1" in step PP60 given in FIG. 34, the retaining roller 121 is waiting at the third position (III), so the system goes to step PP72, and the retaining roller 121 goes from the third position to the second position. When this flag is set to "0", the retaining roller 121 is waiting at the third position (I), so the system goes to step PP71, and the retaining roller 121 goes from the first position (I) to the second position (II). The latter case of going to the step PP71 corresponds to the operation in starting the job, while the case of going to the latter step PP72 corresponds to the operation during continuous treatment of the second sheets in the job and thereafter.

In "retaining roller on control" in step PP71 or PP72, the retaining roller driving stepping motor 126 is operated for the distance in conformity to the distance from each retaining roller waiting position (the first or third position) to the second position. For example, when the sensor 127 has been confirmed to be turned off in "returning roller HP sensor off" checking of step 24, the retaining roller is stopped in "retaining roller stop control" of step P25. Here if the operation for the third position traveling flag set at "1" is performed in step PP70, the flag is reset in "the third position traveling flag←0" of step P74 after the sensor 127 is detected to have been turned on in step PP73.

Upon completion of the aforementioned steps, the retaining roller 121 goes to the second position (II) of FIG. 4, and the retaining function is fulfilled by pressing the retaining roller 121 against the loaded paper. This prevents the loaded paper from being pushed out by the leading edge of the ejected sheet. Further, the "retaining roller retaining operation timer" in step P26 is reset after "retaining roller stop control" in step P25, whereby preparation is made for the next control.

The time when the retaining roller 121 stays at the second position (II) is managed in step P27. In step P27, the value T2 set on the "retaining roller retaining operation timer" is set as time required before pushing out of the loaded paper by the leading edge of the ejected paper is stopped. During this time, the retaining roller 121 remains stopped.

After the lapse of time T2 in step P27, the retaining roller 121 drives the stepping motor 126 in step P28, and starts traveling from the second position to the first position. When arrival at the first position has been confirmed in step P29, stepping motor 126 is stopped in step P30. Upon completion of the aforementioned steps, loaded paper retaining operation by the retaining roller is completed.

In this Example, a third position is provided between the first position and second position as the position where the roller waits until the next retaining function is fulfilled after the returning function has been fulfilled. This has reduced traveling distance of the retaining roller and the traveling time, thereby improving the productivity.

Example 7

This Example is an example of control. When the retaining roller is assumed to be rotating in the direction of returning at all times in this Example, control is made in such a way that rotation is stopped when the second position has been reached to fulfill retaining function.

(a) "Retaining roller rotation stop control" is added between "retaining roller stop control" in step P25 and "retaining roller retaining operation timer reset" in step P26 of FIG. 27 in the Examples explained so far. "Retaining roller rotation start control" is added between "retaining roller off control" of step P28 and "retaining roller HP sensor on?" of step P29.

(b) "Retaining roller rotation stop control" is added between "retaining roller stop control" in step P25 of FIG. 28 and "retaining roller retaining operation timer reset" in step P26. "Retaining roller rotation start control" is added between the "retaining roller off control" in step P28 and "retaining roller HP sensor on?" in step P29.

(c) "Retaining roller rotation stop control" is added between "retaining roller stop control" in step P25 of FIG. 29 and "retaining roller retaining operation timer reset" in step P26. "Retaining roller rotation start control" is added between "retaining roller off control" in step P28 and "retaining roller HP sensor on?" in step P29.

(d) "Retaining roller rotation stop control" is added between "retaining roller stop control" in step P25 of FIG. 30 and "retaining roller retaining operation timer reset" in step P26. "Retaining roller rotation start control" is added between "retaining roller off control" in step P28 and "retaining roller HP sensor on?" in step P29.

(e) "Retaining roller rotation stop control" is added between "retaining roller stop control" in step P25 of FIG. 35 and "retaining roller retaining operation timer reset" in step P26. "Retaining roller rotation start control" is added between "retaining roller off control" in step P28 and "retaining roller HP sensor on?" in step P29.

The above control is possible in the configuration where the rotation drive system of the retaining roller 121 is separated from the rotation drive system of the ejection roller 3, as in the aforementioned FIG. 15(*b*). (1) Retaining roller drive motor 556 is stopped immediately after the retaining roller 121 has moved to the second position (II). (2) Motor 556 is started immediately after the retaining roller 121 has moved from the second position (II).

Upon completion of the aforementioned operations, the retaining roller is stopped when retaining operation is performed by the retaining roller 121. So sheets are excessively returned to the end fence 131, thereby preventing the sheet from being buckled. Further, when the sheets being ejected are brought in contact with the upper portion of the retaining roller at the first or third position feed can be provided by rotation, thereby assisting transportation.

Embodiment 4

This embodiment represents an example of application to an image sheeting apparatus.

This Example relates to an image forming apparatus comprising an image forming means for forming images on sheets and a transporting means for transportation of imaged sheets. The image forming apparatus 50' shown in FIG. 23 has the image forming means common to the image forming apparatus 50 in FIG. 17. The image forming apparatus 50' contains the retaining roller 121 explained in the aforementioned embodiment and the displacement means thereof. Further, the image forming apparatus 50' contains the same components as those of the sheet-like medium post-treatment apparatus 51 shown in FIG. 17. These components will be represented by the same numerals as those in FIG. 17, and will not be described to avoid duplication.

Figure 23:
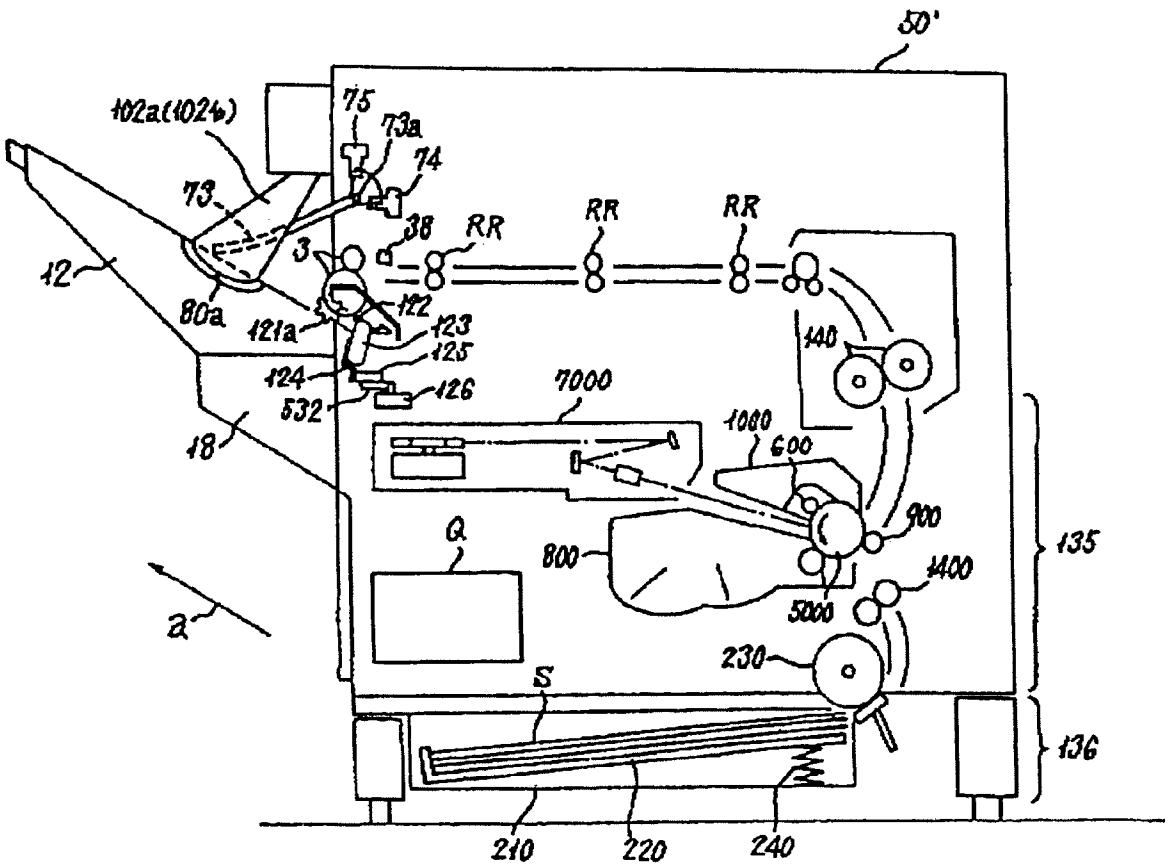
FIG. 23 is a front view representing the schematic configuration of the image forming apparatus.

In FIG. 23, an image-forming unit 135 is arranged approximately at the center of the apparatus proper, and a paper feeder 136 is arranged immediately below this image-forming unit 135. The paper feeder 136 is provided with a paper feeding cassette 210.

An original reading apparatus for reading an original (not illustrated) can be mounted on the upper portion of the image forming apparatus 50' as required. A roller RR as a transporting means for transporting imaged sheets and guide plate are installed on the upper portion of the image forming unit 135.

An electrical unit for electrical drive and control of the apparatus is installed on the image forming unit 135. Further, a drum-like photoconductor 5000 is arranged. Around this photoconductor 5000 are arranged a charging apparatus 600 for charging the surface of this photoconductor 5000, an exposure apparatus 7000 for applying image information onto the photoconductor surface by laser light, a development apparatus 800 for visualization of an electrostatic image formed by exposure on the surface of the photoconductor 5000, a transfer apparatus 900 for transferring on sheets the toner image visualized on the photoconductor 5000, a cleaning apparatus 1000 for removing and collecting toner remaining on the photoconductor surface after transfer, and others.

The photoconductor 5000, charging apparatus 600, exposure apparatus 7000, development apparatus 800, transfer apparatus 900, cleaning apparatus 1000, etc. are constitute major components of the image forming means. A fusing apparatus 140 is arranged approximately above the photoconductor 5000 further downstream from the sheet transport route than the photoconductor 5000. When the image forming apparatus functions as a printer, image signals are input at the time of image formation. The photoconductor 5000 is uniformly charged in a dark place in advance by the charging apparatus 600. Based on image signals, exposure light is applied onto this uniformly charged photoconductor 5000 from a laser diode LD (not illustrated) of the exposure apparatus 7000. Light reaches the photoconductor through the known polygon mirror and lens, and an electrostatic static image is formed on the surface of the photoconductor 5000. This electrostatic static image travels with the rotation of the photoconductor 5000, and is visualized by the development apparatus 800. It further travels toward the transfer apparatus 900. On the other hand, unused sheets are stored in the paper feed cassette 210 of the paper feeder 136. Pressure is applied the bottom plate 220 by a spring 240 in such a way that sheets S on the top position of the bottom plate 220 supported rotatably are pressed against a paper feed roller 230. When paper is fed for transfer, the paper feed roller 230 rotates, and sheets S are fed out of the paper feed cassette 210 by this rotation. They are then transported to a pair of resist rollers 1400.

The sheets fed to the resist rollers 1400 are stopped temporarily. Resist rollers 1400 start feeding the sheets by adjusting the timing in such a way that the positional relationship between the toner image on the surface of the photoconductor 5000 and the leading edge of sheet S will be found at the transfer position suited to image transfer where the transfer apparatus 900 is installed.

A toner image is fused on sheets having been transferred while they are passing through the fusing apparatus 140. Sheets having passed through the fusing apparatus 140 are transported by the roller RR as a transporting means, and are ejected from the ejection roller 3 to the tray 12 through the ejection sensor 38.

The subsequent sheet alignment functions by retaining roller 121, driven lever 122, drive lever 123 and other displacement means have already been described with reference to the aforementioned embodiments, and therefore will not be described to avoid duplication.

In the image forming apparatus of this Example as well, the sheets S loaded onto the tray are aligned in the direction of ejection, and the sheet-like medium can be aligned to a high accuracy.

In the aforementioned Example, the retaining roller 121 rotates in contact with the upper surface of the sheet during the returning operation and returns the sheet S using the friction with sheets S. After the trailing edge of sheet S has hit the end fence 131, slipping is necessary in such a way that the trailing edge of the sheet does not buckle. Frictional coefficient and pressing force must have been set to ensure that such a mode of returning can be realized.

For example, a sponge-like elastic material having irregular surface shape was used as the retaining roller 121. This allows appropriate pressure to be obtained easily by being in contact with the upper surface of sheet S in an deformed state, and ensures the paper to be caught without fail.

Since the retaining roller 121 of the aforementioned embodiments 1 to 4 is driven, it has a returning function of pulling sheets back to the end fence 131. In this case, the retaining roller 121 will be called a returning roller 121. The following describes the returning roller 121.

Embodiment 5

This embodiment represents an example where the position of the returning means (returning roller) is made variable.

Example 1

Figure 36:
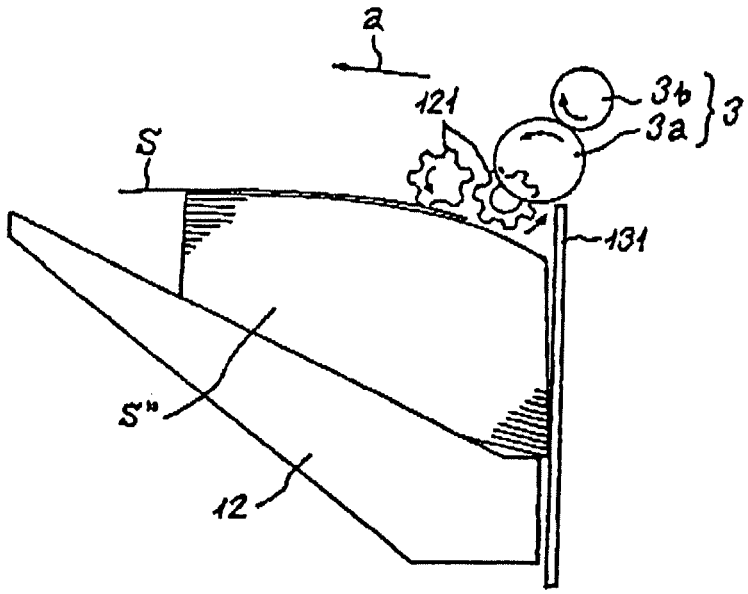
FIG. 36 is a front view representing the tray and returning means.

In FIG. 36 showing the major components of the sheet-like medium alignment apparatus, for example, the ejection roller 121 is made to wait at the first position (shown by a solid line) until sheets S" are ejected from the ejection roller 3 to drop on the surface of the stacked paper loaded on the tray 12. When sheets S have dropped on the surface of appropriate aligned stacked paper S", the roller is moved to the second position (indicated by two-dot chain line) where the trailing edge of the sheet S can be easily caught. Thus, even if the loaded sheets are back curled and returning action under the weight of the sheet itself based on tray inclination is not available, sheet S can be returned until it hits the end fence 131 by the rotation of the returning roller 121 and are aligned. After that, the returning roller 121 waits for returning at the first position.

The returning roller 121 rotates in contact with the upper surface of sheet S, and uses the friction with sheets S to return sheets S. After the trailing edge the sheet S has hit the end fence 131, slipping is essential to ensure that the trailing edge of the sheet S will be buckle. Frictional coefficient and pressing force must have been set to ensure that such a mode of returning can be realized.

In this Example, a sponge-like elastic material having irregular surface shape was used as the retaining roller 121. This allows appropriate pressure to be obtained easily by being in contact with the upper surface of sheet S in a deformed state, and ensures the paper to be caught without fail.

Example 2

In FIG. 36, the returning roller 121 can be located at two different positions—the first and second positions. For example, it can be made to travel between these two positions in conformity to the ejection of sheets. In order to ensure catching of the trailing edge of the sheet having dropped on the tray or on the upper surface of loaded paper at the second position, the space between the first and second positions, namely, the traveling stroke of the returning roller 121 must be made greater than the variation in the position of the trailing edge of the sheet having dropped on the tray 12 or on the upper surface of loaded paper.

The aforementioned variation depends on the type and size of the sheet, the image forming apparatus, post-treatment apparatus and other machines to be used, or the environmental conditions. The traveling stroke of the returning roller is determined with consideration given to these variations.

Example 3

Figure 80:
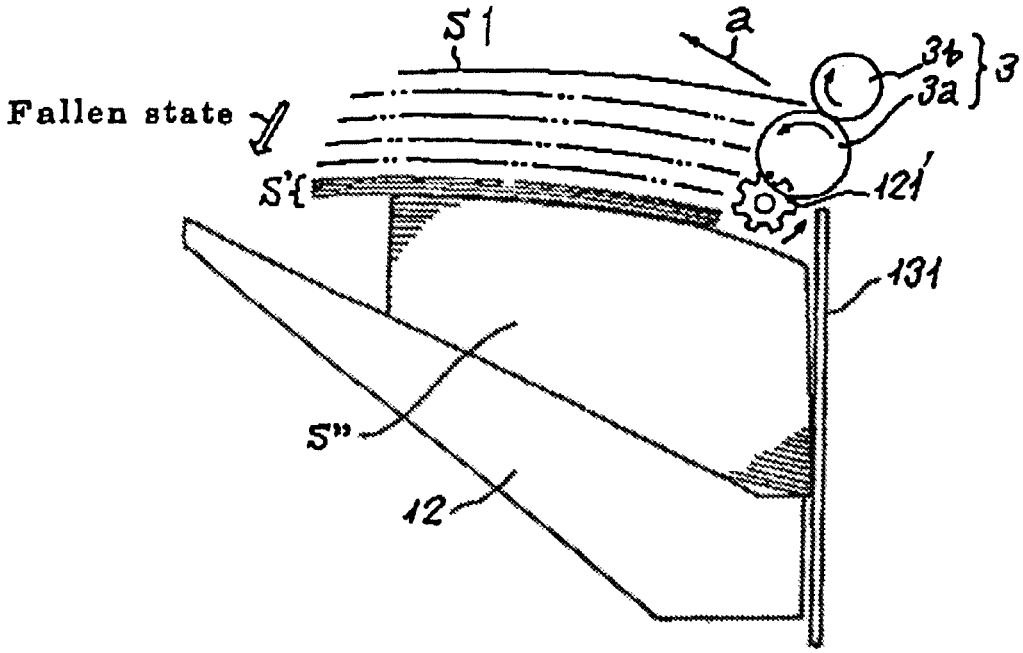
FIG. 80 is a front view representing the state of loaded sheets according to the prior art.

In FIG. 80, the returning roller 121*a* is located at the position of interfering with the trailing edges of the sheet being dropped. Even if the first and second positions are determined with consideration given to the variation in the position of natural fall of the trailing edge of the sheet, for example, the returning roller 121*a* interferes with the trailing edge of the sheet being dropped, and the sheet may bed pushed out in the direction of ejection by feed component in the direction of ejection "a". This may cause the position of drop to be changed.

In other words, the returning roller 121 originally has a function of pushing out the trailing edge of the sheet S in the direction of ejection "a" on the upper portion. For example, the returning roller 121 located at the first position shown by the solid line in FIGS. 36 and 37 interferes with the locus c of the trailing edge of the sheet S being dropped. The position of the returning roller in the process of interference is the circumferential surface at upwardly inclined position. Since the component of force by rotation of the returning roller has a component in the direction of ejection "a", the trailing edge of the sheet S is pressed and pushed out in the direction on the circumferential surface at upwardly inclined position of the returning roller.

When sheets are pushed out in the direction of ejection "a" by such pressing and push-put force, the trailing edge of the sheet S may not be caught even in the second position, depending on the type of the sheet.

For complete elimination of these uncertain elements in this Example, the position of the returning roller 121 defined as the first position in FIG. 36 in the aforementioned Examples 1 and 2 is shifted a little further to the upstream side in the direction of ejection "a"; namely, it is shifted to the right of the locus c of the trailing edge of the sheet in the figure. The aforementioned the first position is determined as the first stop position without interference with sheets S being ejected from the ejection roller 3. The second stop position is the position which is further on the downstream side in the direction of ejection "a" than the first stop position with reference to this first stop position, which is determined with consideration given to the variation of the trailing edge of the sheet, and which can contact the upper surface of the sheet loaded on the tray 12.

In this Example, excellent alignment can be obtained by complete elimination of uncertain elements due to push-out action of sheets by the returning roller.

Example 4

Figure 37:
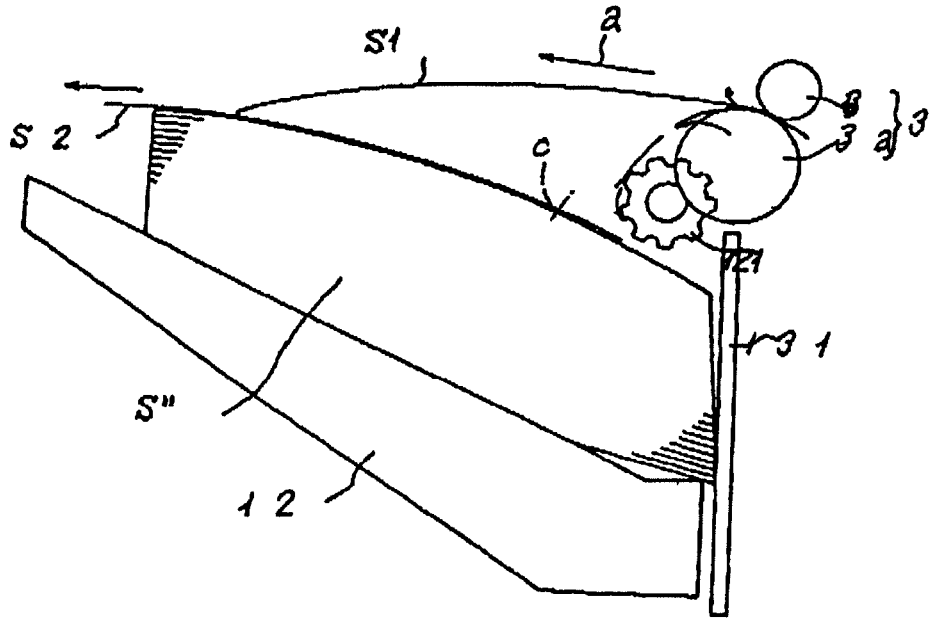
FIG. 37 is a front view representing the tray and returning means.

Depending on the type and size of the sheet, for example, when the trailing edge of the sheet S1 is still gripped by the ejection roller 3 as shown in numeral S1 of FIG. 37, the trailing edge of the sheet S1 may contact the upper surface of sheet S2 located at the top position of the loaded paper S", and the sheet S2 may be pushed out in the direction of ejection "a", with the result that sheet S2 with its trailing edge aligned may be shifted in the direction of ejection "a".

To prevent this, sheet S2 should be held in position by the returning roller 121 to stop the movement of the sheet S2, until pushing of the sheet S2 by the trailing edge of the sheet S1 is stopped. The position of the returning roller 121 to perform this retaining function can be the same as the second stop position. Alternatively, the returning roller 121 may be rotated during retaining operation in the same direction, as during the returning operation rotation is not necessarily essential. If placed in the state of rotation, returning function is also provided.

As described above, when the returning roller 121 is to fulfill retaining function, the following cycle 1 is repeated:

Cycle 1: (1) the first stop position (first sheet) →(2) the second stop position for returning →(3) the first stop position (4) →the second stop position for retaining →(1) the first stop position → . . .

For the first sheet, however, the returning roller 121 must be placed at the first stop position where there is no interference with falling sheets in order not to interfere with natural fall of sheets from the ejection roller 3. In the subsequent process, whether for retaining or returning, the waiting position need not be the first stop position when the roller moves to the second stop position. A third stop position provided between the first and second stop positions will ensure a higher speed operation and higher speed ejection since the traveling distance to the second stop position is shorter.

Thus, in this Example, a third stop position is provided between the first and second stop positions. The roller is returned to this third stop position after the second stop position for returning, and is moved to the second stop position for retaining from this third stop position. Thus, the traveling cycle of the returning roller 121 is Cycle 2 given below:

Cycle 2: (1) the first stop position (the first sheet) →(2) the second stop position for returning →(3) the third stop position →(4) the second stop position for retaining →(5) the third stop position ← (2) the second stop position for returning. . . .

However, when the returning roller 121 is located at the second stop position for retaining operation, and the returning roller 3 is rotating in the direction of returning, the trailing edge of the sheet being dropped after having been ejected from the ejection roller 3 contacts the upper portion of the returning roller 3. If this occurs, then the sheet may be pushed away by the component of force in the direction of ejection "a". Therefore, the returning roller 121 must travel from the second stop position to the first stop position before the trailing edge of the sheet falls on the returning roller 121 to give interference.

Based on this concept, the aforementioned cycle 2 is not adequate. The following cycle 3 is practical.

Cycle 3: (1) the first stop position (the first sheet) →(2) the second stop position for returning →(3) the third stop position →(4) the second stop position for retaining →(5) the first stop position. . . .

As can been seen, when back-curled sheets are loaded on the tray 12, two operations of returning rollers 121 are performed for one sheet. The first operation is intended to move the roller to the second stop position for returning operation intended to prevent misalignment caused by the failure of sheets to return along the inclination of the loaded surface of the tray 12, resulting from the fact that an excessive number of back-curled sheets loaded on the tray 12 and the angle of inclination on the loaded surface has become less acute. The second operation is intended to perform retaining operation to prevent possible misalignment due to the sheets S2 being pushed out when the leading edge of the next sheet S1 has brought in contact with already loaded sheets S2.

The returning roller 121 away from the returning position (the second stop position) subsequent to the first returning operation is not at the default position (the first stop position), but waits at the third stop position between the first and second stop positions. The traveling time of the returning roller 121 can be reduced by moving to the retaining position (the second stop position) for retaining operation. This makes it possible to cope with an image forming apparatus of higher speed.

To ensure that the trailing edge of the sheet being dropped is not pushed out by rotation of the returning roller, control is made so that the roller will return from the retaining position (the second stop position) to the first stop position in the earlier phase before interference occurs. This cycle is repeated thereafter.

Embodiment 6

This embodiment represents an example of a displacement means.

In order to move the returning roller 121 to two or more different positions on a cyclic basis, for example, to the first and second position, or the first second and third stop positions, it is practical to use a mechanical displacement means. The following shows some examples of displacement means.

Figure 38:
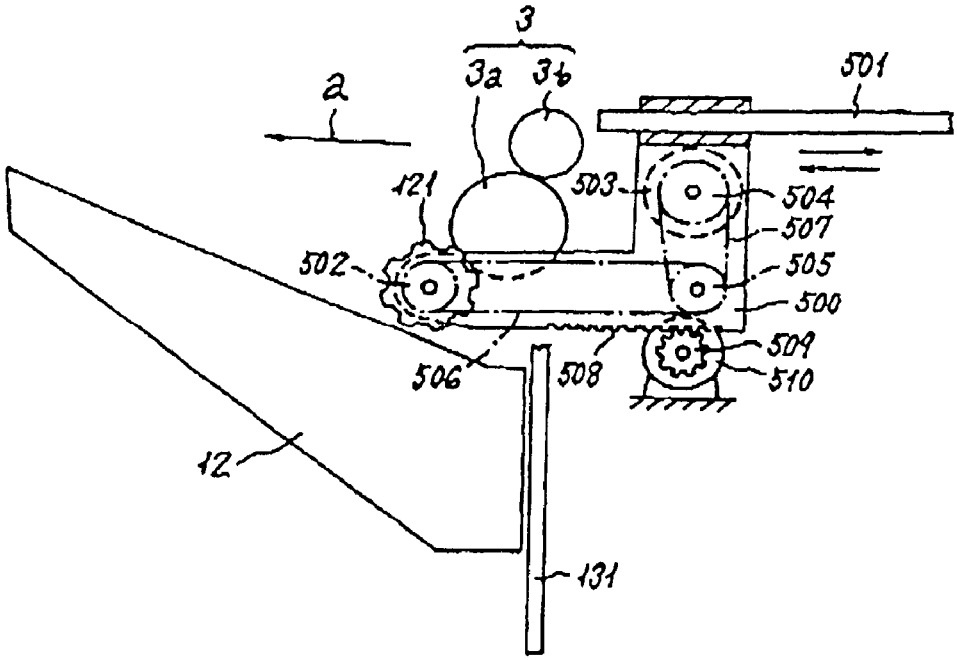
FIG. 38 is a front view representing an example of the rack-based displacement means.

In FIG. 38, the returning roller 121*a* is journaled by a moving body 500. The front of the moving body 500 is L-shaped, and the upper portion is fitted slidably with a guide member 501 long in the direction of displacement. The returning roller 121*a* is journaled by the moving body 500. A pulley 502 is integrally provided on the shaft integral with the returning roller 121*a*. A motor 503 is fixed on the moving body 500, and a pulley 504 is fixed on the shaft.

Above the moving body 500, an idle pulley 505 is journaled to at the position between the pulley 502 and pulley 504. A belt 506 is applied between the idle pulley 505 and pulley 502, and a belt 507 is applied between the idle pulley 505 and pulley 504. This configuration allows rotation of the motor 503 to be transmitted to the returning roller 121*a*, whereby the returning roller 121*a* is rotated. A rack 508 is sheeted on the lower surface of the moving body 500, and a pinion 509 is meshed with this rack 508. The pinion 509 is fixed to the rotating shaft of the motor 510 journaled to the immovable member.

In the displacement means having such a configuration, the moving body 500 can be moved reciprocally along the guide member 501 by driving the motor 510 in conformity to the direction of rotation through meshing between the rack 508 and pinion 509. The returning roller 121*a* can be moved to any desired position in the direction of displacement by the control of the amount of rotation and direction of rotation of the motor 510.

In the displacement means of this Example, displacement is performed using the meshing between the rack and pinion, so the traveling locus of the returning means 121 is linear. When traveling from the first stop position to the second stop position, the returning roller 121*a* contacts the upper surface of the back curled sheet loaded on the tray 12, and may push out this sheet in the direction of ejection "a". Further, if the trailing edge of the sheet loaded on the tray 12 is face-curled, then the curled portion may be hit by the roller, and the sheet may be pushed out by the returning roller 121*a*. Further, the returning roller 121*a* is moved together with a moving body 500 with motor 503 mounted thereon, so a considerably heavy object and large-sized member must be moved. Because of this large-sized structure, considerably flexible measures must be devised for the layout in the vicinity of the ejection roller 3. There are such similar points to be taken care of.

An example of another displacement means for displacing the returning roller 121*a* is shown in FIGS. 9 to 16.

Example 1

In this Example, when a shift mode for sorting the sheets is selected in the sheet-like medium post-treatment apparatus 51 given in FIG. 17, the sheets transported from the image forming apparatus 50 are received by a pair of inlet roller 1 in FIG. 17 as described above. They are then ejected onto the tray 12 through a pair of transport roller 2*a* and a pair of transport roller 2*b* by an ejection roller 3 as a final transport means. In this case, branching jaws 8*a* and 8*b* remain at the default position, and sheets are ejected onto the tray 12 one after another through the same transport route.

In other words, sheets S are ejected onto the tray 12 by a pair of ejection rollers 3 as shown in FIG. 12. After the trailing edge of the sheet has removed from the ejection roller 3, sheets drop into the shift tray 12, while touching the outer periphery of the returning roller 121. A certain time after drop, a stepping motor 126 for return roller drive operates, and the returning roller 121 remaining at the first position is displaced to the second position. It returns the ejected sheets until they are pressed against the end fence 131, whereby sheets are aligned.

If the movement from the first position of the returning roller 121 to the second position is started before the trailing edge of the ejected sheet contacts the tray 12 or paper loaded on the tray 12, then it is possible to prevent loaded sheets from being pushed out by the ejected paper.

On the other hand, in the initial operation immediately after power has been turned on, the stepping motor 126 for returning roller drive is operated, and is stopped when the sensor 127 is turned off. Then the returning roller 121 is placed at the first stop position (indicated by a solid line in FIG. 14), and waits for vertical aligning operation at this position.

Figure 39:
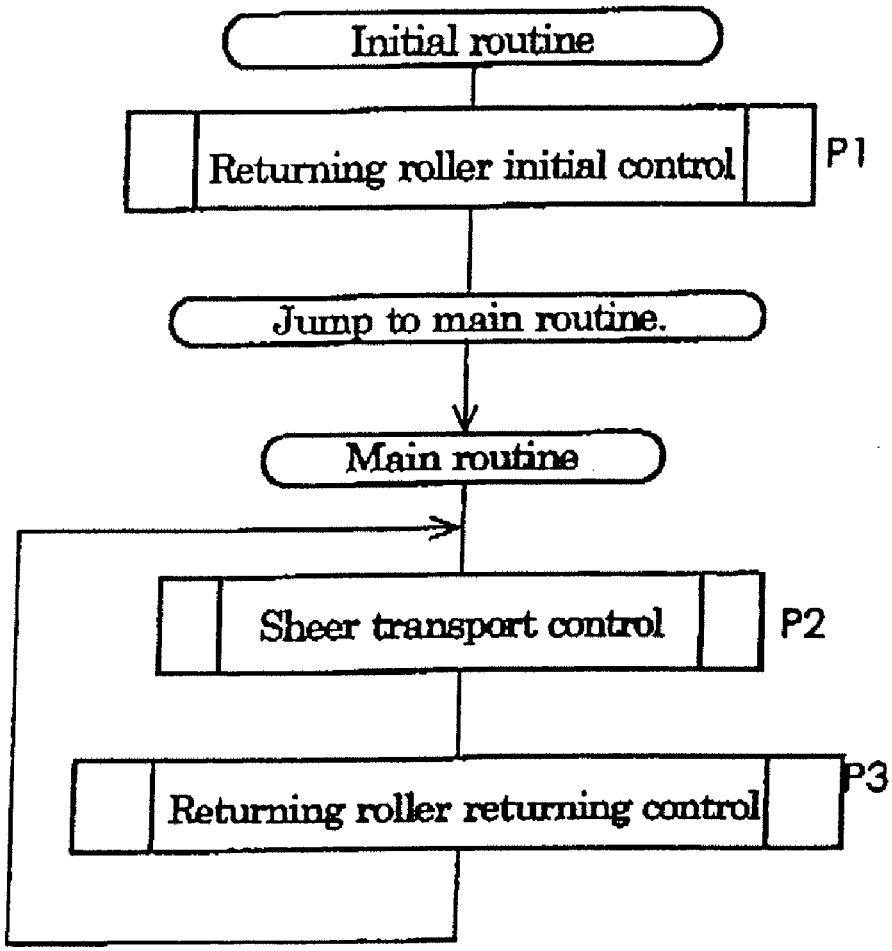
FIG. 39 is a flow chart illustrating the control procedures.

The following describes the details of the operation of the returning roller using a flow chart, similarly to the case of the retaining roller: FIG. 39 relates to the entire control of the sheet-like medium post-treatment apparatus in this Example. It represents only the portion related to the control wherein the returning roller 121 is moved from the first position to the second position after ejection of the sheets onto the tray 12.

FIG. 39 shows the initial operation to be performed immediately after power of the sheet-like medium post-treatment apparatus 51 has been turned on, and the main routine immediately after completion of initial operation. The sub-routine of "returning roller initial control" in step P1 is a sub-routine for returning the returning roller 121 to the first stop position. This is not described since it is apparent without description. The sub-routine of "sheet transport control" in step P2 is a sub-routine the details of which are given in FIG. 40. The sub-routine of "returning roller returning control" in step P3 is a sub-routine the details of which are given in FIG. 41.

Figure 40:
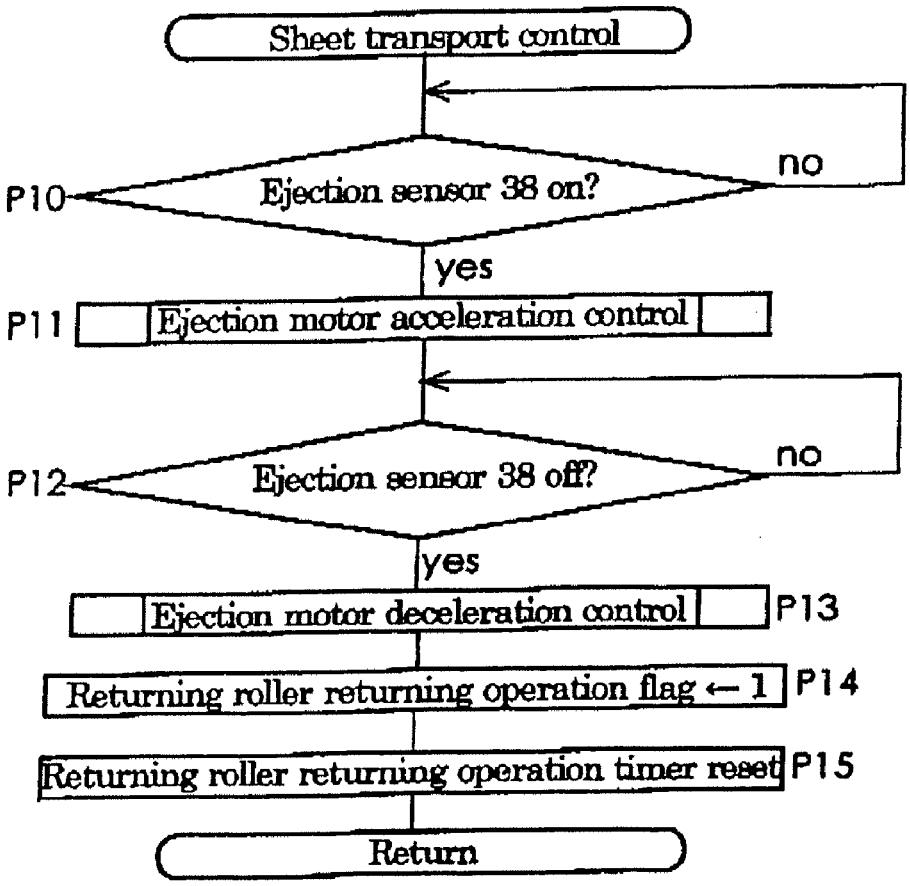
FIG. 40 is a flow chart illustrating the control procedures.

In FIG. 39, control moves from step P1 to step P2 when the sheet-like medium post-treatment apparatus 51 is turned on, and the sub-routine for sheet transport control shown in FIG. 40 is implemented. In this case, control is made for sheets transported inside the sheet-like medium post-treatment apparatus 51.

In FIG. 17, sheets are ejected from the image forming apparatus 50 and detection of a jam by an inlet sensor 36 is controlled in the sheet-like medium post-treatment apparatus 51. Then ejection sensor 38 is controlled.

To improve stacking properties when sheets are ejected into the tray 12, control is made in such a way that the speed of the ejection roller 3 for feeding out sheets is lower than normal sheet transport speed. Immediately before capturing the next sheet subsequent to ejection of a sheet, the speed goes back to the normal feed speed (speed increase) in order to reduce feeding time. However, immediately after job is started, the stepping motor 132 as an ejecting motor is started at the normal transport speed. The feed speed of the first sheet after the job is started is not controlled.

First, when the leading edge of the sheet being transported has been detected by the ejection sensor 38 in "ejection sensor 38 on?" checking of step P10, the speed of the stepping motor 132 for paper ejection to the normal speed is increased in step P11 "ejecting motor acceleration control".

Then control proceeds to "ejection sensor 38 off?" checking in step P12. Time of the trailing edge of the sheet having passed through the ejection sensor 38 is used as a trigger to perform ejecting motor deceleration control in step P13, thereby reducing the sheet transport speed to eject sheets onto the tray 12.

Then immediately when "returning roller returning operation flag" is set to "1" in step P14, "returning roller returning operation timer" is reset in step P15, control quits this routine after subsequent processing (not illustrated) has been completed.

In step P12, immediately when the ejection sensor is off, "returning roller returning operation flag" is set to "1" in step P14. Control proceeds to step P3 in FIG. 39, and returning roller returning control shown in FIG. 41 is performed.

Figure 41:
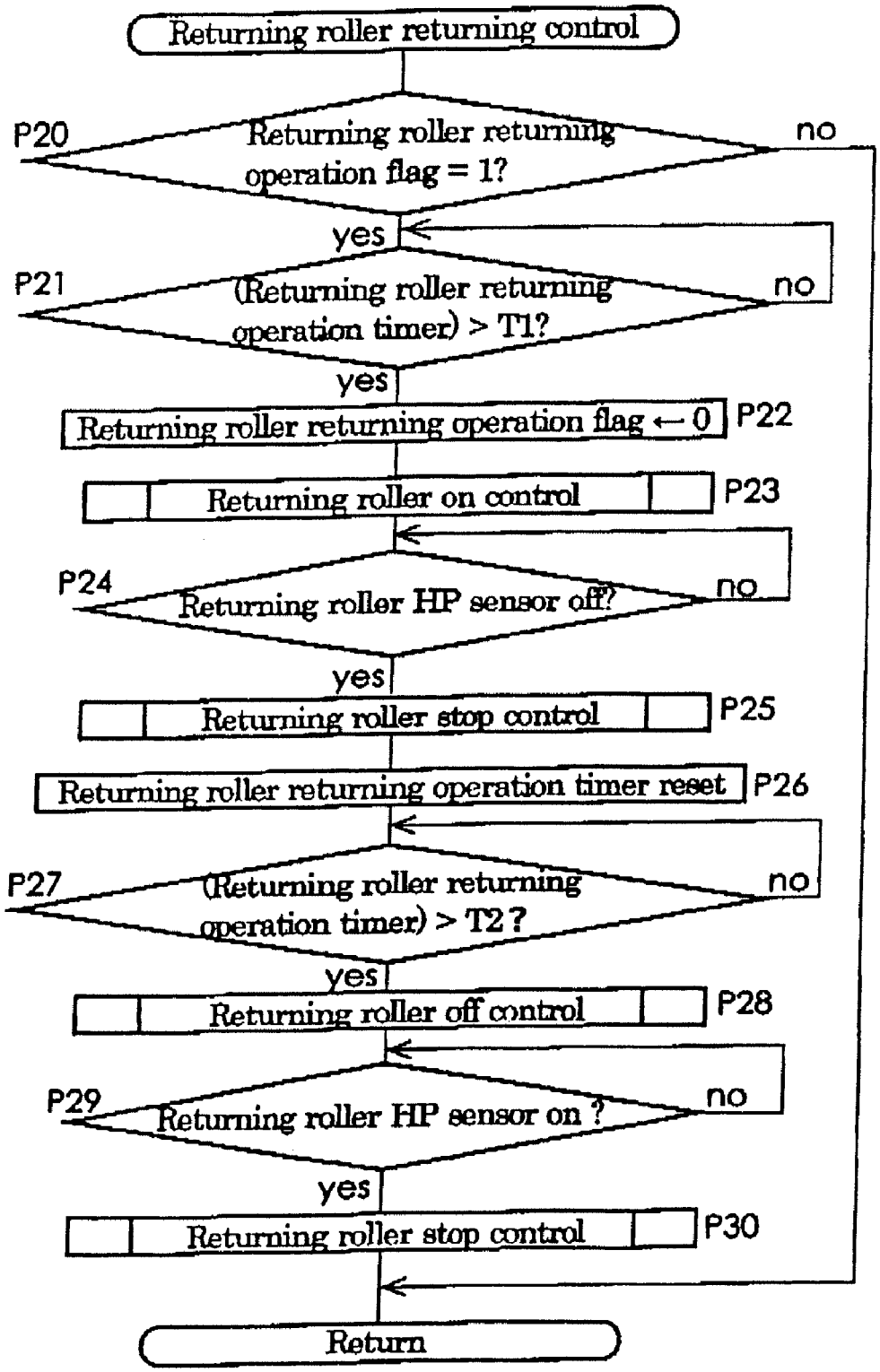
FIG. 41 is a flow chart illustrating the control procedures.

In step P20 of FIG. 41, control goes to step P21 since the returning roller returning operation flag is already set to "1" in step P14 of FIG. 40. In step P21, "returning roller returning operation timer" value is compared with "T". If it becomes greater than "T1", then control moves to step P22. Returning roller 121 is operated after "returning roller returning operation flag" has been set to "0".

The time until sheets are completed loaded on the tray 12 (or on the paper loaded on the tray 12, but to avoid confusion, expression "on tray 12" will be used) after the trailing edge of the sheet has left the ejection sensor 38 is set as the value of "T1". The returning roller is operated after sheets have completely dropped on the tray. The aforementioned set time must be set with consideration given to the distance from the ejection sensor 38 to the nip of the ejection roller 3, transport speed, and time required for free fall onto the tray after passing through the ejection roller. Time is counted through timer counting by the CPU700 and clock counting of the stepping motor 132 for paper ejection.

In the "returning roller on control" of step P23, the stepping motor 126 for returning roller drive is operated, and traveling of the returning roller 121 is controlled from the first stop position shown by a solid line of FIGS. 36 and 14 to the second stop position indicated by a two-dot chain line of FIGS. 36 and 14.

The stepping motor 126 is controlled in such a way that it is stopped after being rotated a specified amount by setting the number of pulses equivalent to the time required traveling of returning roller 121 from the first stop position to the second stop position. Upon termination of the set pulses, a flag denoting termination can be set to proceed to the next control. Further, there are many stepping motor control methods including the one specific to CPU.

Here "returning roller HP sensor off?" (the second position traveling ended?) is checked in step P24. Check is made to make sure that the sensor 127 is turned off by rotation of the shield plate 531. The position where the sensor 127 is off is considered as the second stop position of the returning roller 121, and the stepping motor 126 is stopped in step P25. This indicates that the returning roller 121 has traveled to the second stop position.

Upon termination of returning operation, "returning roller returning operation timer" is reset in step P26. In step P27, the "returning roller returning operation timer" value is compared with the set value "T2", and the returning roller at the second stop position remains for a specified time. This value of "T2" denotes the time required before the sheet returned by the returning roller 121 is pressed against the end face 131 after the returning roller 121 has moved to the second stop position. It is determined by the line speed of the returning roller 121 and returning distance (distance from the trailing edge of the sheet to the end fence 131 at the time of falling).

After lapse of set time T2, control goes to "returning roller off control" in step P28. In this "returning roller off control", the stepping motor 126 as a motor for driving the returning roller 121 is driven again, and the returning roller 121 is returned to the first stop position according to this control.

In "returning roller HP sensor on?" checking of step P29, check is made to make sure that the returning roller 121 has traveled to the first stop position, based on the information of detection from the sensor 127. After arrival at the first stop position has been confirmed, the stepping motor 126 is stopped in "returning roller stop control" of step P30. In the "returning roller HP sensor on?" checking of the previous step P29, the system checks the time required for the sensor 127 to detect that the returning roller 121 has returned to the first stop position. This makes it possible to check for possible operation failure of the returning roller 121 (failure to go back to the first stop position), whereby an operation error can be examined.

In this Example, the returning roller 121 after ejection to the tray 12 is operated, thereby firmly catching the sheets having failed to go back to end fence 131 due to the inclination of the top surface of the load on the tray 12 changed by the state of curling. This ensures excellent aligning, independently of the curling of sheets or loaded state.

In this Example, when the ejection sensor 38 located on the extreme downstream side as one of the sensors related to transport system has determined that the trailing edge of the sheet is not detected, this time point can be used as a trigger to return the operation from the first stop position of the returning roller 121 with respect to the sheet for which returning operation is performed with the minimum time error. This ensures longitudinal aligning. The time required until the operation is started from the first stop position of the returning roller 121 after the ejection sensor 38 has determined that the trailing edge of the sheet is not detected can be set to a constant set value, independently of sheet size. This allows control software to be simplified, thereby permitting miniaturization of the control storage element and cost reduction.

Further, sheets can be returned to the end fence without fail by setting the set value T2 to the time sufficient to permit sheets to hit the end fence. This ensures reliable longitudinal aligning of sheets.

Example 2

This Example is a variation of the aforementioned Example 1. In the present Example, control is made in such a way that the set value T2 in step P27 given in FIG. 41 is changed according to the conditions such as the quality and size of paper, number of stacked sheets or a combination thereof.

(a) Example of Changing in Conformity to the Sheet Size

Figure 42:
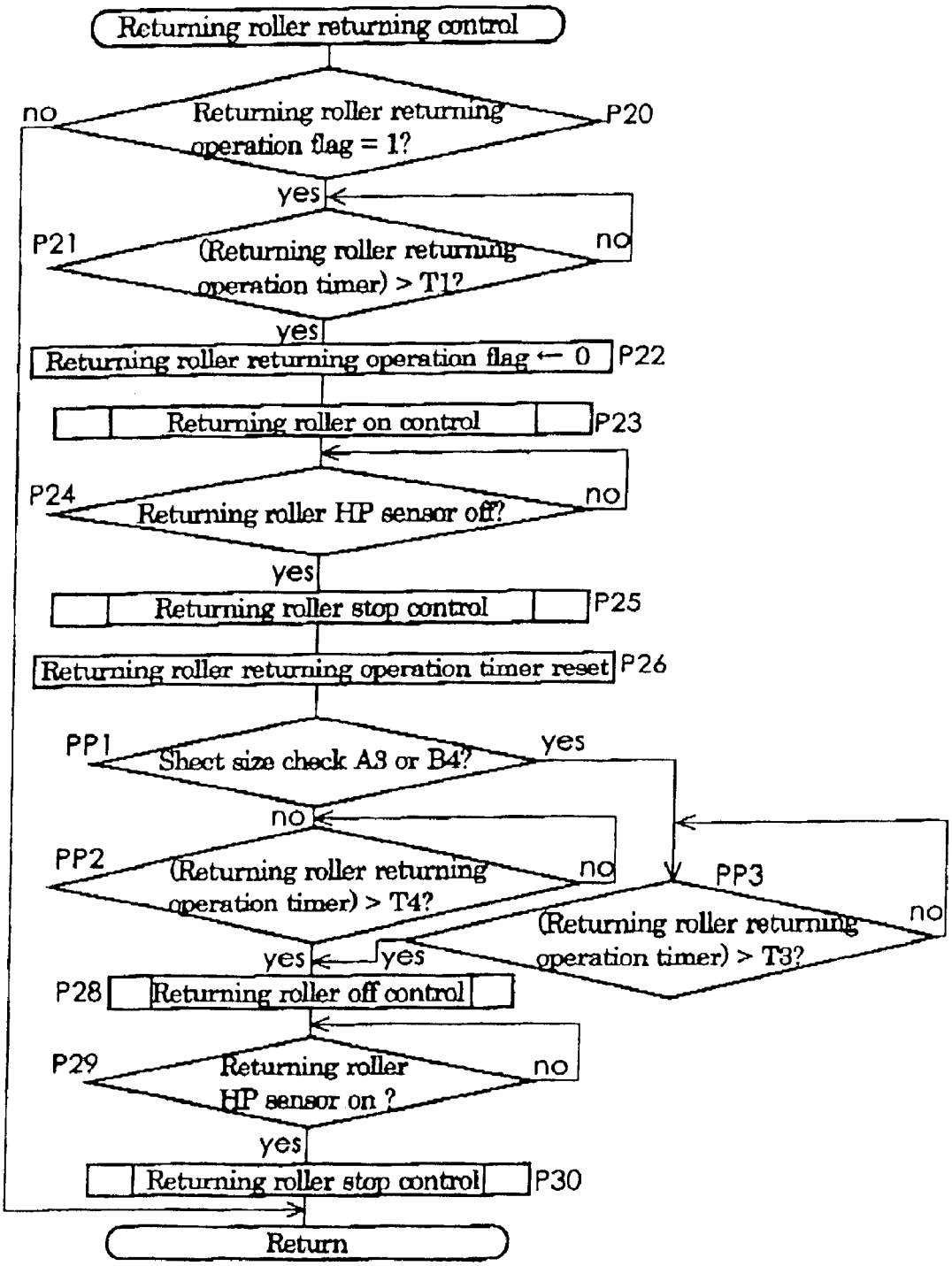
FIG. 42 is a flow chart illustrating the control procedures.

The flow chart given in FIG. 42 according to the present Example corresponds to the one where the step P27 in the flow chart of FIG. 41 is replaced by steps PP1, PP2 and PP3. Other steps are the same as those is FIG. 41. So the same steps are assigned with the same numerals of reference. Only the differences from FIG. 41 will be described below:

As shown in FIG. 42, after termination of the travel to the second stop position of the returning roller 121 in step P25, the sheet size is checked in steps PP1 to PP3 to determine the time of stopping the returning roller 121 at the second stop position. Every time the sheet is ejected to the sheet-like medium post-treatment apparatus 51 by the image forming apparatus 50, the sheet size is sent as a command from the image forming apparatus 50. Based on this command, the sheet size is checked.

In step PP1 for checking the sheet size, A3 or B4 size is checked. In the case of A3 and B4 sizes, the value set on the timer is compared with "T3". It is compared with "T4" for other sizes. Then traveling to the first stop position starts upon lapse of the set time. In the aforementioned Example, only A3 and B4 sheets are checked. Strictly speaking, however, the set value may have to be changed for all sheet sizes or the feed direction of the same sized paper (longitudinal or horizontal).

If the time when the returning roller stops at the second stop position is changed in conformity to paper size, then returning roller can be controlled in conformity to friction and weight of paper due to the difference in sheet size. This ensures a reliable longitudinal alignment of sheets.

(b) Example of Changing in Conformity to the Number of Loaded Sheets

Figure 43:
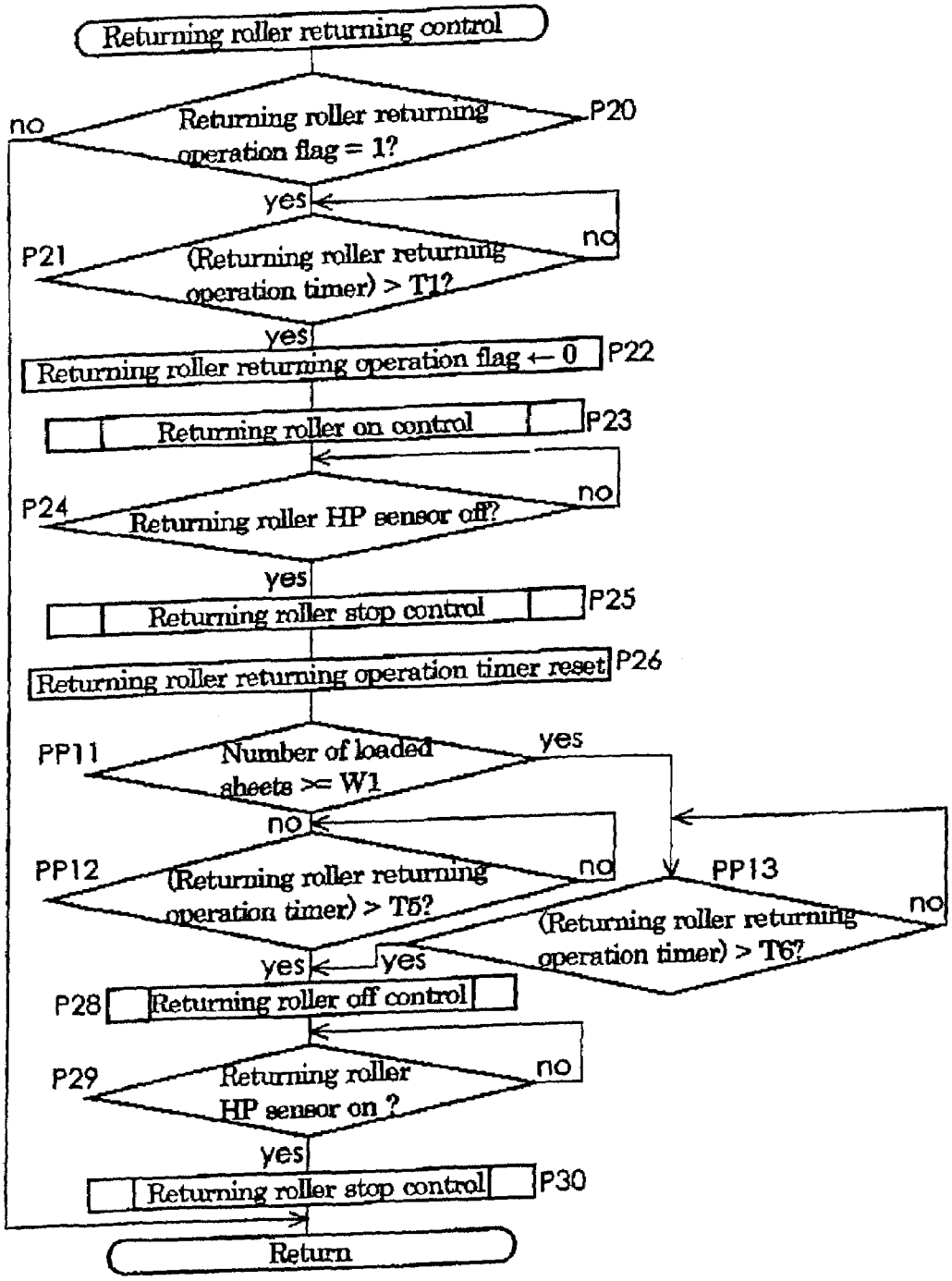
FIG. 43 is a flow chart illustrating the control procedures.

The flow chart given in FIG. 43 according to the present Example corresponds to the one where the step P27 in the flow chart of FIG. 41 is replaced by steps PP11, PP12 and PP13. Other steps are the same as those is FIG. 41. Other steps the same as those in FIG. 41. So the same steps are assigned with the same numerals of reference. Only the differences from FIG. 41 will be described below:

As shown in FIG. 42, after termination of the travel to the second stop position of the returning roller in step P25, the number of sheets loaded on the tray 12 in steps PP1 to PP3 is checked to determine the time of stopping the returning roller 121 at the second stop position.

Here the number of the loaded sheets can be grasped since loaded sheets are counted in step P12 for ejection sensor off checking as shown in FIG. 40.

The number of sheets is reset by the sensor 150 provided on the tray 12 to detect the presence or absence of sheets when all the sheets on the tray have been removed. In step PP11, number of sheets is checked according to whether the number of sheets exceeds a specified level (W1) or not. If the number is smaller than W1, comparison is made with the returning roller stop time set value in step PP12. If it is greater than W1, comparison is made with the returning roller stop time set value "T6" in step PP13. Traveling to the first stop position is started after the lapse of the set time. In this Example, the number of sheets loaded is checked with reference to a specified set value "W1". If required, the set time can be changed in increments of a smaller number of sheets.

As described above, the time for the returning roller staying at the second stop position is changed in conformity to the number of loaded sheets. This makes it possible to carry out the returning roller control in conformity to the change in the profile of loaded surface when a large amount of load is added.

(c) Example of Changing in Conformity to Quality of Paper

Figure 44:
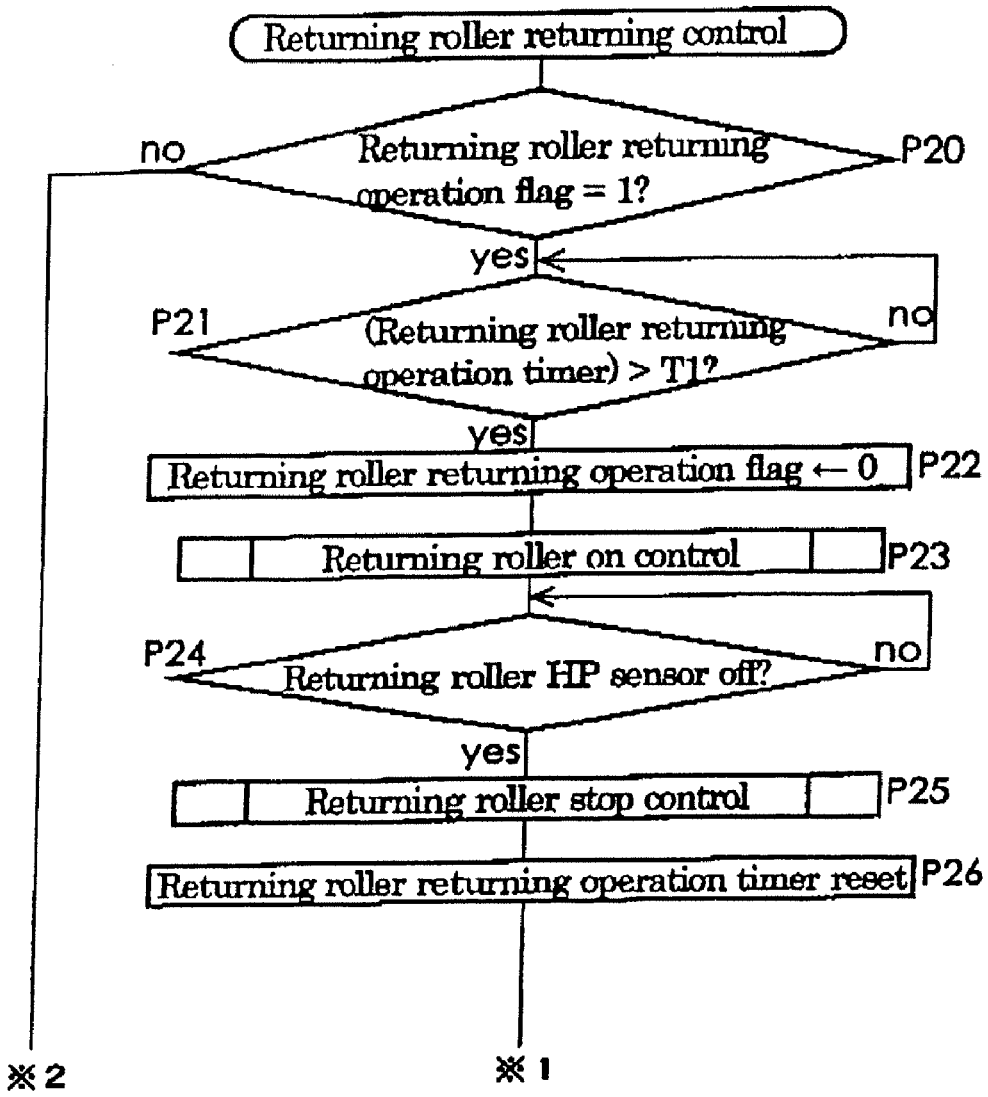
FIG. 44 is a flow chart illustrating the control procedures.
Figure 45:
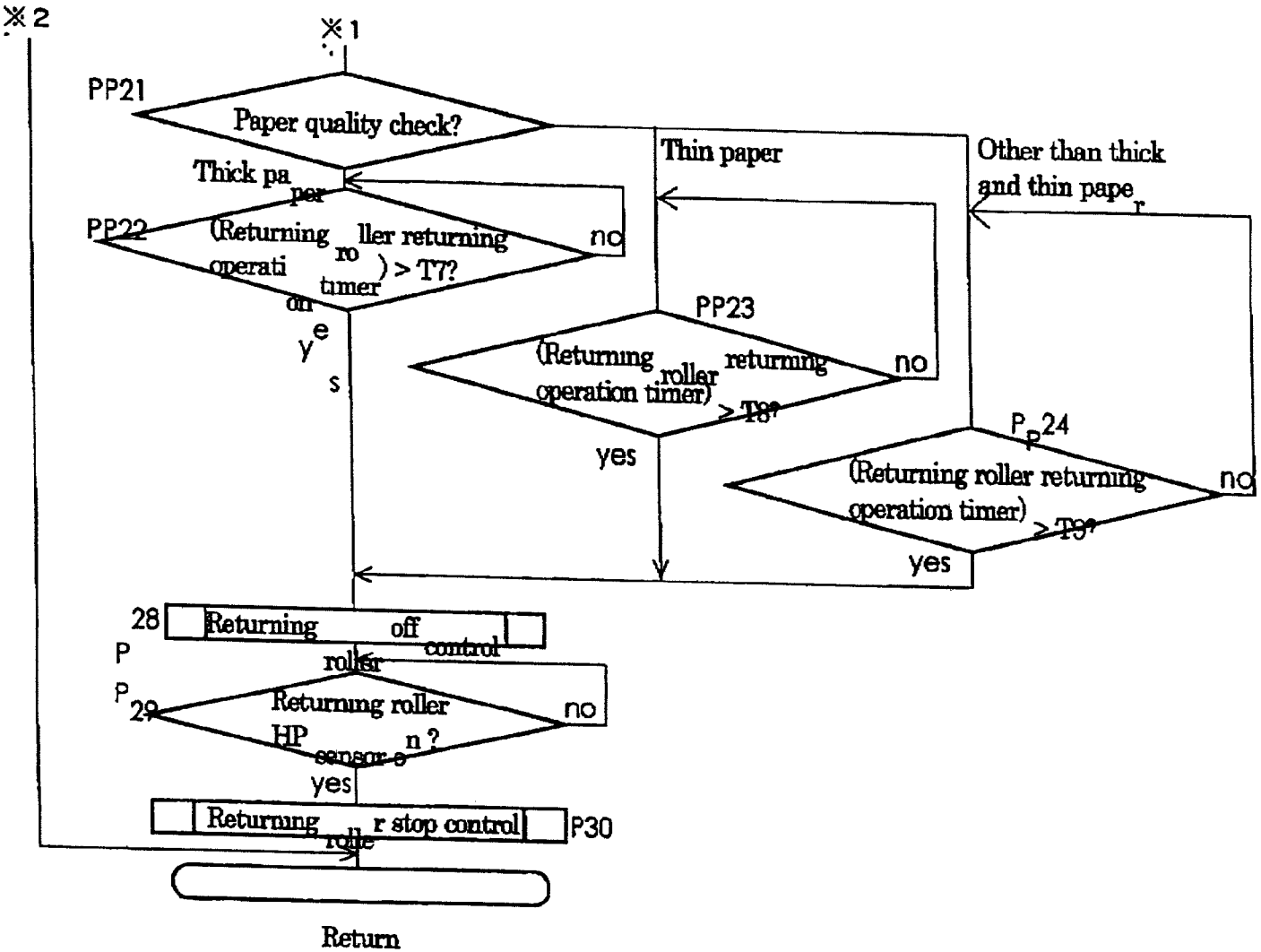
FIG. 45 is a flow chart illustrating the control procedures.

The flow charts given in FIGS. 44 and 45 according to the present Example correspond to the ones where the step P27 in the flow chart of FIG. 41 is replaced by steps PP21 to PP24. Other steps are the same as those is FIG. 41. So the same steps are assigned with the same numerals of reference. Only the differences from FIG. 41 will be described below:

As shown in FIG. 44, after termination of the travel to the second stop position of the returning roller 121 in step P25, the quality of sheets ejected on tray 12 is checked is checked to determine the time of stopping the returning roller 121 at the second stop position.

For checking the paper quality, the operation unit of the image forming apparatus 50 has a thick/thin paper selecting means. When it is selected by a user, paper quality is check according to signals sent sheet size command information sent when sheets are ejected to the sheet-like medium post-treatment apparatus 51.

In the paper quality checking, the number of sheets is compared with the returning roller stop time set value "T7" in the case of thick paper, with "T8" in the case of thin paper, and with "T9" in other cases (plain paper). Traveling to the first stop position is started after the lapse of the set time.

In the aforementioned description, paper quality is checked according to whether paper is thick or thin. It can also be checked according to whether paper is based on the Japanese paper format (A4, B5, etc.) or overseas paper format (letter (LT), depending on the size of sheets.

As described above, the time for the returning roller 121 staying at the second stop position is changed in conformity to the quality of paper. This makes it possible to carry out the returning roller control in conformity to the changes in the friction of paper and weight of paper due to the difference in paper quality. This ensures a reliable longitudinal alignment of sheets.

Example 3

Figure 46:
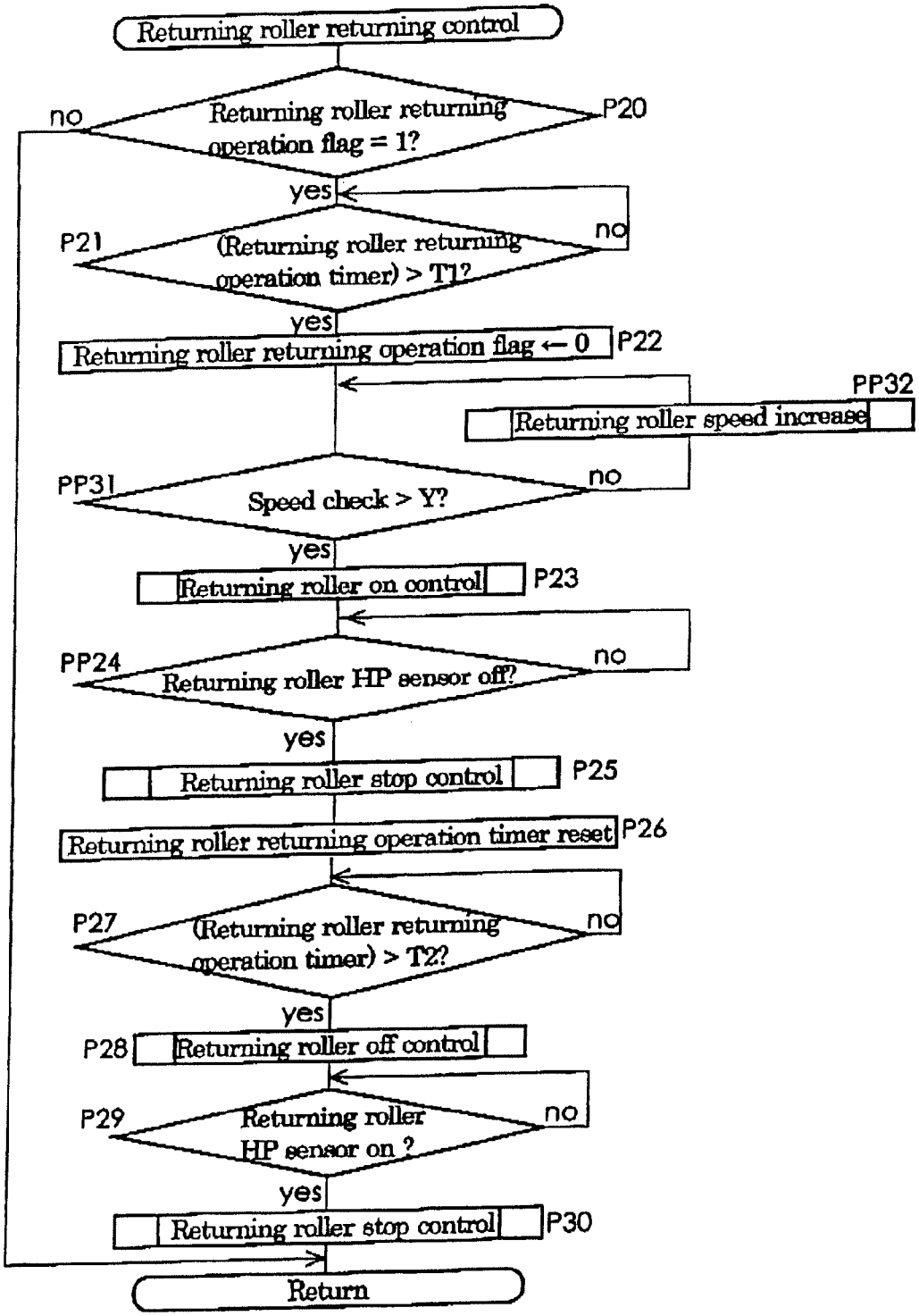
FIG. 46 is a flow chart illustrating the control procedures.

The flow chart given in FIG. 46 according to the present Example corresponds to the one where steps PP31 and PP32 are added between the steps P22 and P23 in the flow chart of FIG. 41. Other steps are the same as those is FIG. 41. So the same steps are assigned with the same numerals of reference. Only the differences from FIG. 41 will be described below:

As shown in FIG. 46, in step P21, the traveling speed of the returning roller 121 is checked before the returning roller 121 is moved from the first stop position to the second stop position after the lapse of the set value T1. Namely, check is made in step PP31 to see if Z>Y, where Y denotes the speed of the returning roller 121 traveling from the first position to the second position, and Z the peripheral speed of the roller resulting from rotation of returning roller.

For Y, the traveling speed of the returning roller 121 can be changed according to the rotation speed of the stepping motor 126. For Z, the peripheral speed of the returning roller 121 can be changed according to stepping motor 132 in the configuration shown in FIG. 15(*a*), and according to the rotation speed of the stepping motor 556 in the configuration shown in FIG. 15(*b*).

Thus, if Z>Y cannot be met in step PP31, control is made to increase the speed of the returning roller 121 in step P32. When Z>Y has been met in step PP31 in the final phase, control proceeds to the next step P23.

Here since the peripheral speed Z affects the sheet alignment speed, it is important to set a value which does not reduce the treatment capacity of the image forming apparatus.

In this Example, the traveling speed of the returning roller 121 from the first stop position to the second stop position is made slower than the peripheral speed of the roller by rotation of the returning roller 121. This ensures that the returning roller 121 is always kept in contact with the loaded paper when it travels from the first stop position to the second stop position. Even when there is an addition of force to push out the loaded paper in the direction of ejection, the returning force by returning roller 121 is greater than that force, so the loaded paper is prevented from being pushed out in the direction of ejection "a", with the result that reliable sheet alignment is be provided.

Example 4

Figure 47:
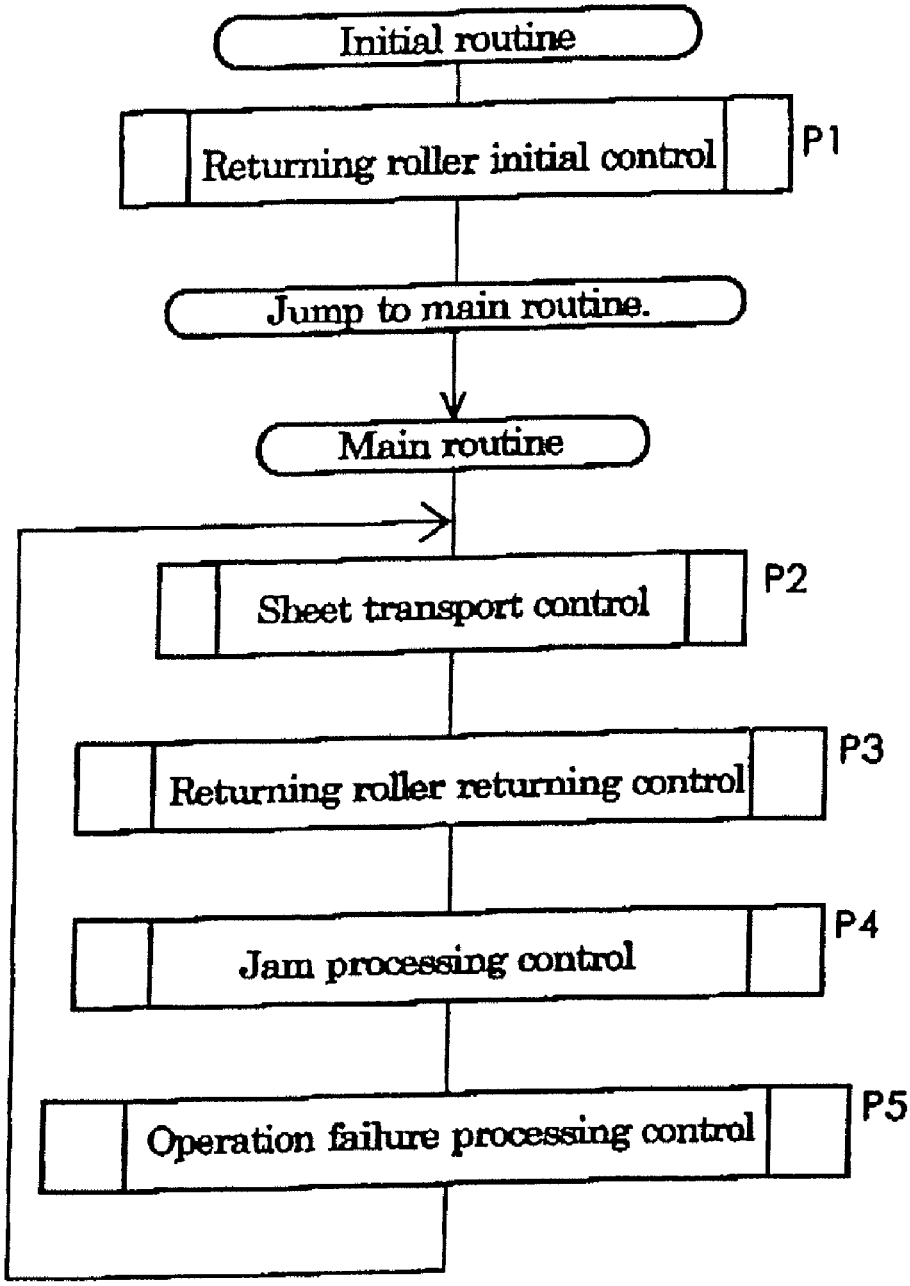
FIG. 47 is a flow chart illustrating the control procedures.

In this Example, FIG. 47 indicates the initial operation to be performed immediately after the power of sheet-like medium post-treatment apparatus 51 has been turned on, and the main route which is always passed through upon termination of initial operation. Basic configuration is the same as that of the aforementioned FIG. 39, the difference being that sub-routines of step P4 of "jam treatment control" and step P5 of "operation failure control" are added after step P3.

(a) Procedure Taken Against Jamming

Figure 48:
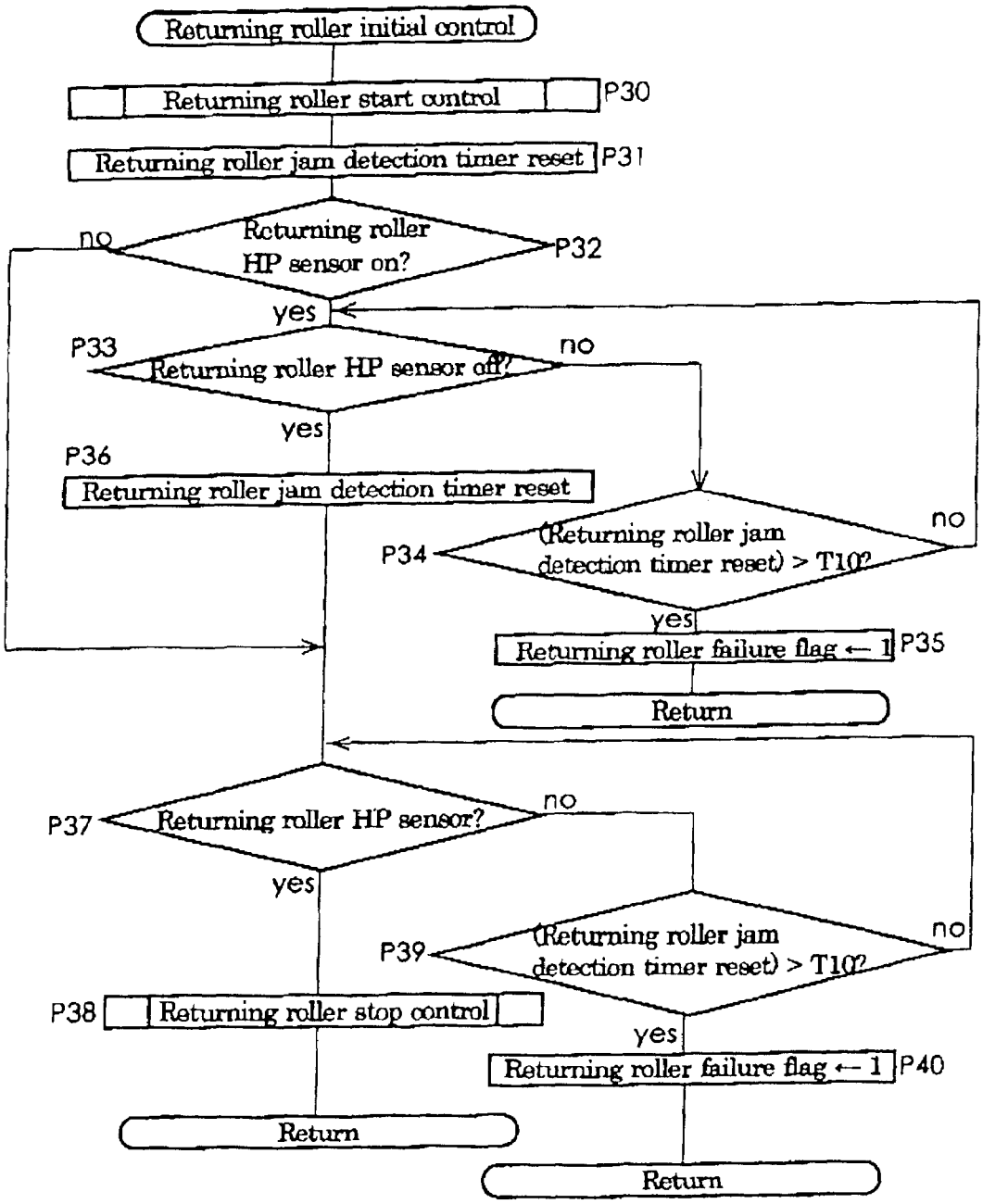
FIG. 48 is a flow chart illustrating the control procedures.

When returning roller initial control routine (sub-routine called out from the initial routine) shown in FIG. 48 is called out by the initial routine in FIG. 47, the following treatment will be carried out:

In the returning roller initial control of FIG. 48, rotation of the returning roller 121 is started and the "returning roller jam detecting timer" is reset in step P31, independently of the position of the returning roller 121 in step P30. Then the sensor 127 for detecting the first stop position of the returning roller is checked in step P32, and the following control is effected in conformity to the output from this sensor:

In this Example, the first stop position of the returning roller 121, for example, the home position (HP) is set at the moment when the output from the sensor 127 changes from Off to On state. If the sensor 127 is On in the initial state, the Off state is confirmed first, then operation is stopped the moment it is changed to On state. If the sensor in the initial state is off, the operation is stopped the moment it is changed to On state. That position is assumed as the first stop position.

1. When the sensor 127 is On in Step P32 of "returning roller HP sensor on?" checking:

In this case, the returning roller 121 remains as it is stopped at the first stop position. If this sensor is On when checked in step P33 of "returning roller HP sensor off?" checking, "returning roller jam detecting timer" in step P34 is compared with the set value T10. If this timer is smaller than "T10", step P33 of "returning roller HP sensor off?" checking is repeated.

The time normally required for the sensor output to change from On to Off state plus value $\alpha$ is set as the set value "T10". If the sensor output is not changed by a failure in the returning roller drive motor and HP sensor, such a failure is detected by this timer which has exceeded the set value "T10".

Figure 49:
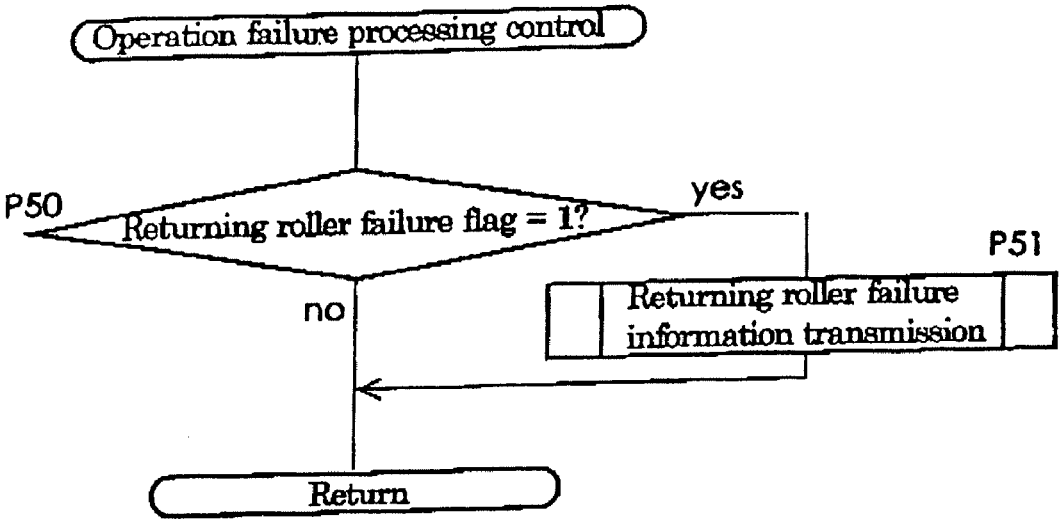
FIG. 49 is a flow chart illustrating the control procedures.

When a failure has been detected, "1" is set to "returning roller failure flag" in step P35. If the returning roller failure flag is "1" in step P50 in the sub-routine of operation failure treatment control of FIG. 49, then returning roller failure information is sent to the image forming apparatus in step P51.

If the sensor has detected the Off state in step P33 of "returning roller HP sensor off?" checking shown in FIG. 48, "returning roller jam detecting timer" in step P36 is reset, and the control proceeds to the "returning roller HP sensor on?" checking in the next step P37.

While the same control as the aforementioned failure detection control is effected in this check, the On state of the sensor is checked. If the On state is found out, the returning roller drive is stopped in step P38. This position is assumed as the first stop position (home position) of the returning roller 121.

2. When the sensor 127 is Off in step P37 of "returning roller HP sensor Off?" checking:

In this case, the returning roller 121 is not yet returned to the first stop position. Treatment is performed by "returning roller HP sensor Off?" checking in the step P32. The same treatment as that in the aforementioned steps P34 and P35 is performed in steps P39 and P40, thereby determining the home position of the returning roller.

Figure 51:
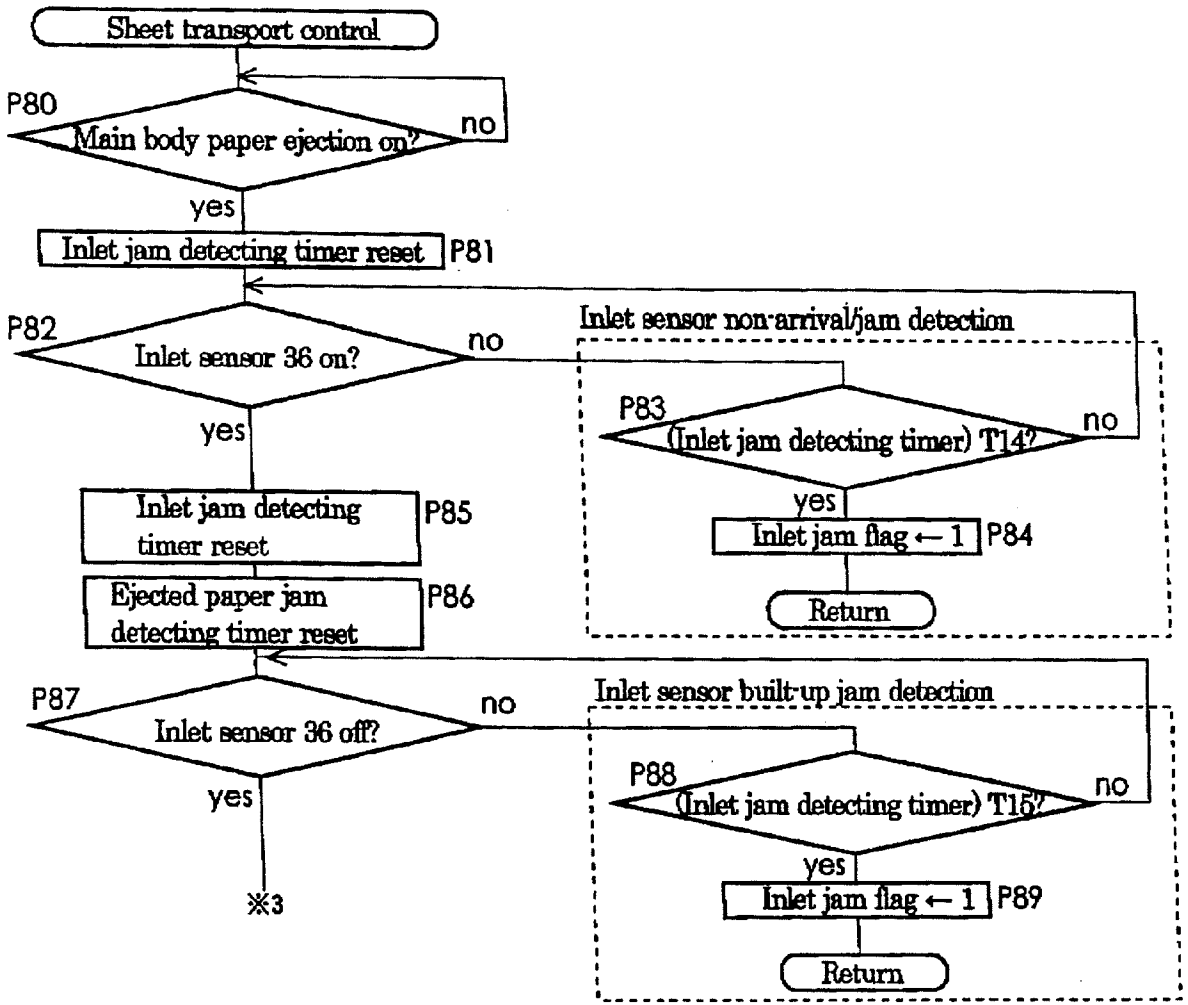
FIG. 51 is a flow chart illustrating the control procedures.
Figure 52:
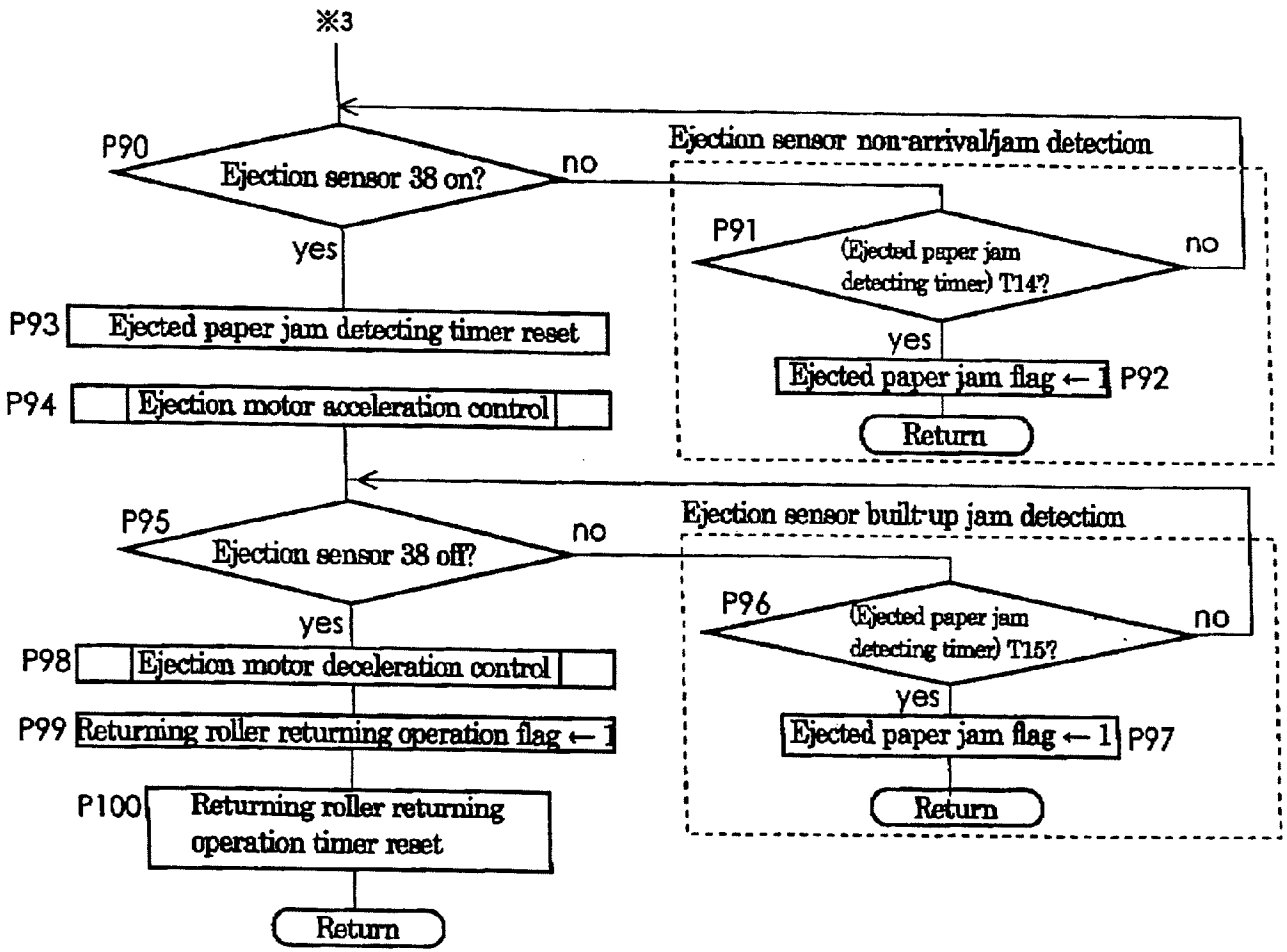
FIG. 52 is a flow chart illustrating the control procedures.

The following describes the returning operation by the returning roller 121: In sheet transport control shown in FIGS. 51 and 52. "Ejection sensor off" in step P95 of FIG. 52 is used as a trigger to set "1" to "returning roller returning operation flag in step P99. Then in returning roller returning control shown in FIG. 50, the following control is performed:

Since "returning roller returning operation flag=1" from the above description, control proceeds from step P60 to step P61, and the value of "returning roller returning operation timer" is compared with "T11" in step P61. If it is greater than "T11", control proceeds to the next one. After the "returning roller returning operation flag" is reset to "0" in step P62, the returning roller is operated.

Time required for the sheet completely falling on the tray 12 after its trailing edge has passed through the ejection sensor 38 is set as the value of timer set value "T11". The returning roller 121 is operated after the sheet has completely fallen on the tray 12. The aforementioned set time must be set with consideration given to the distance from the ejection sensor 38 to the nip of the ejection roller 3, linear transport speed, and time for free fall on the tray 12 subsequent to passing through ejection roller. Timing is counted through timer counting by the CPU700 and clock counting of the stepping motor 132 as an ejecting motor.

In the next step P64 of "returning roller On control", the stepping motor 126 as a returning roller drive motor is operated, and the returning roller 121 is fed to the second stop position indicated by a two-dot chain line in FIGS. 36 and 14.

After the returning roller jam detecting timer is reset in step P64, "returning roller HP sensor off?" (the second stop position traveling ended?)" checking is started in step P65. A check is made to see that the sensor 127 for detecting the home position of the returning roller is off. In step P68, the returning roller is stopped at the returning position. In this case, the second stop position is the position of the returning roller 121 where the sensor 127 changes from On to Off state.

Here while "On" is detected in step P65 of "returning roller HP sensor off?" checking, comparison is made between the "returning roller jam detecting timer" value and set value "T12" in step P66 as in the initial case. If the value set on the timer is less than "T12", step P65 of "returning roller HP sensor off?" is repeated. If the timer value exceeds the set value "T2" and an error is detected, "1" is set to "returning roller failure flag" in step P67. Returning roller failure information is sent to the image forming apparatus in conformity to "operation failure treatment control" in FIG. 49.

Figure 50:
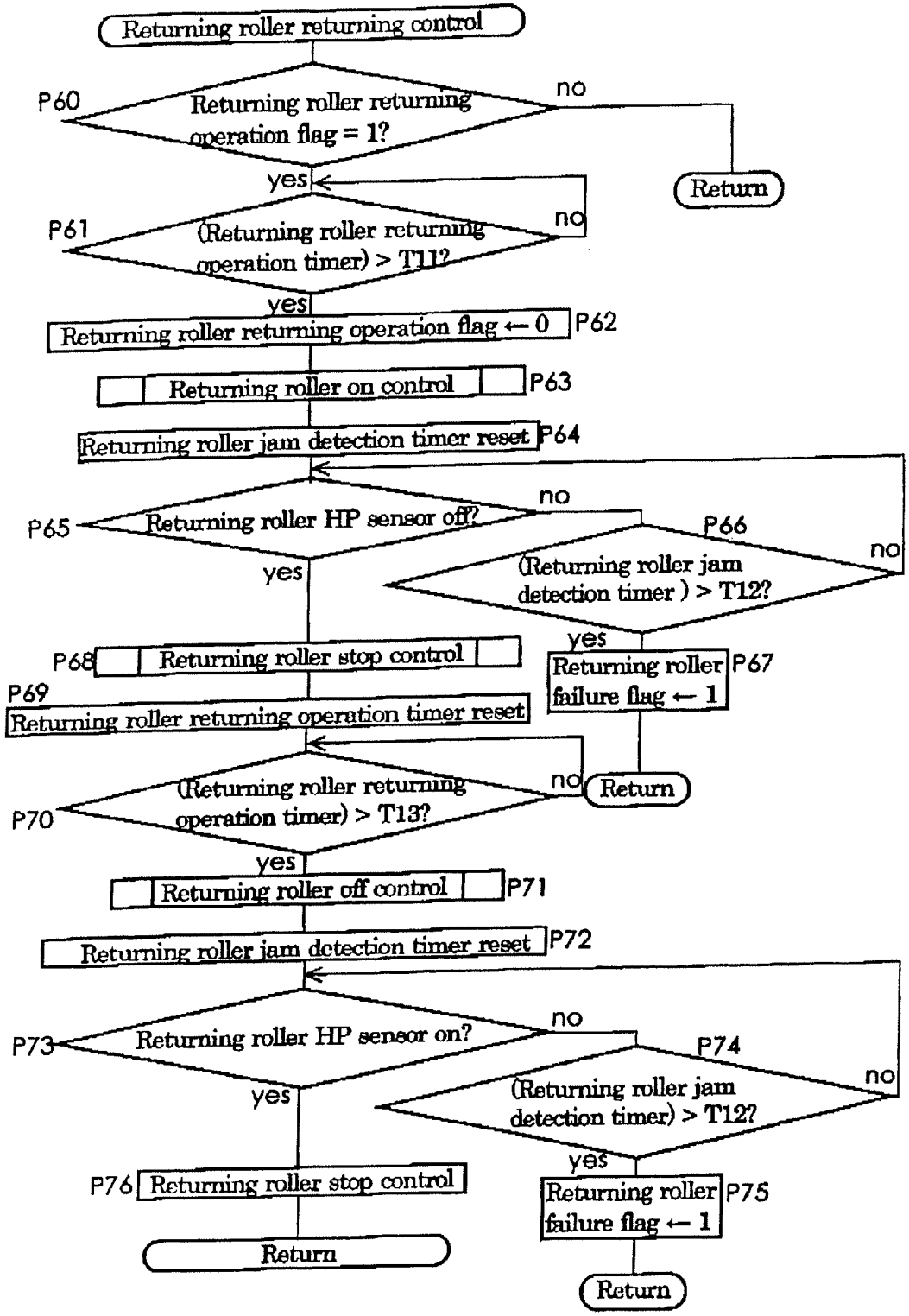
FIG. 50 is a flow chart illustrating the control procedures.

In FIG. 50, "returning roller returning operation timer" is reset in step P69 after completion of returning operation in step P68, and "returning roller returning operation timer" is reset in step P69. In step P70, "returning roller returning operation timer" value is compared with the set value "T13". The returning roller is stopped by the second stop position (returning position) for a specified time. The value of set value T13 is determined by the peripheral linear speed of the returning roller 121 and sheet returning distance.

After the lapse of time T13 as the set time, control goes to step P71 of "returning roller off control". In "returning roller off control", the stepping motor 126 for moving the returning roller 121 is driven, and the returning roller 121 is moved from the second fixed position to the first stop position. In this control, the aforementioned returning roller failure detection control is also performed.

For this purpose, "returning roller jam detecting timer" is reset in step P72. After that, if the sensor 127 fails to ascertain that the returning roller 121 has traveled to the first stop position in step P73 of "returning roller HP sensor on?" checking, then the same steps P74 and P75 as the aforementioned steps P66 and P67 are taken. If the sensor 127 has succeeded in ascertaining that the returning roller 121 has traveled to the first stop position in step P73, the stepping motor 126 for returning roller drive is stopped in step P76 of "returning roller stop control". Upon completion of the aforementioned steps, longitudinal aligning operation for one sheet is now complete.

The following describes the control method for returning the returning roller 121 to the first stop position when a jam has occurred in the sheet transport route upstream from the ejection roller 3:

Upon termination of returning roller initial control shown in FIG. 48, control goes to the main routine as shown in FIG. 47, and treatment such as "sheet transport control" in step P2 is carried out. The details of this sheet transport control are as shown in FIG. 51. Treatment carried out includes detection of jamming of passing paper or setting of a flag for each control by using the sensor output as a trigger.

In FIG. 51, "main body paper ejection on?" checking is performed in step P80. "Main body paper ejection on?" is a signal sent from image sheeting apparatus 50 when the leading edge of the sheet has arrived at the ejection roller 525 of the image forming apparatus 50 (FIG. 17). After confirmation of the receipt of this signal, the sheet-like medium post-treatment apparatus 51 waits for the sheets received in step P81 (inlet jam detecting timer is reset in this routine).

Then "inlet sensor 36 on?" checking is performed in step P82. If it is on, the control goes to step P87 of "inlet sensor off?" checking. If it is off, the control proceeds to the step P83 to per sheet inlet sensor non-arrival/jam detection. In the inlet non-arrival/jam detection, the value of "inlet jam detecting timer" is compared with the set value "14" in step 83. The set value "T14" is determined by the distance from the ejection roller of the image forming apparatus 50 to the inlet sensor 36 of the sheet-like medium post-treatment apparatus 51, and linear transport speed of the sheet. When the timer has exceeded the set value "T14", the inlet sensor non-arrival/jam is assumed to have occurred. After "1" is set to "inlet jam flag" in step P84, the control quit this routine in return.

If inlet sensor 36 has been found to be "on" in step P82, "inlet jam detecting timer reset" is performed in step P85, and "ejected paper jam detecting timer reset" in step P86. In step P87, "inlet sensor off?" is checked. "Inlet jam detecting timer resetting" in the previous step P85 is carried out in order to detect the build-up jam in the inlet sensor 36. "Ejected paper jam detecting timer resetting" in step P86 is intended to detect ejection sensor non-arrival/jam.

If "off" state is detected in step P87 of "inlet sensor off?" checking, the sheet passes through the inlet sensor 36 successfully. The control proceeds to the next step P90 of "ejection sensor On?" checking in FIG. 52.

On the other hand, while the "on" state is detected in step P87, control proceeds to step P88 in order to detect the inlet built-up jam, and comparison is made between "inlet jam detecting timer" value and set value T15. The set value T15 is determined by the sheet size and linear transport speed. When the timer has exceeded the set value T15, the inlet sensor built-up jam is considered to have occurred, and "1" is set to "inlet jam flag" in step P89. Control quits this routine in return.

In the ejection sensor 38 located further on the downstream side in the direction of transport than the inlet sensor 36, ejection sensor non-arrival/jam detection is performed in steps 90 to 92, and ejection sensor built-up jam detection is performed in steps P95 to P100. If ejected paper jam is detected in each jam detection, the control quits this routine after "1" is set to the "ejected paper jam flag". The set value of the ejected paper jam detecting timer is 14' in step P91, and the set value of the ejected paper jam detecting timer is T15' in step P96. If jam is not detected in steps P90, P95, etc., normal treatment is performed. Sheets are ejected to the tray 12.

As can been seen, jam is detected by sheet transport control. When "1" is set to the inlet jam flag and ejected paper jam flag, treatment control after jamming is carried out.

Figure 53:
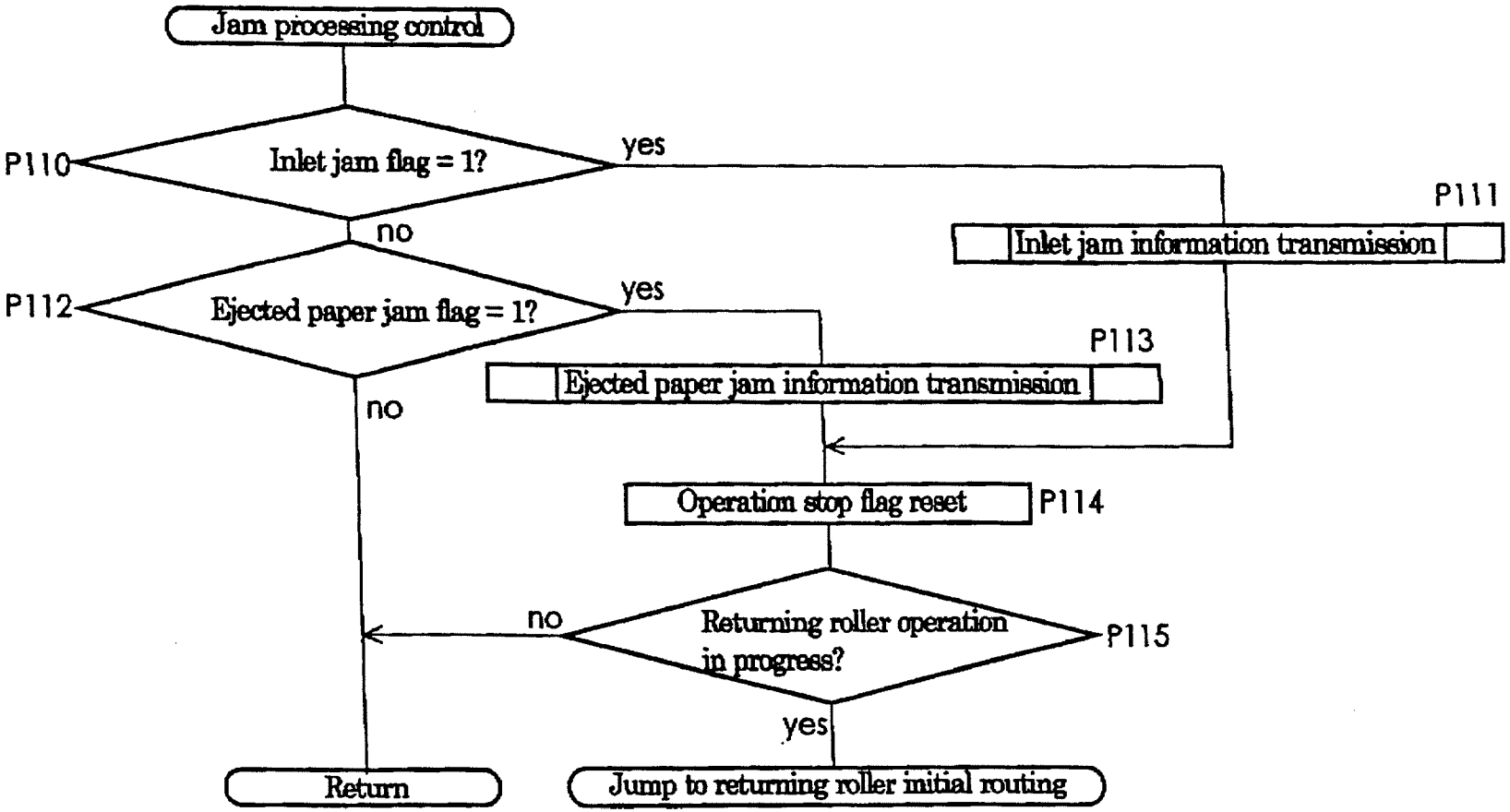
FIG. 53 is a flow chart illustrating the control procedures.

In FIG. 53, each of the inlet jam flag and ejected paper jam flag is checked in steps P110 and P112. If "1" is set to the flag, each jam information is sent to the image forming apparatus (steps P111 and P113). At the same time, all operations are stopped in step P114. Further, each flag is reset.

Then "returning roller operation in progress?" checking is performed in step P115. When the returning roller 121 is in the process of operation, control jumps to "returning roller initial routine", and proceeds to returning roller initial control shown in 48. Similarly to the case when power is turned on, returning roller initial operation is performed, and the returning roller is fed to the home position.

If jam occurs in this control, the returning roller 121 travels to the first stop position, namely, home position, thereby eliminating the possibility of damaging the returning roller during jam treatment by a user.

(b) Procedures Taken Against Failure of Returning Means

Figure 54:
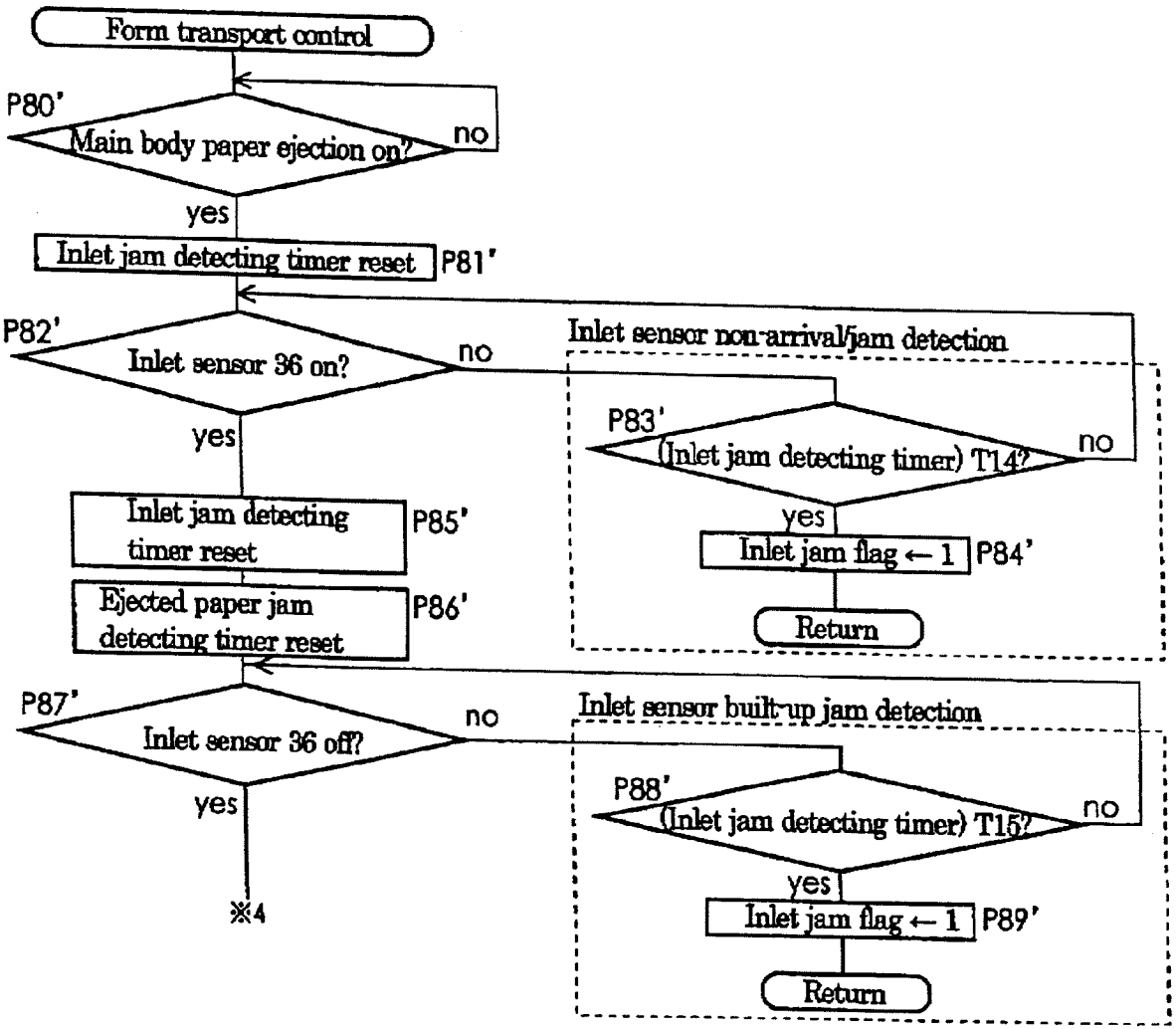
FIG. 54 is a flow chart illustrating the control procedures.
Figure 55:
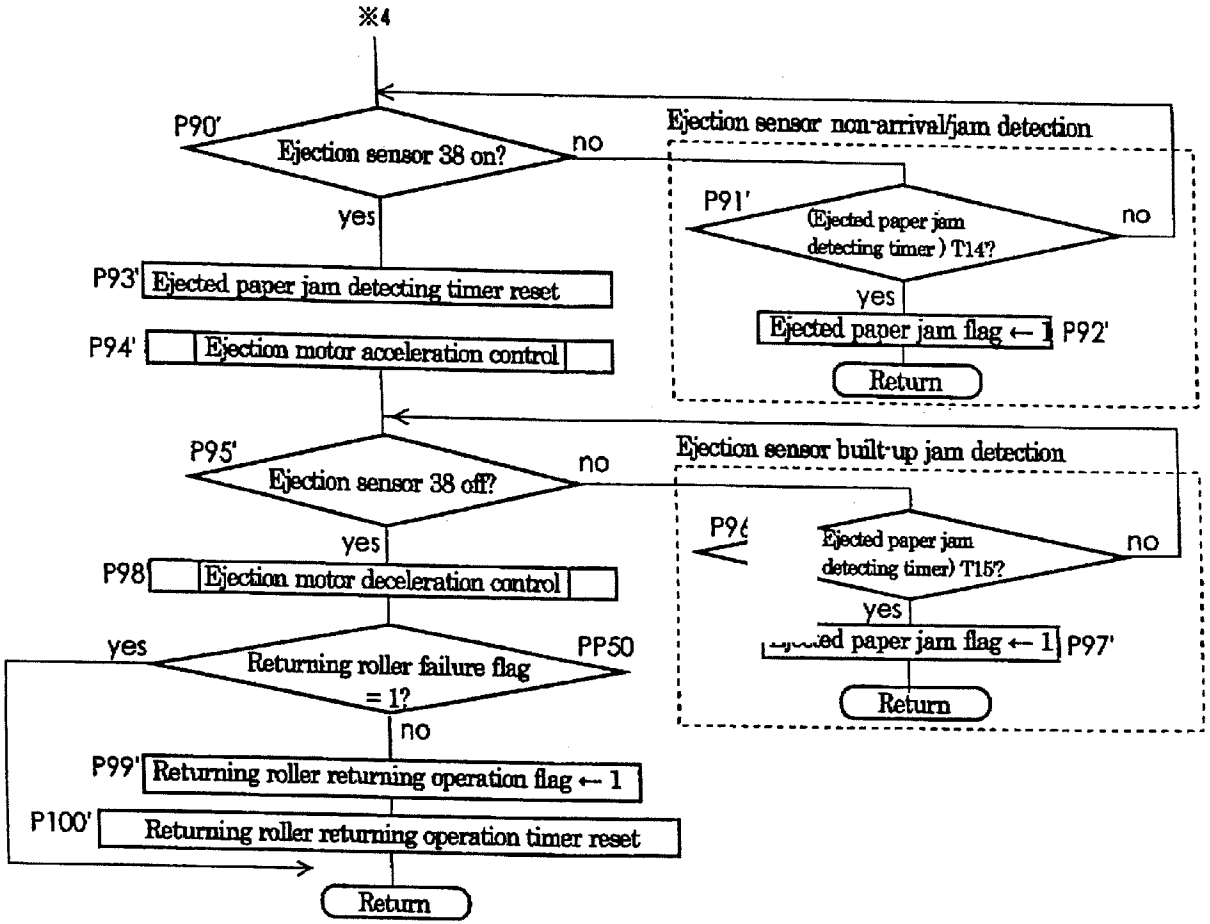
FIG. 55 is a flow chart illustrating the control procedures.

As described above, if an error of the returning roller is detected and "1" is set to the "returning roller failure flag" in returning roller initial control in FIG. 48 and returning roller returning control in FIG. 50, then control is made in such a way that the returning operation of the returning roller is not performed in sheet transport control given in FIGS. 54 and 55.

In FIGS. 54 and 55, treatment such as jam detection during sheet transport is carried out, similarly to the case of FIGS. 51 and 52 in the Example of the aforementioned "a". Since the similar step is taken, the steps are assigned with the same numerals of reference to indicate correspondence.

The only difference in the flow chart in FIGS. 54 and 55 from the flow charts of FIGS. 51 and 52 is that step PP50 is present between step P98' and step P99'.

In FIG. 55, the "returning roller failure flag=1?" checking is carried out in step PP50 after ejection sensor off detection in step P95'. Normally, this flag is reset to "0". Returning operation is performed in FIG. 50 by "returning roller returning flag 1" of the step P99 and "returning roller returning operation timer reset" in the step P100' in subsequent treatment. However, when an error of returning roller is detected, and "1" is set to the returning roller failure flag in step PP50, treatment in step P99' and step P100' is not performed in this routine. Therefore, the operation of the returning roller is not performed because control proceeds from step P60 of FIG. 50 to return.

If failure of the returning roller 121 to move to a specified position within a specified time or a similar error has been detected in this control, longitudinal end of the sheet by the returning roller cannot be performed, sheet ejection operation can be performed without stopping the system.

Example 5

In control by the control means in the second embodiment, the drive speed of the returning roller is controlled in such a way that the drive speed at the first stop position is slower than the drive speed (reference speed) at the second stop position.

The peripheral speed of the returning roller 121 is set to speed Va, so that the returning roller 121 can return the sheet to the end fence 131 at the second stop position. However, in case the trailing end of the sheet is brought into contact with the returning roller upon ejection of the sheet when in the stop state at the first stop position, there is a danger that the sheet trailing end may be flipped and pushed out to a position where the sheet cannot be captured by the returning roller 121 which has travailed to the second position because the drive speed corresponding to the speed Va is comparatively high speed.

In this example, the drive speed of the returning roller 121 at the first stop position is set to a slower speed than the drive speed at the second stop position, thereby preventing the trailing edge of the ejected sheet from being flipped and pushed out in the direction of ejection. Moreover, at this speed, even if the returning roller 121 is brought into contact with the sheet at the first stop position, the returning roller is brought into contact with the trailing end of the sheet and trailing end can be scraped off onto the tray. Thus, the trailing end of the sheet is not flown toward the direction of ejection "a" and the returning roller can capture the sheet at the second stop position, thereby assuring the longitudinal aligning.

In the aforementioned, the drive speed of the returning roller at the second stop position is set to such a speed that even if the trailing end of the sheet is brought into contact with the returning roller, the sheet is not pushed out in the direction of ejection.

When the sheet is ejected onto the tray, if the trailing end of the sheet is brought into contact with the returning roller 121 in the wait state at the first stop position, the sheet can be scraped off onto the tray 12.

However, when the drive speed of the returning roller 121 becomes faster than a predetermined speed, there is a danger that the trailing end of the sheet is flipped by the returning roller and pushed out in the direction of ejection "a" without scraping down the sheet. The drive speed of the returning roller 121 is set according to the material of the returning roller.

On the other hand, while the rotation of the returning roller 121 is in the stop state, the sheet being ejected is brought into contact with the returning roller 121 and friction stops the trailing end of the sheet. That is, the returning roller 121 prevents ejection of the sheet. For this, rotation of the returning roller 121 at the first stop position is required and the drive speed is the point in question. When the drive speed is set as in this example, the sheet can properly ejected onto the tray 12.

Furthermore, in the above example, the drive speed of the returning roller at the first stop position is controlled to be constant.

As is shown in FIG. 17, the sheet post-treatment apparatus 51 connected to the image forming apparatus 50 can be used in combination with various types of image forming apparatuses. The sheet transport speed in the sheet post-treatment apparatus is also changed according to the printing speed of the image forming apparatus used. However, in the present example, the drive speed of the returning roller 121 is controlled to be constant independently of the image forming apparatus connected.

Thus, even when connection is made to a plurality of image forming apparatuses having different transport speed values, the drive speed of the returning roller 121 is constant. Accordingly, the trailing end of the sheet being ejected is not flipped or pushed out in the direction of ejection, and it is possible to scrape off the sheet, thereby assuring the longitudinal aligning of the sheet.

Embodiment 7

As has been described above, in the sheet post-treatment apparatus and the image forming apparatus, sheets ejected from the ejecting means should be accurately sorted when stacked because sheet bundles after sorting and stacking may be punched in the subsequent step.

The sheet-like medium alignment apparatus according to the present invention may be constituted as a stand-alone type or may be used integrally or in combination, for example, with an image forming apparatus having no aligning function or sorting function or with a sheet post-treatment apparatus having no aligning function or sorting function, so that sheets are aligned on the tray by the aligning function and sorted by the sorting function.

Hereinafter, explanation will be given, through a sheet post-treatment apparatus having a sheet-like medium alignment apparatus, on mechanical configuration of ejecting means for ejecting sheets, a tray as loading means for loading sheets ejected by the ejecting means, sorting means, and returning means. Furthermore, explanation will be given on variable control of the sheet ejection speed through a flowchart. Lastly, explanation will be given on the image forming apparatus.

[1] Sheet Post-treatment Apparatus

Firstly, the sheet post-treatment apparatus has configuration which has been already explained with reference to FIG. 17 and its detailed explanation is omitted here.

[2] Aligning Means a. Entire Configuration

The upper portions of the aligning members 102*a* and 102*b* are supported in the frame 90 shown in FIG. 17. The frame 90 includes traveling means for traveling the aligning member, retracting means for retrieving the aligning member, and a drive device for the aligning member as means for causing aligning operation of the aligning members 102*a* and 102*b* and other operation for the aligning operation to be performed for the aligning operation. Control means for operating the aligning members 102*a* and 102*b* share control means of the sheet post-treatment apparatus 51 shown in FIG. 17 and are connected to the frame 90 via an input/output line (not illustrated). The aligning members 102*a* and 102*b* perform sheet aligning operation and other operation required for the sheet aligning operation.

A mechanical portion for driving the aligning members 102*a* and 102*b* are contained in the box-shaped frame 90 to constitute an integral block. In FIG. 17, the frame 90 is screwed to the main body of the sheet post-treatment apparatus 51 or detachably attached by concavo-convex attaching/detaching means, so that a user not requiring the aligning function of the aligning members can easily remove the means.

b. Aligning Member

As shown in FIG. 18 A and FIGS. 57 to 60, each of aligning members 102*a* and 102*b* is formed as a sheet-shaped body. Aligning portions 102*a*1 and 102*b*1 are located at the lowermost position of the aligning members 102*a* and 102*b* and have faces opposing to each other which are orthogonal to the aforementioned shift direction "d".

Thus, the aligning portions 102*a*1 and 102*b*1 are constituted by flat surfaces having opposing surfaces orthogonal to the shift direction "d" and accordingly, by moving the aligning members 102 and 103 in the shift direction "d", it is possible to accurately align sheets S loaded on the tray 12 by contacting the aligning portions 102*a*1 and 102*b*1 to the sides of the sheets S. Moreover, because of the sheet-shaped body, it is possible to obtain a compact configuration.

Figure 57:
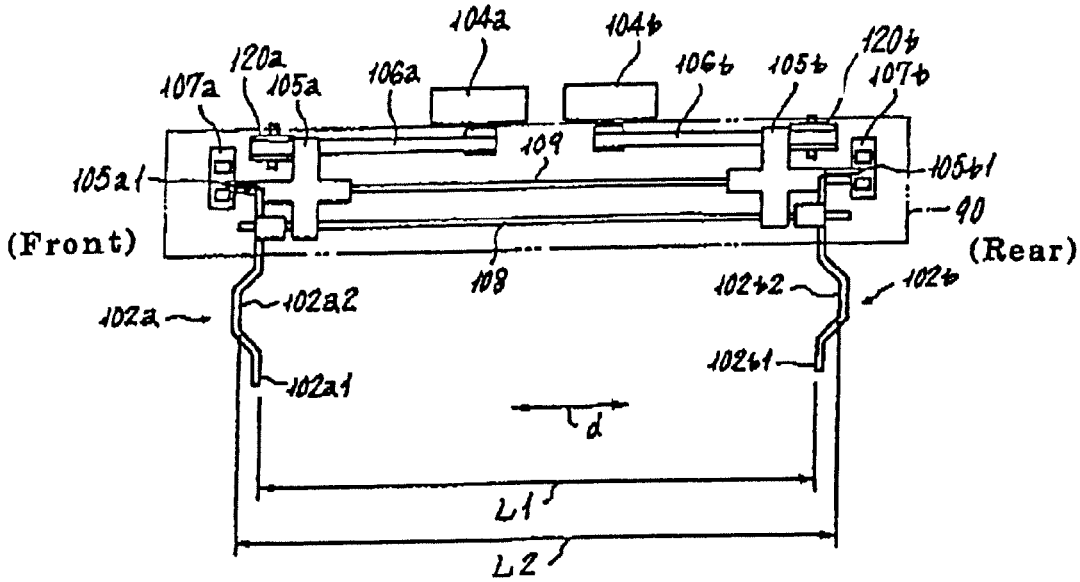
FIG. 57 is a schematic front view representing the aligning member and aligning member traveling means as viewed from the ejection roller.

In FIG. 57, the aligning members 102*a* and 102*b* are configured as follows. That is, in order to facilitate the sheet S ejected from the ejection roller 3 shown in FIGS. 17 and 18, to be introduced into the space between the aligning members 102*a* and 102*b*, the aligning members 102*a*1 and 102*b*2 constitute escape portions 102*a* and 102*b* formed at a distance L2 greater than the distance L1 between the aligning portions 102*a*1 and 102*b*1.

When a sheet S is ejected onto the tray 12, the aligning members 102*a* and 102*b* travel to a wait position or acceptance position. That is, the aligning members 102*a* and 102*b* are at a predetermined distance from each other greater than the width of the sheet, so as to wait for ejection of the sheet S from the ejection roller 3. This predetermined distance is, for example in FIG. 58, greater than the width of the sheet S by 7 mm at one side. The aligning members 102*a* and 102*b* are waiting at the acceptance position to define the minimum distance enabling to accept sheets which are ejected to positions varying in the shift direction "d". When sheets are ejected and loaded on the tray 12, the aligning members 102*a* and 102*b* travel from the acceptance position to the position shown in FIG. 59 so as to align the sheet. This acceptance position is reduces the time required for aligning as compared to a case when the aligning members 102*a* and 102*b* return to a home position (at a greater distance) at each aligning operation.

Figure 58:
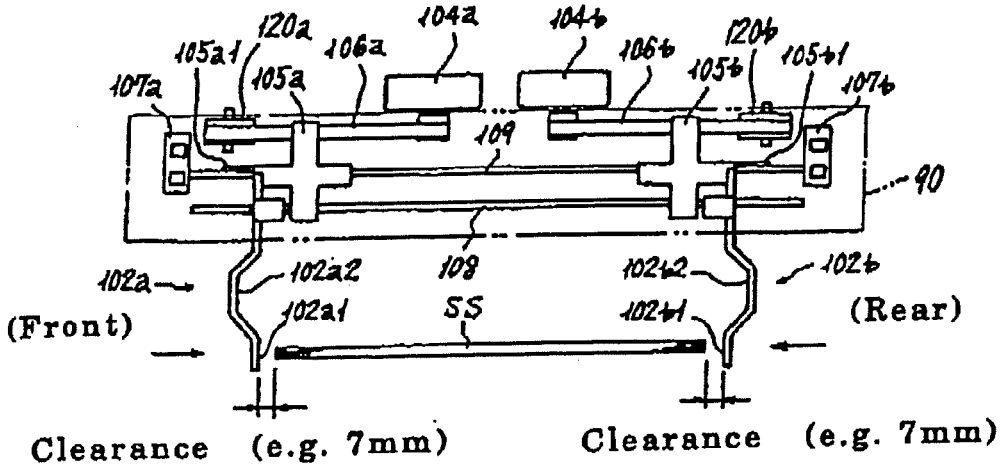
FIG. 58 is a schematic front view representing the aligning member and aligning member traveling means as viewed from the ejection roller.

When a sheet S is ejected from the ejection roller 3 and has dropped onto the tray 12 to a complete stop, i.e., when a predetermined for this process has passed, the aligning members 102*a* and 102*b* are both moved to approach each other as shown by arrows in FIG. 58 (case 1) or one of the aligning members 102*a* and 102*b* remains unmoved while the other alone is moved in the arrow direction in FIG. 58 (case 2), so that the aligning members 102*a*1 and 102*b*1 are set to the aligning position to define a distance slightly smaller than the sheet width.

At this aligning position, the aligning portions 102*a*1 and 102*b*1 are brought into contact with the ends of the sheet bundle to press the bundle by, for example, 1 mm at each side. This pressing aligns the ends of the sheet bundle SS. After this, the aligning members 102*a* and 102*b* return to the acceptance position shown in FIG. 58 to wait for ejection and loading of the following sheet S.

It should be noted that the case 1 in which both of the aligning members 102 and 102*b* are moved to approach each other will be referred to as a both-side shift mode, whereas the case 2 in which one of the aligning members is unmoved while the other alone is moved in the arrow direction for aligning will be referred to as a one-side shift mode. These methods will be detailed in a paragraph explaining "aligning operation".

Figure 59:
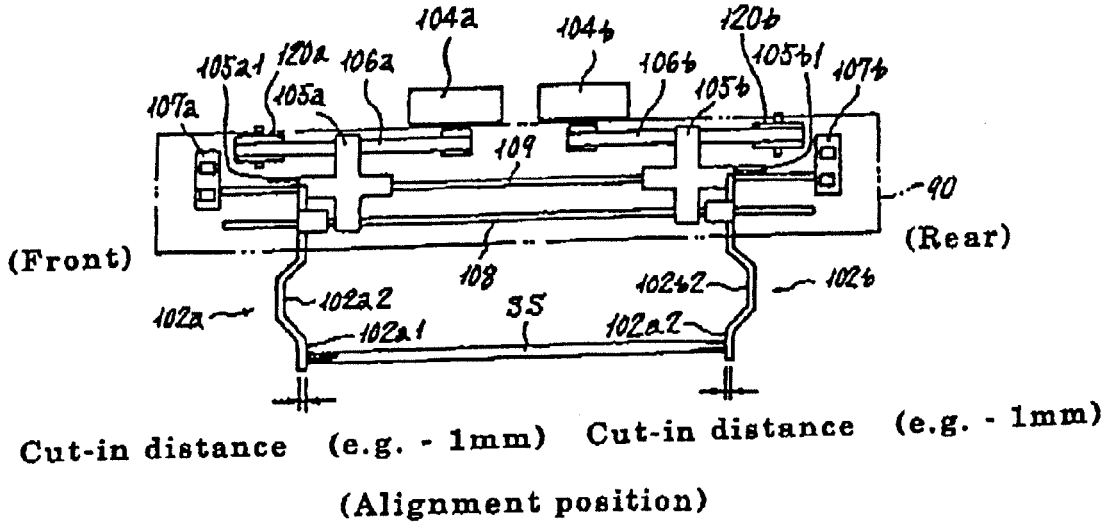
FIG. 59 is a schematic front view representing the aligning member and aligning member traveling means as viewed from the ejection roller.

In one job, the aligning members 102*a* and 102*b* travel between the acceptance position shown in FIG. 58 and the aligning position shown in FIG. 59 until all the sheets constituting one unit are ejected.

The positions in the shift-direction "d" of the sheets S ejected from the ejection roller 3 when the aligning members 102*a* and 102*b* are at the acceptance position shown in FIG. 58 are slightly varied due to skew. As the acceptance position of the aligning portions 102*a*1 and 102*b*1 increases its opposing distance, the sheets can be accepted easily. However, if the opposing distance is too large, the aligning members 102*a* and 102*b* require a long time to travel to the necessary position, disabling high-speed sheet ejection.

Accordingly, the opposing distance between the aligning members 102*a*1 and 102*b* is reduced to a value as small as possible to reduce the distance of the acceptance position of the aligning members 102 and 102*b* and the opposing distance of the upper portions of the aligning portions 102*a*1 and 102*b*1 is increased so as to enable the sheets S to be accepted.

In the shift mode, whether in one-side or both-side shift mode, if there is a deviation of by a predetermined amount on the unit in the previous job already aligned, and the shift of A4-sized sheet is about 20 mm at the time of loading and alignment of the unit for the current job, then, of the aligning members 102*a* and 103*b*, those located on the downstream side in the direction of shift immediately before the current job in the current job is positioned opposed to, and is contact with the top surface of the sheet bundle of the unit in the previous job.

In the one-side shift mode, the aligning member in contact with the upper surface of the sheet bundle of the unit of the preceding job is kept unmoved and the aligning member of the other side can be moved for aligning. However, in the both-side shift mode, both of the aligning members 102*a* and 102*b* move and accordingly the aligning operation is performed while in contact with the upper surface of the sheet.

Moreover, in either of the one-side shift mode and the both-side shift mode, if the aligning members 102*a* and 102*b* remain at the acceptance position shown in FIG. 58 after completion of a preceding job, the aligning members 102*a* and 102*b* may scrape off the unit of the preceding job which was aligned by the aligning members 102*a* and 102*b* and may put it out of order by deviating in the direction of shift on the tray 12 when the tray 12 is shifted for the current job. To evade this, the aligning members 102*a* and 102*b* are retrieved from the upper surface of the sheet after completion of each job.

The retracting operation may be performed by moving the aligning members 102*a* and 102*b* themselves or by lowering the tray 121. A more specific example will be detailed later in the paragraph of "retracting operation". It is noted that when moving the aligning members 102*a* and 102*b* themselves, rotation may be performed around a single point as a fulcrum. In this method, the bottoms of the aligning members 102*a* and 102*b* slide along the upper surface of the sheet upon retracting operation, which may disturb alignment of the sheets.

Thus, in the both-side shift mode, friction with the upper surface of the sheet is caused upon alignment operation. Moreover, in both of the one-side shift mode and the both-side shift mode, friction with upper surface of the sheet is caused upon the retracting operation. Although there is a difference in the degree of friction depending on the method used, there is a danger that aligned sheets may be disturbed by friction between the bottoms of the aligning members 102*a* and 102*b* and the top of sheets S in varying degrees.

To cope with this, a material of the aligning members 102*a* and 102*b* is selected in such a manner that a friction coefficient between the bottoms of the aligning members 102*a* and 102*b* is smaller than a friction coefficient between the sheets, and the surface roughness is processed so that the surface has a friction coefficient smaller than the friction coefficient between the sheets. Accordingly, there is no danger of disturbing the aligned sheets (sheet bundle) in the aligning operation and the retracting operation.

c. Aligning Member Traveling Means

As has been described above, the aligning members 102*a* and 102*b* move in the shift-direction "d" from the acceptance position in FIG. 58 to the aligning position in FIG. 59 upon aligning operation. Moreover, the aligning members 102*a* and 102*b* can further travel to the home position where the aligning members 102*a* and 10*b* are positioned at a farther distance than at the acceptance position.

To enable this movement in the shift-direction "d", there is provided the aligning member traveling means, which will be detailed below.

When the one-side shift mode is employed,

The aligning member traveling means is designed as follows: When the one-side shift mode is used, one of the aligning members 102*a* and 103 is kept immovable and the other travels at every shift of the tray 12, and the role of these members alternates. When the both-side shift mode is used, both of aligning members 102*a* and 103 are placed closer to each other and are separated from each other by the same distance at every shift of the tray 12.

Accordingly, in the both-side shift mode, it is possible to employ a linkage mechanism for linking one of the aligning members with the other. However, in the one-side shift mode, it is impossible to employ any linkage mechanism. In the linkage mechanism, a drive source for movement is shared by one and the other of the aligning members, thereby enabling the construction to be simplified. Here, explanation will be given on aligning member traveling means capable of moving the aligning members 102*a* and 102*b* independently of each other. Such aligning member traveling means which will be detailed below can also be applied to the movement of the aligning members in the both-side shift mode.

Figure 60:
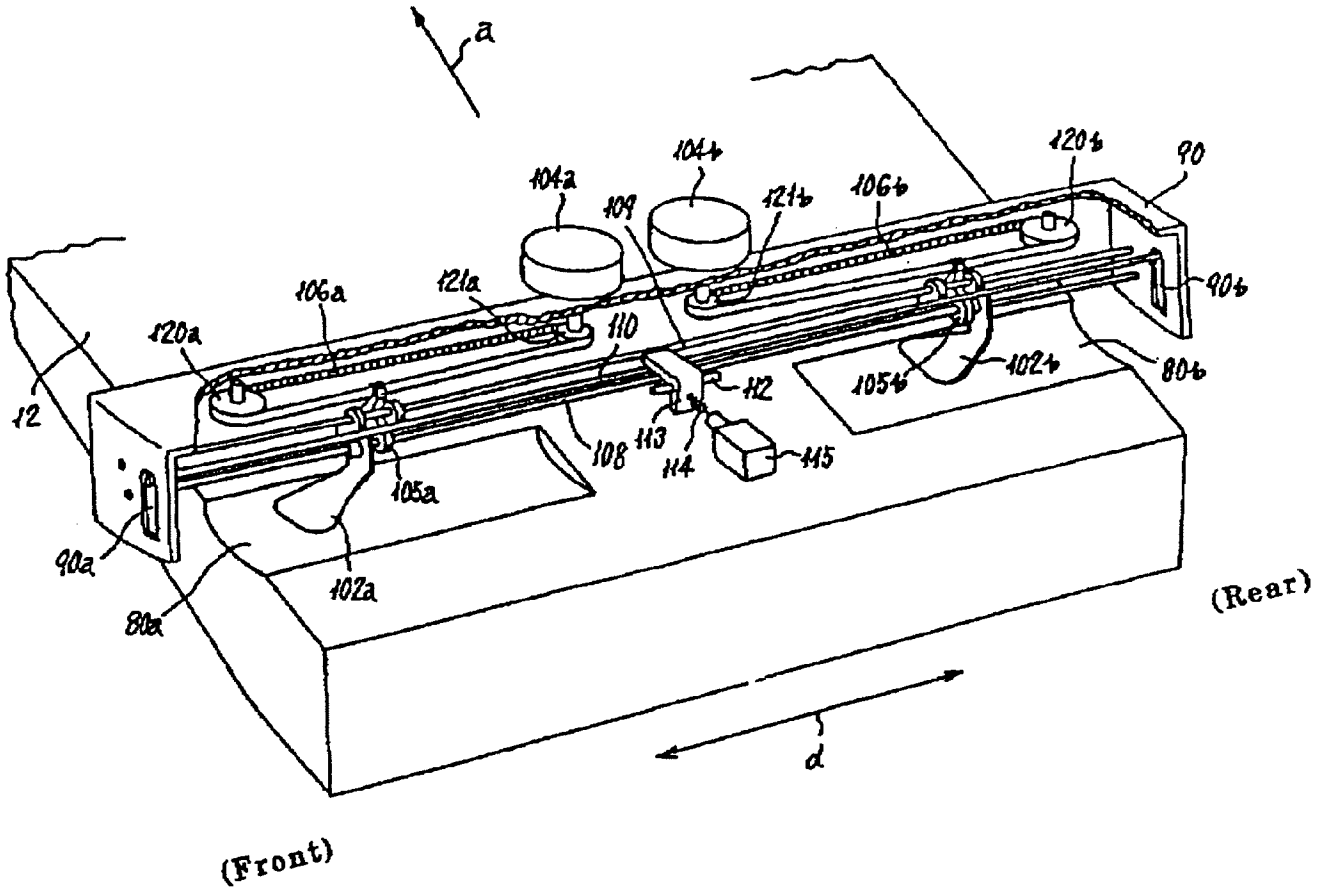
FIG. 60 is a perspective view representing the major portion of the aligning member traveling means.

In FIG. 60, when the tray 12 is viewed from the upstream side toward the downstream in the direction of ejection "a" and if it is assumed that the left side of the shift-direction "d" is a front side and the right side is a rear side. Then the aligning member 102*a* serves as the aligning member of the front side while the aligning member 102*b* serves as the aligning member of the rear side.

Firstly, explanation will be given on the traveling means of the aligning member 102*a* of the front side.

In FIG. 60, the aligning member 102*a* is slidably pivoted around a cylindrical shaft 108 which is parallel to the shift direction "d". The shaft 108 has two ends fixed to the frame 90.

Figure 61:
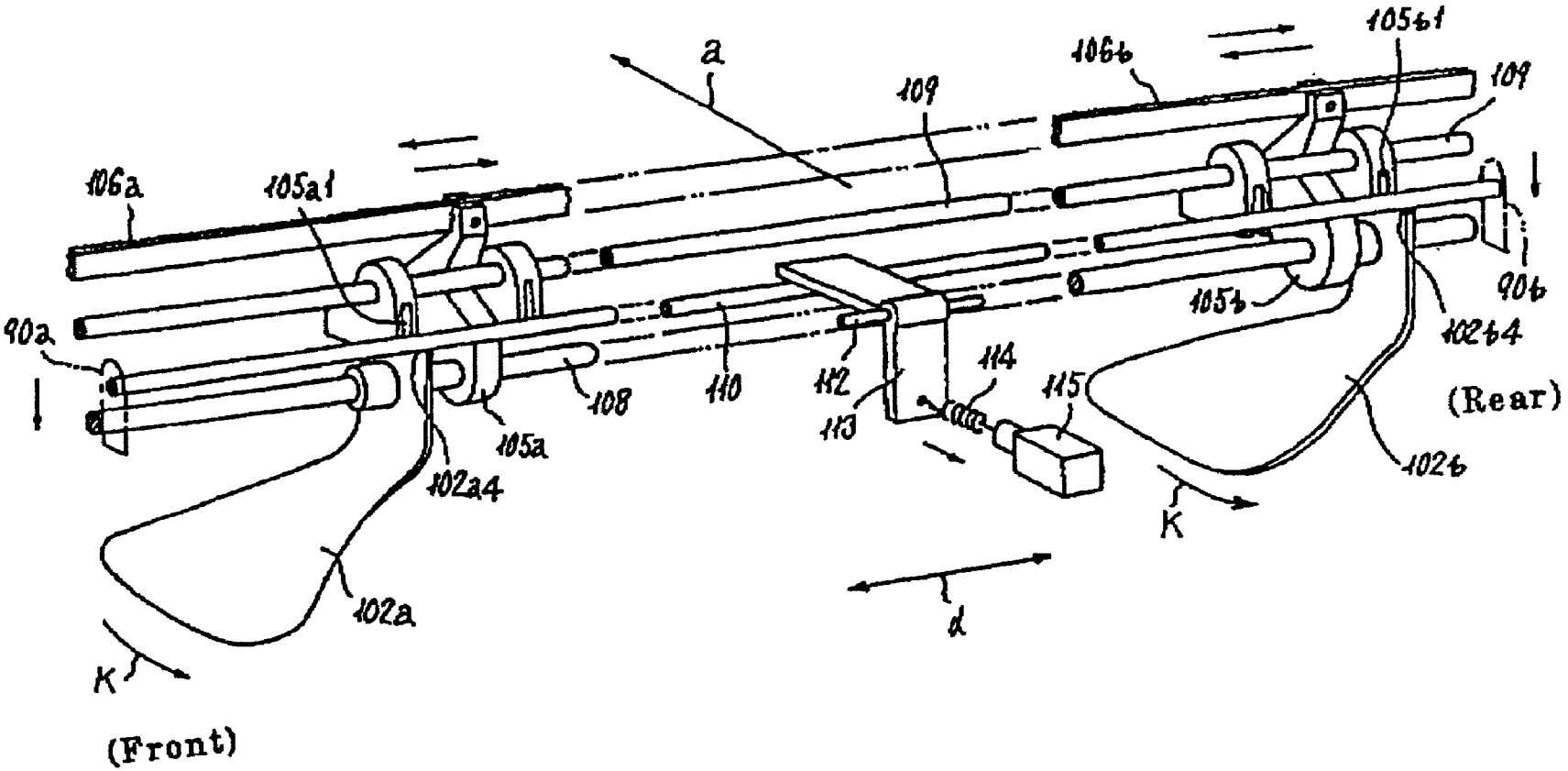
FIG. 61 is a perspective view representing the major portion of the aligning member traveling means.
Figure 62:
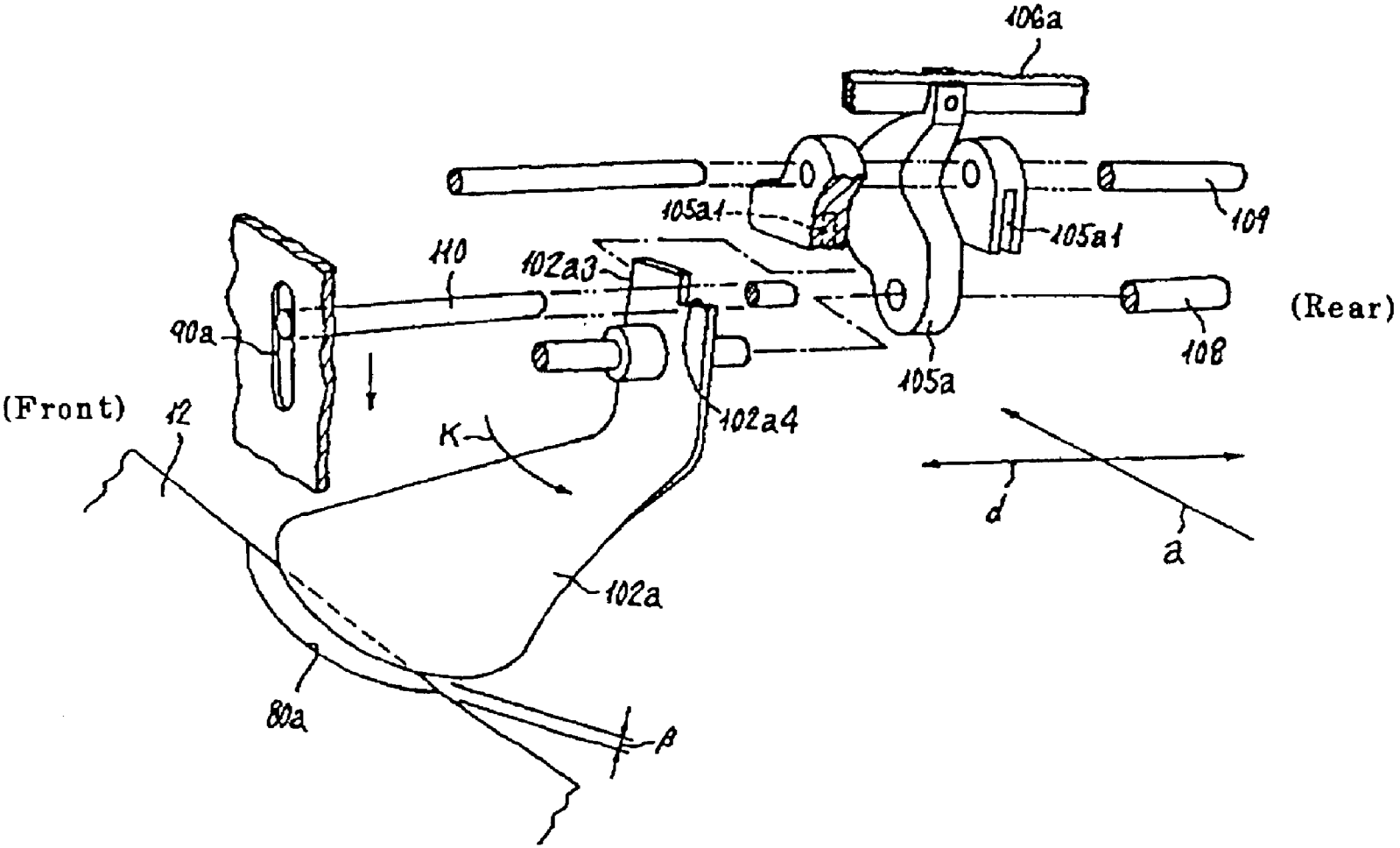
FIG. 62 is a perspective view representing the major portion of the drive mechanism of the aligning member.

As shown in FIGS. 61 and 62, the upper end of the aligning member 102 is engaged in a slit 105*a*1 which parallel to a plane orthogonal to the shaft 108 formed to extend through a receiving table 105*a*. The receiving table 105*a* is slidably engaged with the shaft 108 and also slidably engaged with a guide shaft 109 which is parallel to the shaft 108. Furthermore, the receiving table 105*a* has an upper portion fixed to a timing belt 106*a*.

As shown in FIG. 60, the timing belt 106*a* is arranged on pulleys 120*a* and 121*a*. The pulley 120*a* is supported by a shaft fixed to the frame 90. The pulley 121*a* is fixed to a rotation shaft of a stepping motor 104*a* fixed to the frame 90.

The stepping motor 104*a*, the receiving table 105*a*, the timing belt 106*a*, the shaft 108, and the guide shaft 109 are the main components constituting the aligning member traveling means for the aligning member 102*a*.

Next, explanation will be given on the aligning member moving member for the aligning member 102*b* of the rear side.

As shown in FIGS. 61 and 62, the aligning member 102*b* is slidably attached to the shaft 108 to which the aligning member 102 is attached. Moreover, this aligning member 102 is engaged in a slit 105*b*1 of the receiving table 105*b* in the same way as the engagement between the aligning member 102*a* and the receiving table 105*a*.

The receiving table 105*b* has its upper portion fixed to the timing belt 106*b*. As shown in FIG. 60, the timing belt 106*b* is arranged on pulleys 120*b* and 121*b*. The pulley 121*b* is fixed to a rotation shaft of a stepping motor 104*b* fixed to the frame 90.

The stepping motor 104, the receiving table 105*b*, the timing belt 106*b*, the shaft 108, and the guide shaft 109 are the main component constituting the traveling means of the reception member 102*b*.

In this example, the shaft 108 and the guide shaft 109 have functions to securely support and guide the receiving tables 105*a* and 105*b* and they are shared. However, regions used upon movement of the aligning members 102*a* and 102*b* are not accurately overlapped between the front side and the rear side and accordingly, they may also be provided independently of each other.

Thus, the aligning members 102*a* and 102*b* can be said to be arranged as independent traveling means from each other. By driving each of the stepping motors 104*a* and 104*b* to rotate in the forward direction and in the backward direction, each of the timing belts 106*a* and 106*b* is independently rotated, which shifts the receiving tables 105*a* and 105*b*, and the aligning members 102*a* and 102*b* respectively engaged in the slits 105*a*1 and 105*b*1 formed in the receiving tables 105*a* and 105*b* move in the shift direction "d" independently of each other.

The aligning member traveling means having the aforementioned configuration can drive each of the aligning members 102*a* and 102*b* independently. For example, when performing the aligning operation in the one-side shift mode, the aligning member 102 is kept unmoved while the aligning member 102*b* is moved in an arbitrary job and after shifting the tray, the aligning member 102*b* is kept unmoved while the aligning member 102*a* is moved in the subsequent job. Thus, it is possible to perform alignment operation after sorting by alternating the role of the unmoved member and the role of the moving member between the aligning members 102*a* and 102*b*.

Moreover, in the alignment operation, it is possible to employ the both-side shift mode in which both of the aligning members 102*a* and 102*b* are moved. As compared to the both-side shift mode, in the one-side shift mode, the aligning member positioned on the sheet bundle on the tray 12 is kept unmoved and accordingly, the alignment of the papers may not be disturbed so easily. However, when using independent traveling means, it is also possible to employ the one-side shift mode.

d. Position Control of the Aligning Members

In FIGS. 61 and 62, the shaft 108 serves as a guide to guide the aligning member 102*a* in the shift direction "d" and also as a support shaft for rotatably supporting the aligning member 102*a*. The aligning member 102*a* has an upper end portion engaged in the slid 105*a*1 as has been described above, and a lower end portion extending from the shaft 108 in the direction of ejection "a". Accordingly, the aligning member 102*a* has its center of gravity slightly shifted toward the direction of ejection "a" and subjected to a moment of arrow K direction centered on the shaft 108 by its weight.

Figure 63:
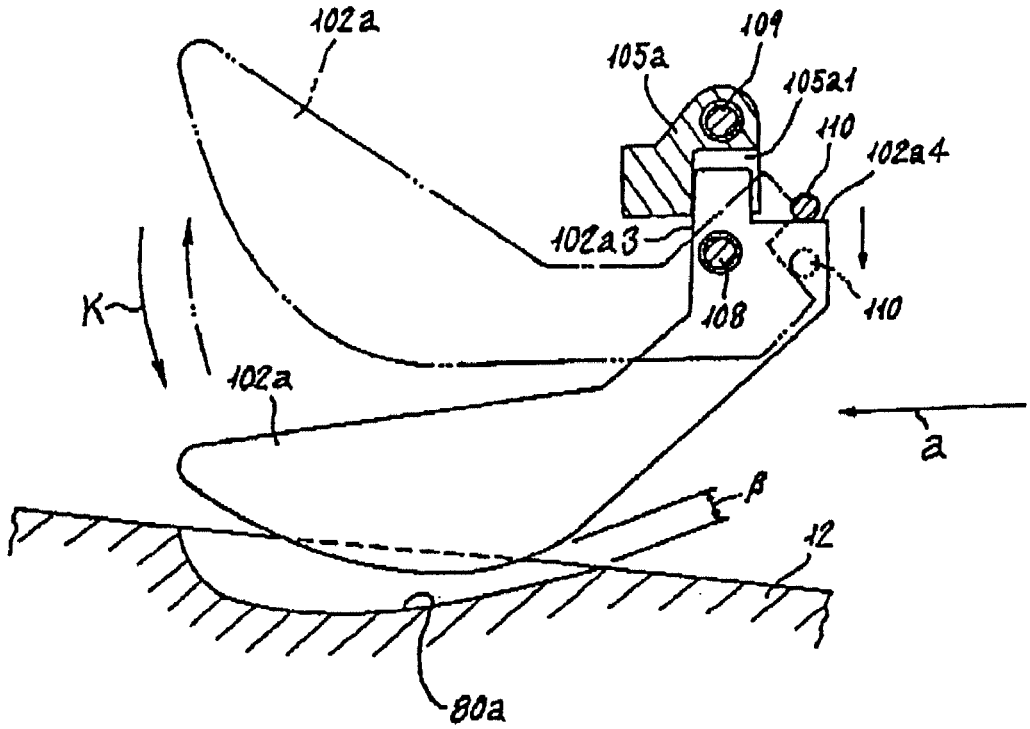
FIG. 63 is a front view illustrating the retract position and aligning position of the aligning member.

As shown in FIGS. 62 and 63, the slit 105*a*1 is not a through hole but closed at its depth. Accordingly, rotation of the aligning member 102*a* by the K-direction moment is prevented by the abutment between the upper end portion 102*a* of the aligning member 102*a* and the depth of the slit 105*a*1 while no interference is caused with the sheet S on the tray 12. In FIG. 63, the aligning member 102*a* indicated by a solid line is in a state where this rotation is prevented.

Because the slit 105*a* is formed in the receiving table 105*a*, the receiving table 105*a* also serves as a regulating member for regulating an amount of rotation of the aligning member 102*a* around the shaft 108. This configuration and function also exist between the aligning member 102*b* and the receiving table 105*b*.

The receiving table 105*a* having the slit 105*a*1 and the receiving table 105*b* function to regulate rotation of the aligning members 102*a* and 102*b* by moment caused by their weights, thereby automatically maintaining a constant position on the rotation direction. This eliminates the need of providing a positioning mechanism for positioning in the rotation direction.

As shown in FIG. 60 and FIGS. 62 to 64, and FIG. 66(*b*), at least when no sheets are loaded on the concaves 80*a* and 80*b*, the aligning members 102*a* and 102*b* have their lower end portions are located below the loading surface of the tray 12, i.e., in the concaves 80*a* and 80*b*, so that the aligning members 102*a* and 102*b* are engaged in the depth of the slits 105*a*1 and 105*b*1.

As shown in FIG. 58, when the aligning members 102 and 102*b* are located at the receiving position on the shift direction "d", the concave 80*a* is formed on the loading surface of the tray 12 and at the position opposing to the aligning member 102*a*. If a sheet is loaded so as to cover this concave 80*a*, the aligning member 102 is brought into abutment with the upper surface of the sheet by its weight. Similarly, the concave 80*b* is formed at the position opposing to the aligning member 102*b* at the receiving position. If a sheet is loaded so as to cover this concave 80*b*, the aligning member 102 is brought into abutment with the upper surface of this sheet by its weight.

The aligning members 102*a* and 102*b* always tend to rotate by their weights and if no sheet is present on the tray 12, rotation may be caused in the concaves 80*a* and 80*b*. Accordingly, as shown in FIGS. 61 and 63, the aligning members 102*a* and 102*b* are engaged at the depth of the slits 105*a*1 and 105*b*1. Thus, the K-direction rotation is prevented but rotation in the reverse direction is not prevented. Accordingly, when a sheet S is loaded on the tray 12 so as to cover the concaves 80*a* and 80*b*, the aligning members 102*a* and 102*b* are brought into contact with the sheet S by their weights.

Figure 64:
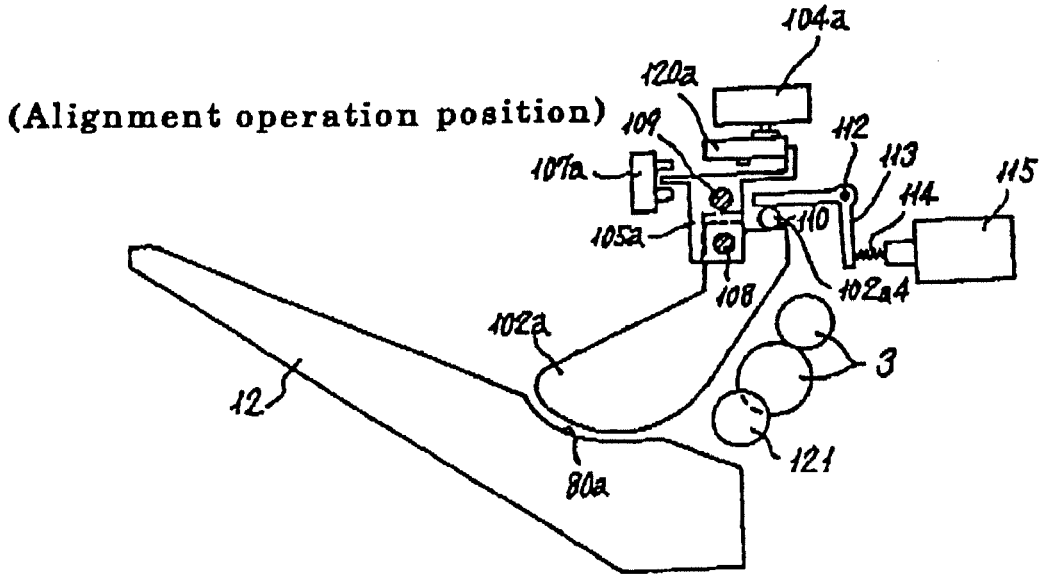
FIG. 64 is a front view illustrating the aligning position of the aligning member.

As has been described above, when no sheet is on the tray 12, the aligning members 102 and 102*b* have their lower end portions positioned in the concaves 80*a* and 80*b* by their weights, and when a sheet is present, the aligning members 102*a* and 102*b* are brought into contact with the upper surface of the sheet by their weights. In either of these states, movement in the shift direction enables switching to the aligning operation. Hereinafter, these states will be referred to work positions. In FIG. 64, the position of the aligning member 102*a* when no sheet is present is indicated as an aligning work, but when a sheet is present, the state of the aligning member 102*a* in abutment with the upper surface of the sheet by its weight is the work position. That is, the work position includes both of these states. Moreover, the aligning member 102*b* may also be located at the work position similar to that of the aligning member 102*a*.

Thus, the aligning members 102*a* and 102*b* at the receiving position shown in FIG. 58, and when at the aligning work position shown in FIG. 64, keep a state of partial intrusion into the concaves 80 and 80*b* of the tray 12 when not covered by a sheet and a state of contact with the upper surface of a sheet if any on the concaves 80*a* and 80*b*.

The aligning members 102*a* and 102*b* are placed at the receiving position in FIG. 58 on the shift direction "d" and at the aligning work position of FIG. 64 in the direction of rotation around the shaft 108. In this state, when a sheet is loaded on the tray 12 between the aligning members 102*a* and 102*b*, both or one of the aligning members 102*a* and 102*b* is moved for aligning operation, thereby enabling alignment of the sheets loaded on the tray 12.

By appropriately setting the position of gravity center of the aligning members 102*a* and 102*b*, it is possible to adjust (reduce) the contact pressure against the sheets S, thereby facilitating sorting of the sheets which have been already aligned.

In FIGS. 57 to 59, shield plates 105*a*1 and 105*b*1 are attached to the receiving tables 105*a* and 105*b*, respectively. When the stepping motors 104*a* and 104*b* rotate to move the receiving tables 105*a* and 105*b* so as to increase the distance between them, the shield plate 105*a*1 of the receiving table 105*a* is inserted into the home position sensor 107*b* for optical shielding while the shield plate 105*b*1 of the receiving table 105*b* is inserted into the home position sensor 107*b* for optical shielding. These shaded states are detected by the home position sensors 107*a* and 107*b*, respectively and the detection signals are used to control/stop the stepping motors 104*a* and 104*b*.

When the shield plates 105*a*1 and 105*b*1 are detected by the home position sensors 107*a* and 107*b*, respectively, the aligning members 102*a* and 102*b* are at their home position.

The distance between these home positions is sufficient as compared to the maximum width of the sheets of various sizes to be sorted and aligned.

Before starting the sorting/aligning operation, the aligning members 102*a* and 102*b* are waiting at these home positions. In FIG. 57, the aligning members 102*a* and 102*b* are at their home positions.

As shown in FIG. 58, the aligning members 102*a* and 102*b* are moved from their home positions by drive of the stepping motors 104*a* and 104*b* by a predetermined pulse according to the sheet width of the sheets S ejected from the ejection roller 3, and wait at the receiving position. After a sheet drops onto the tray 12 and stops completely, the aligning members 102*a* and 102*b* are moved to the aligning position shown in FIG. 59 and perform the aligning operation. At this time, the sheet bundle SS loaded on the tray 12 are aligned, and the aligning members 102*a* and 102*b* again move to the receiving position shown in FIG. 58 for receiving a subsequent sheet.

Upon completion of a series of job associated with the aligning operation by repeating the aforementioned process, the aligning members 102*a* and 102*b* again move to their home positions shown in FIG. 57.

Thus, by means of the stepping motors 104*a* and 104*b*, the receiving tables 105*a* and 105*b* including the shield members 105*a*1 and 105*b*1, the timing belts 106*a* and 106*b*, the shaft 108, guide shaft 109 as traveling means, and the home position sensors 107*a* and 107*b* as control means, the aligning portions 102*a*1 and 102*b*1 of the aligning members 102*a* and 102*b* are moved between at least two positions, i.e., the receiving position shown in FIG. 58 and the aligning position shown in FIG. 59. Thus, by setting the receiving position, the movement amount of the aligning members 102*a* and 102*b* upon the aligning operation can be reduced as compared to the case when they move from their home positions for receiving and aligning a sheet.

e. Aligning Member Retracting Means

In FIGS. 61 to 65, as has been described above, the aligning member 102*a* is pivotally attached to the shaft 108. At an upstream portion in the direction of ejection "a" from this pivot point, an L-shaped notch is formed. This notch has a pressing face 102*a*4 which is located approximately in a horizontal direction when the aligning member 102*a* is at the aligning work position shown in FIG. 64. Similarly, the aligning member 102*b* has a pressing face 102*b*4.

A shaft 110 parallel to the shaft 108 is in abutment, by its weight, to these pressing faces 102*a*4 and 102*b*4. The shaft 110 has end portions in the longitudinal direction which are respectively engaged in slots 90*a* and 90*b* in a perpendicular direction formed in the side plate portions of the frame 90 (see FIG. 61), so that the end portions can move up and down.

As shown in FIGS. 60, 61 and 64, one end of an L-shaped lever supported via a shaft 112 on the frame 90 is placed by its weight on the center portion of the shaft 110. The other end of the lever 113 is linked to a plunger of a solenoid 115 via a spring 114. The solenoid 115 is arranged on the frame 90.

When the solenoid 115 is in a off state (not excited), as shown in FIGS. 62 and 63, by the moment of the aligning members 102*a* and 102*b* under their own weight, their upper end portions 102*a*3 is brought into abutment with the depth of the slid 105*a*1 or the lower end portions of the aligning members 102*a* and 102*b* are brought into contact with the sheet on the tray 12, when the upper end portions 102*a*3 is slightly detached from the depth of the slit 105*a*, i.e., the aligning work position shown in FIG. 64. At this aligning work position, as described above, the aligning members 102*a* and 102*b* are located in the concaves 80*a* and 80*b* on the tray 12 or in contact with the uppermost surface of the sheets loaded on the tray 12.

Figure 65:
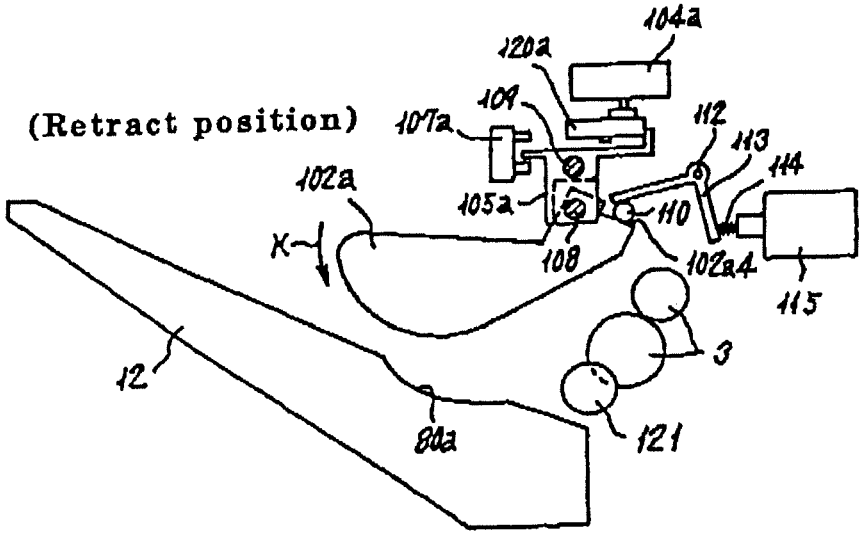
FIG. 65 is a front view illustrating the retract position of the aligning member.

As shown in FIG. 65, when the solenoid in a on state (excited), the plunger of the solenoid 115 is pulled and the lever 113 is rotated. With this, as shown in FIGS. 61 and 62, the shaft 110 is guided by the lever 13 into the slots 90*a* and 90*b* and pushed down.

As shown in FIGS. 61 to 65, since the shaft 110 is engaged with the pressing faces 102*a*4 and 102*b*4 of the notch formed on the aligning members 102*a* and 102*b*, when the shaft 110 is pushed down as shown in FIG. 65, the aligning members 102*a* and 102*b* are rotated in a direction opposite to the K-direction to move from the concaves 80*a* and 80*b* or from the uppermost surface of the sheets loaded on the tray 12 to high above the tray 12.

The position of the aligning members 102*a* and 102*b* when placed high above the tray 12 are shown in dotted line in FIG. 63 and in a solid line in FIG. 65. This position is called a retract position. The shaft 110, the lever 113, and the solenoid 115 constitute the retracting means for setting the aligning members 102*a* and 102 to the retract position.

f. Aligning Member Drive Unit

In FIGS. 61, 62, 64, and 65, a constituting portion supporting the aligning members 102*a* and 102*b* includes; (1) the shaft 109 as a fulcrum shaft to which the aligning members 102*a* and 102*b* are pivotally attached; (2) the shaft 110 which is brought into abutment with the pressing faces 102*a*4 and 102*b*4 serving as functioning points of the aligning members slightly shifted from the shaft 108; and (3) rotation preventing members constituted by the receiving tables 105*a* and 105*b* having depths of the slits 105*a*1 and 105*b*1 capable of preventing rotation around the shaft 108 caused by the aligning members 102*a* and 102*b* under their own weight. The shaft 108 also serves as a guide shaft for guiding the aligning members 102*a* and 102*b* in the shift direction "d" as the aligning direction. The receiving tables 105*a* and 105*b* also serve as drive means for moving the aligning members 102*a* and 102*b* in the shift direction "d". Furthermore, the constituting portion includes a pair of aligning members arranged to sandwich sides of the sheets parallel to the direction of ejecting sheets and capable of moving in the aligning direction to be contact with and apart from the ends, thereby aligning the ends.

Thus, the aligning members 102*a* and 102*b* can be brought into contact with the upper surface of the sheet S by the load corresponding to the moment by the moment under their own weight. By adjusting this load, it is possible to adjust the contact pressure onto the sheet S. When no sheet is present, as shown by a solid line in FIG. 63, the aligning members 102*a* and 102*b* can be placed in the concaves 80*a* and 80*b* of the tray 12 while the upper portion of the aligning member 102*a* is engaged in the depth of the slit 105*a*1, thereby assuring contact of the aligning members 102*a*1 and 102*b*1 with the ends of the sheet S.

Furthermore, switching drive means including a lever 13 and a solenoid 115 is provided for switching between a state of pressing the pressing face 102*b*4 as a functioning point to work in the shaft 110 as the pressing shaft and a state of releasing the pressing. This enables switching between the state of the aligning members 102*a* and 102*b* retracting from the uppermost surface of the sheets S and the state of the aligning members 102*a* and 102*b* to be brought into contact with the sheets S by the angular moment produced under their own weight.

g. Relationship Between the Aligning Members and the Tray

The positioning means 96 explained with reference to FIG. 18 controls the position of the tray 12 in the vertical direction in such a manner that the vertical position of the tray 12 or the uppermost surface of the sheets loaded on the tray 12 is set to an appropriate ejection position for properly ejecting sheets S from the ejection roller 3. The aligning work position explained in FIG. 64 is set at this appropriate ejection position.

When the aligning members 102*a* and 102*b* are moved in the shift direction for performing the aligning operation, the aligning operation can be effectively performed. Moreover, when the tray 12 is shifted for sorting, it is possible to prevent interference between the sheets on the tray 12 and the aligning members 102*a* and 102*b*.

When the aligning members 102*a* and 102*b* are located at the aligning work position explained in FIG. 64, the lower end portions of the aligning members 102*a* and 102*b* partially protrude into the concaves provided on the tray 12, and as shown in FIGS. 62 and 63, the aligning members 102*a* and 102*b* do not interfere with the tray 12 because of the interval "β" in the concaves 80*a* and 80*b*. Here, as has been explained in FIG. 18, the tray 12 is at the appropriate ejection position set by the tray vertical positioning means 96.

Since the concaves 80*a* and 80*b* are formed, the lower end portions of the aligning members 102*a* and 102*b* are positioned in the concaves 80*a* and 80*b*, i.e., at a lower position than the upper surface of the tray 12. Accordingly, the lower portions of the aligning members 102*a* and 102*b*, more particularly, the aligning portions 102*a*1 and 102*b*1 in the lower end portions of the aligning members 102*a* and 102*b* are assured to be placed orthogonal to the ends of the sheets S via the concaves 80*a* and 80*b*. Thus, the aligning portions 102*a*1 and 102*b*1 are assured to be in contact with end of even the lowermost sheet S to be aligned.

h. Preventing Interference Between the Aligning Members and Sheets

After completion of sheet ejection and subsequent aligning in a job unit, if the tray 12 is shifted in the shift direction "d" for sorting while the aligning members 102*a* and 102*b* are at the receiving position shown in FIG. 58, the aligned sheet bundle SS may be scraped off by the lower end portions of the aligning members 102*a* and 102*b* when the tray 12 is shifted. To prevent this, before the tray 12 is shifted, the sheets on the tray 12 are separated from the aligning members 102*a* and 102*b* by the retracting means.

Moreover, after a predetermined number of units are sorted, the sheet width may be changed for a subsequent predetermined number of units to be sorted. In preparation for this step, the aligning members 102*a* and 102*b* should be moved to a position having a greater open distance than at the receiving position. Upon the movement of the aligning members 102*a* and 102*b* for this, the aligning members 102*a* and 102*b* should not interfere with the sheets on the tray 12 which have been already aligned by the aligning members 102*a* and 102*b*. Accordingly, before moving the aligning members 102*a* and 102*b* to a greater-open position than the receiving position, the home position, or to an arbitrary position of a smaller open distance than at the home position, the sheets on the tray 12 are separated from the aligning members 102*a* and 102*b*, i.e., retract operation is performed in advance.

This retract operation may be performed by three methods; by rotating the aligning members 102*a* and 102*b* (retracting method 1), by lowering the tray 12 (retracting method 2) and by rotating the aligning members 102*a* and 102*b* and lowering the tray 12 (retracting method 3). The amount to be retracted is preferably determined with consideration given to the relationship between the degree of sheet curling and the distance of tray shift, and the relationship a specific apparatus.

Retracting Method 1

In FIGS. 61 to 65, the shaft 110, lever 113 and solenoid 115 constitute the retracting means for placing the aligning members 102*a* and 102*b* to the retract position.

Each time a job is completed, i.e., each time before the tray 12 is shifted, the solenoid 115 is turned on and the aligning members 102*a* and 102*b* are moved to the retract position as shown in FIG. 65. Alternatively, upon completion of sorting of a predetermined number of units, as shown in FIG. 65, the aligning members 102*a* and 102*b* are moved to the retract position.

As shown in FIG. 63, at the retract position, the lower end portions of the aligning members (those portions overlapping with the tray 12) are pushed upward to form a clearance between the aligning members and the tray 12. When this clearance is formed, the tray 12 moves in the shift direction "d" for performing the sorting operation. Thus, it is possible to prevent contact between the uppermost surface of the sheets and the aligning members 102*a* and 102*b*.

The aligning members 102*a* and 102*b* placed at the retract position shown in FIG. 65 by the retracting means can be returned to the aligning work position shown in FIG. 58 by moment under their own weight only by turning off the solenoid 115. It should be noted that the returning operation from the retract position to the aligning work position should be performed after the aligning members 102*a* and 102*b* have been moved to the receiving position shown in FIG. 58.

In case the aligning operation is the one-side shift mode, when the aligning members 102*a* and 102*b* are returned to the aligning work position, one of the aligning members is placed on the sheet bundle of a preceding job while the other of the aligning members is placed outside the ends of the sheet bundle. In a subsequent job, the aligning member placed on the sheet bundle of the preceding job remains unmoved while the aligning member placed outside the ends of the sheets of the preceding job are brought into contact with the ends for performing the aligning operation.

In case the aligning operation is performed in the both-side shift mode, when the aligning members 102*a* and 102*b* are returned to the aligning work position, one of the aligning members is placed on the sheet bundle of a preceding job while the other aligning member is placed outside the ends of the sheet bundle of a preceding job in the same way as in the one-side shift mode. However, in a subsequent job performed after shifting the tray 12, the aligning member placed on the sheet bundle of the preceding job and the aligning member placed outside the ends of the sheet in the preceding job are both brought into contact with the ends of the sheet bundle for performing the aligning operation.

In either of the one-side shift mode or the both-side shift mode, after completion of aligning of sheets by the aligning members 102*a* and 102*b*, the sheets may be taken out of the tray 12. In this case also, the sheet bundle which has been sorted can easily be taken out from the tray 12 because the aligning members 102*a* and 102*b* have been retrieved from the aligning work position shown in FIG. 64 to the retract position shown in FIG. 65.

[Retracting Method 2]

By lowering the tray from the appropriate ejection position by the elevating means 95 shown in FIG. 18(*a*), it is possible to prevent interference between the sheets on the tray and the aligning members 102*a* and 102*b* when the tray 12 is shifted.

The tray 12 remains at the lowered position until the tray 12 is shifted by a predetermined amount for sorting or until the aligning members 102*a* and 102*b* are moved to the receiving position according to a sheet size of the sheets to be aligned upon sorting of a subsequent predetermined number of units. After this, the tray 12 is raised to the appropriate ejection position. This enables ejection of the sheets appropriately onto the tray and performs the aligning operation.

[Retracting Method 3]

This retracting method 3 is a combination of the retracting method 1 in which the solenoid 115 is turned on to operate the aligning members 102*a* and 102*b* and the retracting method 2 in which the elevating means 95 is driven to lower the tray 12. This method is used when the retracting amount obtained only by the method 2 in which the solenoid 115 is turned on or only by the method 3 in which the elevating means 95 is driven. The retracting method 3 makes it possible to obtain a necessary retracting amount. Moreover, since the aligning members 102 and 102*b* are moved to be farther from the tray 12, a necessary retracting amount can be obtained in a short time.

Figure 67:
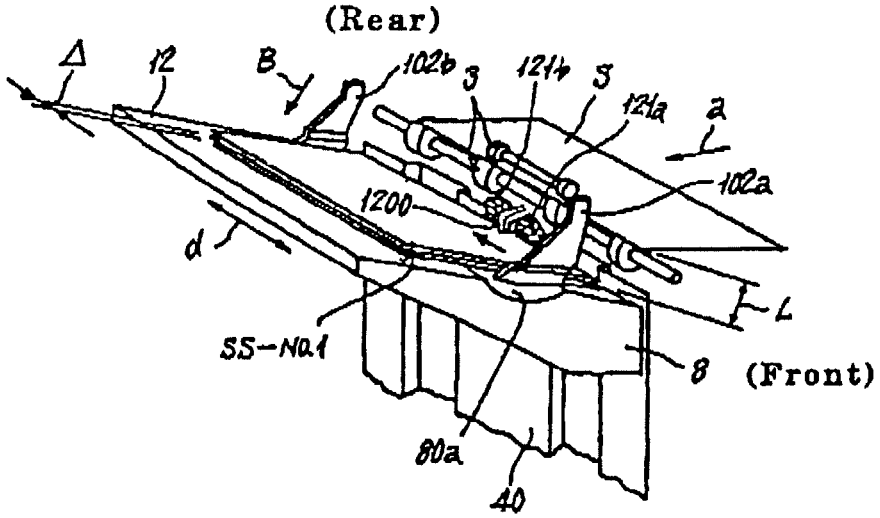
FIG. 67 is a perspective view illustrating the aligning member traveling position in relation to paper.

As a case requiring an especially large retracting amount, there can be considered a case when the sheet S has a significantly large curl. When the aligning members 102 and 102*b* are shifted in the shift direction "c" with respect to the tray 12, if the sheet S is curled as much as shown in FIG. 67, the normal retracting amount may not be sufficient.

For example, the sheet S may be curled in the center portion thereof. In such a case, by lowering the tray 12 and retrieving the aligning members 102*a* and 102*b*, it is possible to assure a sufficient amount to prevent interference between the uppermost surface of the sheets and the aligning members 102*a* and 102*b*.

[i] Aligning Operation

The aligning operation may be performed by a one-side shift mode in which one of the aligning members 102*a* and 102*b* is left unmoved while the other aligning member is shifted toward the unmoved aligning member or by a two-side shift mode in which both of the aligning members 102 and 102*b* are moved toward each other.

In the one-side shift mode, the unmoved aligning member is brought into contact with the sheets of a preceding job which have been aligned. Accordingly, there is an advantage that sheets are not disturbed in the aligning operation but the operation mechanism requires a complicated configuration because the aligning members should be operated in different ways.

In the both-side shift mode, the aligning members are alternately brought into contact with the sheets of a preceding job and it is necessary to set a friction coefficient of the contact portion between the aligning members and the sheets to a value smaller than that between the sheets However, it is possible to employ a mechanism for interlocked operation of the aligning members, which simplifies the drive mechanism.

Hereinafter, explanation will be given on the aligning operation in the one-side shift mode and the both-side shift mode.

Figure 66:
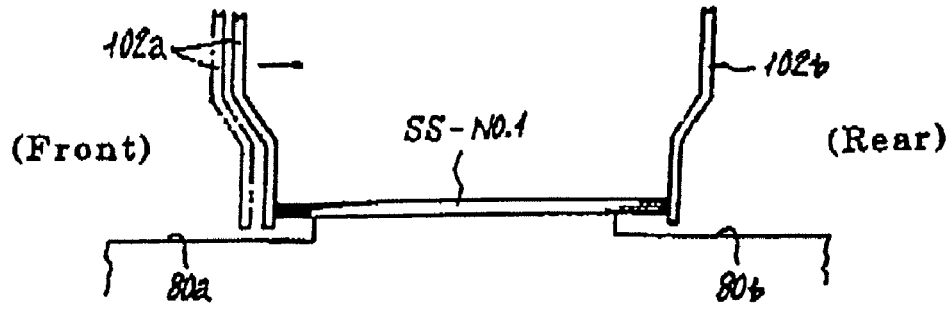
FIGS. 66(*a*), (*b*) and (*c*) are sequential illustrations of the sorting and aligning steps in the one-side shift mode.
Figure 66:
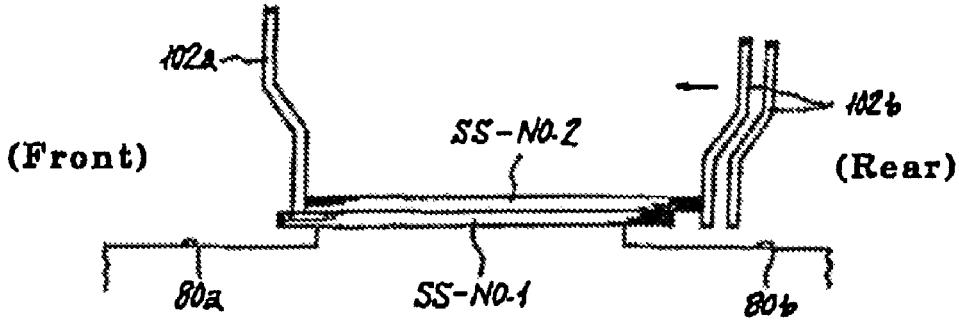
Figure 66:
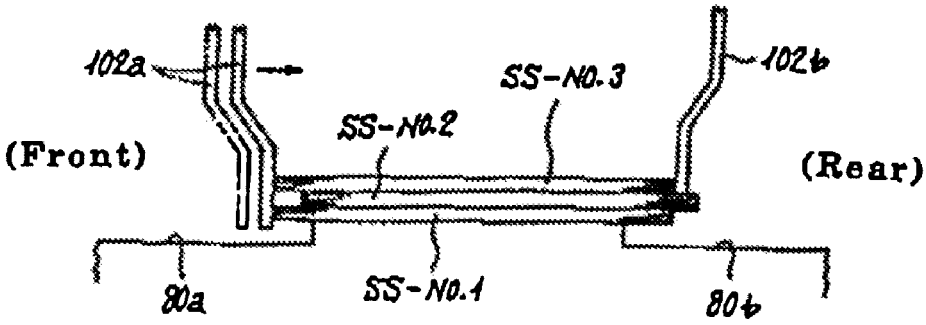
Figure 68:
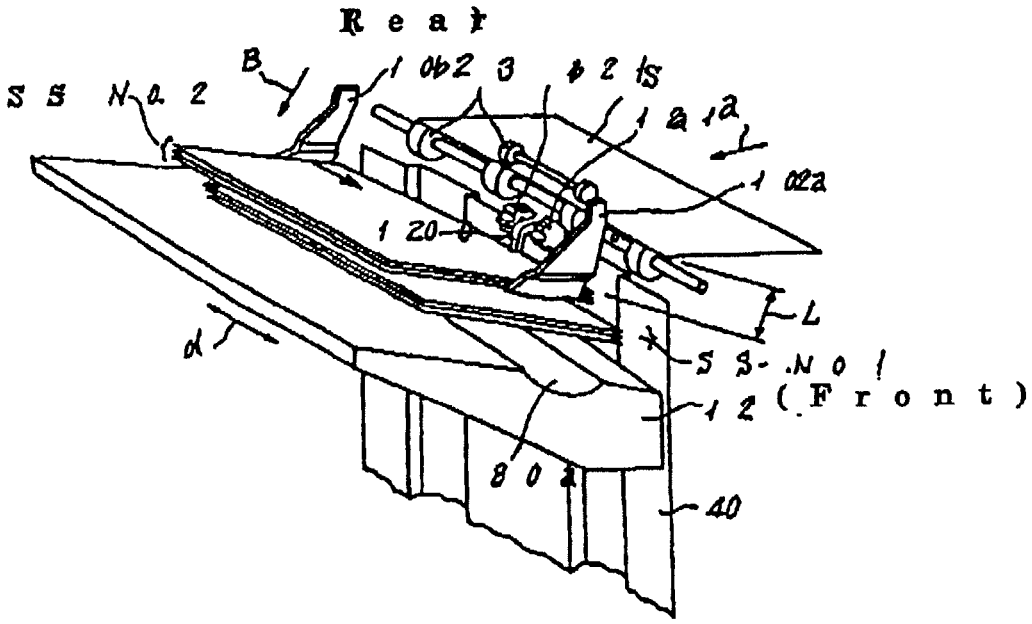
FIG. 68 is a perspective view illustrating the aligning member traveling position in relation to paper.
Figure 69:
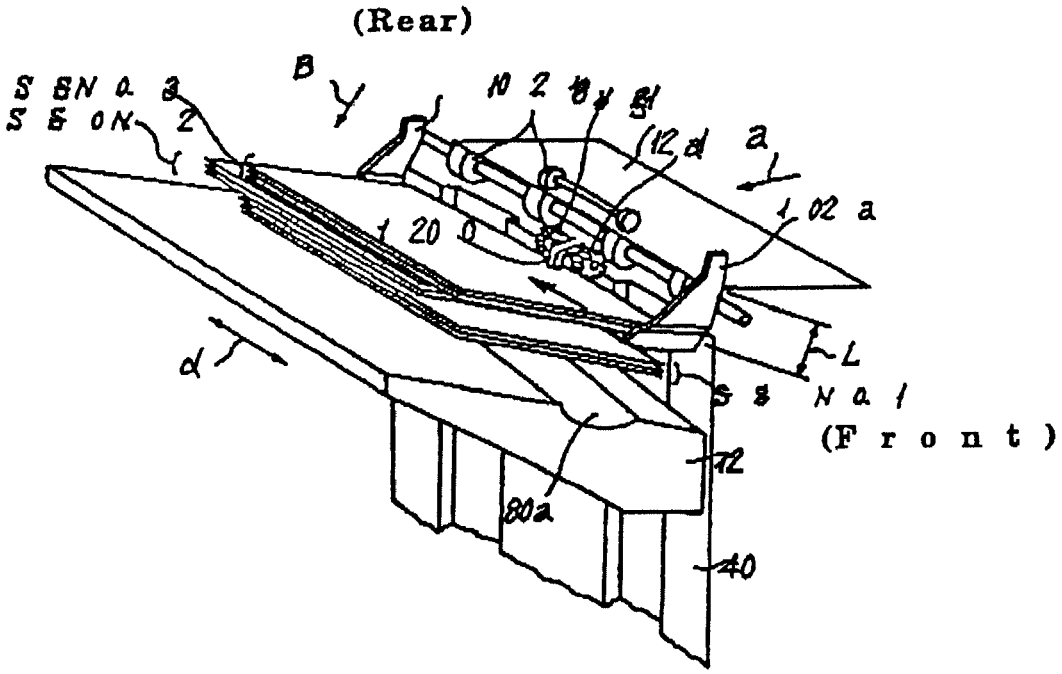
FIG. 69 is a perspective view illustrating the aligning member traveling position in relation to paper.

[1] Aligning in One-Side Shift Mode Referring to FIGS. 66 to 69, explanation will be given on the aligning operation in the one-side shift mode using the aligning members 102*a* and 102*b*. FIG. 66 shows the tray 12 viewed from the upstream to the downstream in the direction of ejection "a" in FIG. 17. FIGS. 68 and 69 are perspective views showing the aligning operation. FIG. 66(*a*) corresponds to FIG. 68; FIG. 66(*b*) corresponds to FIG. 69; and FIG. 66(*c*) corresponds to FIG. 69.

In FIG. 17, the sheet S which has passed along the transport route having the transport roller pair 2*b*, the ejection sensor 38, and the ejection roller 3 is ejected from the ejection roller 3 in the direction of ejection "a".

[Job 1]

In FIGS. 66(*a*) and 67, a sheet S moves downward in a slanting direction toward View B under its own weight, and falls on the tray. Here several sheets constituting a unit have already been fallen. Prior to ejection of the sheet S, the tray 12 is shifted to one end in the shift direction "d", e.g. to the backward position in advance by the tray reciprocating mechanism described in FIGS. 10 to 22, and the aligning members are located at the receiving position shown in FIG. 58 and the aligning work position shown in FIG. 64. Sheets constituting the first sheet bundle SS-No. 1 applied to the first job are already loaded to some extent.

When a sheet S is ejected, the aligning member 102*b* remains unmoved while the aligning member 102*a* moves toward the sheet bundle SS-No. 1 to be in contact with, or to hit, the ends of the sheets which are parallel to the direction of ejection "a" so as to sandwich the sheet bundle SS-No. 1, thereby performing the aligning operation. This aligning operation eliminates a lateral shift amount "A" produced while a sheet S is dropping a free fall distance L. After this, the aligning member 102*a* is returned to the receiving position shown in FIG. 58. This operation is performed each time a sheet S is ejected and loaded on the tray 12.

A sheet ejection may be or may not be accompanied by a shift command signal. The sheet accompanied by the shift command signal is the first sheet of a sheet unit. At the moment when a sheet passes the ejection sensor 38, control means detects to see whether the sheet is accompanied by the shift command signal or not.

After ejecting a predetermined number of sheets constituting the first sheet bundle SS-No. 1, if the control means does not detect the shift command signal, which means the end of the job, the aligning members 102*a* and 102*b* are returned to the home positions (shown in FIG. 57) without shifting the tray 12.

[Job 2]

After ejecting the predetermined number of sheets constituting the first sheet bundle SS-No. 1, if the control means detects the shift command signal, the sheet which has produced the shift command signal is a first sheet of a subsequent job. By the time when the sheet reaches the ejection tray 12, the tray 12 is shifted for the next job. Upon this shift, the aligning members 102*a* and 102*b* are moved to the retract position shown in FIG. 65 (or the tray 12 is lowered and/or the aligning members are retrieved) and in this retracting state, the tray 12 is shifted forward.

After the aforementioned shift, the aligning members 102*a* and 102*b* are moved from the retract position shown in FIG. 65 to the aligning work position based on FIG. 64 and are set to the receiving position shown in FIG. 58. This state is shown in FIGS. 66(*b*) and 68. By the shift of the tray 12, the aligning member 102*a* of the front side is brought into contact with the upper surface of the sheet bundle SS-No. 1 while the aligning member 102*b* of the rear side is positioned at the predetermined receiving position. It should be noted that in FIGS. 66(*b*) and 68, a certain number of sheets constituting the second sheet bundle SS-No. of the second job are loaded.

When a sheet S of the second job is ejected, the aligning member 102*a* of the front side remains unmoved while the aligning member 102*b* of the rear side moves toward the second sheet bundle SS-No. 2 to be in contact with, or hit, the end face of the sheets parallel to the direction of ejection "a"

so as to sandwich the sheet bundle SS-No. 2 and performs the aligning operation at the aligning position shown in FIG. 59. By this aligning operation, the second sheet bundle SS-No. 2 is aligned. After this, the aligning member 102*b* returns to the receiving position shown in FIG. 57. This operation is performed each time a sheet S is ejected and loaded on the tray 12.

A sheet ejection may be or may not be accompanied by a shift command signal. The sheet accompanied by the shift command signal is the first sheet of a sheet unit. At the moment when a sheet passes the ejection sensor 38, control means detects to see whether the sheet is accompanied by the shift command signal or not.

After ejecting a predetermined number of sheets constituting the second sheet bundle SS-No. 2, if the control means does not detect the shift command signal, which means the end of the job, the aligning members 102*a* and 102*b* are returned to the home positions (shown in FIG. 57) without shifting the tray 12.

[Job 3]

After ejecting the predetermined number of sheets constituting the second sheet bundle SS-No. 2, if the control means detects the shift command signal, the sheet which has produced the shift command signal is a first sheet of a subsequent job. By the time when the sheet reaches the ejection tray 12, the tray 12 is shifted for the next job. Upon this shift, the aligning members 102*a* and 102*b* are moved to the retract position shown in FIG. 65 (or the tray 12 is lowered and/or the aligning members are retrieved) and in this retracting state, the tray 12 is shifted forward.

After the aforementioned shift, the aligning members 102*a* and 102*b* are moved from the retract position shown in FIG. 65 to the aligning work position based on FIG. 64 and are set to the receiving position shown in FIG. 58. This state is shown in FIGS. 66(*c*) and 68. By the shift of the tray 12, the aligning member 102*a* of the rear side is brought into contact with the upper surface of the second sheet bundle SS-No. 2 while the aligning member 102*b* of the front side is positioned at the predetermined receiving position. It should be noted that in FIGS. 66(*c*) and 69, a certain number of sheets constituting the third sheet bundle SS-No. 3 of the third job are loaded.

When a sheet S of the third job is ejected, the aligning member 102*b* of the rear side remains unmoved while the aligning member 102*a* of the front side moves toward the third sheet bundle SS-No. 2 to be in contact with, or hit, the end face of the sheets parallel to the direction of ejection "a" so as to sandwich the sheet bundle SS-No. 3 and performs the aligning operation at the aligning position shown in FIG. 59. By this aligning operation, the third sheet bundle SS-No. 3 is aligned. After this, the aligning member 102*a* returns to the receiving position shown in FIG. 58. This operation is performed each time a sheet S is ejected and loaded on the tray 12.

A sheet ejection may be or may not be accompanied by a shift command signal. The sheet accompanied by the shift command signal is the first sheet of a sheet unit. At the moment when a sheet passes the ejection sensor 38, control means detects to see whether the sheet is accompanied by the shift command signal or not.

After ejecting a predetermined number of sheets constituting the third sheet bundle SS-No. 3, if the control means does not detect the shift command signal, which means the end of the job, the aligning members 102*a* and 102*b* are returned to the home positions (shown in FIG. 57) without shifting the tray 12.

After ejecting the predetermined number of sheets constituting the third sheet bundle SS-No. 3, if the control means does detects the shift command signal, the sheet which has produced the shift command signal is a first sheet of a subsequent job. By the time when the sheet reaches the ejection tray 12, the tray 12 is shifted for the next job. Upon this shift, the aligning members 102*a* and 102*b* are moved to the retract position shown in FIG. 65 (or the tray 12 is lowered and/or the aligning members are retrieved) and in this retracting state, the tray 12 is shifted forward to wait for ejection of a first sheet of a unit. After this, the aforementioned procedure is repeated.

[2] Aligning in Both-side Shift Mode

Figure 70:
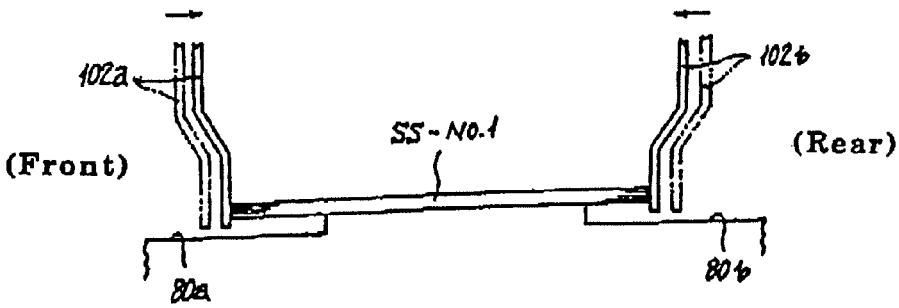
FIGS. 70(*a*), (*b*) and (*c*) are sequential illustrations of the sorting and aligning steps in the both-side shift mode.
Figure 70:
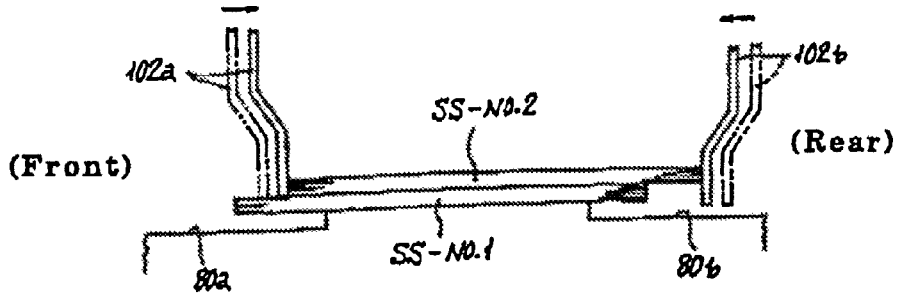
Figure 70:
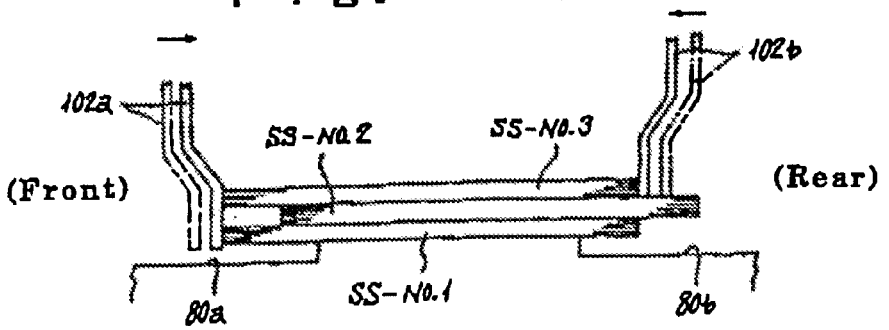
Figure 71:
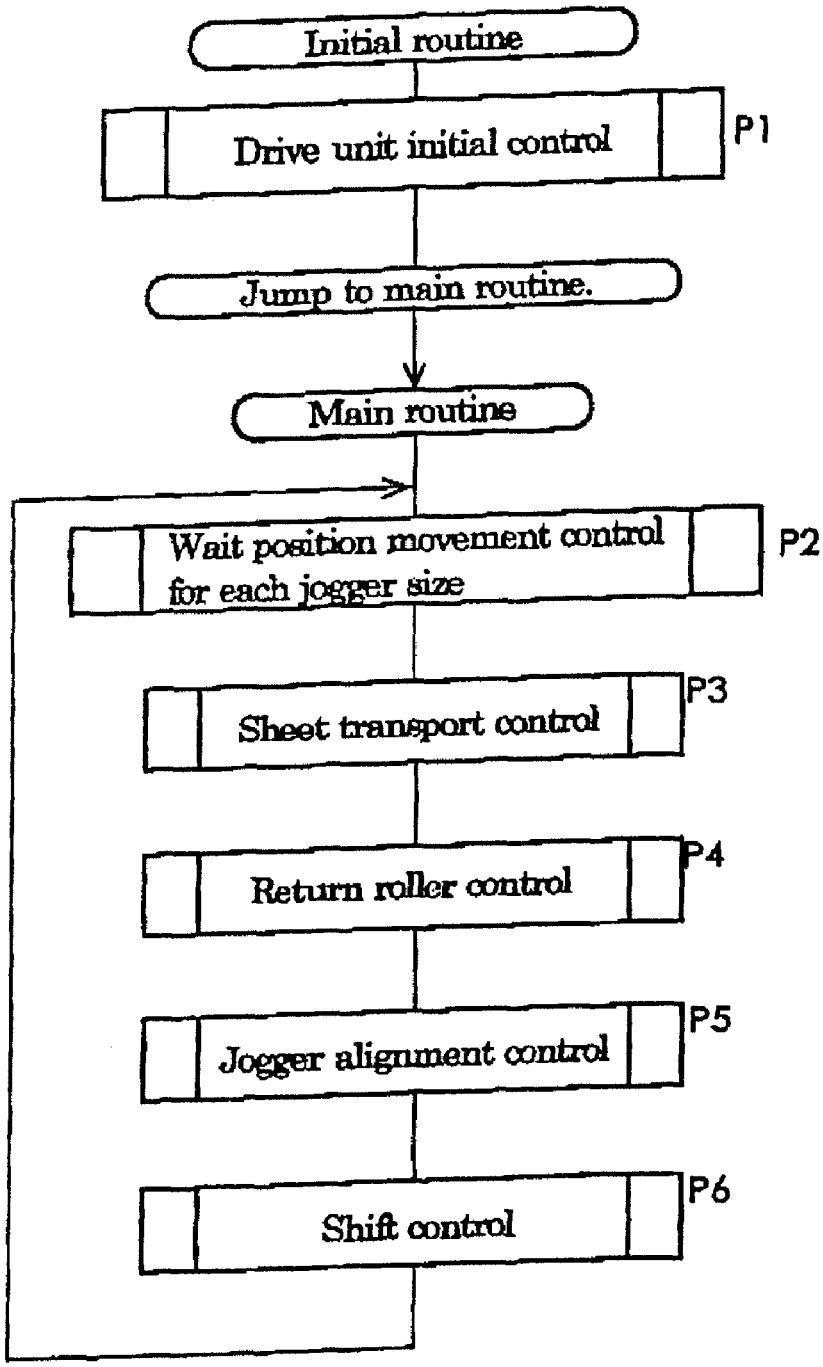
FIG. 71 is a flow chart according to the present invention.

Referring to FIG. 7, explanation will be given on the aligning operation by the aligning members 102*a* and 102*b* according to the both-side shift mode. FIG. 70 shows the tray 12 viewed from the upstream side to the downstream side in the direction of ejection "a" in FIG. 17.

In FIG. 17, the sheet S which has passed along the transport route having the transport roller 7, the ejection sensor 38, and the ejection roller 3 is ejected from the ejection roller 3 toward the direction of ejection "a".

[Job 1]

In FIG. 70(*a*), in the same way as in the one-side shift mode, the sheet S falls onto the tray 12. Here, it is assumed that a certain number of sheets constituting a unit have been already loaded. Before ejecting the sheets S, the tray 12 is moved to one end (rear end, for example) of the shift direction "c" by the tray reciprocating mechanism explained in FIGS. 19 to 22, the aligning members are located at the receiving position shown in FIG. 58 and at the aligning work position shown in FIG. 64, and a certain number of sheets constituting a first sheet bundle SS-No. 1 of the first job have been loaded.

[Job 1]

When a sheet S is ejected, both of the aligning members 102*a* and 102*b* remain unmoved while the aligning member 102*a* moves toward the sheet bundle SS-No. 1 to be in contact with, or to hit, the ends of the sheets which are parallel to the direction of ejection "a" so as to sandwich the sheet bundle SS-No. 1, thereby performing the aligning operation. This aligning operation eliminates a lateral shift amount Δ caused while a sheet S is dropping by a free fall distance L as in the one-side shift mode. After this, the aligning members 102*a* and 102*b* are returned to the receiving position shown in FIG. 58. This operation is performed each time a sheet S is ejected and loaded on the tray 12.

A sheet ejection may be or may not be accompanied by a shift command signal. The sheet accompanied by the shift command signal is the first sheet of a sheet unit. At the moment when a sheet passes the ejection sensor 38, control means detects to see whether the sheet is accompanied by the shift command signal or not.

After ejecting a predetermined number of sheets constituting the first sheet bundle SS-No. 1, if the control means does not detect the shift command signal, which means the end of the job, the aligning members 102*a* and 102*b* are returned to the home positions (shown in FIG. 57) without shifting the tray 12.

[Job 2]

After ejecting the predetermined number of sheets constituting the first sheet bundle SS-No. 1, if the control means detects the shift command signal, the sheet which has produced the shift command signal is a first sheet of a subsequent job. By the time when the sheet reaches the ejection tray 12, the tray 12 is shifted for the next job. Upon this shift, the aligning members 102*a* and 102*b* are moved to the retract position shown in FIG. 65 (or the tray 12 is lowered and/or the aligning members are retrieved) and in this retracting state, the tray 12 is shifted forward.

After the aforementioned shift, the aligning members 102*a* and 102*b* are moved from the retract position shown in FIG. 65 to the aligning work position based on FIG. 64 and are set to the receiving position shown in FIG. 58. This state is shown in FIGS. 66(*b*) and 68. By the shift of the tray 12, the aligning member 102*a* of the front side is brought into contact with the upper surface of the sheet bundle SS-No. 1 while the aligning member 102*b* of the rear side is positioned at the predetermined receiving position. It should be noted that in FIG. 70(*b*), a certain number of sheets constituting the second sheet bundle SS-No. of the second job are loaded.

When a sheet S of the second job is ejected, the aligning members 102*a* and 102*b* move toward the second sheet bundle SS-No. 2 to be in contact with, or hit, the end faces of the sheets parallel to the direction of ejection "a" so as to sandwich the sheet bundle SS-No. 2 and perform the aligning operation at the aligning position shown in FIG. 59. By this aligning operation, the second sheet bundle SS-No. 2 is aligned. After this, the aligning members 102*a* and 102*b* return to the receiving position shown in FIG. 58. This operation is performed each time a sheet S is ejected and loaded on the tray 12.

A sheet ejection may be or may not be accompanied by a shift command signal. The sheet accompanied by the shift command signal is the first sheet of a sheet unit. At the moment when a sheet passes the ejection sensor 38, control means detects to see whether the sheet is accompanied by the shift command signal or not.

After ejecting a predetermined number of sheets constituting the second sheet bundle SS-No. 2, if the control means does not detect the shift command signal, which means the end of the job, the aligning members 102*a* and 102*b* are returned to the home positions (shown in FIG. 57) without shifting the tray 12.

[Job 3]

After ejecting the predetermined number of sheets constituting the second sheet bundle SS-No. 2, if the control means detects the shift command signal, the sheet which has produced the shift command signal is a first sheet of a subsequent job. By the time when the sheet reaches the ejection tray 12, the tray 12 is shifted for the next job. Upon this shift, the aligning members 102*a* and 102*b* are moved to the retract position shown in FIG. 65 (or the tray 12 is lowered and/or the aligning members are retrieved) and in this retracting state, the tray 12 is shifted forward.

After the aforementioned shift, the aligning members 102*a* and 102*b* are moved from the retract position shown in FIG. 65 to the aligning work position based on FIG. 64 and are set to the receiving position shown in FIG. 58. This state is shown in FIG. 70(*c*). By the shift of the tray 12, the aligning member 102*b* of the rear side is brought into contact with the upper surface of the second sheet bundle SS-No. 2 while the aligning member 102*a* of the front side is positioned at the predetermined receiving position. It should be noted that in FIG. 70(*c*), a certain number of sheets constituting the third sheet bundle SS-No. 3 of the third job are loaded.

When a sheet S of the third job is ejected, the aligning members 102*a* and 102*b* move toward the third sheet bundle SS-No. 3 to be in contact with, or hit, the end faces of the sheets parallel to the direction of ejection "a" so as to sandwich the sheet bundle SS-No. 3 and performs the aligning operation at the aligning position shown in FIG. 59. By this aligning operation, the third sheet bundle SS-No. 3 is aligned. After this, the aligning members 102*a* and 102*b* return to the receiving position shown in FIG. 58. This operation is performed each time a sheet S is ejected and loaded on the tray 12.

A sheet ejection may be or may not be accompanied by a shift command signal. The sheet accompanied by the shift command signal is the first sheet of a sheet unit. At the moment when a sheet passes the ejection sensor 38, control means detects to see whether the sheet is accompanied by the shift command signal or not.

After ejecting a predetermined number of sheets constituting the third sheet bundle SS-No. 3, if the control means does not detect the shift command signal, which means the end of the job, the aligning members 102*a* and 102*b* are returned to the home positions (shown in FIG. 57) without shifting the tray 12.

After ejecting the predetermined number of sheets constituting the third sheet bundle SS-No. 3, if the control means detects the shift command signal, the sheet which has produced the shift command signal is a first sheet of a subsequent job. By the time when the sheet reaches the ejection tray 12, the tray 12 is shifted for the next job. Upon this shift, the aligning members 102*a* and 102*b* are moved to the retract position shown in FIG. 65 (or the tray 12 is lowered and/or the aligning members are retrieved) and in this retracting state, the tray 12 is shifted forward to wait for ejection of a first sheet of a unit. After this, the aforementioned procedure is repeated.

It should be noted that when performing the sorting operation, the shifting and aligning operations may be performed by moving the aligning members 102*a* and 102*b* in the shift direction by a necessary amount without moving the aligning members 102 and 102*b*. Next, explanation will be given on control of the ejection speed.

a. Speed Control of the Ejecting Means

As has been described above, for aligning sheets ejected onto the tray, the aligning means 102*a* and 102*b* are operated by the stepping motors 104*a* and 104*b* as drive sources, so as to perform the aligning operation. Moreover, in a method where the tray 12 is not shifted, the stepping motors 104*a* and 104*b* are used as drive sources for shifting the aligning members 102*a* and 102*b* to perform the sorting and the aligning operations. Alternatively, in a method in which the tray 12 is moved in the shift direction for sorting, sorting means composed of the tray shift means 98 is operated to perform sorting. Furthermore, returning rollers 121 and 121' are displayed to perform the return operation. Moreover, together with the return operation, it is possible to perform the pressing operation.

Each of the sheets is ejected from the image forming apparatus at a constant time interval inherent to the image forming apparatus, via the transport roller 560 into the sheet post-treatment apparatus 51. In the sheet post-treatment apparatus 51, a pair of entrance rollers 1, a pair of transport rollers 2*a* and 2*b*, and other components transport a sheet at a reception linear speed according to the aforementioned constant sheet interval. For example, a time interval between passing of a leading edge of a sheet and that of a subsequent sheet is constant. Since the sheets have an identical size, the sheet interval (time interval) between a trailing edge of a sheet and that of a subsequent sheet is also constant. There is also an image forming apparatus which cannot perform the aligning, sorting and returning operations within the aforementioned sheet interval inherent to that image forming apparatus. To cope with this, without modifying the aforementioned sheet interval inherent to the image forming apparatus, control which will be detailed below is performed so as to enable the aligning, returning and sorting operations by adjusting the time in the sheet aligning apparatus according to the present invention.

Basically, the aligning operation performed by the aligning means and the return operation performed by the returning means are performed within the sheet interval (time), and the sorting operation performed by the sorting means is performed between a job (unit) and a subsequent job (unit), i.e., between the moment when the aligning and return operations of the last sheet of a job (unit) are completed and the moment when the trailing end of the first sheet of the subsequent job (unit) reaches the surface of the sheet loaded on the tray 12.

According to the present invention, in case the sheet interval (time) is insufficient for the operation time that can be used for return and aligning, the linear speed of the ejection roller 3 is increased by that operation time as compared to the aforementioned reception linear speed, so as to obtain time until the sheet is loaded on the tray.

For example, when time Ts required for the aligning operation by the aligning means 102*a* and 102*b* and the return operation by the returning means 121 is greater than the time interval T1 at the sheet reception speed V1 (Ts>T1), it is possible to assure the time required for the aligning means 102*a* and 102*b* to perform the aligning operation and for the returning roller 121 to perform the return operation by increasing the ejection speed of the ejection roller 3 as compared to the aforementioned V1 so as to satisfy a new sheet interval (time T4:T4>Ts).

When the speed is increased, the sheet ejection speed of sheets ejected by the ejection roller 3 is increased, which in turn increases the time required for the leading edge of a subsequent sheet to pass a predetermined point. This enables returning and the aligning operations. This speed increase control is performed each time when a sheet is transported by the ejection roller in the job.

Moreover, in case the time required for the sorting means to perform sorting operation such as the time for performing the shift of the tray 12 in the shift direction "d" is insufficient, it is possible to assure the time required for the sorting means to perform sorting operation until the moment when the first sheet after the sorting is loaded on the tray by delaying the moment when the trailing end of the first sheet after the shifting, i.e., the first sheet of a subsequent job (unit) is detached from the ejected sheet 3. The delay is realized by reducing the linear speed of the ejection roller 3.

For example, when time Tc required for the sorting operation by the sorting means is greater than the time interval T1 at the sheet reception speed V1 (Ts>T1), the aforementioned V1 is reduced to as to satisfy the sheet interval (time T3: Ts>Tc) only for the ejection speed of the first sheet after sorting, and being transported during sorting.

These relationships will be detailed below by referring to the time chart in FIG. 56.

Figure 56:
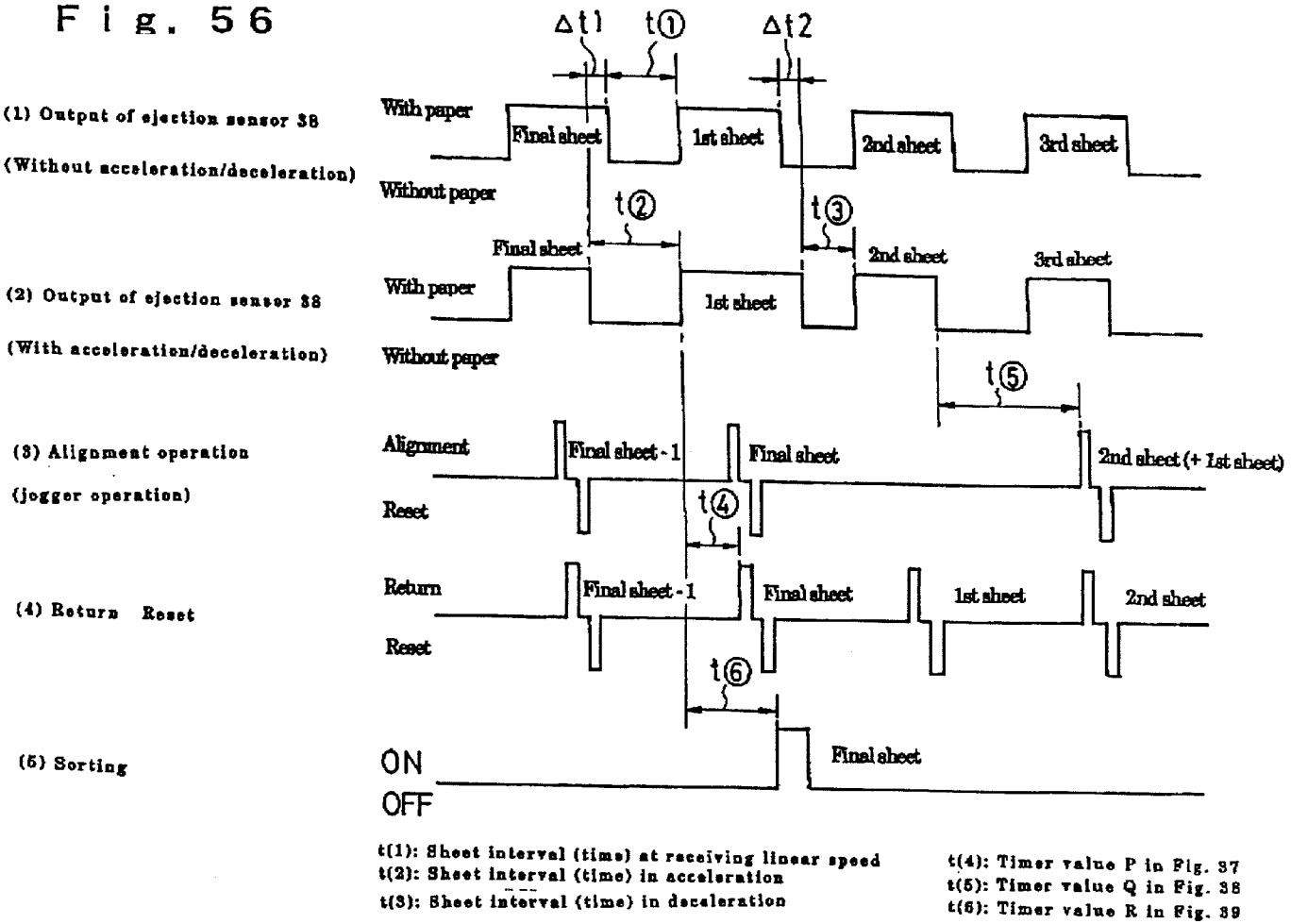
FIG. 56 is a timing chart illustrating the present invention.

In FIG. 56, (1) shows output of the ejection sensor 38 at the sheet reception speed V1 when no speed increase or reduction is performed by the ejection roller 3, so that the leading edge of each of the sheets is detected at a constant interval at the time of rising. Moreover, t1 is a time interval between the moment when the trailing edge of a sheet (for example, the last sheet of a preceding job) is detected by the ejection sensor 38 and the moment when the leading edge of a subsequent sheet (for example, the first sheet of the subsequent job).

(2) shows output of the ejection sensor 38 at the sheet reception speed V1 when speed of the ejection roller 3 is increased or decreased. When the ejection speed of a preceding sheet (for example, the last sheet of a preceding job) is increased, the time interval t2 between the moment when the trailing edge of the last sheet is detected by the ejection sensor 38 and the moment when the leading edge of a subsequent sheet is greater than the time interval t1 by Δdt1. This Δdt1 is a time obtained by the speed increase, so that the time can be used for the aligning operation of (3) and the return operation of (4).

Moreover, the moment when the trailing edge of the first sheet in FIG. 56(1) is detected by the ejection sensor 38 can be compared to the moment when the trailing edge of the first sheet is detected in (2) as follows. In case (2), the ejection speed of the ejection roller 3 for the first sheet is reduced and the trailing edge passing moment is delayed by Δt2, which enables the tray 12 to travel in the shift direction "d".

The return operation is performed each time when a sheet is ejected. The returning roller 121 can contact only with the uppermost sheet and this sheet in direct contact is fed out toward the end fence 131 by a rotation force causing friction. The return force does not function on the sheet for which this return operation is not performed even once.

As compared to this, the aligning operation by the aligning members 102*a* and 102*b* may be omitted for the first sheet after the sorting operation without affecting the aligning accuracy. A small number of sheets such two can be aligned simultaneously with a sufficient accuracy.

In this example, the aligning operation is omitted for the first sheet (corresponding to the first sheet of a unit) after the sorting operation. The time obtained by omitting the aligning operation after the sorting can be utilized for the return operation and the sorting operation which requires a lot of time. For the first sheet, operation is performed at the interval timed for alignment of the next 2-nd sheet. The time for two sheets together is the same as that for 1-sheet. As is clear from (4), the return operation is performed each time.

As has been described above, when the linear speed is increased or decreased by the ejection roller 3, it is assumed that the speed is set to an appropriate ejection speed enabling an appropriate stacking on the tray 12 immediately before the sheet trailing edge passes the ejection roller 3. This is because, if a sheet is ejected to an extremely different position, the sheet may not be aligned properly even when the aligning means and the returning means are provided.

In the example, explanation has been given on the returning roller 121 in FIG. 9 to FIG. 15. The explanation on the returning roller 121 also applies to the returning roller 121 in FIG. 38.

b. Control Example Using the Control Means

In this example, as shown in FIG. 17, the image forming apparatus 50 is linked to the sheet post-treatment apparatus 51 provided with the sheet aligning apparatus according to the present invention. In this entire system, control is performed for the speed increase/decrease of the ejection roller 3, aligning, return, and sorting operations. It should be noted that the aligning operation will be explained in the case of the both-side shift mode explained with reference to FIG. 70 and the sorting operation will be explained in the method where the tray 12 is shifted.

Figure 72:
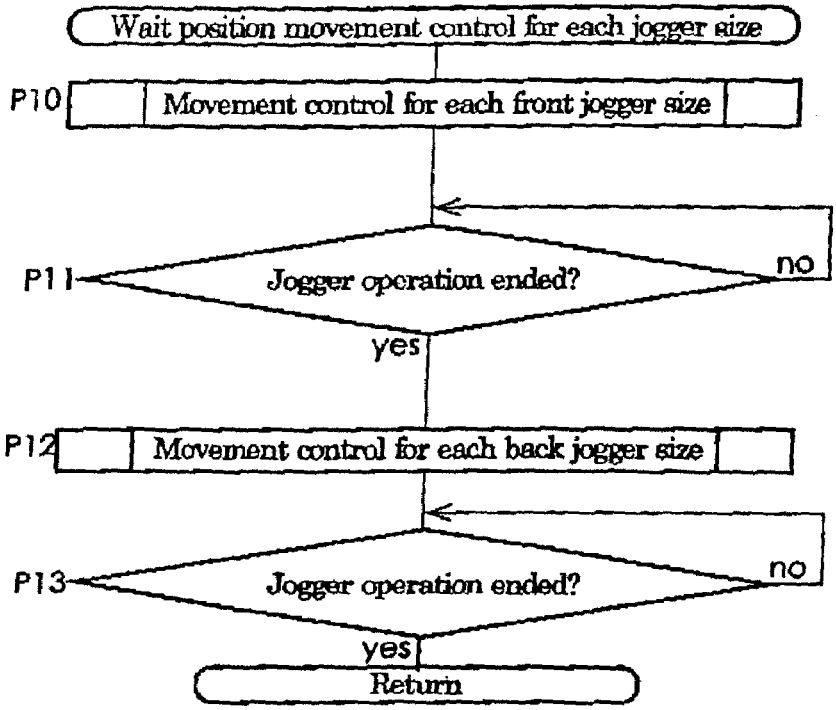
FIG. 72 is a flow chart according to the present invention.

FIG. 72 shows a control circuit of the control means. Information is exchanged between a CPU 700 and a ROM 710 containing a control program. A clock signal is fed to the CPU 700 and the CPU performs the control shown in a flowchart as follows.

For this, the CPU 700 exchanges signals with the image forming apparatus 50 and is fed with information from a sensor group 730, so as to output information to a stepping motor control driver 740, a motor driver 750, and a driver 760.

The sensor group 730 includes various sensors used in the sheet post-treatment apparatus and the sheet aligning apparatus according to the present invention. That is, the sensor group 703 includes various sensors used in the control based on the flowchart which will be detailed below.

The stepping motor control driver 740 controls various stepping motors used in the sheet post-treatment apparatus 51 and the sheet aligning apparatus according to the present invention, such as stepping motors used in the flowchart which will be detailed below. In FIG. 72, the stepping motor is denoted by a reference symbol M.

The motor driver 750 controls various DC motors used in the sheet post-treatment apparatus 51 and the sheet aligning apparatus according to the present invention, such as motors used in the flowchart explained below. In FIG. 72, it is denoted by a reference symbol M.

The driver 760 controls various solenoids used in the sheet post-treatment apparatus 51 and the sheet aligning apparatus according to the present invention, such as solenoids used in the flowchart explained below. In FIG. 72, the solenoid is denoted by a reference symbol SOL. The CPU 700 in FIG. 72 constitutes a main part which executes the flowchart below, i.e., the main part of the control means in the present invention.

In the sheet post-treatment apparatus 51, in case the shift mode for sheet sorting is selected, a sheet transported from the ejection roller 560 of the image forming apparatus 50 is received by the entrance rollers 1 and passes along the transport rollers 2*a* and transport rollers 2*b* to be ejected onto the tray 12 as the last transport means. Here, sheets are successively ejected one after another onto the tray 12 passing along the transport route while the branching claws 80 and 8*b* remain at default positions.

A processing flow explained below show only those portions associated with the present invention in the sheet post-treatment apparatus. When the main switch which governs the image forming apparatus 50 and the sheet post-treatment apparatus 51 in FIG. 17 is turned on and the sorting mode is selected, an initial routine and a subsequent main routine are executed. In an initial routine, step P1 executes "drive initial control", so that the aligning members 102*a* and 102*b* are moved to the home positions shown in FIG. 57 and the flags are reset to 0. It is noted that in the flowchart, a "front jogger" represents the aligning member 102*a* and a "rear jogger" represents the aligning member 102*b*.

After the step P1 is completed, control is passed to the main routine. In the main routine, step P2 executes "wait position control based on jogger size" (detailed in FIG. 72); step P3 executes "sheet transport control" (detailed in FIG. 73); step P4 executes "returning roller control" (detailed in FIG. 74); step P5 executes "jogger aligning control" (detailed in FIG. 75), and step P6 executes "shift control (detailed in FIG. 76). These steps are performed successively and repeated as is necessary. It should be noted that when the main routine is started, it is assumed that the returning roller 121 is rotating.

Referring to FIG. 72, explanation will be given on the "wait position control based on jogger size" constituting step P2. In step P10, the stepping motor 104*a* is driven to move the aligning member 102*a* to the receiving position shown in FIG. 58 according to the sheet size. Step 11 checks the movement of a predetermined number of steps up to the aforementioned receiving position.

In step P12 and step P13, the stepping motor 104 is driven to move the aligning member 102*b* to the predetermined receiving position.

For movement to these receiving positions, the solenoid 115 is turned on to move the aligning members 102*a* and 102*b* to the retract position explained in FIG. 65 before they are moved to the predetermined receiving positions, and then the solenoid 115 is turned off.

Figure 73:
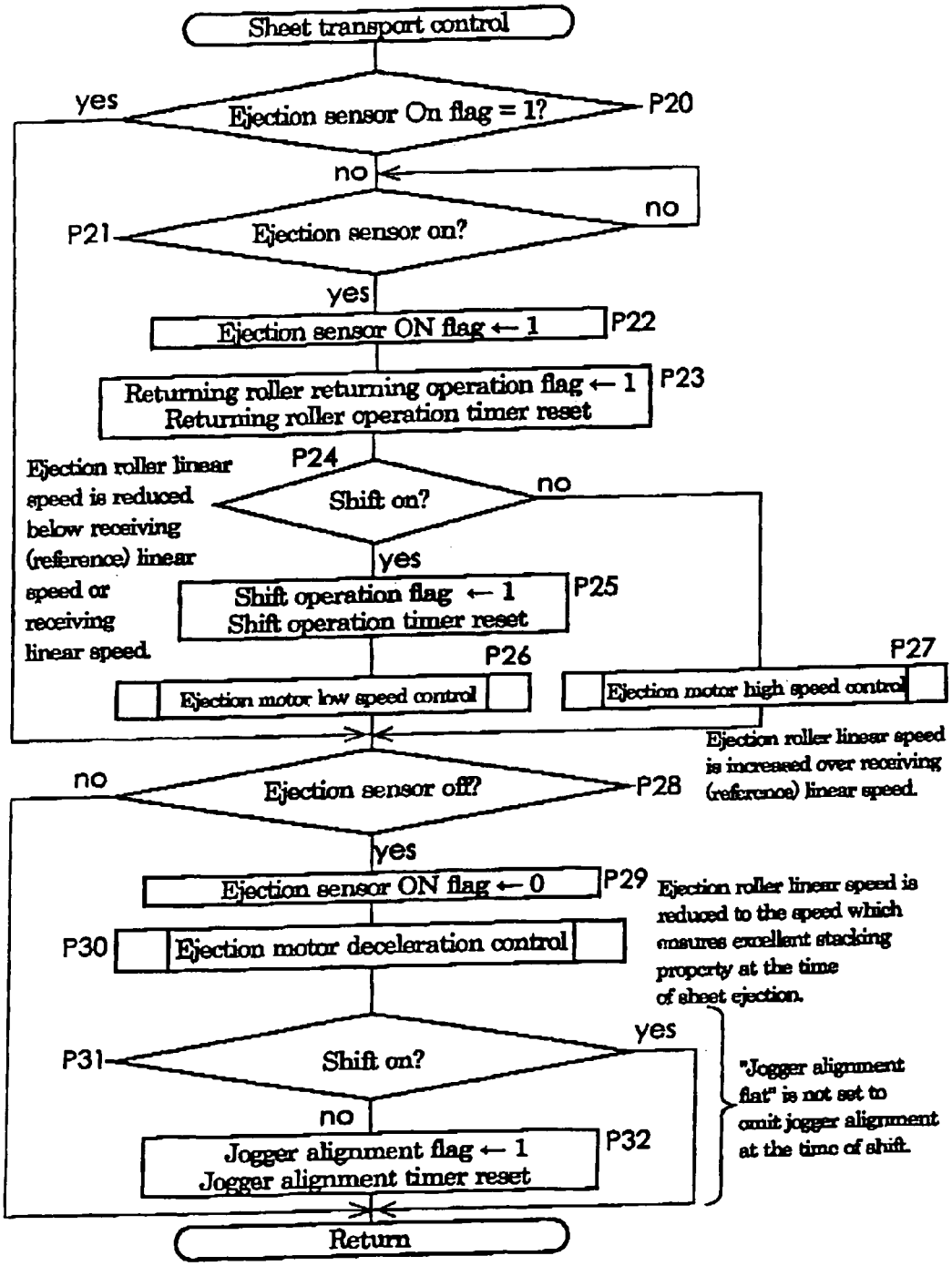
FIG. 73 is a flow chart according to the present invention.

Referring to FIG. 73, explanation will be given on the "sheet transport control" constituting step P3. In step P20, since the flag has been reset in the preceding step P1, control is passed to step P21. After the sheet passes the ejection sensor 38, in step P29, the ON flag of the ejection sensor is reset and control is passed from step P20 directly to step P28.

Here, explanation is given on a case when control is passed to step P21 so as to wait for detection of the sheet leading edge by the ejection sensor 38. Upon detection of the sheet leading edge, in step P22, the ejection sensor ON flag is set to 1 and control is passed to step P23, where the returning roller operation flag is set to 1 and the returning roller operation timer is reset to start time counting. Then, control is passed to step P24.

The "shift on?" in step P24 is the timing when a sheet to be sorted is ejected and is a shift command signal transmitted from the image forming apparatus together with information such as sheet size. The shift instruction by this shift command signal is checked in this step. If no instruction is received, not sorting is required and only the aligning and returning of the sheets in the job (unit) are performed. To obtain the time required for this operation, control is passed to step P27 and speed of the stepping motor associated with drive of the ejection roller 3 is increased over the reception reference linear speed. This speed increase corresponds to the speed increased in columns "last sheet", "second sheet", "third sheet" and the like in (2). The time obtained as a result of this speed increase can be indicated by $\Delta t1$. During the time interval between the sheets which is added by this $\Delta t1$, the aligning operation and the return operation are performed.

In case step P24 decides that the shift instruction of the shift command signal has been received, control is passed to step P25, where the "shift operation flag" is set to 1, the shift operation timer is reset, and in step P26, speed of the sheet ejection motor, i.e., the stepping motor 132 associated with drive of the sheet ejection roller 3 is reduced to a lower speed, thereby delaying the sheet ejection speed.

This speed decrease control corresponds to the speed decrease in the transporting the "first sheet" in column (2) in FIG. 56, i.e., a delay time $\Delta dt2$. The time that the first sheet of a subsequent job is caught by this ejection roller 3 is increased by this $\Delta t2$. This delay time $\Delta t2$ is utilized for shifting the tray 12.

Step P28 checks where the sheet trailing edge has been detected by the sheet ejection sensor 38. When the sheet has passed the sheet ejection sensor 38, in step P29, the "sheet ejection sensor ON flag" is reset and the control is passed to step P30, where the speed of the sheet ejection roller 3 is readjusted to a speed appropriate for stacking. That is, the linear speed of the ejection roller 3 which has been increased in step P27 is reduced before the sheet trailing edge passes the ejection roller 3, so that the sheet is ejected onto the tray 12 at a linear speed which ensures excellent stacking property.

In step P31, check is made again to decide whether the shift instruction has been issued. If the shift instruction has been received, as has been explained in (3) of FIG. 56, the aligning operation is omitted for the first sheet. Accordingly, the return is performed without setting the "jogger aligning operation flag" and without resetting the jogger aligning operation timer. In case step P31 decides that the shift instruction is not received, control is passed to step P32 to set the "jogger aligning operation flag" and reset the "timer aligning operation timer".

Figure 74:
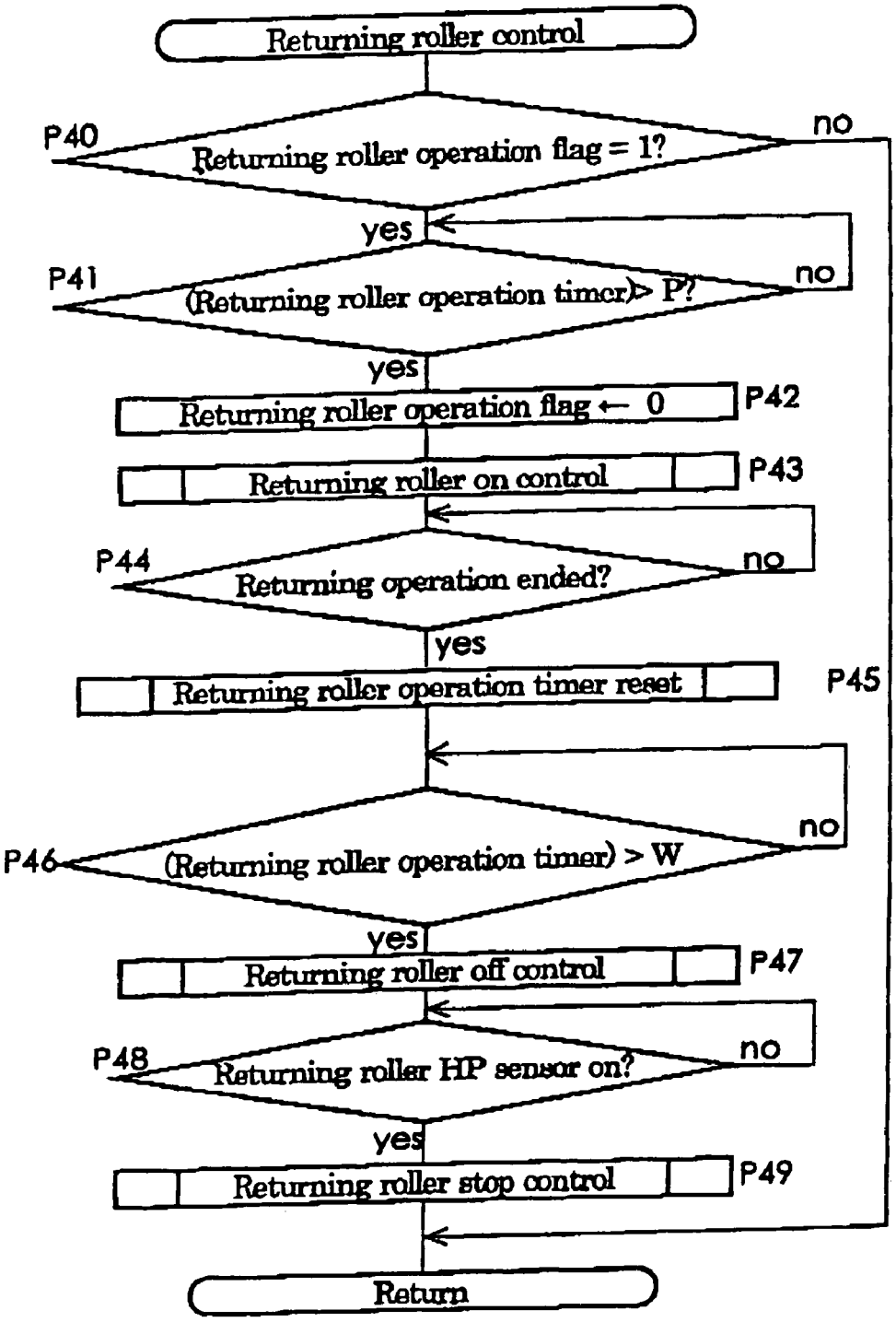
FIG. 74 is a flow chart according to the present invention.

Referring to FIG. 74, explanation will be given on the "returning roller control" of step P4. Since the return operation flag has been set in step P23, control is passed from step P40 to step P41. When the time lapse from the moment when the sheet leading edge is detected by the sheet ejection sensor 38 exceeds the time P set for the sheet leading edge to reach the loaded sheets, the return operation flag is reset in step P42, after which step P43 activates the stepping motor 126 to move the returning roller 121 from the first position (I) to the second position (II). Thus, the time P is set for the sheet leading edge to reach the loaded sheet. Accordingly, in this example, prior to the return operation (function) by the returning roller 121, the pressing operation (function) is also performed.

In step P42, the "sheet ejection sensor ON flag" is reset, so that the leading edge of a subsequent sheet is detected in step P21 and until the flag is set to 1, check in step P40 results in "No". Accordingly, the operation of the returning roller is performed only upon detection of the sheet leading edge by the ejection sensor 38.

When step P44 decides that the stepping motor 126 has been driven by predetermined number of pulses to move to the second position (II), the movement of the returning roller 121 is stopped. Then control is passed to step P45, where the "returning roller operation timer" is reset, and step P46 checks whether a predetermined return time W has passed. During this time, the sheet is returned. When step P46 decides that the predetermined return time has passed, the sheet hits the end fence 131 to be aligned. In step P47, the stepping motor 126 is driven from the second position (II) to the first position (I). In step P48, when the home position sensor 127 detects that the returning roller 121 has returned to the first position, then in step P49, the stepping motor 126 is stopped and the returning roller 121 moves to the first position and stops.

Figure 75:
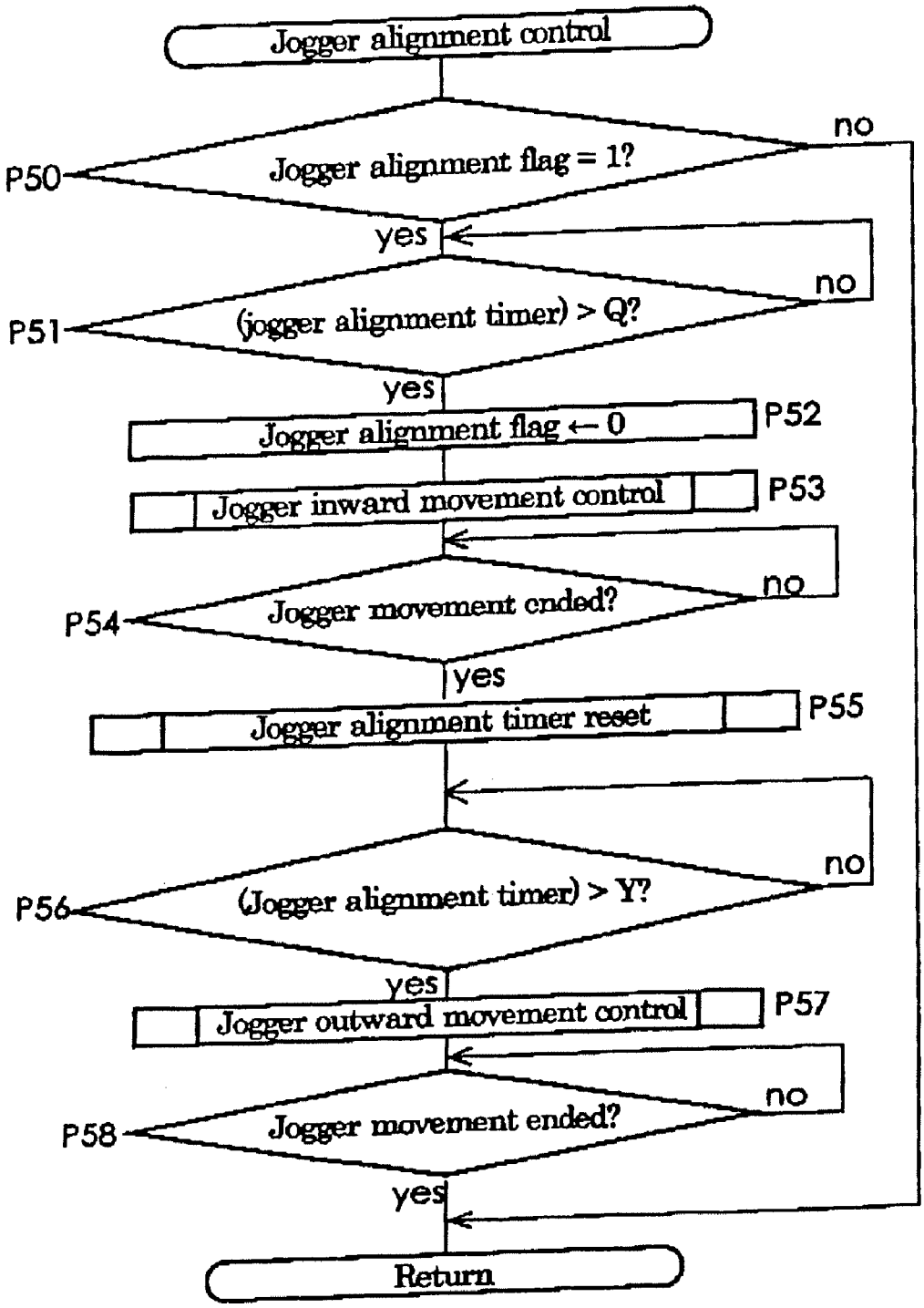
FIG. 75 is a flow chart according to the present invention.

Referring to FIG. 75, explanation will be given on the "jogger aligning control" constituting step P5. Since the "jogger aligning operation flat" has been set to 1 in step P32, control is passed from step P50 to step 51. The trailing edge detection in step P28 is used as a trigger, in step P51, to count, i.e., wait for passing of the time Q required for the sheet trailing edge to reach the upper surface of the loaded sheet. After the sheet has fallen onto the loaded paper, the "jogger aligning operation flag" is reset in P52.

By resetting the "jogger aligning operation flag" in step P52, step P50 results in "No" and no jogger aligning operation is performed. In step P53, the aligning members 102*a* and 102*b* are moved from the receiving position shown in FIG. 58 toward the aligning position shown in FIG. 59, i.e., control is made to perform jogger inward movement and the stepping motors 104*a* and 104 are driven. It should be noted that upon the jogger inward movement, it is assumed the retracting operation shown in FIG. 65 is performed.

Step P54 checks whether the stepping motors 104*a* and 104 have been driven by a predetermined drive amount and the aligning members 102*a* and 102 be are moved to the aligning position. To maintain the aligning members 102*a* and 102*b* at this aligning position for the aligning operation for a predetermined period of time Y, they are kept at this aligning position in steps P55 and P556. In steps P57 and P58, the aligning members 102*a* and 102*b* are returned to the receiving position shown in FIG. 58. It is assumed that the retracting operation shown in FIG. 65 is performed in the jogger outward movement control in step P57 upon return to the receiving position.

When the returning roller 121 is at the second position (II), it is impossible to perform the aligning operation by the aligning members 102*a* and 102*b* and one of the operations should be performed first. In this example, as is clear from the time chart of FIG. 56, the aligning operation is performed prior to the return operation.

Figure 76:
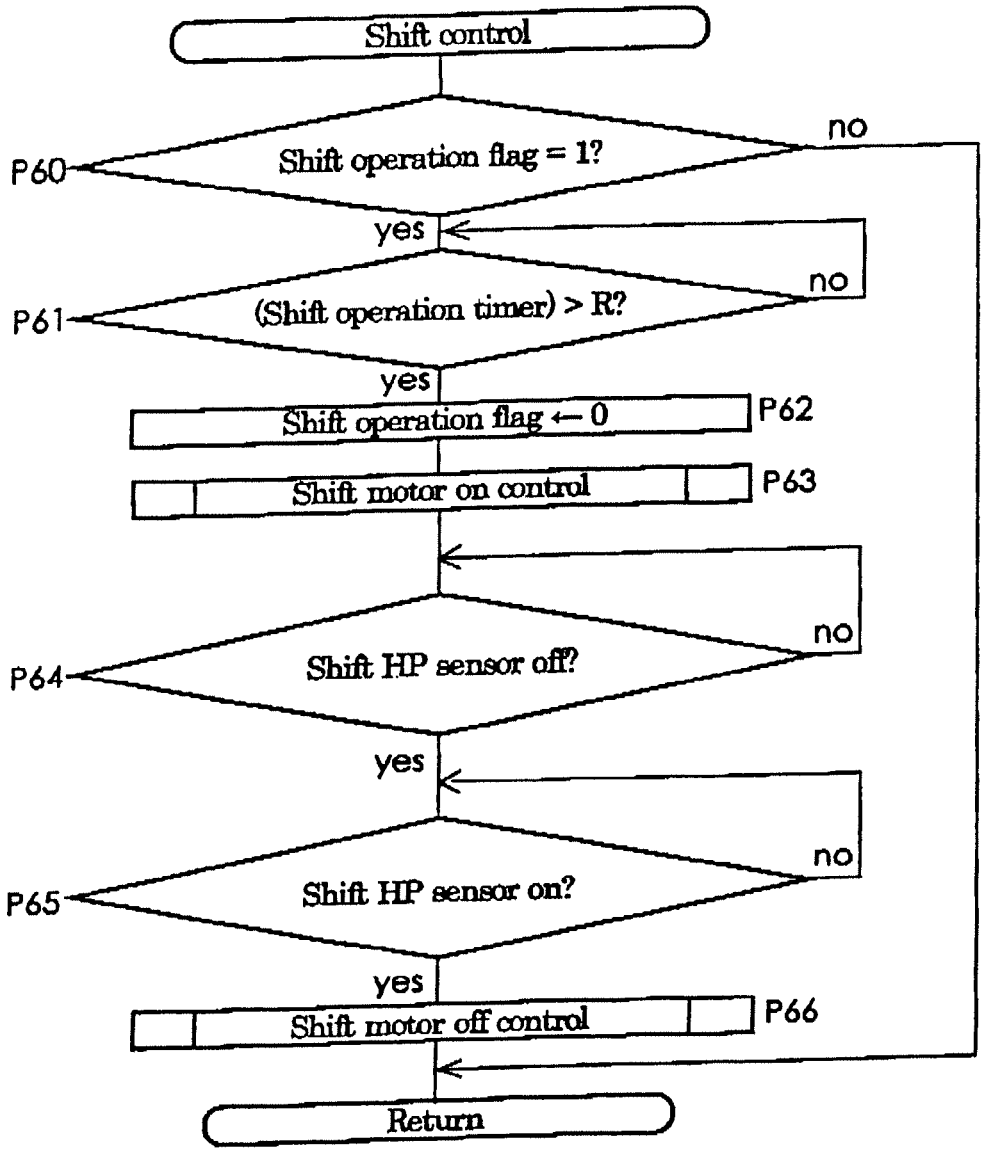
FIG. 76 is a flow chart according to the present invention.

Referring to FIG. 76, explanation will be given on the "shift control" constituting step P6. The "shift operation flag" has been set to 1 in step P25 and control is passed from step P60 to step P61. The leading edge detection in step P21 is used as a trigger to count, in step P61, the lapse of the time R set for a sheet to reach the upper surface of the loaded sheet. After the sheet has fallen onto the loaded sheet, the "shift operation flag" is reset in step P62.

By resetting the "shift operation flag" in step P62, step P60 results in "No" and no shift operation is performed except for the case when step P21 detects a sheet leading edge and the shift instruction of step P24 is present.

In step P63, drive of the tray shift motor 44 is started. In an initial state, as shown in FIG. 21, the sensor 48 as the shift home position sensor is overlapped with the encoder 47 and in a ON state. Accordingly, rotation continues until the ON position in step P64. Next, control is passed to step P65 and the rotation continues until the sensor 48 is turned on (see FIG. 22). Thus, the portion shown by a reference symbol Z1 immediately after the overlap with the encoder from the notch 43L stops at the position detected by the sensor 48 (step P66).

At a subsequent cycle, as shown in FIG. 22, the sensor 48 is overlapped with the portion Z1 of the encoder 47 and in the ON state. Accordingly, the rotation continues to reach the notch where the sensor is turned off in step P64. Next, control is passed to step P65, and the rotation continues to reach the position where the sensor 48 is turned ON, i.e., to the state shown in FIG. 21 (step P66). Thus, it is possible to shift the tray 12 forward and backward alternately.

In this example, explanation has been given on the returning roller 121 of FIGS. 9 to 15. This explanation also applies to the returning roller 121 of FIG. 38.

What is claimed is:

1. A sheet-like medium treatment apparatus, comprising:

an ejector configured to eject a transported sheet-like medium;

a tray on which the sheet-like medium ejected by the ejector is loaded;

a tray traveling device configured to sort the sheet-like medium loaded on the tray by traveling the tray in a direction of shift substantially orthogonal to a direction of ejection of the sheet-like medium by the ejector for a predetermined distance;

an aligning device configured to align the sheet-like medium loaded on the tray and having a pair of aligning members configured to align positions of end faces of the sheet-like medium ejected by the ejector and loaded on the tray by contacting with the end faces of the sheet-like medium in parallel with the direction of the ejection to sandwich the end faces; and a controller configured to drive the aligning device to align a sheet-like medium ejected and loaded subsequent to sorting of the sheet-like medium to a position different from a position of the sheet-like medium loaded before the sorting is carried out.

2. The sheet-like medium treatment apparatus according to claim 1, wherein the aligning device includes an aligning member traveling device configured to independently travel one of the aligning members from the other aligning member or vice versa in a direction of approaching and separating away from each other.

3. The sheet-like medium treatment apparatus according to claim 2, wherein each of the aligning members is positioned by the aligning member traveling device to at least two positions of: a receiving position where an aligning portion of the aligning member is located outside the end face of the sheet-like medium ejected from the ejector and separated from the end face; and an aligning position where the aligning portion of the aligning member is located further inside the sheet-like medium than the receiving position and is in contact with the end face.

4. The sheet-like medium treatment apparatus according to claim 1, wherein the tray includes a concave on an upper surface thereof such that a part of the aligning members is positioned below the upper surface of the tray.

5. The sheet-like medium treatment apparatus according to claim 4, wherein the concave has dimensions which allow the aligning members to be accommodated when the aligning members align the minimum sized sheet-like medium.

6. The sheet-like medium treatment apparatus according to claim 4, wherein the concave has dimensions which allow the aligning members to be accommodated even when the tray has shifted in the direction of shift.

7. The sheet-like medium treatment apparatus according to claim 4, wherein, when no sheet-like medium is loaded on the tray, the sheet-like medium is configured to be ejected by the ejector in a state in which the part of the aligning members is located below a loading surface of the tray.

8. The sheet-like medium treatment apparatus according to claim 4, wherein the aligning device includes a supporting shaft configured to support the aligning members rotatably, and a regulating member configured to regulate an amount of rotation about the supporting shaft of the aligning members.

9. The sheet-like medium treatment apparatus according to claim 8, wherein the aligning members are configured to rotate by moment under their own weight, and are configured to be placed inside the concave on the upper surface of the tray or at a working position contacting with a top surface of the sheet-like medium loaded on the tray.

10. The sheet-like medium treatment apparatus according to claim 1, further comprising a retracting device configured to retract the aligning members by rotating and moving the aligning members from a work position to a retract position separated from a position where the aligning members come in contact with a top surface of the sheet-like medium loaded on the tray.

11. The sheet-like medium treatment apparatus according to claim 10, wherein the aligning members are configured to be moved to the retract position by the retracting device after completion of aligning a series of sheet-like media or before sorting by the tray is carried out.

12. The sheet-like medium treatment apparatus according to claim 11, wherein the aligning members are configured to be displaced from the retract position to the work position by the retracting device, after the aligning members have moved to the receiving position or the tray have moved in the direction of shift to perform the sorting.

13. The sheet-like medium treatment apparatus according to claim 1, further comprising:

an elevating device configured to elevate the tray; and a positioning device configured to determine a position of the tray fed by the elevating device in a vertical direction such that the vertical position of an upper surface of the tray or the sheet-like medium loaded on the upper surface of the tray is in an appropriate ejection position suitable for the ejection of the sheet-like medium from the ejector when the sheet-like medium is ejected by the ejector.

14. The sheet-like medium treatment apparatus according to claim 13, wherein the tray is configured to be lowered from the appropriate ejection position by the elevating device after a predetermined number of sheet-like media in a given job has been aligned, before the tray is moved in the direction of shift to sort the sheet-like media in the next job.

15. The sheet-like medium treatment apparatus according to claim 14, wherein the tray is configured to be moved upward to the appropriate ejection position by the elevating device after the aligning members have moved to a receiving position or after the tray has been moved in the direction of shift to sort the sheet-like media in the next job.

16. The sheet-like medium treatment apparatus according to claim 1, wherein each of the aligning members includes a plate body, an aligning portion of each of the aligning members is located at a bottom part of the aligning member, and mutually opposite surfaces of the aligning members are formed of a flat surface substantially orthogonal to the direction of shift, respectively.

17. The sheet-like medium treatment apparatus according to claim 1, wherein each of the aligning members includes a sheet escape portion in which an upper part of an aligning portion of each of the aligning members is formed in a space greater than an opposing interval between each of the aligning portions, so as to guide the sheet-shaped medium ejected from the ejector within an opposing interval between each of the aligning members.

18. The sheet-like medium treatment apparatus according to claim 1, wherein an inner edge of each lower end of each of the aligning members is formed in a sharp edge.

19. The sheet-like medium treatment apparatus according to claim 1, wherein the aligning members include a material in which frictional coefficient of each lower end of the aligning members in contact with the sheet-like medium is smaller than frictional coefficient between the sheet-like media.

20. The sheet-like medium treatment apparatus according to claim 1, wherein the aligning members are supported above the ejector by an apparatus body.

21. The sheet-like medium treatment apparatus according to claim 1, wherein the aligning device is structured to be attachable to and detachable from an apparatus body.

22. An image forming apparatus, comprising:

an image forming device configured to form an image on a sheet-like medium;

a transporting device configured to transport the sheet-like medium on which the image is formed; and a sheet-like medium treatment apparatus, including:

an ejector configured to eject a transported sheet-like medium;

a tray on which the sheet-like medium ejected by the ejector is loaded;

a tray traveling device configured to sort the sheet-like medium loaded on the tray by traveling the tray in a direction of shift substantially orthogonal to a direction of ejection of the sheet-like medium by the ejector for a predetermined distance;

an aligning device configured to align the sheet-like medium loaded on the tray and having a pair of aligning members configured to align positions of end faces of the sheet-like medium ejected by the ejector and loaded on the tray by contacting with the end faces of the sheet-like medium in parallel with the direction of the ejection to sandwich the end faces; and a controller configured to drive the aligning device to align a sheet-like medium ejected and loaded subsequent to sorting of the sheet-like medium to a position different from a position of the sheet-like medium loaded before the sorting is carried out.

23. A sheet-like medium post-treatment apparatus, comprising:

a post-treatment device configured to carry out post-treatment of a sheet-like medium;

a transporting device configured to transport the post-treated sheet-like medium; and a sheet-like medium treatment apparatus, including:

an ejector configured to eject a transported sheet-like medium;

a tray on which the sheet-like medium ejected by the ejector is loaded;

a tray traveling device configured to sort the sheet-like medium loaded on the tray by traveling the tray in a direction of shift substantially orthogonal to a direction of ejection of the sheet-like medium by the ejector for a predetermined distance;

an aligning device configured to align the sheet-like medium loaded on the tray and having a pair of aligning members configured to align positions of end faces of the sheet-like medium ejected by the ejector and loaded on the tray by contacting with the end faces of the sheet-like medium in parallel with the direction of the ejection to sandwich the end faces; and a controller configured to drive the aligning device to align a sheet-like medium ejected and loaded subsequent to sorting of the sheet-like medium to a position different from a position of the sheet-like medium loaded before the sorting is carried out.

24. An image forming post-treatment apparatus, comprising:

an image forming unit having an image forming device configured to form an image on a sheet-like medium and a first transporting device configured to transport the sheet-like medium on which the image is formed;

a post-treatment unit configured to carry out post-treatment of the sheet-like medium ejected from the image forming unit;

a second transporting device configured to transport the sheet-like medium post-treated by the post-treatment unit; and a sheet-like medium treatment apparatus, including:

an ejector configured to eject a transported sheet-like medium;

a tray on which the sheet-like medium ejected by the ejector is loaded;

a tray traveling device configured to sort the sheet-like medium loaded on the tray by traveling the tray in a direction of shift substantially orthogonal to a direction of ejection of the sheet-like medium by the ejector for a predetermined distance;

an aligning device configured to align the sheet-like medium loaded on the tray and having a pair of aligning members configured to align positions of end faces of the sheet-like medium ejected by the ejector and loaded on the tray by contacting with the end faces of the sheet-like medium in parallel with the direction of the ejection to sandwich the end faces; and a controller configured to drive the aligning device to align a sheet-like medium ejected and loaded subsequent to sorting of the sheet-like medium to a position different from a position of the sheet-like medium loaded before the sorting is carried out.

* * * * *